US011543095B2

(12) United States Patent
Sato et al.

(10) Patent No.: US 11,543,095 B2
(45) Date of Patent: Jan. 3, 2023

(54) VEHICLE LAMP WITH PARTICULAR ATTACHMENT OF SPATIAL LIGHT MODULATOR TO HEAT SINK

(71) Applicant: KOITO MANUFACTURING CO., LTD., Tokyo (JP)

(72) Inventors: Ryuho Sato, Shizuoka (JP); Yukinobu Hiranaka, Shizuoka (JP); Takahiko Honda, Shizuoka (JP); Yosuke Ohashi, Shizuoka (JP); Takashi Ito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/045,699

(22) PCT Filed: Apr. 4, 2019

(86) PCT No.: PCT/JP2019/014964
§ 371 (c)(1),
(2) Date: Oct. 6, 2020

(87) PCT Pub. No.: WO2019/194276
PCT Pub. Date: Oct. 10, 2019

(65) Prior Publication Data

US 2021/0025562 A1 Jan. 28, 2021

(30) Foreign Application Priority Data

Apr. 6, 2018 (JP) ..... JP2018-073701
Apr. 20, 2018 (JP) ..... JP2018-081299
(Continued)

(51) Int. Cl.
*F21S 41/675* (2018.01)
*F21S 41/26* (2018.01)
(Continued)

(52) U.S. Cl.
CPC ..... *F21S 41/675* (2018.01); *F21S 41/147* (2018.01); *F21S 41/26* (2018.01); *F21S 41/29* (2018.01); *F21S 41/33* (2018.01); *F21S 41/39* (2018.01)

(58) Field of Classification Search
CPC ..... F21V 29/505; F21S 41/147; F21S 41/33; F21S 41/334; F21S 41/336; F21S 41/39; F21S 41/675
See application file for complete search history.

(56) References Cited

U.S. PATENT DOCUMENTS 6,016,173 A 1/2000 Crandall
6,075,577 A 6/2000 Crandall
(Continued)

FOREIGN PATENT DOCUMENTS

CN 1241503 A 1/2000
CN 1401058 A 3/2003
(Continued)

OTHER PUBLICATIONS

Machine translation of Sato et al. JP 2016-091976A, retrieved from worldwide.espacenet.com on Jan. 24, 2022 (Year: 2022).*
(Continued)

*Primary Examiner* — Rajarshi Chakraborty
*Assistant Examiner* — Steven Y Horikoshi
(74) *Attorney, Agent, or Firm* — Osha Bergman Watanabe & Burton LLP

(57) ABSTRACT

A lens holder which supports a projection lens is screwed and fixed to a bracket which supports a spatial light modulator. A positioning pin configured to position the lens holder in a left-right direction with respect to the bracket is inserted into a long hole which is formed in the bracket and extends in a lamp front-rear direction. The screwing and fixing is performed in a state where the positioning pin is inserted
(Continued)

into the long hole and is appropriately moved in the lamp front-rear direction, so that the lens holder is restricted from being displaced in a left-right direction with respect to the bracket, and it is possible to finely adjust a positional relationship between the projection lens and the spatial light modulator in the lamp front-rear direction.

6 Claims, 63 Drawing Sheets

(30) Foreign Application Priority Data

| | | |
|---|---|---|
| Jul. 12, 2018 | (JP) | JP2018-132358 |
| Sep. 7, 2018 | (JP) | JP2018-167585 |
| Dec. 27, 2018 | (JP) | JP2018-245149 |
| Dec. 27, 2018 | (JP) | JP2018-245150 |
| Dec. 27, 2018 | (JP) | JP2018-245151 |
| Dec. 27, 2018 | (JP) | JP2018-245152 |

(51) Int. Cl.

| | |
|---|---|
| ***F21S 41/33*** | (2018.01) |
| ***F21S 41/147*** | (2018.01) |
| ***F21S 41/29*** | (2018.01) |
| ***F21S 41/39*** | (2018.01) |

(56) References Cited

U.S. PATENT DOCUMENTS

| | | | | |
|---|---|---|---|---|
| 6,234,655 | B1 | 5/2001 | Suehiro et al. | |
| 2003/0056325 | A1 | 3/2003 | Koshikawa et al. | |
| 2003/0117810 | A1 | 6/2003 | Nakazawa et al. | |
| 2005/0001985 | A1* | 1/2005 | Kitabayashi | H04N 9/3144 353/100 |
| 2006/0238645 | A1* | 10/2006 | Goo | H04N 5/7458 348/E5.142 |
| 2007/0216879 | A1* | 9/2007 | Yoshikawa | G03B 21/145 353/99 |
| 2008/0175017 | A1 | 7/2008 | Terada et al. | |
| 2008/0253142 | A1 | 10/2008 | Nakada | |
| 2009/0135564 | A1* | 5/2009 | Chen | H05K 7/20472 361/709 |
| 2010/0302464 | A1 | 12/2010 | Raring et al. | |
| 2011/0168374 | A1 | 7/2011 | Watanabe et al. | |
| 2012/0127747 | A1 | 5/2012 | Ahn et al. | |
| 2012/0307511 | A1 | 12/2012 | Cheng | |
| 2013/0314934 | A1 | 11/2013 | Ohmi et al. | |
| 2015/0211703 | A1 | 7/2015 | Nakazawa et al. | |
| 2015/0377439 | A1 | 12/2015 | Madelaine et al. | |
| 2016/0047518 | A1 | 2/2016 | Rottstaedt | |
| 2016/0344988 | A1 | 11/2016 | Kase et al. | |
| 2017/0067613 | A1 | 3/2017 | Mouri et al. | |
| 2017/0151901 | A1 | 6/2017 | Sazuka et al. | |
| 2017/0255006 | A1* | 9/2017 | Hou | G02B 7/181 |
| 2017/0269354 | A1 | 9/2017 | Suzuki et al. | |
| 2017/0299140 | A1 | 10/2017 | Lee et al. | |
| 2017/0343173 | A1 | 11/2017 | Takada et al. | |
| 2018/0187859 | A1 | 7/2018 | Duval et al. | |
| 2021/0018157 | A1* | 1/2021 | Mitterlehner | F21S 41/36 |
| 2021/0025562 | A1 | 1/2021 | Sato et al. | |

FOREIGN PATENT DOCUMENTS

| | | | |
|---|---|---|---|
| CN | 1430012 | A | 7/2003 |
| CN | 2639704 | Y | 9/2004 |
| CN | 101149136 | A | 3/2008 |
| CN | 101221347 | A | 7/2008 |
| CN | 101285562 | A | 10/2008 |
| CN | 101904001 | A | 12/2010 |
| CN | 102322603 | A | 1/2012 |
| CN | 102449550 | A | 5/2012 |
| CN | 102478190 | A | 5/2012 |
| CN | 103727473 | A | 4/2014 |
| CN | 204345482 | U | 5/2015 |
| CN | 104949072 | A | 9/2015 |
| CN | 204629263 | U | 9/2015 |
| CN | 105371206 | A | 3/2016 |
| CN | 205424543 | U | 8/2016 |
| CN | 106168731 | A | 11/2016 |
| CN | 107013861 | A | 8/2017 |
| CN | 107166192 | A | 9/2017 |
| CN | 107166289 | A | 9/2017 |
| CN | 107218445 | A | 9/2017 |
| CN | 107329232 | A | 11/2017 |
| CN | 107435884 | A | 12/2017 |
| CN | 108302486 | A | 7/2018 |
| CN | 108458314 | A | 8/2018 |
| CN | 209893300 | U | 1/2020 |
| EP | 2966343 | A1 | 1/2016 |
| EP | 3232247 | B1 | 10/2017 |
| JP | H07-015431 | U | 3/1995 |
| JP | 2006-220836 | A | 8/2006 |
| JP | 2006208454 | A | 8/2006 |
| JP | 2009-010157 | A | 1/2009 |
| JP | 2016091976 | A | 5/2016 |
| JP | 2016-115582 | A | 6/2016 |
| JP | 201754608 | A | 3/2017 |
| JP | 2017076558 | A | 4/2017 |
| WO | 2016093066 | A1 | 6/2016 |

OTHER PUBLICATIONS

Copy of Foreign Priority Document EP 18155280, filed Feb. 6, 2018, priority of US PGPub 2021/0018157 A1 (Year: 2018).*

Machine Translation of Foreign Priority Document EP 18155280, retrieved on May 3, 2022 (Year: 2022).*

International Search Report issued in corresponding International Application No. PCT/JP2019/014964; dated Jun. 18, 2019 (14 pages).

Written Opinion of the International Searching Authority issued in corresponding International Application No. PCT/JP2019/014964; dated Jun. 18, 2019 (12 pages).

Office Action issued in Chinese Application No. 201910337752.X; dated Oct. 15, 2021 (22 pages).

Office Action issued in Chinese Application No. 201910353782.X; dated Jun. 11, 2021 (13 pages).

Office Action issued in Chinese Application No. 201910270457.7; dated Jan. 8, 2021 (19 pages).

Office Action issued in Chinese Application No. 201910337752.X; dated Apr. 1, 2021 (22 pages).

Office Action issued in Japanese Application No. 2018-245150, dated Aug. 3, 2022 (9 pages).

Office Action issued in Chinese Application No. 201910322694.3, dated Apr. 26, 2022 (15 pages).

Office Action issued in Chinese Application No. 201910500205.9, dated Apr. 26, 2022 (15 pages).

Office Action issued in Chinese Application No. 201910553666.2, dated Apr. 28, 2022 (16 pages).

Notice of Reasons for Refusal in corresponding Japanese Application No. 2018-167585, dated Sep. 21, 2022 (8 pages).

* cited by examiner

VEHICLE LAMP WITH PARTICULAR ATTACHMENT OF SPATIAL LIGHT MODULATOR TO HEAT SINK

TECHNICAL FIELD

The present disclosure relates to a vehicle lamp, a spatial light modulation unit, and a lamp unit.

BACKGROUND ART

As described in Patent Literature 1, there is known a vehicle lamp configured to emit light from a light source toward a front side of a lamp via a spatial light modulator and a projection lens.

There is also known an illumination device in which a spatial light modulator and a support board which supports a peripheral edge portion of the spatial light modulator from a rear side are electrically connected, and an illumination device in which a reflective spatial light modulator and a control board are electrically connected in a state where the control board is abutted against a peripheral edge portion of the spatial light modulator from a rear side.

There is also known an in-vehicle spatial light modulation unit which includes a spatial light modulator. Patent Literature 1 describes a spatial light modulation unit of a vehicle lamp which includes a spatial light modulator configured to reflect light from a light source toward a projection lens.

There is also known a spatial light modulation unit in which a spatial light modulator and a support board which supports a peripheral edge portion of the spatial light modulator from a rear side are electrically connected.

There is also known an in-vehicle lamp unit configured to emit light from a light source reflected by a spatial light modulator toward a front side of the unit via an optical member, such as a projection lens.

CITATION LIST

Patent Literature

Patent Literature 1: JP2016-091976A

SUMMARY OF INVENTION

Technical Problem

Such a vehicle lamp can form various light distribution patterns with high accuracy by controlling spatial distribution of light reaching the projection lens of the spatial light modulator.

However, in order to realize such a function, it is necessary to position the spatial light modulator with respect to the projection lens with high positional accuracy.

If a configuration in which a bracket which is abutted against the peripheral edge portion of the spatial light modulator from a front side is arranged on the front side of the spatial light modulator while a heat sink which elastically presses the spatial light modulator toward the front side in a state of being abutted against a central portion of the spatial light modulator is arranged on the rear side of the spatial light modulator is employed in the illumination device, it is possible to prevent an excessive load from acting on the spatial light modulator. As a result, it is possible to secure the electric connection between the spatial light modulator and the support board and to prevent the spatial light modulator from being damaged. Moreover, it is possible to maintain the electric connection between the spatial light modulator and the control board.

However, when such a configuration is directly applied to the vehicle lamp, the following problem may occur.

That is, since a vibration load or an impact load acts on the vehicle lamp due to traveling of a vehicle or the like, a positional relationship between the spatial light modulator and the heat sink tends to be misaligned. A positional relationship between the control board and the bracket or the heat sink also tends to be misaligned.

When the positional relationship between the spatial light modulator and the heat sink is misaligned, an excessive load acts on the spatial light modulator, which may damage the spatial light modulator. Moreover, when the positional relationship between the control board and the bracket or the heat sink is misaligned, an excessive load acts on a connection portion between the spatial light modulator and the control board, which may damage the connection portion.

The spatial light modulation unit described in "Patent Literature 1" can form various light distribution patterns as a vehicle lamp with high accuracy by controlling spatial distribution of light reflected by the spatial light modulator.

If a bracket abutted against a peripheral edge portion of the spatial light modulator from a unit front side is arranged on the unit front side of the spatial light modulator as a configuration of the spatial light modulation unit including the reflective spatial light modulator, it is possible to stably maintain electric connection between the spatial light modulator and the support board.

However, when such a configuration is directly applied to an in-vehicle spatial light modulation unit, the following problem may occur.

That is, since a vibration load or an impact load acts on the in-vehicle spatial light modulation unit due to traveling of a vehicle or the like, a positional relationship between the support board, which supports the spatial light modulator, and the bracket tends to be misaligned. When the positional relationship between the support board and the bracket is misaligned, an excessive load acts on a connection portion between the spatial light modulator and the support board, which may damage the connection portion.

Patent Literature 1 also discloses a spatial light modulator in which each of a plurality of reflecting elements constituting a reflection control unit thereof is capable of taking a first angular position to reflect light from a light source that reaches the reflecting element toward an optical member, and taking a second angular position to reflect in a direction deviated from the optical member.

In a lamp unit including such a spatial light modulator, since lighting and extinguishing of the light source is frequently repeated to change light distribution patterns formed by emitted light in accordance with a traveling state of a vehicle, electromagnetic noise is generated along with such lighting and extinguishing control, which may adversely affect control of the spatial light modulator.

Patent Literature 1 also discloses a spatial light modulator which includes a reflection control unit (display unit 32) in which a plurality of reflecting elements (micromirrors 31) configured to reflect light from a light source are arranged, and a translucent plate (transparent member 33) arranged on a unit front side of the reflection control unit.

Space between the reflection control unit and the translucent plate is sealed by a housing portion (support portion 34) configured to accommodate the reflection control unit.

In a lamp unit including such a spatial light modulator, in order to form light distribution patterns with high accuracy by emitted light thereof, it is preferable to set a rear focus of a projection lens, which serves as an optical member, to a position of the reflection control unit. However, unexpected shadows or glare may occur in the light distribution patterns when foreign matter, such as dust, adheres to the reflection control unit.

However, since space between the translucent plate (which is arranged on the unit front side of the reflection control unit) and the reflection control unit is sealed, it is possible to prevent the foreign matter from adhering to the reflection control unit.

Since a position of the translucent plate is displaced from a rear focus of the projection lens toward the unit front side even when the foreign matter is attached to the translucent plate, an image of the foreign matter projected by the optical member becomes blurred, and a shadow or glare thereof becomes less noticeable.

However, further improvement is desired to effectively prevent the unexpected shadow or glare from being generated in the light distribution pattern formed by the light emitted from the lamp unit.

If the translucent plate includes a seal portion, which is configured to seal the housing portion, at a peripheral edge portion thereof in the configuration of the spatial light modulator, it is possible to improve sealability of the space between the reflection control unit and the translucent plate.

However, when external light is applied to such a lamp unit from a direction close to a horizontal direction, such as sunlight of morning and evening, the external light converges on the seal portion of the spatial light modulator through the optical member in an optical path that is substantially opposite to the light emitted from the light source, and the seal portion is melted and damaged due to such converged light, so that the sealability of the space between the reflection control unit and the translucent plate is impaired.

Patent Literature 1 also discloses a lamp unit configured to reflect light emitted from a light source toward a spatial light modulator by a reflector. A light source support member configured to support the light source is arranged below the spatial light modulator together with the reflector.

In such a lamp unit, since the light source support member is arranged below the spatial light modulator, it is possible to easily arrange an optical member at a position close to a surface of a vehicle body, and thus a degree of freedom in vehicle design can be improved.

On the other hand, since a heat dissipating member configured to dissipate heat generated by lighting of the light source is arranged below the light source support member, an up-down direction dimension of the lamp unit is increased, so that it is not easy to secure space for arranging the lamp unit.

An object of the present disclosure is to provide a vehicle lamp capable of arranging a spatial light modulator with high positional accuracy with respect to a projection lens.

Another object of the present disclosure is to provide a vehicle lamp capable of effectively reducing damage to a spatial light modulator caused by a vibration load or the like.

Another object of the present disclosure is to provide a vehicle lamp capable of effectively reducing damage to a connection portion between a spatial light modulator and a control board.

Another object of the present disclosure is to provide a spatial light modulation unit capable of effectively reducing damage to a connection portion between a spatial light modulator and a support board caused by a vibration load or the like.

Another object of the present disclosure is to provide a lamp unit capable of minimizing an influence of noise on a spatial light modulator.

Another object of the present disclosure is to provide a lamp unit capable of effectively preventing an unexpected shadow or glare from being generated in a light distribution pattern.

Another object of the present disclosure is to provide a lamp unit capable of preventing a seal portion of a spatial light modulator from being melted and damaged due to external light.

Another object of the present disclosure is to provide a lamp unit capable of ensuring a heat dissipation function without increasing an up-down direction dimension thereof even when a light source support member is arranged below a spatial light modulator.

Solution to Problem

A vehicle lamp according to one aspect of the present disclosure is a vehicle lamp configured to emit light from a light source toward a front side of a lamp via a spatial light modulator and a projection lens. The vehicle lamp includes:

a bracket configured to support the spatial light modulator; and a lens holder configured to support the projection lens.

The lens holder includes a positioning protruding portion.

The bracket includes an elongated hole extending in a lamp front-rear direction.

The positioning protruding portion is inserted into the elongated hole, and the lens holder is positioned with respect to the bracket in a direction orthogonal to the lamp front-rear direction.

The lens holder is fixed to the bracket by mechanical fastening.

A vehicle lamp according to another aspect of the present disclosure is a vehicle lamp configured to emit light from a light source toward a front side of a lamp via a spatial light modulator and a projection lens. The vehicle lamp includes:

a bracket configured to support the spatial light modulator; and a lens holder configured to support the projection lens.

The bracket includes a positioning protruding portion.

The lens holder includes an elongated hole extending in a lamp front-rear direction.

The positioning protruding portion is inserted into the elongated hole, the bracket is positioned with respect to the lens holder in a direction orthogonal to the lamp front-rear direction.

The lens holder is fixed to the bracket by mechanical fastening.

A specific configuration of the above "spatial light modulator" is not particularly limited as long as the spatial light modulator can control spatial distribution of light reaching the projection lens. For example, a spatial light modulator which uses a digital micromirror, or a spatial light modulator which uses a transmissive liquid crystal or a reflective liquid crystal may be employed.

A specific aspect of the above "mechanical fastening" is not particularly limited. For example, a fastening structure such as screwing or clipping can be employed.

A vehicle lamp according to another aspect of the present disclosure includes:

a spatial light modulator configured to reflect light from a light source toward a front side of a lamp;

a support board which is arranged on a lamp rear side of the spatial light modulator and is configured to support a peripheral edge portion of the spatial light modulator from the lamp rear side in a state of being electrically connected to the spatial light modulator;

a bracket which is arranged on a lamp front side of the spatial light modulator and is abutted against the peripheral edge portion of the spatial light modulator from the lamp front side;

a heat sink which is arranged on the lamp rear side of the support board and is configured to elastically press the spatial light modulator toward the lamp front side in a state of being abutted against a central portion of the spatial light modulator; and at least one shaft which is arranged around the spatial light modulator and extends in a lamp front-rear direction.

At least one shaft insertion hole is formed in the support board.

At least one shaft positioning hole is formed in the bracket.

The shaft is inserted through the shaft insertion hole, a rear end portion thereof is fixed to the heat sink, and a front end portion thereof is inserted into the shaft positioning hole.

A vehicle lamp according to another aspect of the present disclosure includes:

a spatial light modulator configured to reflect light from a light source toward a front side of a lamp;

a control board which is arranged on a lamp rear side of the spatial light modulator and is electrically connected to the spatial light modulator in a state of being abutted against a peripheral edge portion of the spatial light modulator;

a pressing tool which is arranged on a lamp front side of the spatial light modulator and is configured to elastically press the spatial light modulator toward a rear side of the lamp in a state of being abutted against the peripheral edge portion of the spatial light modulator;

a heat sink which is arranged on the lamp rear side of the spatial light modulator and is configured to elastically press the spatial light modulator toward the front side of the lamp in a state of being abutted against a central portion of the spatial light modulator; and a board bracket which is arranged on the lamp rear side of the control board and is configured to support the control board in a state of being abutted against the control board.

The pressing tool is fixed to the board bracket from the lamp front side, and the heat sink is fixed to the board bracket from the lamp rear side.

A specific configuration of the above "spatial light modulator" is not particularly limited as long as the spatial light modulator can control spatial distribution of light reaching the projection lens. For example, a spatial light modulator which uses a digital micromirror, or a spatial light modulator which uses a reflective liquid crystal may be employed.

The above "control board" is electrically connected to the spatial light modulator in the state of being abutted against the peripheral edge portion of the spatial light modulator, and may be electrically connected to the spatial light modulator in a state of being directly abutted against the peripheral edge portion of the spatial light modulator. The control board may also be electrically connected to the spatial light modulator in a state of being abutted against the peripheral edge portion of the spatial light modulator via another member.

The above "pressing tool" is configured to elastically press the spatial light modulator toward the rear side of the lamp in the state of being abutted against the peripheral edge portion of the spatial light modulator, and a specific configuration for realizing such a structure is not particularly limited.

The above "heat sink" is configured to elastically press the spatial light modulator toward the front side of the lamp in the state of being abutting against the central portion of the spatial light modulator, and a specific configuration for realizing such a structure is not particularly limited.

The above "board bracket" is configured to support the control board in the state of being abutted against the control board, and a specific support structure thereof is not particularly limited.

A spatial light modulation unit according to another aspect of the present disclosure includes:

a spatial light modulator configured to reflect light from a light source;

a support board which is arranged on a unit rear side of the spatial light modulator and is configured to support a peripheral edge portion of the spatial light modulator from the unit rear side in a state of being electrically connected to the spatial light modulator;

a bracket which is arranged on a unit front side of the spatial light modulator and is abutted against the peripheral edge portion of the spatial light modulator from the unit front side; and a plurality of clamping members which are mounted at a plurality of locations of the support board and are configured to clamp the support board from two sides in a unit front-rear direction.

Each of the clamping members is fixed to the bracket.

A specific application of the above "spatial light modulation unit" is not particularly limited as long as the spatial light modulation unit is placed on a vehicle. For example, the spatial light modulation unit may be employed in a vehicle lamp to realize a function of forming a light distribution pattern, or in a head-up display (HUD) to realize a function of generating image information.

A specific configuration of the above "spatial light modulator" is not particularly limited as long as the spatial light modulator can control spatial distribution of reflected light when light from the light source is reflected. For example, a spatial light modulator which uses a digital micromirror, or a spatial light modulator which uses a reflective liquid crystal may be employed.

The above "unit front-rear direction" refers to a direction orthogonal to a reflected light control region of the spatial light modulator. A front side of the reflected light control region is referred to as the "unit front side", and a rear side of the reflected light control region is referred to as the "unit rear side".

A direction in which the light from the light source is reflected by the above "spatial light modulator" may be a direction perpendicular to the reflected light control region of the spatial light modulator or a direction inclined with respect to the reflected light control region.

The above "support board" is configured to support the peripheral edge portion of the spatial light modulator from the unit rear side in the state of being electrically connected to the spatial light modulator, and may be configured to directly support the peripheral edge portion of the spatial light modulator. The support board may also be configured to support the peripheral edge portion of the spatial light modulator via another member.

A specific clamping structure or mounting position of the above "clamping member" is not particularly limited as long as the clamping member is mounted on the support board in the state of clamping the support board from the two sides in the unit front-rear direction. A specific structure for fixing the above "clamping member" to the bracket is also not particularly limited.

A lamp unit according to another aspect of the disclosure includes:

a light source;

a spatial light modulator configured to reflect light from the light source, the spatial light modulator including a reflection control unit in which a plurality of reflecting elements configured to reflect the light from the light source are arranged;

an optical member configured to emit the light reflected by the spatial light modulator toward a front side of the unit; and a light shielding member which is arranged between the spatial light modulator and the optical member and is made of an electrically grounded conductive member.

Each of the plurality of reflecting elements is capable of taking a first angular position to reflect the light from the light source that reaches the reflecting element toward the optical member, and taking a second angular position to reflect in a direction deviated from the optical member.

The light shielding member shields light reflected from each of the plurality of reflecting elements when the second angular position is taken.

A specific configuration of the above "spatial light modulator" is not particularly limited as long as the spatial light modulator can control spatial distribution of reflected light when light from the light source is reflected. For example, a spatial light modulator which uses a digital micromirror may be employed.

A specific configuration of the above "optical member" is not particularly limited as long as the optical member is configured to emit the light from the light source reflected by the spatial light modulator toward the front side of the unit. For example, a projection lens, a reflector, or a mirror may be employed.

A specific arrangement or configuration of the above "light shielding member" is not particularly limited as long as the light shielding member is made of an electrically grounded conductive member and is arranged to shield the light reflected from each of the plurality of reflecting elements when the second angular position is taken.

A lamp unit according to another aspect of the disclosure includes:

a light source;

a spatial light modulator configured to reflect light from the light source, the spatial light modulator including: a reflection control unit which includes a plurality of reflecting elements configured to reflect the light from the light source; a housing portion configured to accommodate the reflection control unit; and a translucent plate which is supported by the housing portion in a state of being arranged on a unit front side of the reflection control unit;

a projection lens configured to emit the light reflected by the spatial light modulator toward a front side of the unit;

a bracket configured to support the spatial light modulator, the bracket being arranged on the unit front side of the spatial light modulator and including an opening portion which surrounds the translucent plate; and a translucent cover which is supported by the bracket and is configured to cover the opening portion from the unit front side.

A specific configuration of the above "spatial light modulator" is not particularly limited as long as the spatial light modulator can control spatial distribution of reflected light when light from the light source is reflected. For example, a spatial light modulator which uses a digital micromirror, or a spatial light modulator which uses a reflective liquid crystal may be employed.

A specific arrangement or configuration of the above "bracket" is not particularly limited as long as the bracket supports the spatial light modulator in the state of being arranged on the unit front side of the spatial light modulator and includes the opening portion which surrounds the translucent plate.

A specific arrangement or configuration of the "translucent cover" is not particularly limited as long as the translucent cover is a translucent member configured to cover the opening portion of the bracket from the unit front side.

A lamp unit according to another aspect of the disclosure includes:

a light source;

a spatial light modulator configured to reflect light from the light source, the spatial light modulator including: a reflection control unit which includes a plurality of reflecting elements configured to reflect the light from the light source; a housing portion configured to accommodate the reflection control unit; a translucent plate arranged on a unit front side of the reflection control unit; and a seal portion configured to seal the translucent plate to the housing portion at a peripheral edge portion of the translucent plate;

an optical member configured to emit the light reflected by the spatial light modulator toward a front side of the unit;

a bracket which is arranged on the unit front side of the spatial light modulator and is configured to support the spatial light modulator;

a plate-shaped member which is arranged between the spatial light modulator and the bracket, the plate-shaped member including an opening portion configured to cover the seal portion from the unit front side and to surround the reflection control unit; and a gasket interposed between the plate-shaped member and the housing portion.

A lamp unit according to another aspect of the disclosure includes:

a light source;

a spatial light modulator configured to reflect light from the light source;

an optical member configured to emit the light reflected by the spatial light modulator toward a front side of the unit;

a light source support member which is arranged below the spatial light modulator and is configured to support the light source;

a heat dissipating member which is arranged on a unit front side of the light source support member and below the optical member, and is configured to dissipate heat generated by lighting of the light source; and a heat transfer member configured to connect the heat dissipating member and the light source support member.

A specific configuration of the above "spatial light modulator" is not particularly limited as long as the spatial light modulator can control spatial distribution of reflected light when light from the light source is reflected. For example, a spatial light modulator which uses a digital micromirror, or a spatial light modulator which uses a reflective liquid crystal may be employed.

A specific configuration of the above "optical member" is not particularly limited as long as the optical member is configured to emit the light from the light source reflected by the spatial light modulator toward the front side of the unit. For example, a projection lens, a reflector, or a mirror may be employed.

A specific arrangement or configuration of the above "bracket" is not particularly limited as long as the bracket supports the spatial light modulator in the state of being arranged on the unit front side of the spatial light modulator.

A specific arrangement of the above "plate-shaped member" and a specific shape of the "opening portion" are not particularly limited as long as the plate-shaped member is configured such that the opening portion is formed to cover the seal portion from the unit front side and to surround the reflection control unit.

A specific arrangement or configuration of the above "heat dissipating member" is not particularly limited as long as the heat dissipating member is arranged on the unit front side of the light source support member and below the optical member.

A specific arrangement or configuration of the above "heat transfer member" is not particularly limited as long as the heat transfer member is configured to connect the heat dissipating member and the light source support member.

Advantageous Effects of Invention

The vehicle lamp according to the present disclosure is configured to emit light from the light source toward the front side of the lamp via the spatial light modulator and the projection lens. Various light distribution patterns can be formed with high accuracy by controlling spatial distribution of light reaching the projection lens in the spatial light modulator.

The lens holder which is configured to support the projection lens is fixed, by mechanical fastening, to the bracket which is configured to support the spatial light modulator. Therefore, the projection lens and the spatial light modulator can be reliably supported.

The positioning protruding portion, which is configured to position the lens holder with respect to the bracket in the direction orthogonal to the lamp front-rear direction, is formed on the lens holder. The elongated hole which extends in the lamp front-rear direction is formed in the bracket. The fixing is performed by mechanical fastening in the state where the positioning protruding portion is inserted into the elongated hole. Therefore, the following operational effect can be obtained.

That is, the fixing is performed by mechanical fastening in a state where the positioning protruding portion of the lens holder is inserted into the elongated hole of the bracket and is appropriately moved in the lamp front-rear direction. As a result, the lens holder can be restricted from being displaced in the direction orthogonal to the lamp front-rear direction with respect to the bracket, and a positional relationship in the lamp front-rear direction between the projection lens supported by the lens holder and the spatial light modulator supported by the bracket can be finely adjusted. Therefore, the spatial light modulator can be arranged with high positional accuracy with respect to the projection lens.

The positioning protruding portion, which is configured to position the lens holder with respect to the bracket in the direction orthogonal to the lamp front-rear direction, is formed on the bracket. The elongated hole which extends in the lamp front-rear direction is formed in the lens holder. The fixing is performed by mechanical fastening in the state where the positioning protruding portion is inserted into the elongated hole. As a result, the following operational effect can be obtained.

That is, the fixing is performed by mechanical fastening in a state where the positioning protruding portion of the bracket is inserted into the elongated hole of the lens holder and is appropriately moved in the lamp front-rear direction, so that the lens holder can be restricted from being displaced in the direction orthogonal to the lamp front-rear direction with respect to the bracket, and the positional relationship in the lamp front-rear direction between the projection lens supported by the lens holder and the spatial light modulator supported by the bracket can be finely adjusted. As a result, the spatial light modulator can be arranged with high positional accuracy with respect to the projection lens.

In this way, according to the present disclosure, the spatial light modulator can be arranged with high positional accuracy with respect to the projection lens in the vehicle lamp configured to emit the light from the light source toward the front side of the lamp via the spatial light modulator and the projection lens.

In the above configuration, although it is possible to use one positioning pin as a specific configuration of the positioning protruding portion, rigidity of the positioning protruding portion can be improved if the positioning protruding portion is constituted by two positioning pins which are spaced apart in the lamp front-rear direction.

In the above configuration, if the positioning protruding portion is constituted by a standing wall extending in the lamp front-rear direction, the rigidity of the positioning protruding portion can be significantly improved as compared with the case where the positioning protruding portion is constituted by the one positioning pin.

In the above configuration, if the positioning protruding portion is fixed to the bracket or the lens holder by caulking around the elongated hole, it is possible to easily maintain the positional relationship between the projection lens supported by the lens holder and the spatial light modulator supported by the bracket in a state where fine adjustment in the lamp front-rear direction is completed. The above "fixing by caulking" may be realized by heat caulking or cold caulking. Instead of the above "fixing by caulking", laser welding or the like may also be employed.

In the above configuration, if the fixing of the mechanical fastening is performed at two front and rear locations on left and right sides of the projection lens, the projection lens can be more reliably supported. If the positioning protruding portion and the elongated hole are respectively arranged between the two front and rear locations on the left and right sides of the projection lens, the state where the positioning protruding portion is inserted into the elongated hole can be reliably maintained, and a positioning function thereof can be improved.

The vehicle lamp according to the present disclosure includes the spatial light modulator which is configured to reflect the light from the light source toward the front side of the lamp. Therefore, various light distribution patterns can be formed with high accuracy by controlling spatial distribution of reflected light in the spatial light modulator.

The spatial light modulator is electrically connected to the support board which is configured to support the peripheral edge portion of the spatial light modulator from the lamp rear side. The bracket which is abutted against the peripheral edge portion of the spatial light modulator from the lamp front side is arranged on the lamp front side of the spatial light modulator. The heat sink, which is configured to elastically press the spatial light modulator toward the lamp front side in the state of being abutted against the central portion of the spatial light modulator, is arranged on the lamp rear side of the spatial light modulator. As a result, it is possible to prevent an excessive load from acting on the spatial light modulator. Therefore, the electric connection between the spatial light modulator and the support board can be secured and the spatial light modulator can be prevented from being damaged.

At least one shaft which extends in the lamp front-rear direction is arranged around the spatial light modulator in a state where a rear end portion of the shaft is fixed to the heat sink. A front end portion of the shaft is inserted into a shaft positioning hole in a state where the shaft is inserted through a shaft insertion hole formed in the support board. As a result, the following operational effect can be obtained.

That is, presence of the at least one shaft allows the heat sink and the bracket to be maintained in a fixed positional relationship with respect to the direction orthogonal to the lamp front-rear direction. Therefore, even when a vibration load or an impact load acts on the vehicle lamp, it is possible to effectively prevent the positional relationship between the spatial light modulator and the heat sink from being misaligned and to effectively prevent the excessive load from acting on the spatial light modulator, and thereby effectively preventing the spatial light modulator from being damaged.

In this way, according to the present disclosure, the spatial light modulator can be effectively prevented from being damaged by the vibration load or the like in the vehicle lamp that includes the reflective spatial light modulator.

In the above configuration, if the front end portion of the shaft protrudes from the shaft positioning hole toward the front side of the lamp while a displacement restricting member is attached to the front end portion to restrict the bracket from displacing toward the lamp front side by engaging with a front surface of the bracket, the heat sink and the bracket can be maintained in a fixed positional relationship not only in the direction orthogonal to the lamp front-rear direction but also in the lamp front-rear direction. As a result, positional misalignment between the spatial light modulator and the heat sink can be more effectively prevented, and the effect of preventing the damage to the spatial light modulator can be improved.

In the above configuration, if the front end portion of the shaft is fixed to the bracket with an adhesive in the shaft positioning hole, the heat sink and the bracket can be easily maintained in the fixed positional relationship not only in the direction orthogonal to the lamp front-rear direction but also in the lamp front-rear direction. As a result, the positional misalignment between the spatial light modulator and the heat sink can be still more effectively prevented, and the effect of preventing the damage to the spatial light modulator can be further improved.

Even when an adhesive effect is not obtained due to deterioration of the adhesive over time, the state where the spatial light modulator is elastically pressed by the heat sink can still be maintained.

In the above configuration, if a plurality of stepped bolts which extend in the lamp front-rear direction are arranged around the spatial light modulator, and each of the stepped bolts is screwed to the bracket at a small diameter portion thereof in a state where the stepped bolts are inserted through a bolt insertion hole formed in the heat sink and a bolt insertion hole formed in the support board from the lamp rear side while a spring configured to elastically press the support board toward the lamp front side is attached to a large diameter portion of each of the stepped bolts, elastic pressing of the spatial light modulator can be stably performed by the heat sink.

If the plurality of stepped bolts are arranged at two upper and lower locations on the left and right sides of the spatial light modulator while shafts are arranged between the two upper and lower locations on the left and right sides of the spatial light modulator, a state where a front end portion of each shaft is inserted into each shaft positioning hole of the bracket can be reliably maintained, and a positioning function thereof can be improved.

The vehicle lamp according to the present disclosure includes the spatial light modulator which is configured to reflect the light from the light source toward the front side of the lamp. Various light distribution patterns can be formed with high accuracy by controlling spatial distribution of reflected light in the spatial light modulator.

The pressing tool which is configured to elastically press the spatial light modulator toward the rear side of the lamp in the state of being abutted against the peripheral edge portion of the spatial light modulator is arranged on the lamp front side of the spatial light modulator. The heat sink, which is configured to elastically press the spatial light modulator toward the front side of the lamp in the state of being abutted against the central portion of the spatial light modulator, is arranged on the lamp rear side of the spatial light modulator. As a result, even when a vibration load or an impact load acts on the vehicle lamp, it is possible to prevent an excessive load from acting on the spatial light modulator. Therefore, the damage to the spatial light modulator can be effectively reduced.

The control board which is electrically connected to the spatial light modulator in the state of being abutted against the peripheral edge portion of the spatial light modulator is arranged on the lamp rear side of the spatial light modulator. The board bracket which is configured to support the control board in the state of being abutted against the control board is arranged on the lamp rear side of the control board. The pressing tool is fixed to the board bracket from the lamp front side, and the heat sink is fixed from the lamp rear side. As a result, even when a vibration load or an impact load acts on the vehicle lamp, a positional relationship between the control board and the board bracket or the heat sink can be prevented from being misaligned, and it is possible to prevent an excessive load from acting on a connection portion between the spatial light modulator and the control board. Therefore, damage to the connection portion between the spatial light modulator and the control board can be effectively reduced.

In this way, according to the present disclosure, it is possible to effectively prevent the spatial light modulator from being damaged and prevent the connection portion between the spatial light modulator and the control board from being damaged by the vibration load or the like in the vehicle lamp that includes the reflective spatial light modulator.

Further, in the above configuration, if an elastic pressing force of the pressing tool with respect to the spatial light modulator is set to a value larger than an elastic pressing force of the heat sink with respect to the spatial light modulator, a state where the peripheral edge portion of the spatial light modulator is always pressed against the control board can be maintained, so that electric connection between the spatial light modulator and the control board can be more reliably maintained.

The above "elastic pressing force of the pressing tool with respect to the spatial light modulator" refers to an elastic pressing force which is a sum of elastic pressing forces at each location in a case where the pressing tool elastically presses the spatial light modulator at a plurality of locations. Similarly, the above "elastic pressing force of the heat sink with respect to the spatial light modulator" refers to an elastic pressing force which is a sum of elastic pressing forces at each location in a case where the heat sink elastically presses the spatial light modulator at a plurality of locations.

Further, in the above configuration, a plurality of first stepped bolts which are configured to fix the pressing tool to the board bracket are arranged around the spatial light modulator. A tip end surface of a large diameter portion of each of the first stepped bolts is abutted against the control board in a state where the large diameter portion is inserted through a bolt insertion hole of the pressing tool. Each of the first stepped bolts is screwed to the board bracket at a small diameter portion thereof in a state where the small diameter portion is inserted through a bolt insertion hole formed in the control board. A first spring which is configured to elastically press the pressing tool toward the rear side of the lamp is attached to the large diameter portion of each of the first stepped bolts. With such a configuration, it is possible to easily press the spatial light modulator stably by the pressing tool with a predetermined elastic pressing force.

By employing such a configuration, since the control board is also supported by the board bracket at the same time when the pressing tool is fixed to the board bracket, a configuration of the vehicle lamp can be simplified. Instead of such a configuration, it is also possible to employ a configuration in which the control board is supported by the board bracket by fixing the control board to the board bracket in a state independent of the fixing of the pressing tool to the board bracket.

Further, in the above configuration, if a plurality of second stepped bolts which are configured to fix the heat sink to the board bracket are arranged around the spatial light modulator, a tip end surface of a large diameter portion of each of the second stepped bolts is abutted against the board bracket in a state where the large diameter portion is inserted through a bolt insertion hole formed in the heat sink, each of the second stepped bolts is screwed to the board bracket at a small diameter portion thereof while a second spring which is configured to elastically press the heat sink toward the front side of the lamp is attached to the large diameter portion, it is possible to easily press the spatial light modulator by the heat sink stably with a predetermined elastic pressing force.

Further, in the above configuration, a protruding piece which protrudes toward the front side of the lamp is formed on each of left and right end portions of the heat sink. A guide groove portion which engages with upper and lower end surfaces of the protruding piece and extends in the lamp front-rear direction is formed in each of left and right end portions of the board bracket. With such a configuration, the heat sink can be prevented from rotating in an up-down direction with respect to the board bracket. As a result, the central portion of the spatial light modulator can be easily pressed by the heat sink with a uniform pressure distribution.

Further, an elongated hole extending in the lamp front-rear direction is formed in each of the protruding pieces, a screw hole is formed in each of the groove portions, and a screw is fastened to each screw hole via each elongated hole. As a result, if the heat sink is fixed to the board bracket in a state where the heat sink is positioned in the lamp front-rear direction with respect to the board bracket, a positional relationship between the members can be fixed while maintaining a state where the spatial light modulator is pressed by predetermined elastic pressing forces from two sides in the lamp front-rear direction. As a result, even when a vibration load or an impact load acts on the vehicle lamp, it is possible to prevent a load that is equal to or greater than the elastic pressing force of the pressing tool and the elastic pressing force of the heat sink from acting on the spatial light modulator and a connection portion between the spatial light modulator and the control board.

The spatial light modulation unit according to the present disclosure includes the spatial light modulator that reflects the light from the light source. Various light distribution patterns can be formed with high accuracy and various types of image information can be generated with high accuracy by controlling spatial distribution of reflected light in the spatial light modulator.

The spatial light modulator is electrically connected to the support board which is configured to support the peripheral edge portion of the spatial light modulator from the unit rear side. The bracket which is abutted against the peripheral edge portion of the spatial light modulator from the unit front side is arranged on the unit front side of the spatial light modulator. Therefore, electric connection between the spatial light modulator and the support board can be stably maintained.

The clamping members which are configured to clamp the support board from two sides in the unit front-rear direction are mounted at a plurality of locations of the support board, and the clamping members are fixed to the bracket. Therefore, the support board and the bracket can be maintained in a fixed positional relationship with respect to the unit front-rear direction.

Therefore, even when a vibration load or an impact load acts on the spatial light modulation unit, the positional relationship between the support board and the bracket can be prevented from being misaligned in the unit front-rear direction. As a result, even though the spatial light modulation unit is placed on a vehicle, it is possible to effectively prevent an excessive load from acting on a connection portion between the spatial light modulator and the support board and damaging the connection portion.

In this way, according to the present disclosure, it is possible to effectively prevent the connection portion between the spatial light modulator and the support board from being damaged by the vibration load or the like in the in-vehicle spatial light modulation unit that includes the reflective spatial light modulator.

Further, in the above configuration, screw holes extending in a direction orthogonal to the unit front-rear direction are formed at a plurality of locations of the bracket. An elongated hole extending in the unit front-rear direction is formed in each of the clamping members. Each of the clamping members is fixed to the bracket by fastening a screw to each of the screw holes through each of the elongated holes. With such a configuration, the support board can be fixedly supported by the bracket in a state where the support board is arranged at an optimum position in the unit front-rear direction. As a result, damage to the connection portion between the spatial light modulator and the support board caused by the vibration load or the like can be more effectively reduced.

If a guide groove portion which extends in the unit front-rear direction is formed at each of a plurality of locations of the bracket to engage with each of the clamping members, the clamping members can be prevented from being inadvertently rotated when the clamping members are mounted to the support board by screwing. As a result, each of the clamping members can be mounted to the support board in an appropriate state.

Further, in the above configuration, if the plurality of locations where the clamping members are mounted on the support board are set at two upper and lower locations on the left and right sides of the spatial light modulator, the support board can be fixedly supported by the bracket stably. As a result, the damage to the connection portion between the spatial light modulator and the support board caused by the vibration load or the like can be more effectively reduced.

Further, in the above configuration, if each of the clamping members is formed by welding two L-shaped metal plates to each other in a state where the two metal plates are spaced apart from each other in the unit front-rear direction, each of the clamping members can be inexpensive and have a simple structure.

Further, in the above configuration, if a heat sink is arranged on the unit rear side of the support board to elastically press the spatial light modulator toward the unit front side in a state of being abutted against the central portion of the spatial light modulator, heat dissipation of the spatial light modulator can be achieved while preventing an excessive load from acting on the spatial light modulator.

The positional relationship between the support board and the bracket is maintained constant in the unit front-rear direction. Therefore, even when a vibration load or an impact load acts on the spatial light modulation unit, a positional relationship between the spatial light modulator and the heat sink is not misaligned. As a result, the spatial light modulator can be prevented from being damaged by a load from the heat sink.

In a case where such a heat sink is provided, if a plurality of stepped bolts which are configured to fix the heat sink to the bracket are arranged around the spatial light modulator, a tip end surface of a large diameter portion of each of the stepped bolts is abutted against the bracket in a state where the large diameter portions are inserted through a bolt insertion hole formed in the heat sink and a bolt insertion hole formed in the support board, each of the stepped bolts is screwed to the bracket at a small diameter portion thereof while a spring which is configured to elastically press the heat sink toward the front side of the unit is attached to the large diameter portion, it is possible to easily press the spatial light modulator by the heat sink stably with a predetermined elastic pressing force.

Further, in the case where such a heat sink is provided, at least one shaft which extends in the unit front-rear direction is arranged around the spatial light modulator in a state where a rear end portion of the shaft is fixed to the heat sink. At least one shaft insertion hole is formed in the support board. At least one shaft positioning hole is formed in the bracket. Further, a front end portion of each shaft is inserted into each shaft positioning hole in a state where each shaft is inserted through each shaft insertion hole. With such a configuration, the following operational effect can be obtained.

That is, presence of the at least one shaft allows the heat sink and the bracket to be maintained in a fixed positional relationship with respect to a direction orthogonal to the unit front-rear direction. Therefore, even in a case where it is difficult to maintain the support board and the bracket in a fixed positional relationship with respect to the direction orthogonal to the unit front-rear direction, the positional relationship can be maintained only by mounting the clamping members at the plurality of locations of the support board. As a result, it is possible to minimize the number of locations where the clamping members are mounted, and it is possible to further simplify the structure of each clamping member.

The above "at least one shaft" may be formed as a member separate from the heat sink, or may be formed integrally with the heat sink.

The lamp unit according to the present disclosure is configured to emit the light from the light source reflected by the spatial light modulator toward the front side of the unit via the optical member. Various light distribution patterns can be formed with high accuracy by controlling spatial distribution of the reflected light in the spatial light modulator.

The spatial light modulator is configured such that each of the plurality of reflecting elements constituting the reflection control unit thereof is capable of taking the first angular position to reflect the light from the light source that reaches the reflecting element toward the optical member, and taking the second angular position to reflect in the direction deviated from the optical member. The light shielding member which shields the light reflected from each of the plurality of reflecting elements when the second angular position is taken is arranged between the spatial light modulator and the optical member. Therefore, light that does not contribute to formation of the light distribution pattern can be prevented from becoming stray light.

The light shielding member is made of an electrically grounded conductive member. The light shielding member can function as an electromagnetic shield that protects the spatial light modulator from noise generated due to repetition of lighting and extinguishing of the light source, thereby effectively preventing control of the spatial light modulator from being adversely affected.

In this way, according to the present disclosure, an influence of noise on the spatial light modulator can be minimized in the lamp unit that includes the reflective spatial light modulator.

Further, in the above configuration, if the light shielding member is formed of a plate-shaped member which is subjected to surface treatment to restrict light reflection, the reflected light from each of the plurality of reflecting elements when the second angular position is taken can be effectively prevented from being re-reflected by the light shielding member and becoming stray light, thereby a light shielding function of the light shielding member can be improved.

As a specific configuration of the light shielding member, if the light shielding member is made of an aluminum plate which is subjected to black alumite treatment, the re-reflection of the light shielding member can be prevented more effectively, and thus the light shielding function of the light shielding member can be further improved.

Further, in the above configuration, if an electrically grounded second conductive member is arranged around a board where the spatial light modulator is placed so as to surround the board, an electromagnetic shielding function for preventing the influence of noise on the spatial light modulator can be further improved.

As a configuration of the second conductive member, a portion of the second conductive member may be formed integrally with the conductive member.

The lamp unit according to the present disclosure is configured to emit the light from the light source reflected by the spatial light modulator toward the front side of the unit via the optical member. Various light distribution patterns can be formed with high accuracy by controlling spatial distribution of the reflected light in the spatial light modulator.

The spatial light modulator includes: the reflection control unit in which the plurality of reflecting elements configured to reflect the light from the light source are arranged; the housing portion configured to accommodate the reflection control unit; and the translucent plate which is supported by the housing portion in the state of being arranged on the unit front side of the reflection control unit. Therefore, it is possible to prevent foreign matter from adhering to the reflection control unit.

The bracket configured to support the spatial light modulator is arranged on the unit front side of the spatial light modulator. The opening portion that surrounds the translucent plate of the spatial light modulator is formed in the bracket. The translucent cover which is configured to cover the opening portion of the bracket from the unit front side is supported on the bracket. Therefore, it is possible to prevent foreign matter from adhering to the translucent plate.

On the other hand, even when foreign matter adheres to the translucent cover, since the translucent cover is spaced apart from the reflection control unit farther on the unit front side than the translucent plate, an image of the foreign matter projected by the projection lens, which serves as the optical member, is greatly blurred. Therefore, an unexpected shadow or glare can be effectively prevented from being generated in the light distribution pattern.

In this way, according to the present disclosure, the unexpected shadow or glare can be effectively prevented from being generated in the light distribution pattern in the lamp unit that includes the reflective spatial light modulator.

The lamp unit according to the present disclosure is suitable for an in-vehicle lamp unit, and can also be used in applications other than in-vehicle use.

Further, in the above configuration, if the translucent cover extends along a convex curved surface centered on a position of the reflection control unit of the spatial light modulator, deviation of an optical path can be effectively prevented when light from the light source that enters the spatial light modulator and light from the light source that is reflected by the spatial light modulator pass through the translucent cover, and thus a light distribution control function of the lamp unit can be improved.

Further, in the above configuration, if a gasket is interposed between the bracket and the housing portion of the spatial light modulator, sealability of space where a front surface of the translucent plate is exposed can be improved, and thus possibility of adhesion of foreign matter to the translucent plate can be further reduced.

Further, in the above configuration, if an annular groove portion which extends to surround the opening portion is formed in a front surface of the bracket, and the translucent cover is attached to the bracket in a state of being engaged with the annular groove portion, the sealability of the space where the front surface of the translucent plate is exposed can be improved, and thus the possibility of adhesion of foreign matter to the translucent plate can be further reduced.

Further, in the above configuration, if an interval in the unit front-rear direction between the translucent cover and the translucent plate is set to a value larger than an interval in the unit front-rear direction between the translucent plate and the reflection control unit, since the translucent cover is arranged at a position spaced apart from the reflection control unit on the unit front side twice or more as far as the translucent plate, it is possible to easily blur the image of the foreign matter projected by the projection lens greatly. Therefore, the unexpected shadow or glare can be more effectively prevented from being generated in the light distribution pattern.

Further, in the above configuration, if the translucent cover has a lens function configured to control light from the light source toward the spatial light modulator, accuracy of control of light incident on the spatial light modulator can be improved and a configuration of the lamp unit can be simplified.

The lamp unit according to the present disclosure is configured to emit the light from the light source reflected by the spatial light modulator toward the front side of the unit via the optical member. Various light distribution patterns can be formed with high accuracy by controlling spatial distribution of the reflected light in the spatial light modulator.

The spatial light modulator includes: the reflection control unit in which the plurality of reflecting elements are arranged; the housing portion configured to accommodate the reflection control unit; the translucent plate which is supported by the housing portion in the state of being arranged on the unit front side of the reflection control unit; and the seal portion configured to seal the translucent plate to the housing portion at the peripheral edge portion of the translucent plate. Therefore, foreign matter such as dust can be prevented from adhering to the reflection control unit.

The plate-shaped member is arranged between the bracket, which is configured to support the spatial light modulator on the unit front side of the spatial light modulator, and the spatial light modulator. The plate-shaped member includes the opening portion which is configured to cover the seal portion from the unit front side and to surround the reflection control unit. The gasket is interposed between the plate-shaped member and the housing portion. As a result, the following operational effect can be obtained.

That is, the seal portion of the spatial light modulator is covered with the plate-shaped member from the unit front side. Therefore, even when external light passes through the optical member or is reflected by the optical member at an angle where the external light converges on the seal portion, the converged light can be shielded by the plate-shaped member. As a result, the seal portion can be prevented from being melted and damaged.

In this way, according to the present disclosure, the seal portion of the spatial light modulator can be prevented from being melted and damaged by the external light in the lamp unit that includes the reflective spatial light modulator. As a result, sealability of internal space of the spatial light modulator can be prevented from being impaired.

In the present disclosure, the gasket is interposed between the plate-shaped member and the housing portion. Therefore, the plate-shaped member can be supported without applying an excessive load to the spatial light modulator. As a result, a function of the spatial light modulator can be prevented from being impaired.

The lamp unit according to the present disclosure is suitable for an in-vehicle lamp unit, and can also be used in applications other than in-vehicle use.

Further, in the above configuration, if the plate-shaped member is engaged with the bracket so as to be positioned in the direction orthogonal to the unit front-rear direction, accuracy of a positional relationship between the reflection control unit of the spatial light modulator and the opening portion of the plate-shaped member can be improved, and thus the seal portion of the spatial light modulator can be covered in an appropriate state.

Further, in the above configuration, if protruding portions are formed at a plurality of locations on a rear surface of the bracket, the plate-shaped member can be easily positioned in the direction orthogonal to the unit front-rear direction by engaging the protruding portions with the plate-shaped member.

Further, in the above configuration, if protruding portions are formed at a plurality of locations on a rear surface of the gasket, the plate-shaped member can be easily supported in a proper manner without applying an excessive load to the spatial light modulator by abutting the protruding portions against the housing portion and elastically deforming the gasket.

Further, in the above configuration, if the plate-shaped member is formed with a plate thickness thinner than that of the translucent plate, it is possible to easily prevent optical paths of the light that enters the spatial light modulator from the light source and the light that is reflected by the spatial light modulator from being inadvertently obstructed by the plate-shaped member.

Further, in the above configuration, if the plate-shaped member is arranged at a position apart from the translucent plate on the unit front side, and a gap between the plate-shaped member and the translucent plate is set to a value smaller than the plate thickness of the translucent plate, it is possible to easily prevent the plate-shaped member from interfering with the translucent plate and to easily prevent the optical paths of the light that enters the spatial light modulator from the light source and the light that is reflected by the spatial light modulator from being inadvertently obstructed by the plate-shaped member.

The lamp unit according to the present disclosure is configured to emit the light from the light source reflected by the spatial light modulator toward the front side of the unit via the optical member. Various light distribution patterns can be formed with high accuracy by controlling spatial distribution of the reflected light in the spatial light modulator.

The light source support member which is configured to support the light source is arranged below the spatial light modulator. Therefore, it is possible to easily arrange the optical member at the position close to the surface of the vehicle body, and thus the degree of freedom in vehicle design can be improved.

The heat dissipating member which is configured to dissipate the heat generated by the lighting of the light source is arranged on the unit front side of the light source support member and below the optical member. The heat dissipating member and the light source support member are connected via the heat transfer member. Therefore, a heat dissipation function can be ensured without increasing an up-down direction dimension of the lamp unit.

In this way, according to the present disclosure, the heat dissipation function can be ensured without increasing the up-down direction dimension even when the light source support member is arranged below the spatial light modulator in the lamp unit that includes the reflective spatial light modulator. As a result, the degree of freedom in vehicle design can be improved, and arrangement space of the lamp unit can be easily secured.

The lamp unit according to the present disclosure is suitable for an in-vehicle lamp unit, and can also be used in applications other than in-vehicle use.

Further, in the above configuration, if the heat transfer member is formed of a heat transport member having a lower thermal resistance than the heat dissipating member, heat transfer efficiency from the light source support member to the heat dissipating member can be improved.

Further, in the above configuration, if a bracket configured to support the spatial light modulator and a holder configured to support the optical member are included, and the bracket includes a horizontal surface portion extending toward the front side of the unit between the holder and the heat dissipating member, heat dissipated from the heat dissipating member is received by the bracket, and thus the heat can be prevented from being directly transmitted to the holder. As a result, optical characteristics of the optical member can be effectively prevented from being changed due to an influence of the heat.

As a configuration of the heat dissipating member, if the heat dissipating member is attached to the bracket in a state where a gap is formed between the heat dissipating member and the horizontal surface portion of the bracket, the heat dissipated from the heat dissipating member can become less likely to be transmitted to the bracket, and thus a thermal effect on the optical member can be further reduced.

Instead of such a configuration, or in addition to such a configuration, if the holder which is configured to support the optical member is attached to the bracket in a state where a gap is formed between the holder and the horizontal surface portion of the bracket, heat dissipated from the bracket can become less likely to be transmitted to the holder, and thus the thermal effect on the optical member can be further reduced.

In the above configuration, if a heat dissipating fan is arranged below the heat dissipating member, and a through hole is formed in the heat dissipating member to guide wind generated by the heat dissipating fan to the optical member, the optical member can be positively cooled, and thus the thermal effect on the optical member can be further reduced.

DESCRIPTION OF EMBODIMENTS

Hereinafter, embodiments of the present disclosure will be described with reference to the drawings.

First Embodiment

First, a first embodiment of the present disclosure will be described.

Figure 1:
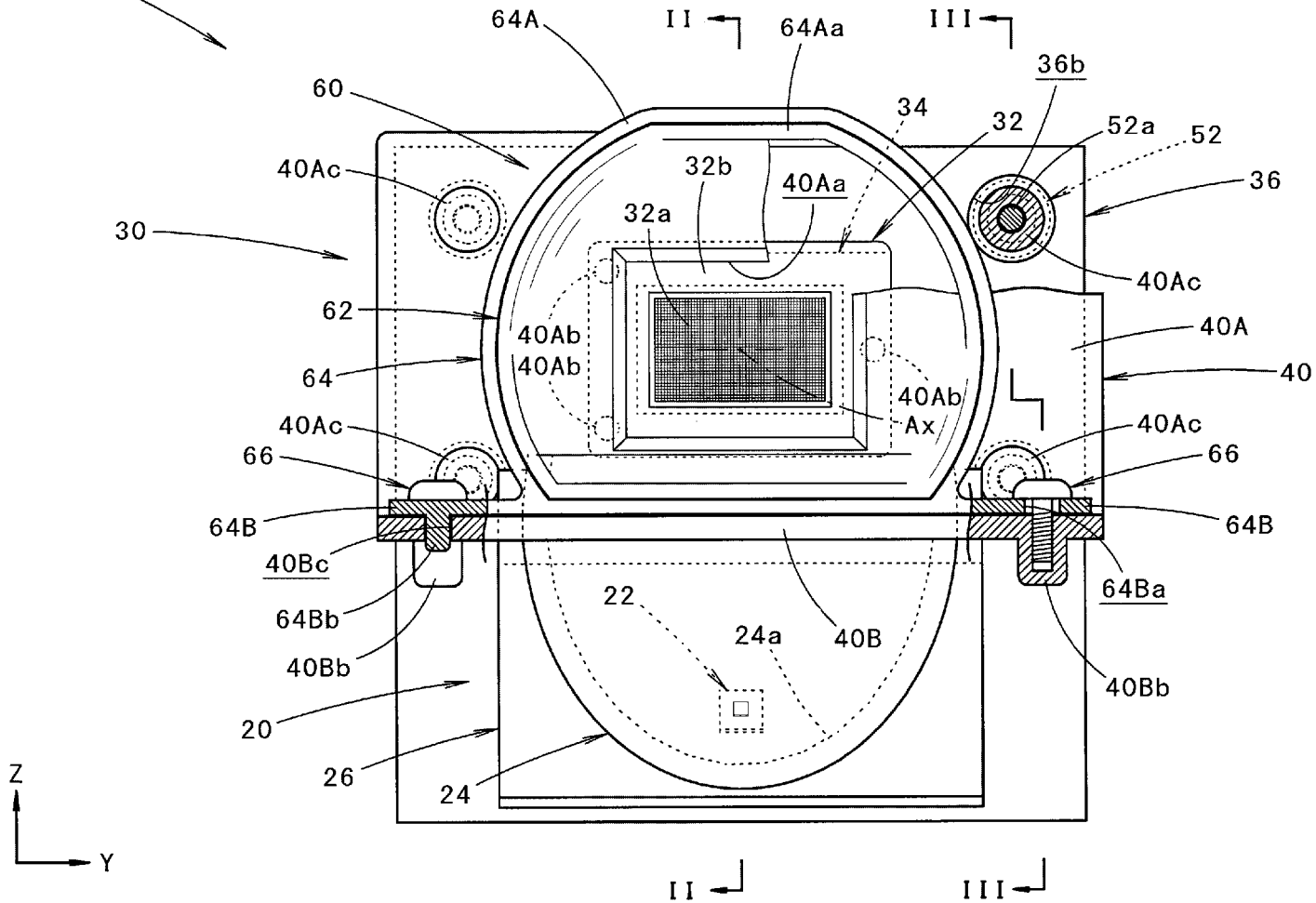
FIG. 1 is a front view showing a vehicle lamp according to a first embodiment of the present disclosure.
Figure 2:
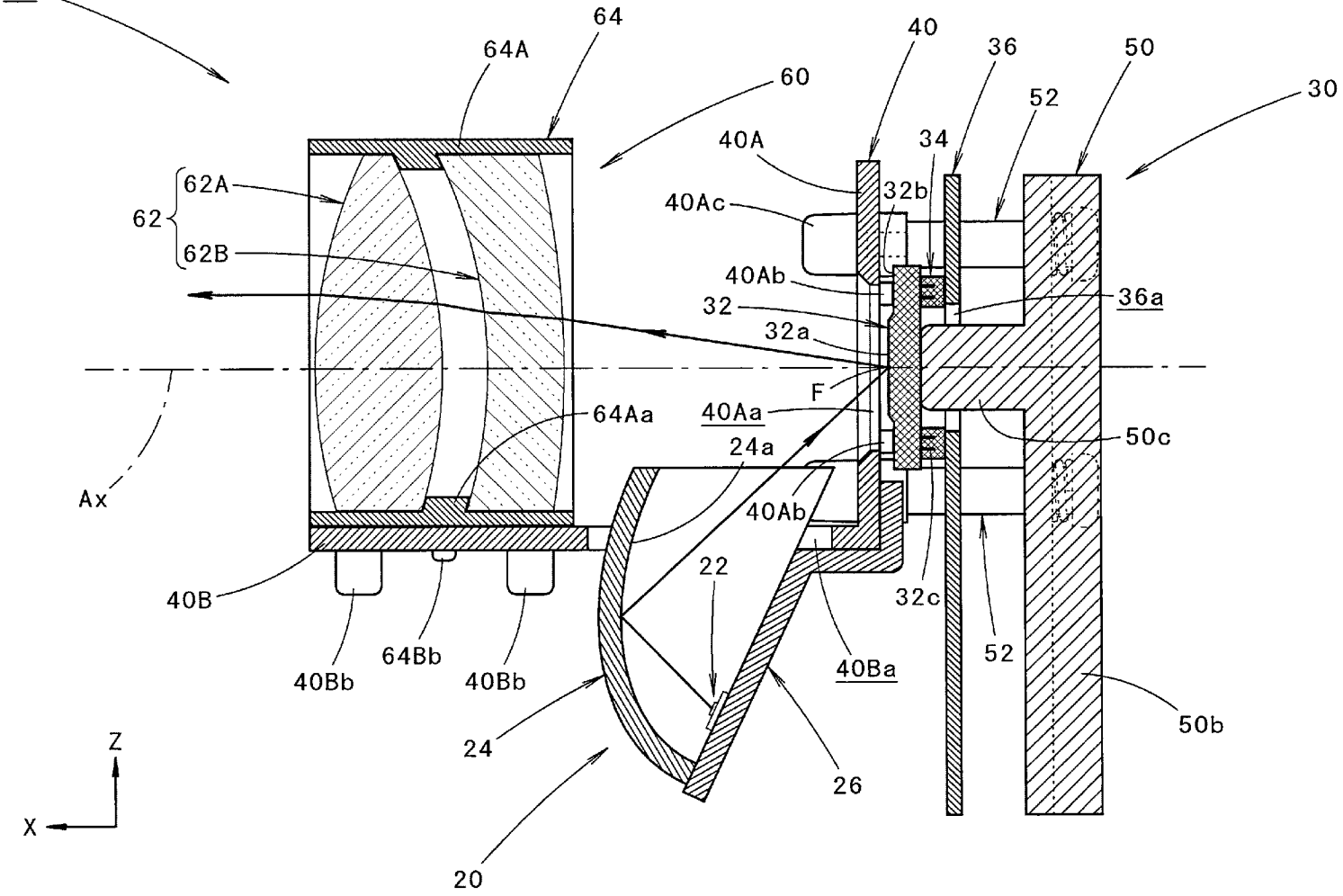
FIG. 2 is a cross-sectional view taken along line II-II of FIG. 1.
Figure 3:
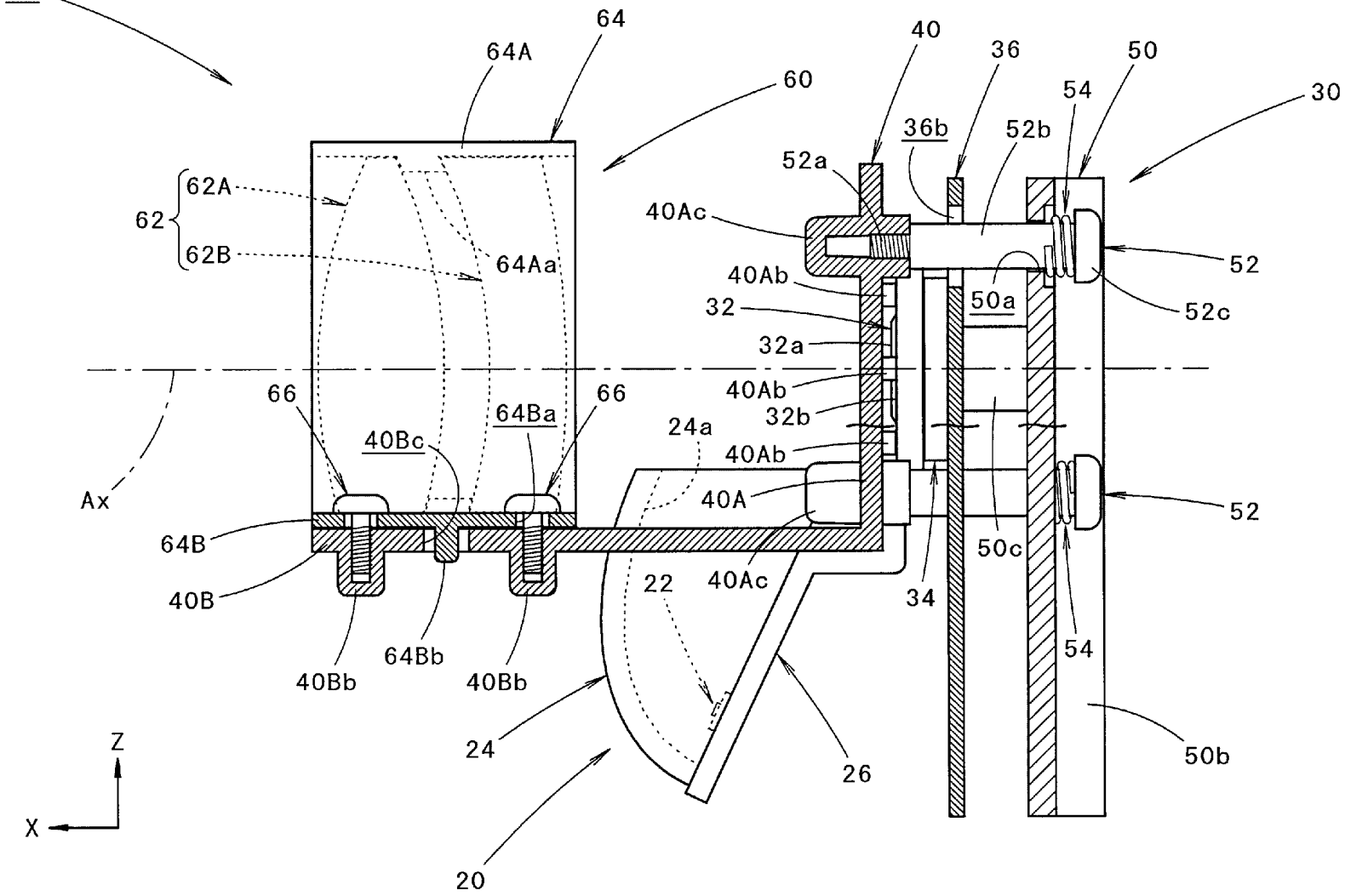
FIG. 3 is a cross-sectional view taken along line of FIG. 1.

FIG. 1 is a front view showing a vehicle lamp 10 according to the first embodiment of the present disclosure, and a part thereof is shown as a cross-sectional view. FIG. 2 is a cross-sectional view taken along line II-II of FIG. 1. FIG. 3 is a cross-sectional view taken along line of FIG. 1.

In these drawings, a direction indicated by X is a "front side" of a lamp (also of a vehicle), a direction indicated by Y is a "left direction" that is orthogonal to the "front side" (also a "left direction" of the vehicle, and a "right direction" in a front view of the lamp), and a direction indicated by Z is an "up direction". The same also applies to the other drawings.

As shown in these drawings, the vehicle lamp 10 according to the present embodiment is a headlamp provided at a front end portion of a vehicle, and is configured as a projector-type lamp unit incorporated in a lamp chamber formed by a lamp body and a translucent cover (not shown).

The vehicle lamp 10 includes: a light source side sub-assembly 20; a spatial light modulator sub-assembly 30; and a lens side sub-assembly 60.

The light source side sub-assembly 20 includes: a light source 22; a reflector 24 configured to reflect light emitted from the light source 22 toward the spatial light modulator sub-assembly 30; and a base member 26 configured to support the light source 22 and the reflector 24.

The spatial light modulator sub-assembly 30 includes: a spatial light modulator 32; a support board 36 arranged on a lamp rear side of the spatial light modulator 32; a bracket 40 arranged on a lamp front side of the support board 36; and a heat sink 50 arranged on the lamp rear side of the spatial light modulator 32.

The lens side sub-assembly 60 includes: a projection lens 62 which has an optical axis Ax extending in a vehicle front-rear direction; and a lens holder 64 configured to support the projection lens 62.

The vehicle lamp 10 according to the present embodiment is configured such that various light distribution patterns can be formed with high accuracy by emitting light from the light source 22 reflected by the reflector 24 toward the front side of the lamp via the spatial light modulator 32 and the projection lens 62. The light distribution patterns are, for example, low-beam light distribution patterns or high-beam light distribution patterns, light distribution patterns that change according to vehicle traveling situations or light distribution patterns that draw characters or symbols on a road surface in front of the vehicle.

In order to realize such light distribution patterns, during an assembly process of the vehicle lamp 10, a positional relationship between the spatial light modulator 32 and the projection lens 62 is finely adjusted in a state where the light source 22 is lit to form the light distribution patterns, and accuracy of the positional relationship is improved.

The vehicle lamp 10 is supported by the bracket 40 of the spatial light modulator sub-assembly 30 or the lamp body in the heat sink 50.

Next, a specific configuration of each of the light source side sub-assembly 20, the spatial light modulator sub-assembly 30, and the lens side sub-assembly 60 will be described.

First, the configuration of the light source side sub-assembly 20 will be described.

The light source 22 is a white light emitting diode, and is fixedly supported by the base member 26 in a state where a light emitting surface thereof faces obliquely upward and forward. The base member 26 is fixedly supported by the bracket 40 of the spatial light modulator sub-assembly 30.

The reflector 24 covers the light source 22 from the lamp front side, and a peripheral edge portion thereof is fixedly supported by the base member 26. The reflector 24 reflects the light emitted from the light source 22 obliquely upward and rearward. A reflecting surface 24*a* of the reflector 24 converges the light emitted from the light source 22 to the vicinity of a rear focal plane which includes a rear focus F of the projection lens 62.

Next, the configuration of the spatial light modulator sub-assembly 30 will be described.

The spatial light modulator 32 is a reflective spatial light modulator, and includes a digital micromirror device (DMD) in which a plurality of micromirrors are arranged in a matrix.

The spatial light modulator 32 is configured to selectively switch a reflection direction of the light from the light source 22 that has reached the spatial light modulator 32 by controlling an angle of a reflecting surface of each of the plurality of micromirrors. Specifically, a mode in which the light from the light source 22 is reflected toward the projection lens 62 and a mode in which the light is reflected toward another direction (that is, a direction that does not adversely affect formation of the light distribution patterns) are selected.

The spatial light modulator 32 is arranged along a vertical plane that is orthogonal to the optical axis Ax at a position of the rear focus F of the projection lens 62, and a reflected light control region 32*a* thereof has a laterally elongated rectangular outer shape centered on the optical axis Ax.

A rear surface of a peripheral edge portion 32*b* of the spatial light modulator 32 that surrounds the reflected light control region 32*a* is supported by the support board 36 via a socket 34.

The socket 34 is configured as a laterally elongated rectangular frame member along the peripheral edge portion 32*b* of the spatial light modulator 32, and is fixed to the support board 36 by soldering or the like in a state of being electrically connected to a conductive pattern (not shown) formed on the support board 36. An opening portion 36*a* that has substantially the same shape as an inner peripheral edge shape of the socket 34 is formed in the support board 36.

The peripheral edge portion 32*b* of the spatial light modulator 32 is formed with a plurality of terminal pins 32*c* that protrude toward the rear side of the lamp from the rear surface thereof, and the plurality of terminal pins 32*c* are fitted into a plurality of fitting holes (not shown) formed in the socket 34 so as to be electrically connected to the socket 34.

The spatial light modulator 32 is supported by the bracket 40 and the heat sink 50 from two sides in the lamp front-rear direction.

The bracket 40 is a member that is made of metal (for example, aluminum die casting), and includes: a vertical surface portion 40A that extends along the vertical plane orthogonal to the optical axis Ax; and a horizontal surface portion 40B that extends along a horizontal plane from a lower end edge of the vertical surface portion 40A toward the front side of the lamp.

An opening portion 40Aa that has a laterally elongated rectangular shape is formed in the vertical surface portion 40A with the optical axis Ax serving as a center. The opening portion 40Aa has a laterally elongated rectangular opening shape that is smaller than an outer peripheral edge shape of the spatial light modulator 32 and larger than the reflected light control region 32*a*, and a front end edge of an inner peripheral surface thereof is chamfered over an entire circumference.

Cylindrical protruding portions 40Ab are formed on a rear surface of the vertical surface portion 40A so as to protrude toward the lamp rear side at three locations around the opening portion 40Aa. Rear end surfaces of the protruding portions 40Ab at the three locations of the bracket 40 are abutted against the peripheral edge portion 32*b* of the spatial light modulator 32 from the lamp front side.

The horizontal surface portion 40B extends to the lamp front side of the reflector 24, and a laterally elongated rectangular opening portion 40Ba where the reflector 24 is inserted is formed in the horizontal surface portion 40B.

The heat sink 50 is a member that is made of metal (for example, aluminum die casting), and extends along the vertical plane that is orthogonal to the optical axis Ax. A plurality of heat dissipating fins 50*b* are formed in a vertical stripe pattern on a rear surface thereof.

A prismatic protruding portion 50*c* that protrudes toward the lamp front side is formed on a front surface of the heat sink 50. The protruding portion 50*c* has a laterally elongated rectangular cross-sectional shape centered on the optical axis Ax, and a size thereof is set to a value smaller than an inner peripheral surface shape of the socket 34. A front end surface of the protruding portion 50*c* is abutted against a central portion of the spatial light modulator 32 (that is, a portion where the reflected light control region 32*a* is located) from the lamp rear side in a state of being inserted into the opening portion 36*a* of the support board 36.

In the spatial light modulator sub-assembly 30, a plurality of stepped bolts 52 are arranged around the spatial light modulator 32. Specifically, four stepped bolts 52 are arranged at two upper and lower locations on left and right sides of the spatial light modulator 32.

Small diameter portions 52*a* located at tip ends of the stepped bolts 52 are screwed to the bracket 40 in a state of being inserted into a bolt insertion hole 50*a* formed in the heat sink 50 and a bolt insertion hole 36*b* formed in the support board 36 from the lamp rear side. In order to realize such a configuration, the bracket 40 is provided with boss portions 40Ac where the small diameter portions 52*a* of the stepped bolts 52 are screwed at four locations corresponding to the four stepped bolts 52.

A spring 54 configured to elastically press the heat sink 50 toward the lamp front side is attached to a large diameter portion 52*b* of each stepped bolt 52. Each spring 54 includes a compression coil spring arranged between a head portion 52*c* of each stepped bolt 52 and the heat sink 50.

In this way, by elastically pressing the heat sink 50 toward the lamp front side at the two upper and lower locations on the left and right sides of the spatial light modulator 32, the central portion of the spatial light modulator 32 is elastically pressed toward the lamp front side in a state where no excessive load is applied to the spatial light modulator. As a result, a state where the plurality of terminal pins 32*c* formed on the peripheral edge portion 32*b* of the spatial light modulator 32 are properly fitted into the fitting holes of the socket 34 (that is, a state where the electric connection between the spatial light modulator 32 and the socket 34 is reliably performed) is maintained.

Next, the configuration of the lens side sub-assembly 60 will be described.

The projection lens 62 includes first and second lenses 62A, 62B that are arranged at a predetermined interval in the lamp front-rear direction on the optical axis Ax.

The first lens 62A that is located on the lamp front side is configured as a biconvex lens, and the second lens 62B that is located on the lamp rear side is configured as a concave meniscus lens that bulges toward the rear side of the lamp. Upper end portions of the first and second lenses 62A, 62B are cut slightly along the horizontal plane, and lower end portions thereof are cut relatively large along the horizontal plane.

Outer peripheral edge portions of the first and second lenses 62A, 62B are supported by the common lens holder 64.

The lens holder 64 is a member that is made of metal (for example, aluminum die casting), and includes: a holder body 64A that surrounds the projection lens 62 in a cylindrical shape; and a pair of flange portions 64B that protrude on left and right sides along the horizontal plane at a lower end portion of an outer peripheral surface of the holder body 64A.

A protruding portion 64Aa that is configured to position the first and second lenses 62A, 62B is formed on an inner peripheral surface of the holder body 64A. Meanwhile, the pair of left and right flange portions 64B are formed in flat plate shapes that extend in the lamp front-rear direction over an entire length of the lens holder 64 with a constant left-right width.

Figure 4:
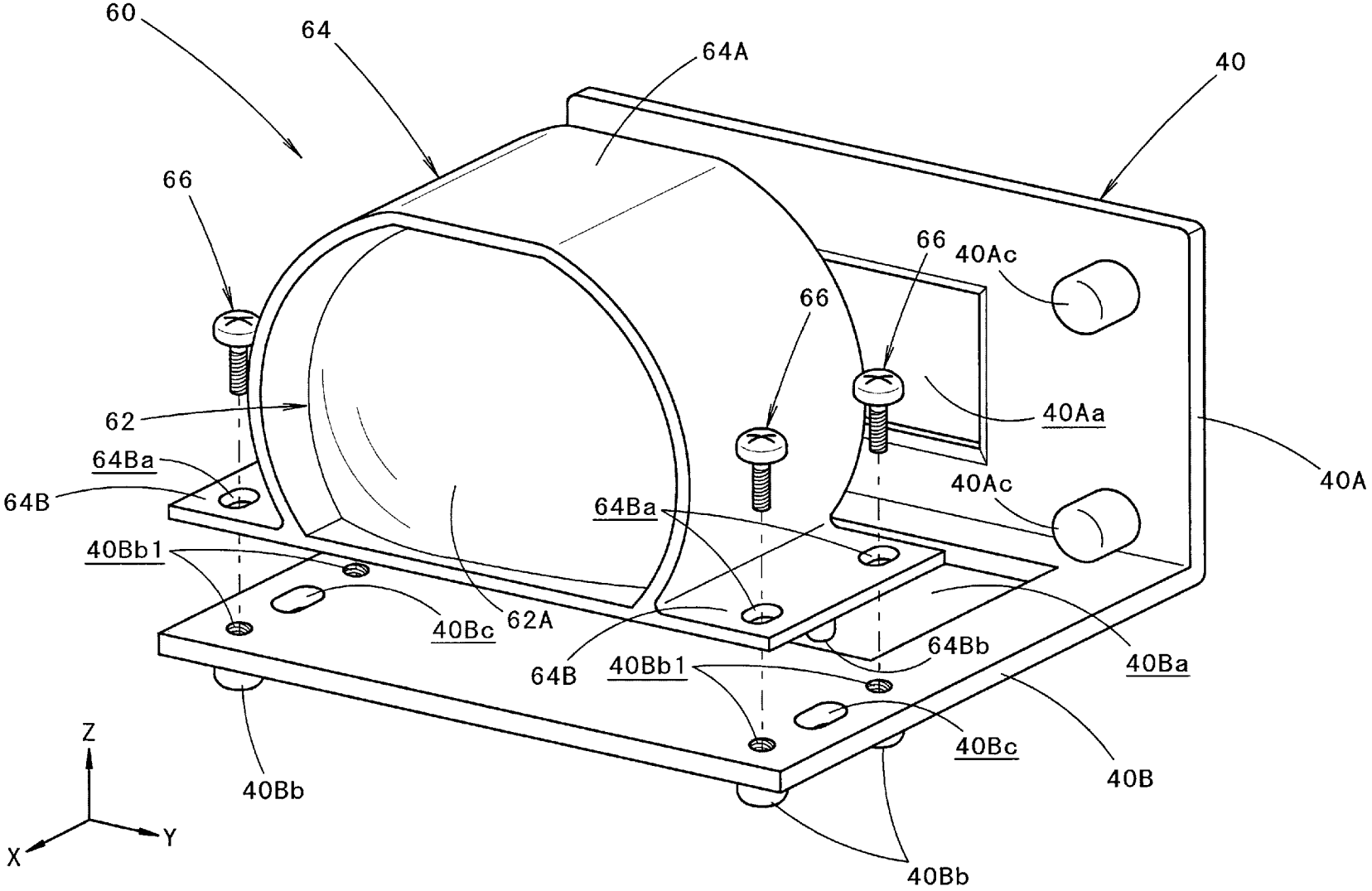
FIG. 4 is an exploded perspective view showing a lens side sub-assembly of the vehicle lamp together with a bracket of a spatial light modulator sub-assembly.

FIG. 4 is an exploded perspective view showing the lens side sub-assembly 60 together with the bracket 40 of the spatial light modulator sub-assembly 30.

Still as shown in FIG. 4, the pair of left and right flange portions 64B of the lens holder 64 are fixed to the horizontal surface portion 40B of the bracket 40 of the spatial light modulator sub-assembly 30 by mechanical fastening. The fixing of the mechanical fastening is performed by screwing.

In order to realize such a configuration, each flange portion 64B of the lens holder 64 is formed with a pair of front and rear screw insertion holes 64Ba that penetrate the flange portion 64B in an up-down direction. Moreover, a pair of front and rear boss portions 40Bb which include screw holes 40Bb1 are formed on the horizontal surface portion 40B of the bracket 40 so as to protrude downward. A screw 66 is screwed into the screw hole of each boss portion 40Bb from an upper side of each flange portion 64B via each screw insertion hole 64Ba.

Each screw insertion hole 64Ba is formed as an elongated hole extending in the lamp front-rear direction with a left-right width that is larger than a screw diameter of each screw 66. As a result, the lens holder 64 can be screwed to the bracket 40 in a state where a position of the lens holder 64 in the lamp front-rear direction is adjusted.

A positioning pin 64Bb is formed on a lower surface of each flange portion 64B of the lens holder 64 so as to protrude vertically downward at a front-rear direction central position of the pair of front and rear screw insertion holes 64Ba. Each positioning pin 64Bb is formed in a cylindrical shape, and a tip end portion thereof is formed in a convex curved surface shape. A downward protrusion amount of each positioning pin 64Bb from the flange portion 64B is set to a value slightly larger than a plate thickness of the horizontal surface portion 40B of the bracket 40.

Meanwhile, an elongated hole 40Bc that penetrates the horizontal surface portion 40B in the up-down direction is formed in the horizontal surface portion 40B of the bracket 40 at a position corresponding to each positioning pin 64Bb. Each elongated hole 40Bc is formed as an elongated hole that extends in the lamp front-rear direction with a left-right width slightly larger than a diameter of the positioning pin 64Bb.

When the lens holder 64 is screwed to the bracket 40, the positioning pin 64Bb is inserted into the elongated hole 40Bc in advance, so that the lens holder 64 is restricted from being displaced in the left-right direction with respect to the bracket 40, and a positional relationship between the lens holder 64 and the bracket 40 can be finely adjusted in the lamp front-rear direction. As a result, the lens holder 64 is prevented from being inadvertently rotated with respect to the bracket 40 due to torque generated at the time of the screwing, and accuracy of a positional relationship between the spatial light modulator 32 and the projection lens 62 is improved.

Next, an operation of the present embodiment will be described.

The vehicle lamp 10 according to the present embodiment is configured to emit light from the light source 22 toward the front side of the lamp via the spatial light modulator 32 and the projection lens 62. Various light distribution patterns can be formed with high accuracy by controlling spatial distribution of light reaching the projection lens 62 in the spatial light modulator 32.

In the vehicle lamp 10 according to the present embodiment, the lens holder 64 which is configured to support the projection lens 62 is fixed by screwing (that is, mechanical fastening) to the bracket 40 which is configured to support the spatial light modulator 32. Therefore, the projection lens 62 and the spatial light modulator 32 can be reliably supported.

The positioning pin 64Bb (that is, the positioning protruding portion), which is configured to position the lens holder 64 with respect to the bracket 40 in the left-right direction (that is, the direction orthogonal to the lamp front-rear direction), is formed on the lens holder 64. The elongated hole 40Bc which extends in the lamp front-rear direction is formed in the bracket 40. The screwing is performed in a state where the positioning pin 64Bb is inserted into the elongated hole 40Bc. As a result, the following operational effect can be obtained.

That is, the screwing is performed in a state where the positioning pin 64Bb of the lens holder 64 is inserted into the elongated hole 40Bc of the bracket 40 and is appropriately moved in the lamp front-rear direction. Therefore, the lens holder 64 can be restricted from being displaced in the left-right direction with respect to the bracket 40, and the positional relationship in the lamp front-rear direction between the projection lens 62 supported by the lens holder 64 and the spatial light modulator 32 supported by the bracket 40 can be finely adjusted. As a result, the spatial light modulator 32 can be arranged with high positional accuracy with respect to the projection lens 62.

In this way, according to the present embodiment, the spatial light modulator 32 can be arranged with high positional accuracy with respect to the projection lens 62 in the vehicle lamp 10 that is configured to emit the light from the light source 22 toward the front side of the lamp via the spatial light modulator 32 and the projection lens 62.

In the present embodiment, the positioning protruding portion configured to position the lens holder 64 in the left-right direction with respect to the bracket 40 is constituted by the one positioning pin 64Bb. Therefore, a configuration of the lamp can be simplified.

In the present embodiment, the screwing is performed at two front and rear locations on left and right sides of the projection lens 62. Therefore, the projection lens 62 can be reliably supported. Moreover, the positioning pin 64Bb and the elongated hole 40Bc are respectively arranged between the two front and rear locations on the left and right sides of the projection lens 62. Therefore, a state where each positioning pin 64Bb is inserted into each elongated hole 40Bc can be reliably maintained, and a positioning function thereof can be improved.

In the above first embodiment, the light emitted from the light source 22 reflected by the reflector 24 is reflected by the spatial light modulator 32. However, it is also possible to employ a configuration in which the light emitted from the light source 22 whose deflection is controlled by a lens or the like is reflected by the spatial light modulator 32 or a configuration in which the light emitted from the light source 22 is directly reflected by the spatial light modulator 32.

In the above first embodiment, the spatial light modulator 32 is a reflective spatial light modulator. However, the spatial light modulator 32 may also be a transmissive spatial light modulator.

Next, a modification of the first embodiment will be described.

First, a first modification of the first embodiment will be described.

Figure 5A:
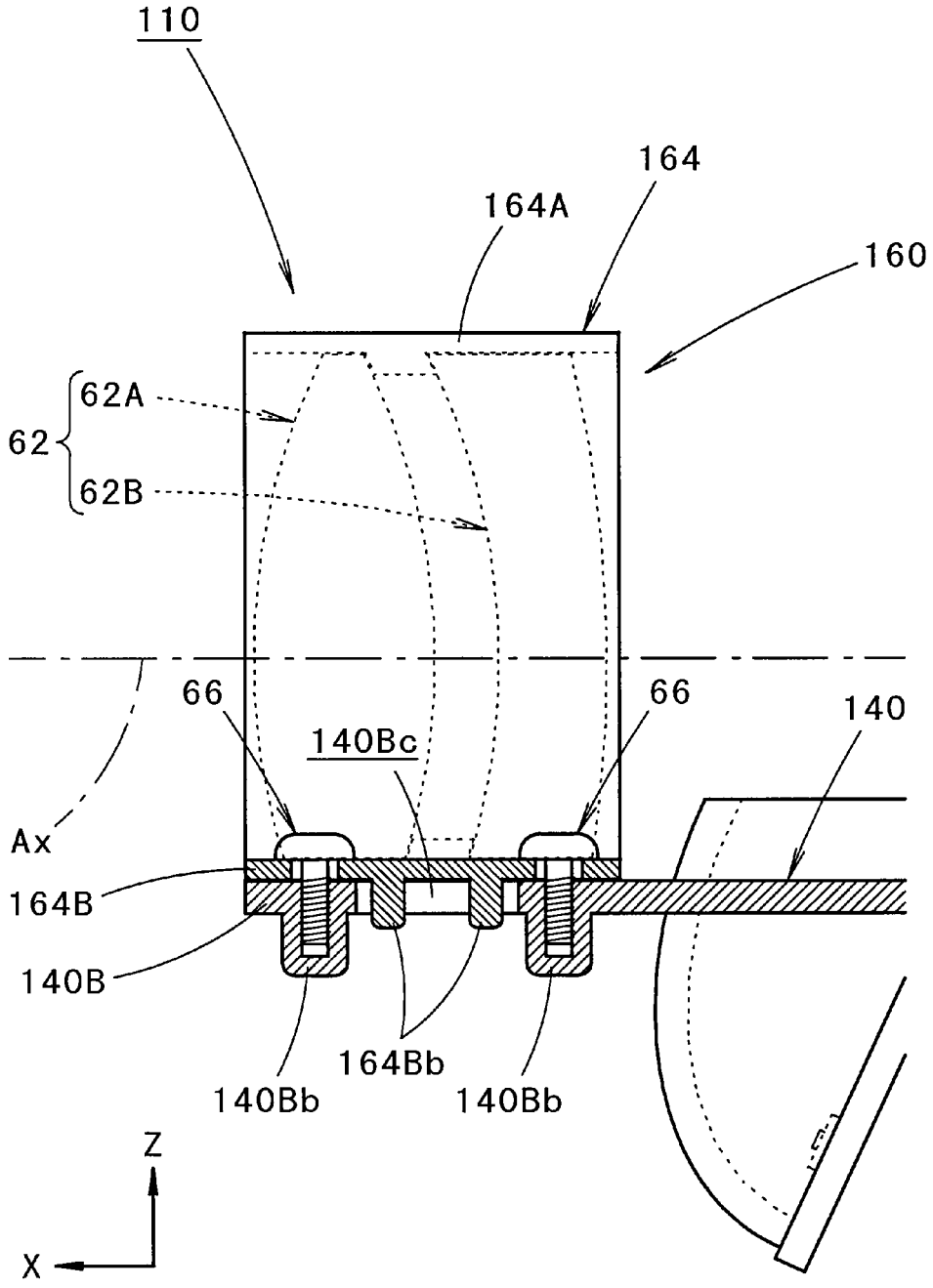
FIG. 5A shows a first modification of the first embodiment, which is substantially the same as FIG. 3.

FIG. 5A shows a main part of a vehicle lamp 110 according to the present modification, which is the same as FIG. 3.

As shown in FIG. 5A, a basic configuration of the vehicle lamp 110 is the same as that of the vehicle lamp 10 according to the first embodiment. A positioning structure between a lens holder 164 of a lens side sub-assembly 160 and a bracket 140 of the spatial light modulator sub-assembly is partially different from that of the first embodiment.

That is, the lens holder 164 of the present modification also includes a pair of flange portions 164B that protrude on left and right sides along the horizontal plane at a lower end portion of an outer peripheral surface of a holder body 164A, and is screwed to a horizontal surface portion 140B of the bracket 140 at two front and rear locations of each flange portion 164B.

In the present modification, a pair of front and rear positioning pins 164Bb are formed on each flange portion 164B of the lens holder 164. Moreover, a single elongated hole 140Bc is formed in the horizontal surface portion 140B of the bracket 140 so as to penetrate the horizontal surface portion 140B in the up-down direction.

The elongated hole 140Bc extends in an elongated manner in the lamp front-rear direction over substantially an entire length between a pair of front and rear boss portions 140Bb, and a left-right width thereof is set to the same value as the elongated hole 40Bc of the first embodiment.

Meanwhile, the pair of front and rear positioning pins 164Bb are formed at positions apart from a front end edge and a rear end edge of the elongated hole 140Bc in a state of being spaced apart from each other in the lamp front-rear direction. Each positioning pin 164Bb has the same configuration as that of the positioning pin 64Bb of the first embodiment.

In this modification, when screwing is performed at two front and rear locations on left and right sides of the holder body 164A, the pair of front and rear positioning pins 164Bb are also inserted into the elongated hole 140Bc of each flange portion 164B. As a result, the lens holder 164 can be restricted from being displaced in the left-right direction with respect to the bracket 140, and a positional relationship in the lamp front-rear direction between the projection lens 62 supported by the lens holder 164 and a spatial light modulator (not shown) supported by the bracket 140 can be finely adjusted.

Moreover, in the present modification, a positioning protruding portion configured to position the lens holder 164 with respect to the bracket 140 is constituted by the pair of front and rear positioning pins 164Bb formed on the flange portions 164B of the lens holder 164. Therefore, the lens holder 164 can be effectively positioned with respect to the bracket 140 not only in the left-right direction but also in a rotation direction around a vertical axis. Moreover, rigidity of the positioning protruding portion can be improved as compared with the case of the first embodiment.

Next, a second modification of the first embodiment will be described.

Figure 5B:
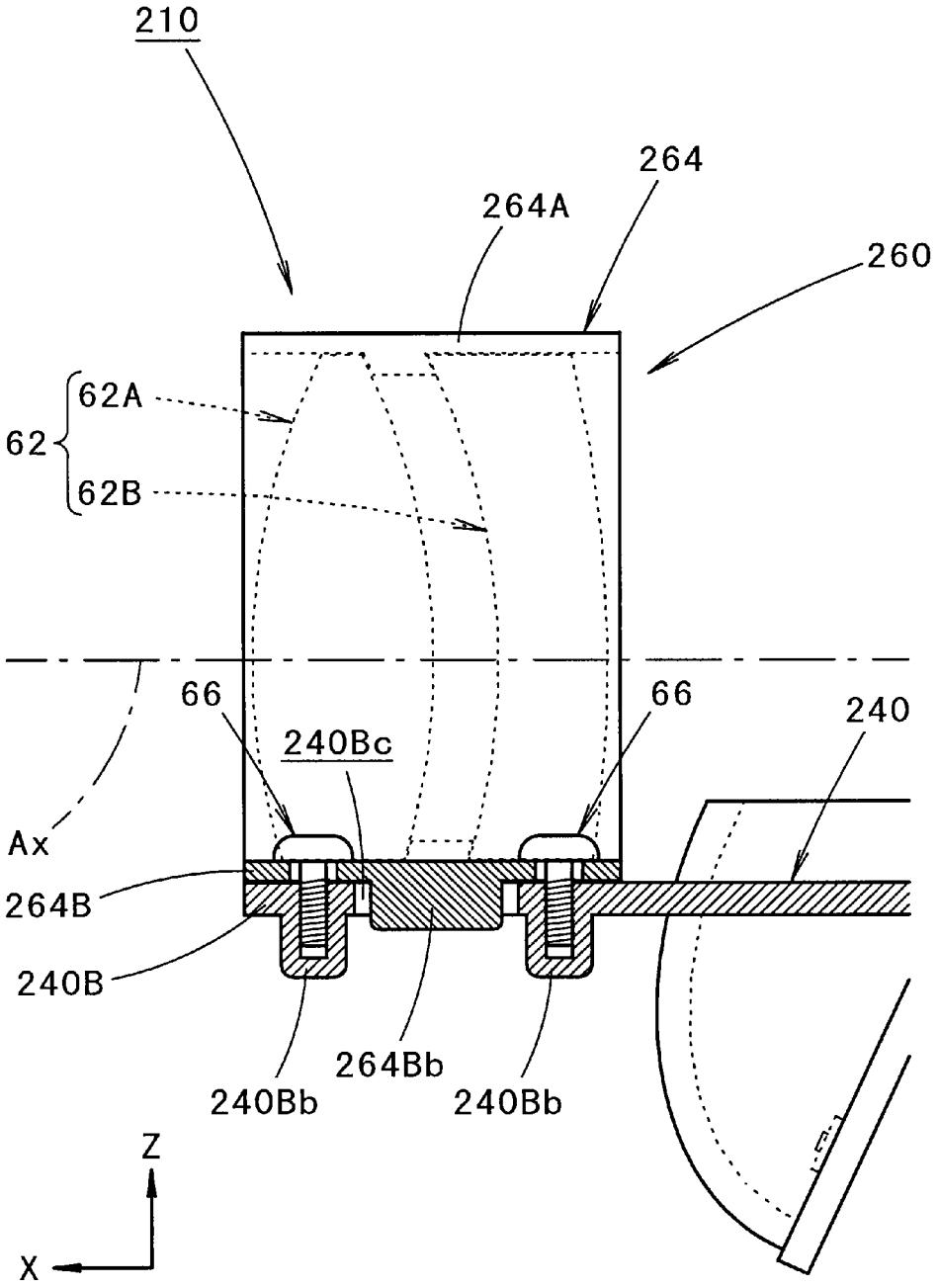
FIG. 5B shows a second modification of the first embodiment, which is substantially the same as FIG. 3.

FIG. 5B shows a main part of a vehicle lamp 210 according to the present modification, which is the same as FIG. 3.

As shown in FIG. 5B, a basic configuration of the vehicle lamp 210 is the same as that of the vehicle lamp 10 according to the first embodiment. A positioning structure between a lens holder 264 of a lens side sub-assembly 260 and a bracket 240 of the spatial light modulator sub-assembly is partially different from that of the first embodiment.

That is, in the present modification, the lens holder 264 also includes a pair of flange portions 264B that protrude on left and right sides along the horizontal plane at a lower end portion of an outer peripheral surface of a holder body 264A. The lens holder 264 is screwed to a horizontal surface portion 240B of the bracket 240 at two front and rear locations of the pair of left and right flange portions 264B.

In the present modification, a standing wall 264Bb that extends in the lamp front-rear direction is formed on each flange portion 264B of the lens holder 264. Moreover, a single elongated hole 240Bc is formed in the horizontal surface portion 240B of the bracket 240 so as to penetrate the horizontal surface portion 240B in the up-down direction.

The elongated hole 240Bc extends in an elongated manner in the lamp front-rear direction over substantially an entire length between a pair of front and rear boss portions 240Bb, and a left-right width thereof is set to the same value as the elongated hole 40Bc of the first embodiment.

Meanwhile, the standing wall 264Bb is formed in a state of being spaced apart from a front end edge and a rear end edge of the elongated hole 240Bc. A left-right width of the standing wall 264Bb is set to the same value as the diameter of the positioning pin 64Bb of the first embodiment, and a downward protrusion amount thereof from the flange portion 264B is also set to the same value as the positioning pin 64Bb of the first embodiment.

In this modification, when screwing is performed at two front and rear locations on left and right sides of the holder body 264A, the standing wall 264Bb is also inserted into the elongated hole 240Bc of each flange portion 264B. As a result, the lens holder 264 can be restricted from being displaced in the left-right direction with respect to the bracket 240, and a positional relationship in the lamp front-rear direction between the projection lens 62 supported by the lens holder 264 and a spatial light modulator (not shown) supported by the bracket 240 can be finely adjusted.

Moreover, in the present modification, a positioning protruding portion configured to position the lens holder 264 with respect to the bracket 240 is constituted by the standing wall 264Bb that is formed on each flange portion 264B of the lens holder 264 and extends in the lamp front-rear direction. Therefore, the lens holder 264 can be effectively positioned with respect to the bracket 240 not only in the left-right direction but also in the rotation direction around the vertical axis. Moreover, the rigidity of the positioning protruding portion can be significantly improved as compared with the case of the first embodiment.

Next, a third modification of the first embodiment will be described.

Figure 6A:
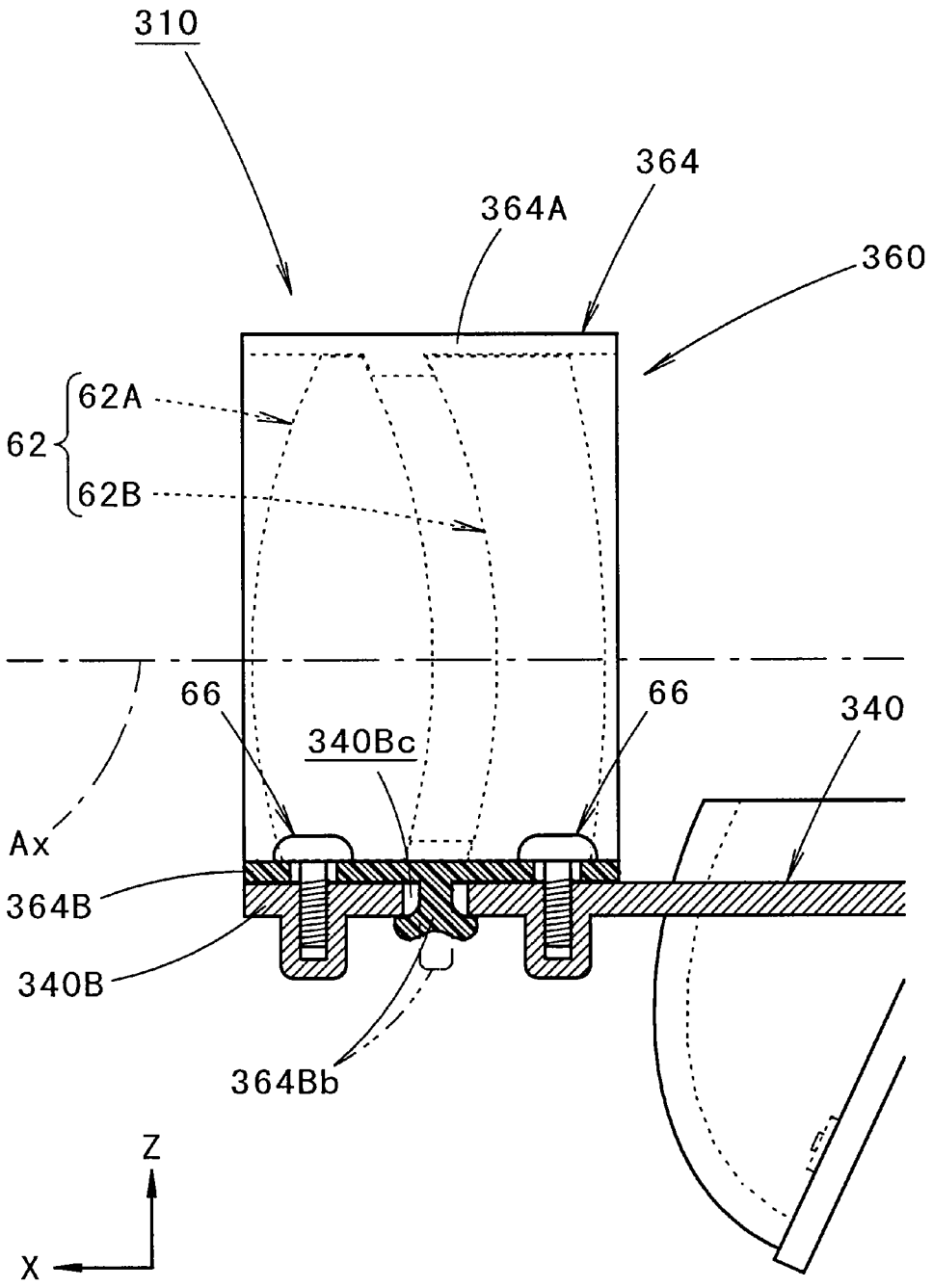
FIG. 6A shows a third modification of the first embodiment, which is substantially the same as FIG. 3.

FIG. 6A shows a main part of a vehicle lamp 310 according to the present modification, which is the same as FIG. 3.

As shown in FIG. 6A, a basic configuration of the vehicle lamp 310 is the same as that of the vehicle lamp 10 according to the first embodiment. A positioning structure between a lens holder 364 of a lens side sub-assembly 360 and a bracket 340 of the spatial light modulator sub-assembly is partially different from that of the first embodiment.

That is, the bracket 340 of the present modification has the same configuration as that of the bracket 40 of the first embodiment, and an elongated hole 340Bc that is the same as the elongated hole 40Bc of the first embodiment is formed in a horizontal surface portion 340B thereof.

Meanwhile, the lens holder 364 of the present modification is a member that is made of synthetic resin (for example, polycarbonate resin). A shape of a holder body 364A of the lens holder 364 and a basic shape of a positioning pin 364Bb are the same as those in the first embodiment. Further, the positioning pin 364Bb is longer than the positioning pin 64Bb of the first embodiment as indicated by a two-dot chain line in the drawing, and a tip portion thereof is caulked by heat caulking to the horizontal surface portion 340B of the bracket 340 around the elongated hole 340Bc.

In the present modification, the tip end portion of the positioning pin 364Bb is engaged by heat caulking with a lower surface of the horizontal surface portion 340B around the elongated hole 340Bc.

By employing the configuration of the present modification, it is possible to easily maintain a positional relationship between the projection lens 62 supported by the lens holder 364 and a spatial light modulator (not shown) supported by the bracket 340 in a state where fine adjustment in the lamp front-rear direction is completed.

In the present modification, the caulking of the positioning pin 364Bb may be performed after completion of screwing or before the completion of the screwing. It is preferable to perform the caulking in a state where a positional relationship between the lens holder 364 and the bracket 340 is fixed by using a jig or the like after the fine adjustment in the lamp front-rear direction is completed before the completion of the screwing.

In the third modification, the positioning pin 364Bb of the lens holder 364 which is made of the synthetic resin is caulked to the horizontal surface portion 340B of the bracket 340 by heat caulking. However, the lens holder 364 may also be a metal member, and the positioning pin 364Bb may also be caulked to the horizontal surface portion 340B of the bracket 340 by cold caulking.

Next, a fourth modification of the first embodiment will be described.

Figure 6B:
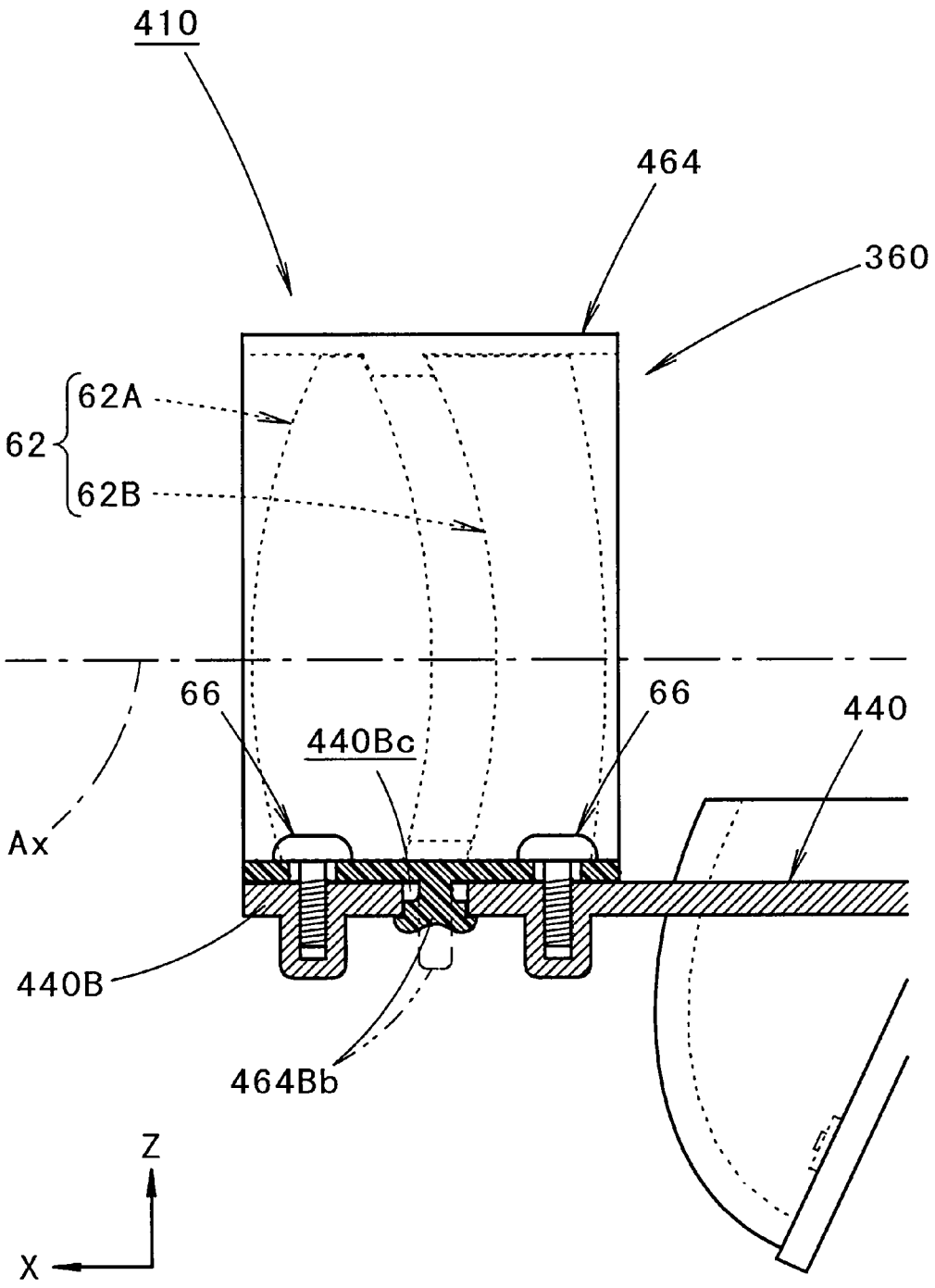
FIG. 6B shows a fourth modification of the first embodiment, which is substantially the same as FIG. 3.

FIG. 6B shows a main part of a vehicle lamp 410 according to the present modification, which is the same as FIG. 3.

As shown in FIG. 6B, a basic configuration of the vehicle lamp 410 is the same as that of the vehicle lamp 310 according to the third modification. An aspect of caulking of a tip end portion of a positioning pin 464Bb is partially different from the case of the third modification.

That is, in the present modification, the tip end portion of the positioning pin 464Bb is also caulked by heat caulking to a horizontal surface portion 440B of a bracket 440 around an elongated hole 440Bc. Further, by increasing a pressing force at the time of the heat caulking, the caulking is performed in a state where the tip end portion of the positioning pin 464Bb is engaged with a lower surface of the horizontal surface portion 440B around the elongated hole 440Bc and a middle portion of the positioning pin 464Bb is filled in the elongated hole 440Bc due to thermal deformation.

By employing the configuration of the present modification, it is possible to more easily maintain a positional relationship between the projection lens 62 supported by the lens holder 464 and a spatial light modulator (not shown) supported by the bracket 440 in the state where the fine adjustment in the lamp front-rear direction is completed.

In the present modification, the caulking of the positioning pin 464Bb may also be performed after the completion of the screwing or before the completion of the screwing. It is preferable to perform the caulking in a state where a positional relationship between the lens holder 464 and the bracket 440 is fixed by using a jig or the like after the fine adjustment in the lamp front-rear direction is completed before the completion of the screwing.

Second Embodiment

Next, a second embodiment of the present disclosure will be described.

Figure 7:
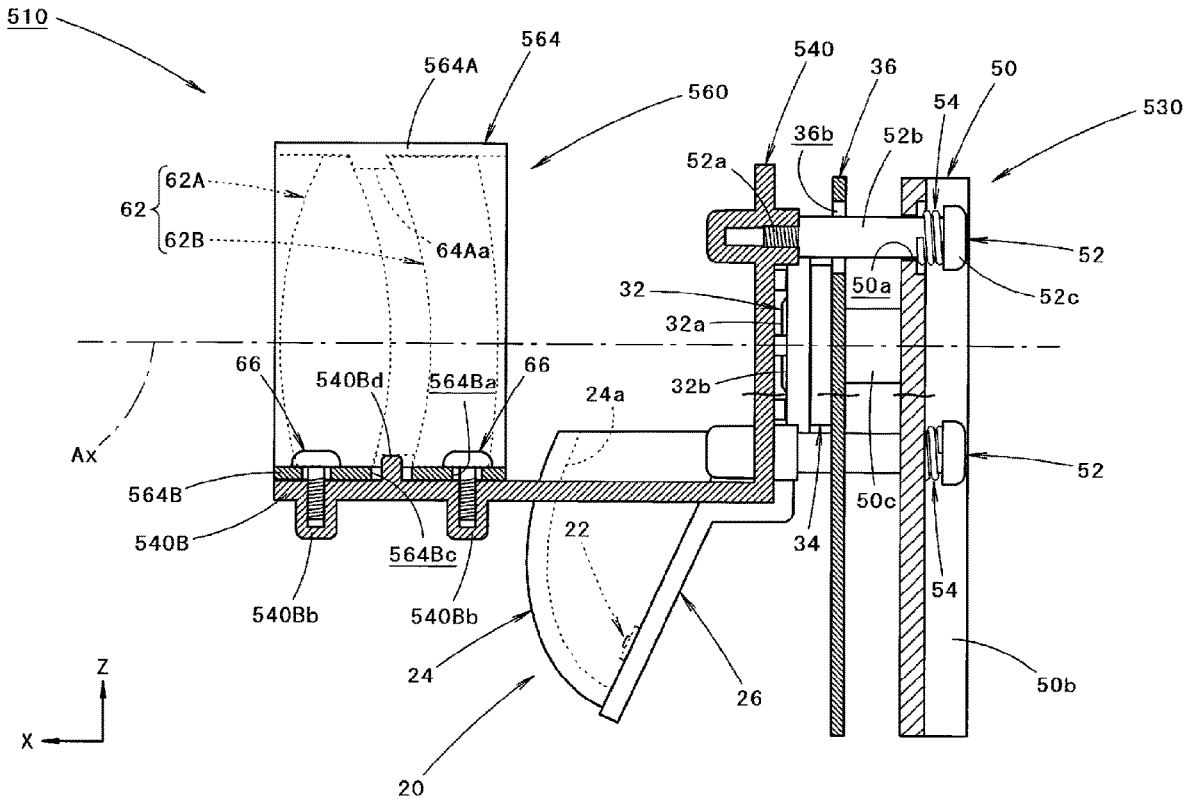
FIG. 7 shows a vehicle lamp according to a second embodiment of the present disclosure, which is substantially the same as FIG. 3.

FIG. 7 shows a vehicle lamp 510 according to the second embodiment of the present disclosure, which is substantially the same as FIG. 3.

As shown in FIG. 7, a basic configuration of the vehicle lamp 510 is the same as that of the vehicle lamp 10 according to the first embodiment. A positioning structure between a lens holder 564 of a lens side sub-assembly 560 and a bracket 540 of a spatial light modulator sub-assembly 530 is partially different from that of the first embodiment.

That is, the lens holder 564 of the present embodiment also includes a pair of flange portions 564B that protrude on left and right sides along the horizontal plane at a lower end portion of an outer peripheral surface of a holder body 564A. The lens holder 564 is screwed to a horizontal surface portion 540B of the bracket 540 at two front and rear locations of each flange portion 564B.

In the present embodiment, each flange portion 564B of the lens holder 564 is also formed with a pair of front and rear screw insertion holes 564Ba that penetrate the flange portion 564B in the up-down direction. Moreover, a pair of front and rear boss portions 540Bb which include screw holes are formed on the horizontal surface portion 540B of the bracket 540 so as to protrude downward. The screw 66 is screwed into the screw hole of each boss portion 540Bb from an upper side of each flange portion 564B via each screw insertion hole 564Ba.

Each screw insertion hole 564Ba is formed as an elongated hole that extends in the lamp front-rear direction with a left-right width larger than the screw diameter of each screw 66. As a result, the lens holder 564 can be screwed to the bracket 540 in a state where a position of the lens holder 564 in the lamp front-rear direction is adjusted.

A positioning pin 540Bd is formed on an upper surface of the horizontal surface portion 540B of the bracket 540 so as to protrude vertically upward at a front-rear direction central position of the pair of front and rear boss portions 540Bb. Each positioning pin 540Bd is formed in a cylindrical shape, and a tip end portion thereof is formed in a convex curved surface shape. An upward protrusion amount of each positioning pin 540Bd from the horizontal surface portion 540B is set to a value slightly larger than a plate thickness of each flange portion 564B of the lens holder 564.

Meanwhile, in each flange portion 564B of the lens holder 564, an elongated hole 564Bc that penetrates the flange portion 564B in the up-down direction is formed at a position corresponding to each positioning pin 540Bd. Each elongated hole 564Bc is formed as an elongated hole that extends in the lamp front-rear direction with a left-right width slightly larger than a diameter of the positioning pin 540Bd.

When the lens holder 64 is screwed to the bracket 40, the positioning pin 540Bd is inserted into the elongated hole 564Bc in advance. Therefore, the lens holder 564 can be restricted from being displaced in the left-right direction with respect to the bracket 540, and a positional relationship in the lamp front-rear direction between the lens holder 564 and the bracket 540 can be finely adjusted. As a result, the lens holder 564 is prevented from being inadvertently rotated with respect to the bracket 540 due to torque generated at the time of the screwing, and the accuracy of the positional relationship between the spatial light modulator 32 and the projection lens 62 is improved.

Next, an operation of the present embodiment will be described.

In the vehicle lamp 510 according to the present embodiment, the lens holder 564 which is configured to support the projection lens 62 is also fixed by screwing (that is, mechanical fastening) to the bracket 540 which is configured to support the spatial light modulator 32. Therefore, the projection lens 62 and the spatial light modulator 32 can be reliably supported.

The positioning pin 540Bd (that is, the positioning protruding portion), which is configured to position the lens holder 564 with respect to the bracket 540 in the left-right direction (that is, the direction orthogonal to the lamp front-rear direction), is formed on the bracket 540. The elongated hole 564Bc which extends in the lamp front-rear direction is formed in the lens holder 564. The screwing is performed in a state where the positioning pin 540Bd is inserted into the elongated hole 564Bc. Therefore, the following operational effect can be obtained.

That is, the fixing is performed by mechanical fastening in a state where the positioning pin 540Bd of the bracket 540 is inserted into the elongated hole 564Bc of the lens holder 564 and is appropriately moved in the lamp front-rear direction. Therefore, the lens holder 564 can be restricted from being displaced in the left-right direction with respect to the bracket 540, and a positional relationship in the lamp front-rear direction between the projection lens 62 supported by the lens holder 564 and the spatial light modulator 32 supported by the bracket 540 can be finely adjusted. As a result, the spatial light modulator 32 can be arranged with high positional accuracy with respect to the projection lens 62.

In the present embodiment, the positioning protruding portion configured to position the lens holder 564 in the left-right direction with respect to the bracket 540 is also constituted by the one positioning pin 564Bb. Therefore, a configuration of the lamp can be simplified.

The configurations of the first to fourth modifications of the first embodiment can also be applied to the configuration of the present embodiment, and the same operational effects as those of the first to fourth modifications of the first embodiment can be obtained in this way.

Third Embodiment

Next, a third embodiment of the present disclosure will be described.

Figure 8:
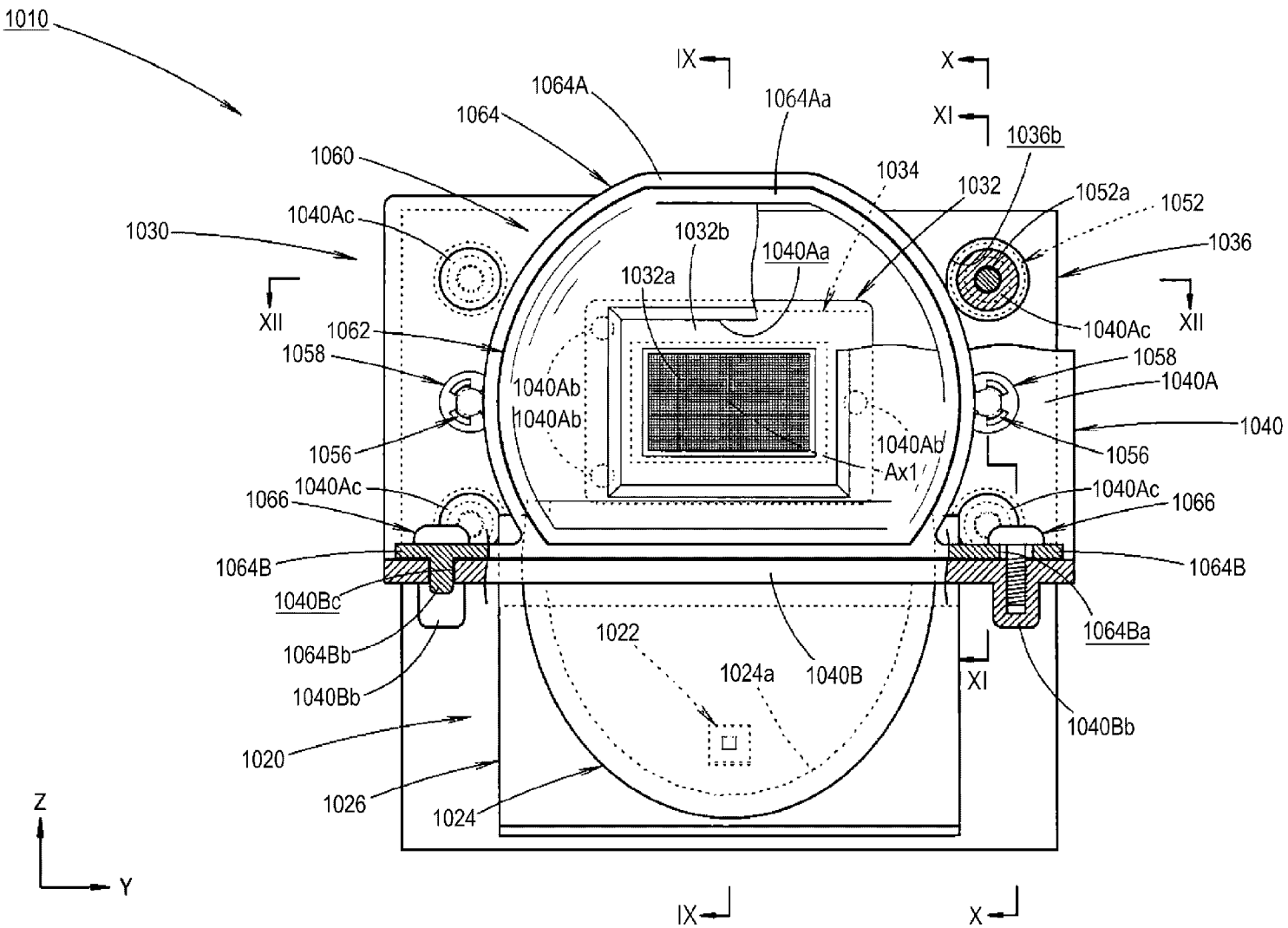
FIG. 8 is a front view showing a vehicle lamp according to a third embodiment of the present disclosure.
Figure 9:
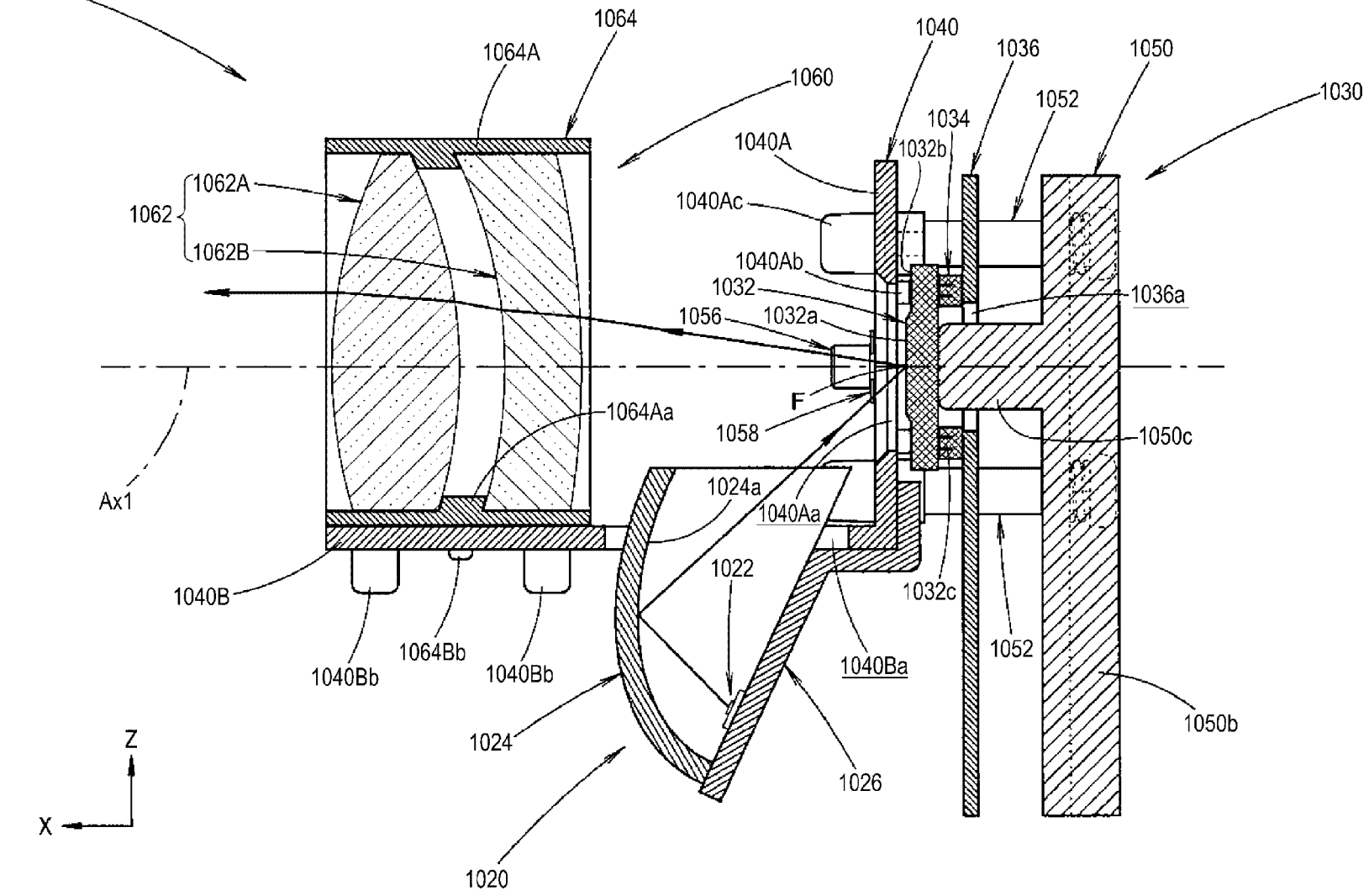
FIG. 9 is a cross-sectional view taken along line IX-IX of FIG. 8.
Figure 10:
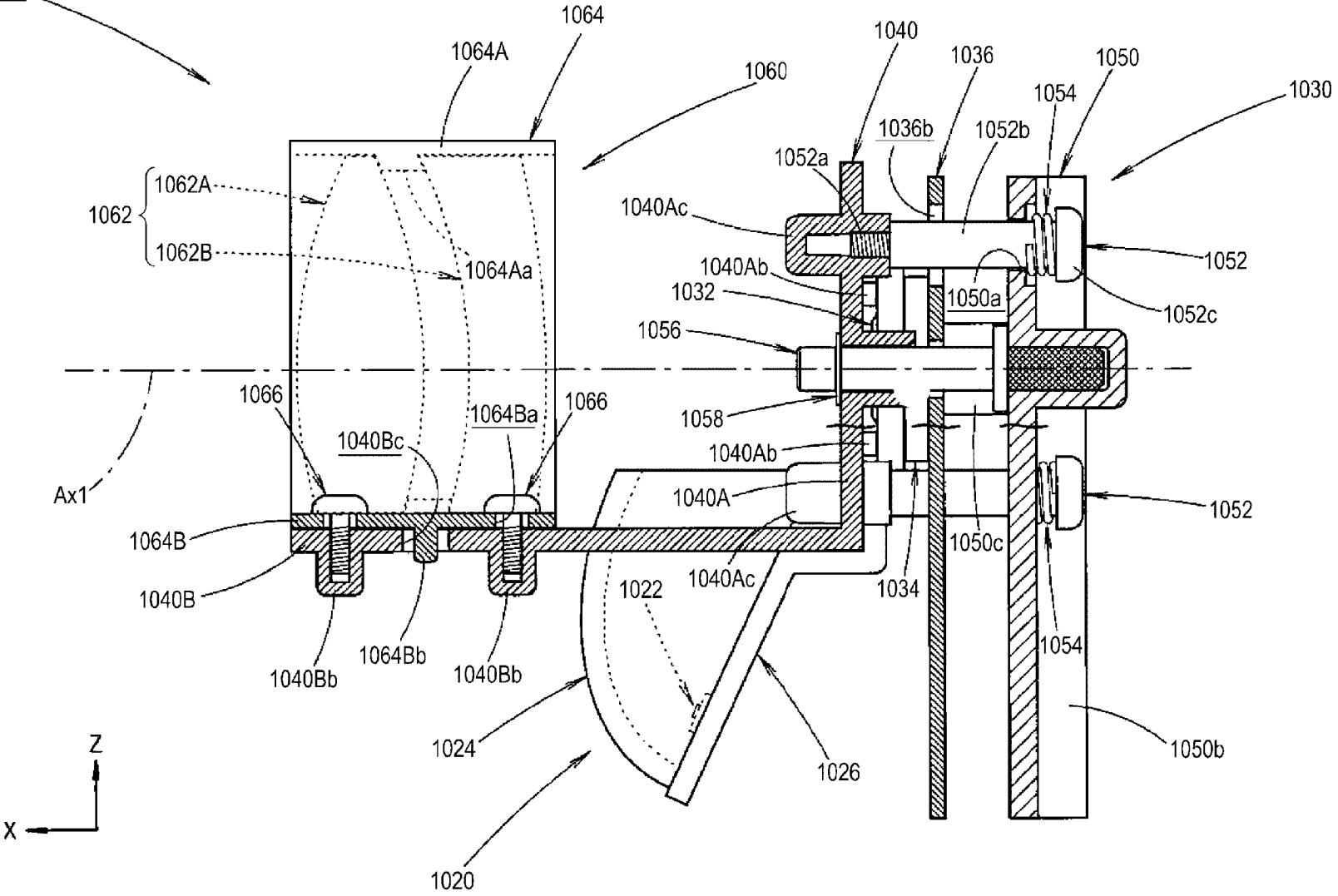
FIG. 10 is a cross-sectional view taken along line X-X of FIG. 8.

FIG. 8 is a front view showing a vehicle lamp 1010 according to the third embodiment of the present disclosure, and a part thereof is shown as a cross-sectional view. FIG. 9 is a cross-sectional view taken along line IX-IX of FIG. 8. FIG. 10 is a cross-sectional view taken along line X-X of FIG. 8.

In these drawings, the direction indicated by X is the "front side" of the lamp (also of the vehicle), the direction indicated by Y is the "left direction" that is orthogonal to the "front side" (also the "left direction" of the vehicle, and the "right direction" in the front view of the lamp), and the direction indicated by Z is the "up direction". The same also applies to the other drawings.

As shown in these drawings, the vehicle lamp 1010 according to the present embodiment is a headlamp provided at a front end portion of a vehicle, and is configured as a projector-type lamp unit incorporated in a lamp chamber formed by a lamp body and a translucent cover (not shown).

The vehicle lamp 1010 includes: a light source side sub-assembly 1020; a spatial light modulator sub-assembly 1030; and a lens side sub-assembly 1060.

The light source side sub-assembly 1020 includes: a light source 1022; a reflector 1024 configured to reflect light emitted from the light source 1022 toward the spatial light modulator sub-assembly 1030; and a base member 1026 configured to support the light source 1022 and the reflector 1024.

The spatial light modulator sub-assembly 1030 includes: a spatial light modulator 1032; a support board 1036 arranged on the lamp rear side of the spatial light modulator 1032; a bracket 1040 arranged on the lamp front side of the support board 1036; and a heat sink 1050 arranged on the lamp rear side of the spatial light modulator 1032.

The lens side sub-assembly 1060 includes: a projection lens 1062 which has an optical axis Ax1 extending in the vehicle front-rear direction; and a lens holder 1064 configured to support the projection lens 1062.

The vehicle lamp 1010 according to the present embodiment is configured such that various light distribution patterns can be formed with high accuracy by emitting light from the light source 1022 reflected by the reflector 1024 toward the front side of the lamp via the spatial light modulator 1032 and the projection lens 1062. The light distribution patterns are, for example, low-beam light distribution patterns or high-beam light distribution patterns, light distribution patterns that change according to vehicle traveling situations, or light distribution patterns that draw characters or symbols on a road surface in front of the vehicle.

In order to realize such light distribution patterns, during an assembly process of the vehicle lamp 1010, a positional relationship between the spatial light modulator 1032 and the projection lens 1062 is finely adjusted in a state where the light source 1022 is lit to form the light distribution patterns, and accuracy of the positional relationship is improved.

The vehicle lamp 1010 is supported by the bracket 1040 of the spatial light modulator sub-assembly 1030 or the lamp body in the heat sink 1050.

Next, a specific configuration of each of the light source side sub-assembly 1020, the spatial light modulator sub-assembly 1030, and the lens side sub-assembly 1060 will be described.

First, the configuration of the light source side sub-assembly 1020 will be described.

The light source 1022 is a white light emitting diode, and is fixedly supported by the base member 1026 in a state where a light emitting surface thereof faces obliquely upward and forward. The base member 1026 is fixedly supported by the bracket 1040 of the spatial light modulator sub-assembly 1030.

The reflector 1024 covers the light source 1022 from the lamp front side, and a peripheral edge portion thereof is fixedly supported by the base member 1026. The reflector 1024 reflects the light emitted from the light source 1022 obliquely upward and rearward. A reflecting surface 1024*a* of the reflector 1024 converges the light emitted from the light source 1022 to the vicinity of a rear focal plane which includes the rear focus F of the projection lens 1062.

Next, the configuration of the spatial light modulator sub-assembly 1030 will be described.

Figure 11:
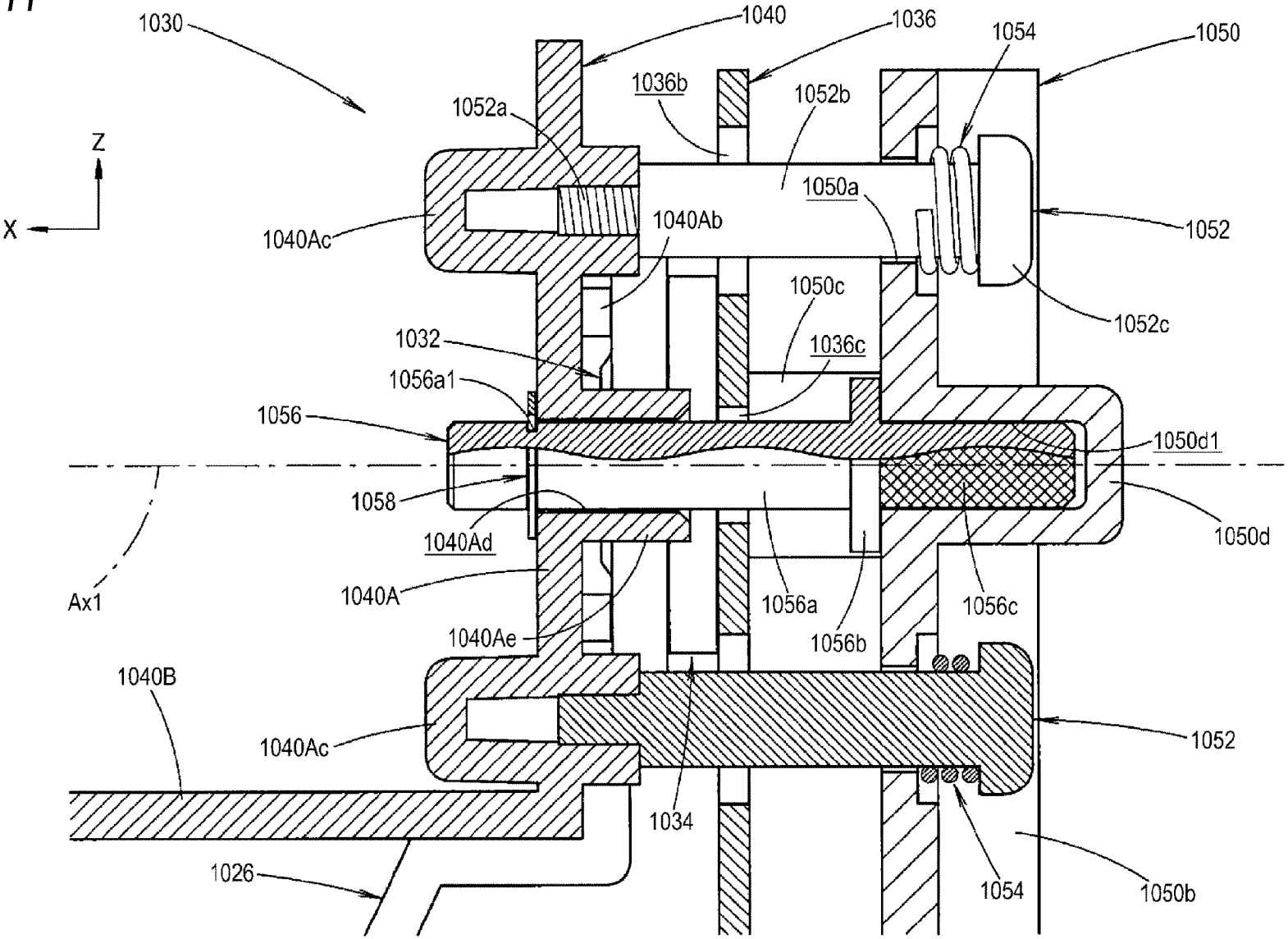
FIG. 11 is a detailed cross-sectional view taken along line XI-XI of FIG. 8.
Figure 12:
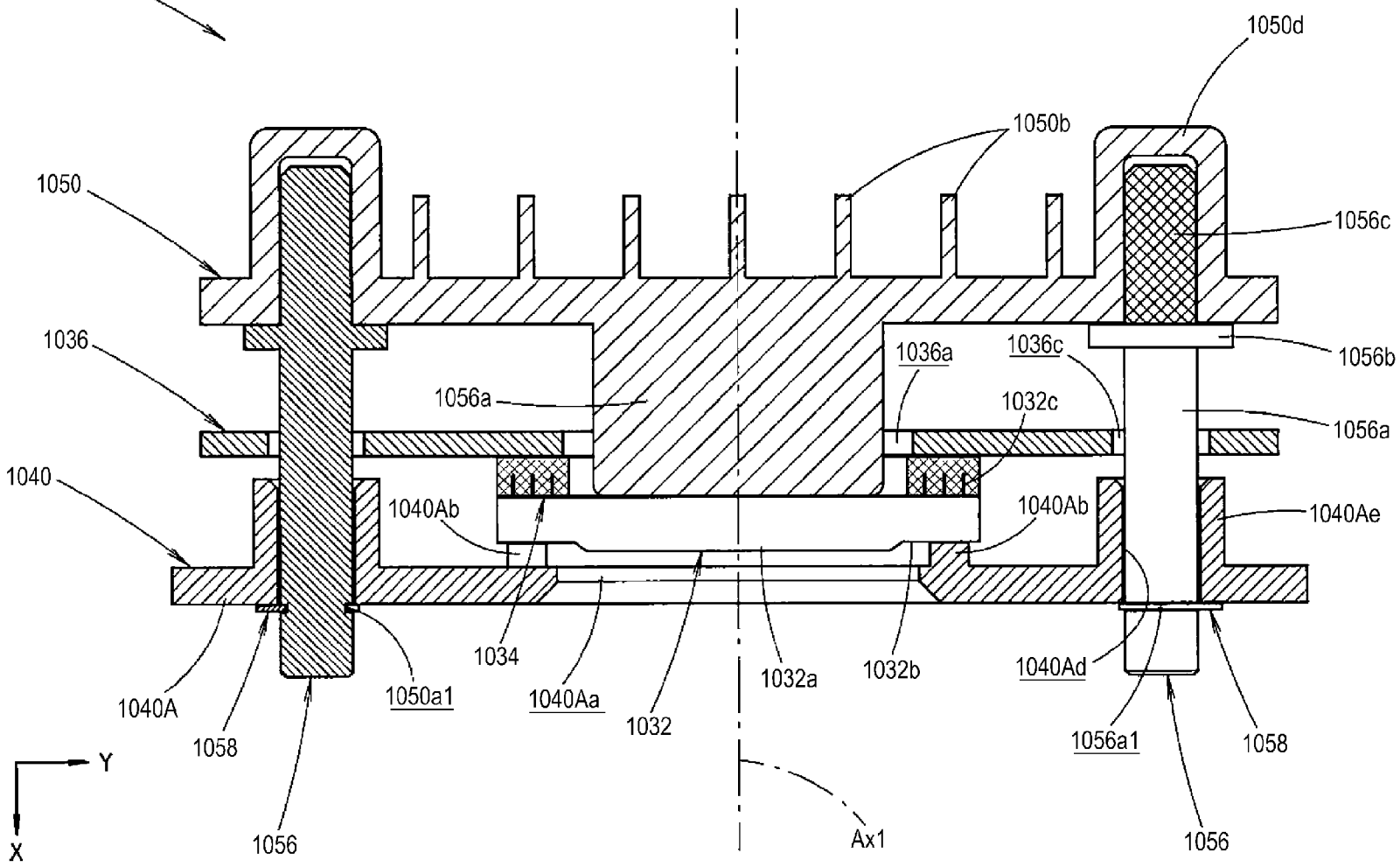
FIG. 12 is a detailed cross-sectional view taken along line XII-XII of FIG. 8.
Figure 13:
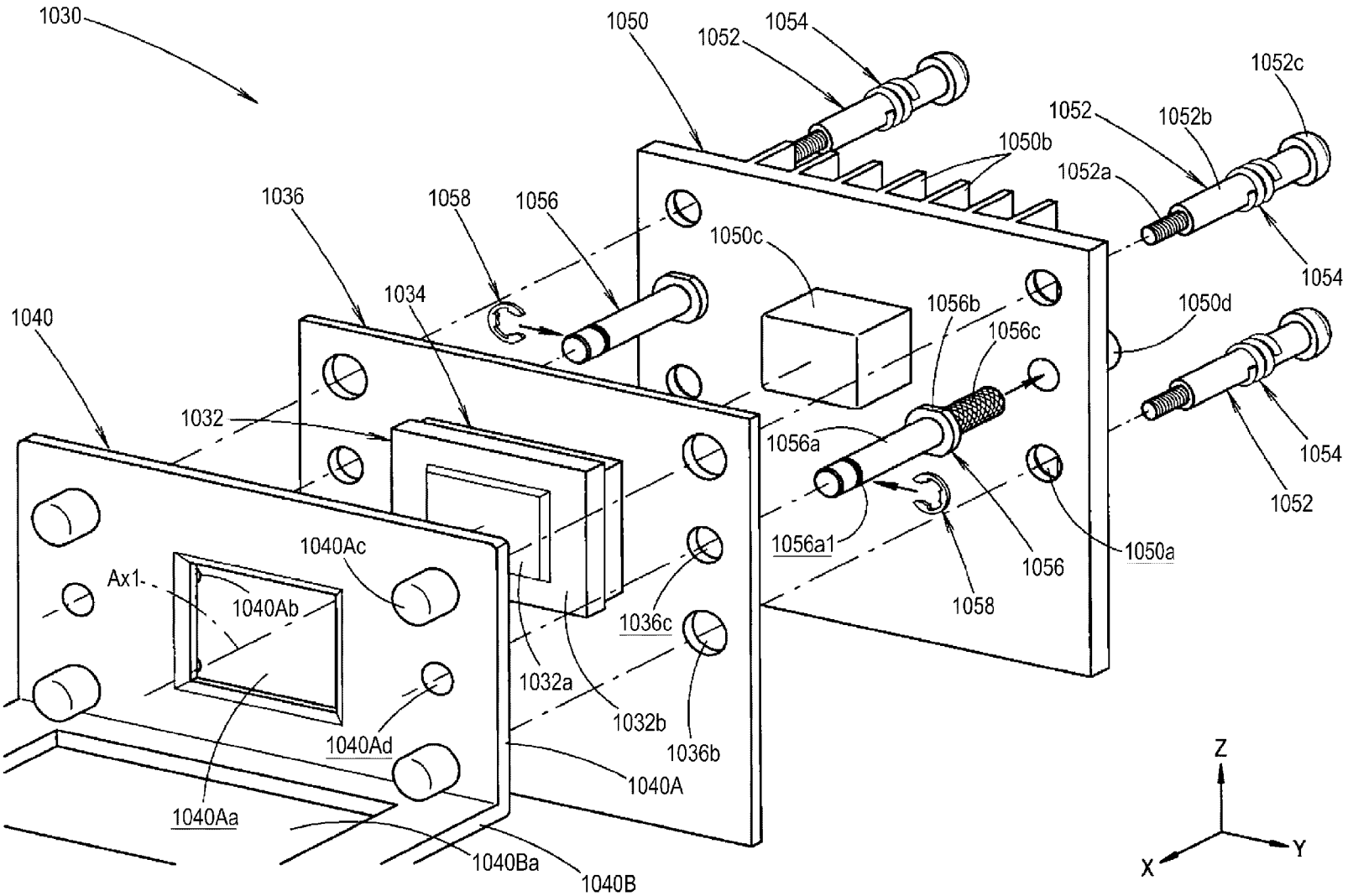
FIG. 13 is an exploded perspective view showing a spatial light modulator sub-assembly of the vehicle lamp.

FIG. 11 is a detailed cross-sectional view taken along line XI-XI of FIG. 8. FIG. 12 is a detailed cross-sectional view taken along line XII-XII of FIG. 8. FIG. 13 is an exploded perspective view showing the spatial light modulator sub-assembly 1030 in a state where constituent elements thereof are exploded.

As shown in these figures, the spatial light modulator 1032 is a reflective spatial light modulator, and includes a digital micromirror device (DMD) in which a plurality of micromirrors are arranged in a matrix.

The spatial light modulator 1032 is configured to selectively switch a reflection direction of the light from the light source 1022 that has reached the spatial light modulator 1032 by controlling an angle of a reflecting surface of each of the plurality of micromirrors. Specifically, a mode in which the light from the light source 1022 is reflected toward the projection lens 1062 and a mode in which the light is reflected toward another direction (that is, a direction that does not adversely affect formation of the light distribution patterns) are selected.

The spatial light modulator 1032 is arranged along a vertical plane that is orthogonal to the optical axis Ax1 at the position of the rear focus F of the projection lens 1062, and a reflected light control region 1032*a* thereof has a laterally elongated rectangular outer shape centered on the optical axis Ax1.

A rear surface of a peripheral edge portion 1032*b* of the spatial light modulator 1032 that surrounds the reflected light control region 1032*a* is supported by the support board 1036 via a socket 1034.

The socket 1034 is configured as a laterally elongated rectangular frame member along the peripheral edge portion 1032*b* of the spatial light modulator 1032, and is fixed to the support board 1036 by soldering or the like in a state of being electrically connected to a conductive pattern (not shown) formed on the support board 1036. An opening portion 1036*a* that has substantially the same shape as an inner peripheral edge shape of the socket 1034 is formed in the support board 1036.

The peripheral edge portion 1032*b* of the spatial light modulator 1032 is formed with a plurality of terminal pins 1032*c* that protrude toward the rear side of the lamp from the rear surface thereof, and the plurality of terminal pins 1032*c* are fitted into a plurality of fitting holes (not shown) formed in the socket 1034 so as to be electrically connected to the socket 1034.

The spatial light modulator 1032 is supported by the bracket 1040 and the heat sink 1050 from two sides in the lamp front-rear direction.

The bracket 1040 is a member that is made of metal (for example, aluminum die casting), and includes: a vertical surface portion 1040A that extends along the vertical plane orthogonal to the optical axis Ax1; and a horizontal surface portion 1040B that extends along the horizontal plane from a lower end edge of the vertical surface portion 1040A toward the front side of the lamp.

An opening portion 1040Aa that has a laterally elongated rectangular shape is formed in the vertical surface portion 1040A with the optical axis Ax1 serving as a center. The opening portion 1040Aa has a laterally elongated rectangular opening shape that is smaller than an outer peripheral edge shape of the spatial light modulator 1032 and larger than the reflected light control region 1032*a*, and a front end edge of an inner peripheral surface thereof is chamfered over an entire circumference.

Cylindrical protruding portions 1040Ab are formed on a rear surface of the vertical surface portion 1040A so as to protrude toward the lamp rear side at three locations around the opening portion 1040Aa. Rear end surfaces of the protruding portions 1040Ab at the three locations of the bracket 1040 are abutted against the peripheral edge portion 1032*b* of the spatial light modulator 1032 from the lamp front side.

The horizontal surface portion 1040B extends to the lamp front side of the reflector 1024, and a laterally elongated rectangular opening portion 1040Ba where the reflector 1024 is inserted is formed in the horizontal surface portion 1040B.

The heat sink 1050 is a member that is made of metal (for example, aluminum die casting), and extends along the vertical plane that is orthogonal to the optical axis Ax1. A plurality of heat dissipating fins 1050*b* are formed in a vertical stripe pattern on a rear surface thereof.

A prismatic protruding portion 1050*c* that protrudes toward the lamp front side is formed on a front surface of the heat sink 1050. The protruding portion 1050*c* has a laterally elongated rectangular cross-sectional shape centered on the optical axis Ax1, and a size thereof is set to a value smaller than an inner peripheral surface shape of the socket 1034. A front end surface of the protruding portion 1050*c* is abutted against a central portion of the spatial light modulator 1032 (that is, a portion where the reflected light control region 1032*a* is located) from the lamp rear side in a state of being inserted into the opening portion 1036*a* of the support board 1036.

In the spatial light modulator sub-assembly 1030, a plurality of stepped bolts 1052 are arranged around the spatial light modulator 1032. Specifically, four stepped bolts 1052 are arranged at two upper and lower locations on left and right sides of the spatial light modulator 1032.

Small diameter portions 1052*a* located at tip ends of the stepped bolts 1052 are screwed to the bracket 1040 in a state of being inserted into a bolt insertion hole 1050*a* formed in the heat sink 1050 and a bolt insertion hole 1036*b* formed in the support board 1036 from the lamp rear side. In order to realize such a configuration, the bracket 1040 is provided with boss portions 1040Ac where the small diameter portions 1052*a* of the stepped bolts 1052 are screwed at four locations corresponding to the four stepped bolts 1052.

A spring 1054 configured to elastically press the heat sink 1050 toward the lamp front side is attached to a large diameter portion 1052*b* of each stepped bolt 1052. Each spring 1054 includes a compression coil spring arranged between a head portion 1052*c* of each stepped bolt 1052 and the heat sink 1050.

In this way, by elastically pressing the heat sink 1050 toward the lamp front side at the two upper and lower locations on the left and right sides of the spatial light modulator 1032, the central portion of the spatial light modulator 1032 is elastically pressed toward the lamp front side in a state where no excessive load is applied to the spatial light modulator. As a result, a state where the plurality of terminal pins 1032*c* formed on the peripheral edge portion 1032*b* of the spatial light modulator 1032 are properly fitted into the fitting holes of the socket 1034 (that is, a state where the electric connection between the spatial light modulator 1032 and the socket 1034 is reliably performed) is maintained.

A pair of left and right shafts 1056 that extend in the lamp front-rear direction are arranged around the spatial light modulator 1032.

Each shaft 1056 is configured as a flanged shaft, and a portion of the shaft 1056 that is located on the lamp front side of a flange portion 1056*b* thereof is configured as a body portion 1056*a*. A rear end portion 1056*c* of each shaft 1056 which is located on the lamp rear side of the flange portion 1056*b* is fixed to the heat sink 1050. The fixing is performed by press-fitting the rear end portion 1056*c* of each shaft 1056 to a press-fitting boss portion 1050*d* formed on the heat sink 1050 from the lamp front side.

A pair of left and right shaft insertion holes 1036*c* where the body portions 1056*a* of the pair of left and right shafts 1056 are inserted are formed in the support board 1036. Each shaft insertion hole 1036*c* is formed as an opening portion that has a diameter larger than that of the body portion 1056*a* of each shaft 1056.

A pair of left and right shaft positioning holes 1040Ad are formed in the vertical surface portion 1040A of the bracket 1040 so as to position the body portions 1056*a* of the pair of left and right shafts 1056 in the direction orthogonal to lamp front-rear direction in a state where the body portions 1056*a* are inserted. Each shaft positioning hole 1040Ad has a diameter that is slightly larger than that of the body portion 1056*a* of each shaft 1056.

Each shaft positioning hole 1040Ad is formed by a sleeve 1040Ae formed on the rear surface of the vertical surface portion 1040A so as to extends toward the rear side of the lamp with a length longer than a plate thickness of the vertical surface portion 1040A. As a result, the shaft positioning hole 1040Ad is slidably engaged with the body portion 1056*a* of each shaft 1056 over a certain length.

A front end portion of the body portion 1056*a* of each shaft 1056 protrudes toward the front side of the lamp from each shaft positioning hole 1040Ad. An E-ring 1058 is attached to the front end portion of the body portion 1056*a* of each shaft 1056 as a displacement restricting member which is configured to restrict displacement of the bracket 1040 toward the lamp front side by engaging with a front surface of the vertical surface portion 1040A of the bracket 1040.

In order to realize such a configuration, an annular groove portion 1056*a*1 is formed in the front end portion of the body portion 1056*a* of each shaft 1056, and the E-ring 1058 is fitted into the annular groove portion 1056*a*1. The annular groove portion 1056*a*1 is formed at a position where an annular wall surface thereof on the lamp rear side is substantially flush with the front surface of the vertical surface portion 1040A of the bracket 1040.

Since the E-ring 1058 is fitted to the body portion 1056*a* of each of the pair of left and right shafts 1056 in this way, the bracket 1040 is restricted from displacing toward the lamp front side on the left and right sides of the spatial light modulator 1032, so that the bracket 1040 is also prevented from being inclined in the left-right direction with respect to the vertical plane orthogonal to the optical axis Ax1.

As described above, the body portion 1056*a* of each shaft 1056 is slidably engaged with each shaft positioning hole 1040Ad over the certain length. Therefore, such a configuration also prevents the bracket 1040 from being inclined with respect to the vertical plane orthogonal to the optical axis Ax1.

Next, the configuration of the lens side sub-assembly 1060 will be described.

As shown in FIGS. 9 and 10, the projection lens 1062 includes first and second lenses 1062A, 1062B that are arranged at a predetermined interval in the lamp front-rear direction on the optical axis Ax1.

The first lens 1062A that is located on the lamp front side is configured as a biconvex lens, and the second lens 1062B that is located on the lamp rear side is configured as a concave meniscus lens that bulges toward the rear side of the lamp. Upper end portions of the first and second lenses 1062A, 1062B are cut slightly along the horizontal plane, and lower end portions thereof are cut relatively large along the horizontal plane.

Outer peripheral edge portions of the first and second lenses 1062A, 1062B are supported by the common lens holder 1064.

The lens holder 1064 is a member that is made of metal (for example, aluminum die casting), and includes: a holder body 1064A that surrounds the projection lens 1062 in a cylindrical shape; and a pair of flange portions 1064B that protrude on left and right sides along the horizontal plane at a lower end portion of an outer peripheral surface of the holder body 1064A.

A protruding portion 1064Aa that is configured to position the first and second lenses 1062A, 1062B is formed on an inner peripheral surface of the holder body 1064A. Meanwhile, the pair of left and right flange portions 1064B are formed in flat plate shapes that extend in the lamp front-rear direction over an entire length of the lens holder 1064 with a constant left-right width.

Figure 14:
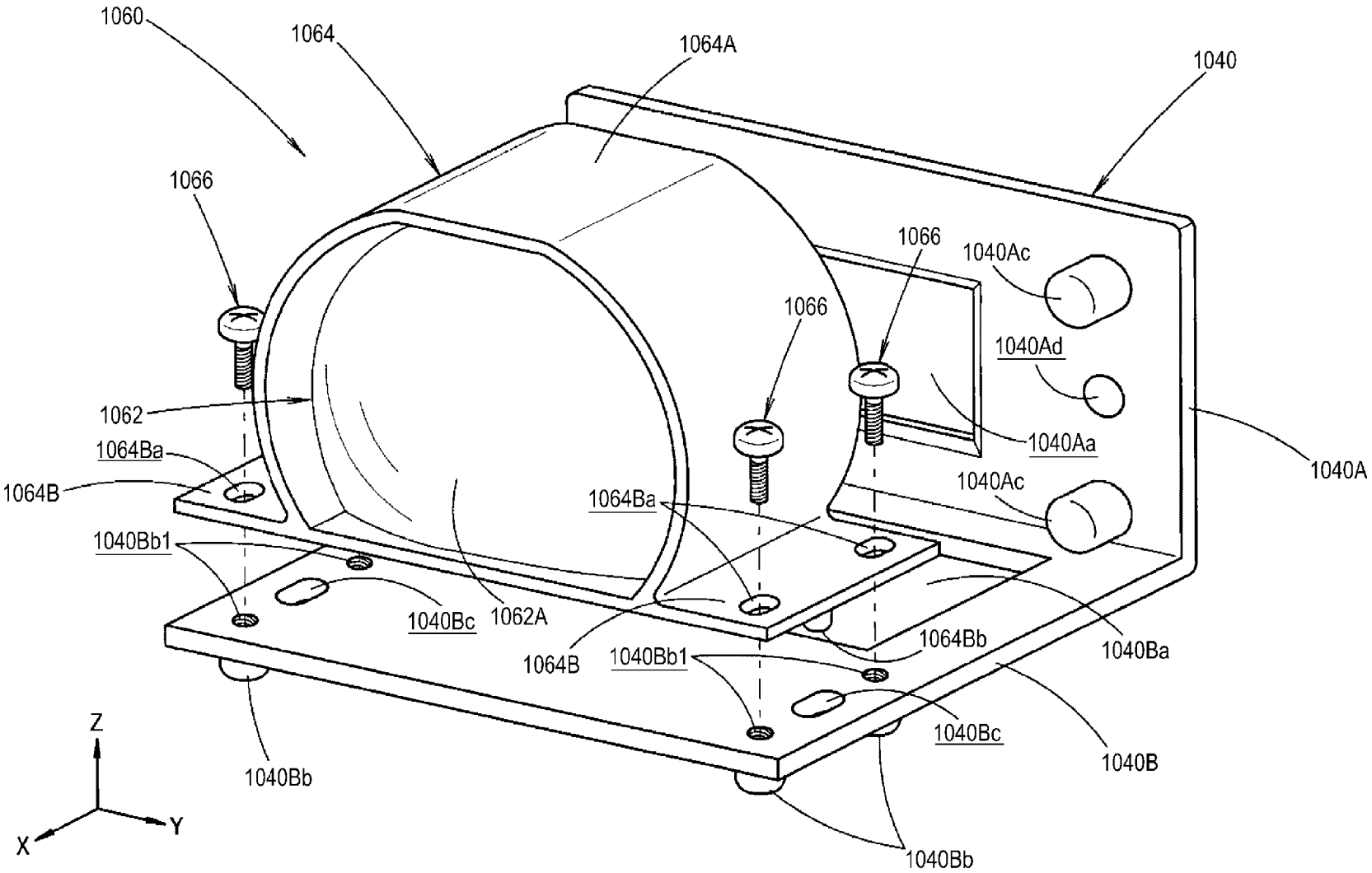
FIG. 14 is an exploded perspective view showing a lens side sub-assembly of the vehicle lamp together with a bracket of the spatial light modulator sub-assembly.

FIG. 14 is an exploded perspective view showing the lens side sub-assembly 1060 together with the bracket 1040 of the spatial light modulator sub-assembly 1030.

Still as shown in FIG. 14, the pair of left and right flange portions 1064B of the lens holder 1064 are fixed to the horizontal surface portion 1040B of the bracket 1040 of the spatial light modulator sub-assembly 1030 by mechanical fastening. The fixing of the mechanical fastening is performed by screwing.

In order to realize such a configuration, each flange portion 1064B of the lens holder 1064 is formed with a pair of front and rear screw insertion holes 1064Ba that penetrate the flange portion 1064B in the up-down direction. Moreover, a pair of front and rear boss portions 1040Bb which include screw holes 1040Bb1 are formed on the horizontal surface portion 1040B of the bracket 1040 so as to protrude downward. A screw 1066 is screwed into the screw hole 1040Bb 1 of each boss portion 1040Bb from an upper side of each flange portion 1064B via each screw insertion hole 1064Ba.

Each screw insertion hole 1064Ba is formed as an elongated hole extending in the lamp front-rear direction with a left-right width that is larger than a screw diameter of each screw 1066. As a result, the lens holder 1064 can be screwed to the bracket 1040 in a state where a position of the lens holder 1064 in the lamp front-rear direction is adjusted.

A positioning pin 1064Bb is formed on a lower surface of each flange portion 1064B of the lens holder 1064 so as to protrude vertically downward at a front-rear direction central position of the pair of front and rear screw insertion holes 1064Ba. Each positioning pin 1064Bb is formed in a cylindrical shape, and a tip end portion thereof is formed in a convex curved surface shape. A downward protrusion amount of each positioning pin 1064Bb from the flange portion 1064B is set to a value slightly larger than a plate thickness of the horizontal surface portion 1040B of the bracket 1040.

Meanwhile, an elongated hole 1040Bc that penetrates the horizontal surface portion 1040B in the up-down direction is formed in the horizontal surface portion 1040B of the bracket 1040 at a position corresponding to each positioning pin 1064Bb. Each elongated hole 1040Bc is formed as an elongated hole that extends in the lamp front-rear direction with a left-right width slightly larger than a diameter of the positioning pin 1064Bb.

When the lens holder 1064 is screwed to the bracket 1040, the positioning pin 1064Bb is inserted into the elongated hole 1040Bc in advance, so that the lens holder 1064 is restricted from being displaced in the left-right direction with respect to the bracket 1040, and a positional relationship between the lens holder 1064 and the bracket 1040 can be finely adjusted in the lamp front-rear direction. As a result, the lens holder 1064 is prevented from being inadvertently rotated with respect to the bracket 1040 due to torque generated at the time of the screwing, and accuracy of a positional relationship between the spatial light modulator 1032 and the projection lens 1062 is improved.

Next, an operation of the present embodiment will be described.

The vehicle lamp 1010 according to the present embodiment is configured to emit light from the light source 1022 toward the front side of the lamp via the spatial light modulator 1032 and the projection lens 1062. Various light distribution patterns can be formed with high accuracy by controlling spatial distribution of light reaching the projection lens 1062 in the spatial light modulator 1032.

The spatial light modulator 1032 is electrically connected to the support board 1036 which is configured to support the peripheral edge portion 1032*b* of the spatial light modulator 1032 from the lamp rear side. The bracket 1040 which is abutted against the peripheral edge portion of the spatial light modulator 1032 from the lamp front side is arranged on the lamp front side of the spatial light modulator 1032. The heat sink 1050, which is configured to elastically press the spatial light modulator 1032 toward the lamp front side in the state of being abutted against the central portion of the spatial light modulator 1032 (that is, the portion where the reflected light control region 1032*a* is located), is arranged on the lamp rear side of the spatial light modulator 1032. Therefore, it is possible to prevent an excessive load from acting on the spatial light modulator 1032. As a result, the electric connection between the spatial light modulator 1032 and the support board 1036 can be secured and the spatial light modulator 1032 can be prevented from being damaged.

The pair of left and right shafts 1056 which extend in the lamp front-rear direction are arranged around the spatial light modulator 1032 in a state where the rear end portions thereof are fixed to the heat sink 1050. The front end portion of each shaft 1056 is inserted into each shaft positioning hole 1040Ad in a state where each shaft 1056 is inserted through each shaft insertion hole 1036*c* formed in the support board 1036. Therefore, the following operational effect can be obtained.

That is, presence of the pair of left and right shafts 1056 allows the heat sink 1050 and the bracket 1040 to be maintained in a fixed positional relationship with respect to the direction orthogonal to the lamp front-rear direction. Therefore, even when a vibration load or an impact load acts on the vehicle lamp 1010, the positional relationship between the spatial light modulator 1032 and the heat sink 1050 can be effectively prevented from being misaligned to apply an excessive load on the spatial light modulator 1032. As a result, the damage to the spatial light modulator 1032 can be effectively reduced.

In this way, according to the present embodiment, the spatial light modulator 1032 can be effectively prevented from being damaged by the vibration load or the like in the vehicle lamp 1010 that includes the reflective spatial light modulator 1032.

In the present embodiment, the front end portion of each shaft 1056 protrudes toward the front side of the lamp from each shaft positioning hole 1040Ad. The E-ring 1058 (that is, the displacement restricting member) is attached to the front end portion to restrict the displacement of the bracket 1040 toward the lamp front side by engaging with the front surface of the vertical surface portion 1040A of the bracket 1040. Therefore, the heat sink 1050 and the bracket 1040 can be maintained in the fixed positional relationship not only in the direction orthogonal to the lamp front-rear direction but also in the lamp front-rear direction. As a result, positional misalignment between the spatial light modulator 1032 and the heat sink 1050 can be more effectively prevented, and the effect of preventing the damage to the spatial light modulator 1032 can be improved.

The shafts 1056 are arranged on the left and right sides of the spatial light modulator 1032, and the E-ring 1058 is fitted into the body portion 1056*a* of each of the pair of left and right shafts 1056. Therefore, the displacement of the bracket 1040 toward the lamp front side can be restricted on the left and right sides of the spatial light modulator 1032. As a result, the bracket 1040 can be prevented from being inclined in the left-right direction with respect to the vertical plane orthogonal to the optical axis Ax1.

Further, the body portion 1056*a* of each shaft 1056 is slidably engaged with each shaft positioning hole 1040Ad over the certain length. Therefore, the bracket 1040 can thus be prevented from being inclined with respect to the vertical plane orthogonal to the optical axis Ax1.

In the present embodiment, the plurality of stepped bolts 1052 that extends in the lamp front-rear direction are arranged around the spatial light modulator 1032. The small diameter portions 1052*a* of the stepped bolts 1052 are screwed to the bracket 1040 in the state of being inserted into the bolt insertion hole 1050*a* formed in the heat sink 1050 and the bolt insertion hole 1036*b* formed in the support board 1036 from the lamp rear side. The spring 1054 that is configured to elastically press the support board 1036 toward the lamp front side is attached to the large diameter portion 1052*b* of each stepped bolt 1052. Therefore, the spatial light modulator 1032 can be elastically pressed by the heat sink 1050 stably.

In the present embodiment, the plurality of stepped bolts 1052 are arranged at the two upper and lower locations on the left and right sides of the spatial light modulator 1032, and the shafts 1056 are arranged between the two upper and lower locations on the left and right sides of the spatial light modulator 1032. Therefore, the state where each shaft 1056 is inserted into each shaft positioning hole 1040Ad of the bracket 1040 via each shaft insertion hole 1036*c* of the support board 1036 can be reliably maintained, and a positioning function thereof can be improved.

Although the fixing of the rear end portion 1056*c* of each shaft 1056 to the heat sink 1050 is performed by press-fitting in the above third embodiment, the fixing may also be performed by screwing or the like.

Although the E-ring 1058 is used as the displacement restricting member in the above third embodiment, other members (for example, a split pin or a loosening prevention washer) may also be used as the displacement restricting member.

Although the light emitted from the light source 1022 reflected by the reflector 1024 is reflected by the spatial light modulator 1032 in the above third embodiment, it is also possible to employ a configuration in which the light emitted from the light source 1022 whose deflection is controlled by a lens or the like is reflected by the spatial light modulator 1032 or a configuration in which the light emitted from the light source 1022 is directly reflected by the spatial light modulator 1032.

Next, a modification of the third embodiment will be described.

First, a first modification of the third embodiment will be described.

Figure 15:
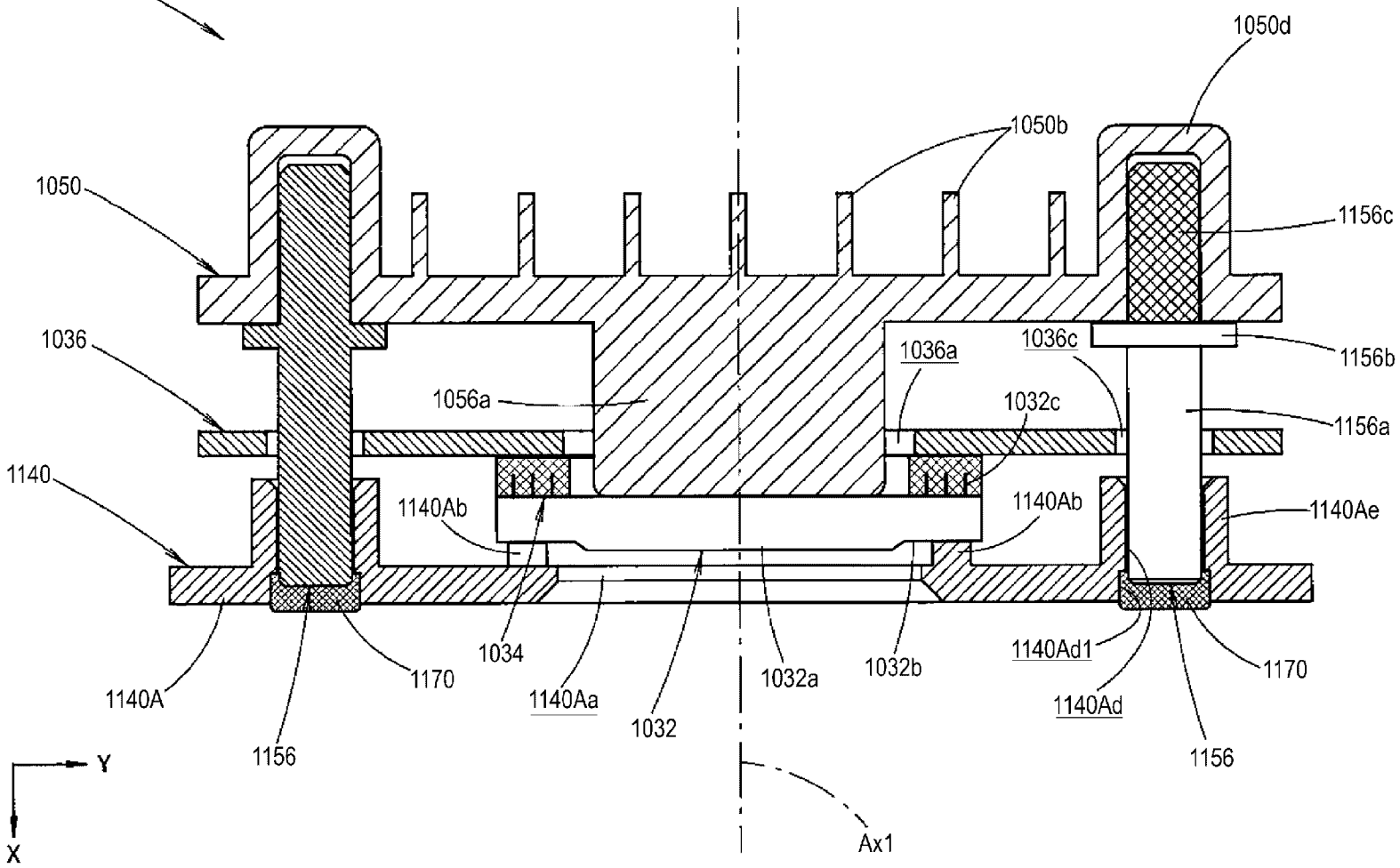
FIG. 15 shows a first modification of the third embodiment, which is the same as FIG. 12.

FIG. 15 shows a main part of a vehicle lamp according to the present modification, which is the same as FIG. 12.

As shown in FIG. 15, a basic configuration of the present modification is the same as that of the third embodiment, except that a configuration of a spatial light modulator sub-assembly 1130 is partially different from that of the third embodiment.

That is, the spatial light modulator sub-assembly 1130 of the present modification also has a configuration in which a pair of left and right shafts 1156 that extend in the lamp front-rear direction are arranged around the spatial light modulator 1032.

Similarly to each shaft 1056 of the third embodiment, each shaft 1156 is configured as a flanged shaft, and a portion of the shaft 1156 that is located on the lamp front side of a flange portion 1156*b* thereof is configured as a body portion 1156*a*. However, the body portion 1156*a* is shorter than the body portion 1056*a* of each shaft 1056 of the third embodiment. Specifically, the body portion 1156*a* of each shaft 1156 is set to a length such that a front end portion thereof does not protrude from each shaft positioning hole 1140Ad of a bracket 1140 toward the front side of the lamp.

The front end portion of the body portion 1156*a* of each shaft 1156 is fixed to the bracket 1140 by an adhesive 1170 in each shaft positioning hole 1140Ad in a state where a front end surface of the body portion 1156*a* is located on the lamp rear side of a front surface of a vertical surface portion 1140A of the bracket 1140.

A front end region 1140Ad1 of each shaft positioning hole 1140Ad of the bracket 1140 of the present modification is formed with an inner diameter slightly larger than other general regions. Therefore, the adhesive 1170 is filled in each shaft positioning hole 1140Ad in a state where a sufficient contact region is secured for both the front end portion of each shaft 1156 and the bracket 1140.

In the present modification, a rear end portion 1156*c* of each shaft 1156 is also fixed to the heat sink 1050.

In the present modification, each shaft positioning hole 1140Ad of the bracket 1140 is formed by a sleeve 1140Ae formed on a rear surface of the vertical surface portion 1140A so as to extends toward the rear side of the lamp with a length longer than a plate thickness of the vertical surface portion 1140A. Further, an opening portion 1140Aa and a protruding portion 1140Ab which are the same as that of the bracket 1040 of the third embodiment are formed in the bracket 1140.

In a case where the configuration of the present modification is employed, the heat sink 1050 and the bracket 1140 can also be easily maintained in a fixed positional relationship not only in the direction orthogonal to the lamp front-rear direction but also in the lamp front-rear direction. As a result, the positional misalignment between the spatial light modulator 1032 and the heat sink 1050 can be still more effectively prevented, and the effect of preventing the damage to the spatial light modulator 1032 can be further improved.

Even when an adhesive effect is not obtained due to deterioration of the adhesive 1170 over time, the state where the spatial light modulator 1032 is elastically pressed by the heat sink 1050 can still be maintained.

Although the body portion 1156*a* of each shaft 1156 is arranged such that the front end portion thereof does not protrude from each shaft positioning hole 1140Ad of the bracket 1140 toward the front side of the lamp in the above first modification, the front end portion may also be arranged to protrude from each shaft positioning hole 1140Ad toward the front side of the lamp and be fixed to the bracket 1140 by the adhesive 1170 around the front end portion.

Next, a second modification of the third embodiment will be described.

Figure 16:
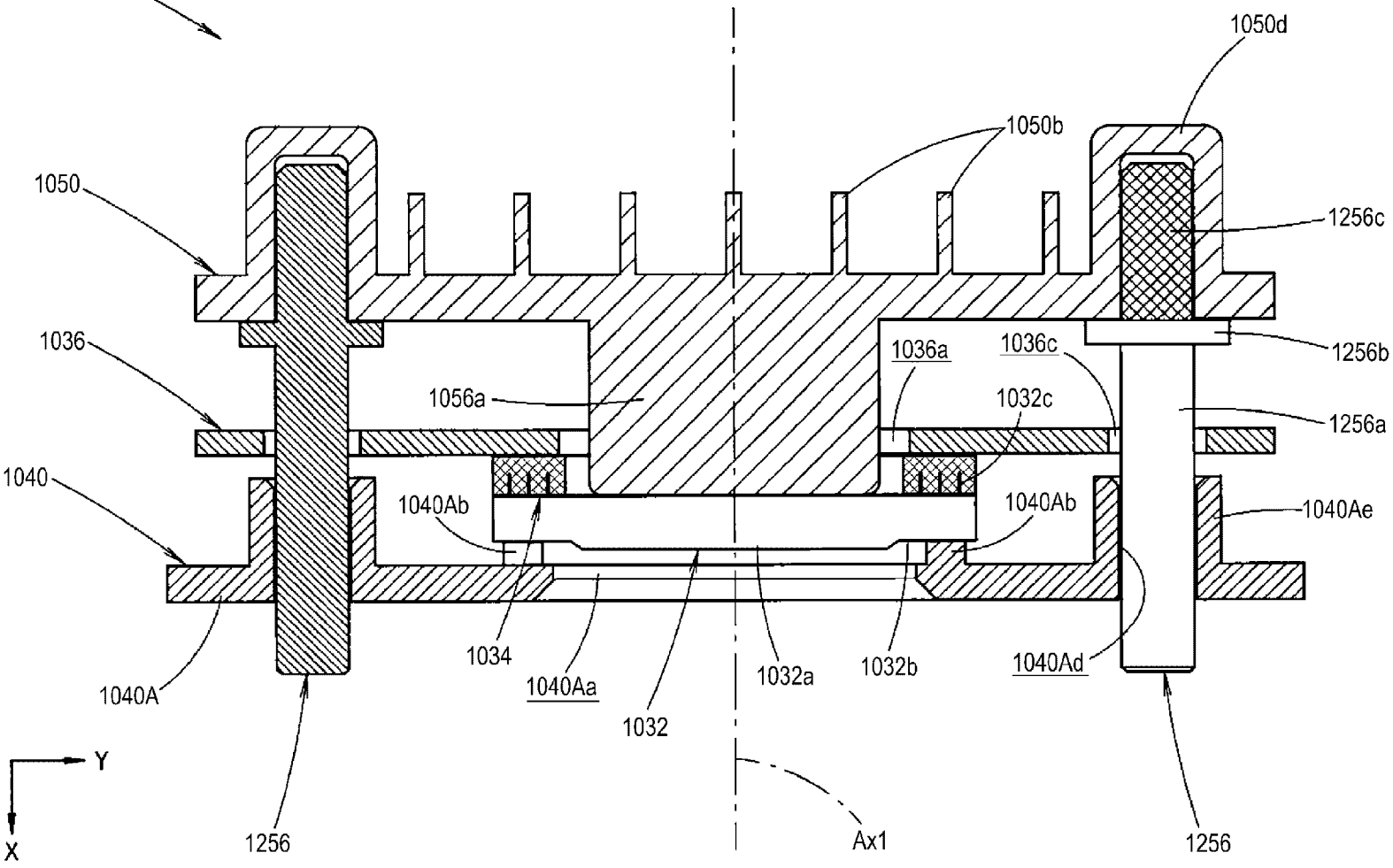
FIG. 16 shows a second modification of the third embodiment, which is the same as FIG. 12.

FIG. 16 shows a main part of a vehicle lamp according to the present modification, which is the same as FIG. 12.

As shown in FIG. 15, a basic configuration of the present modification is the same as that of the third embodiment, except that a configuration of a spatial light modulator sub-assembly 1230 is partially different from that of the third embodiment.

That is, the spatial light modulator sub-assembly 1230 of the present modification also has a configuration in which a pair of left and right shafts 1256 that extend in the lamp front-rear direction are arranged around the spatial light modulator 1032.

Similarly to each shaft 1056 of the third embodiment, each shaft 1256 is configured as a flanged shaft. A portion of each shaft 1256 that is located on the lamp front side of a flange portion 1256*b* thereof is configured as a body portion 1256*a*, and a front end portion of each shaft 1256 protrudes from each shaft positioning hole 1040Ad of the vertical surface portion 1040A of the bracket 1040 toward the front side of the lamp.

However, no annular groove portion is formed in the front end portion of the body portion 1256*a* of each shaft 1256 of the present modification like the annular groove portion 1056*a*1 formed in the body portion 1056*a* of each shaft 1056 of the third embodiment.

In the present modification, a rear end portion 1256*c* of each shaft 1256 is also fixed to the heat sink 1050.

In a case where the configuration of the present modification is employed, the pair of left and right shafts 1256 which extend in the lamp front-rear direction are arranged around the spatial light modulator 1032 in a state where the rear end portions thereof are fixed to the heat sink 1050. The front end portion of each shaft 1256 is inserted into each shaft positioning hole 1040Ad in a state where each shaft 1056 is inserted through each shaft insertion hole 1036*c* formed in the support board 1036. Therefore, the following operational effect can be obtained.

That is, presence of the pair of left and right shafts 1256 allows the heat sink 1050 and the bracket 1040 to be maintained in a fixed positional relationship with respect to the direction orthogonal to the lamp front-rear direction. Therefore, even when a vibration load or an impact load acts on the vehicle lamp, the positional relationship between the spatial light modulator 1032 and the heat sink 1050 can be effectively prevented from being misaligned to apply an excessive load on the spatial light modulator 1032. As a result, the damage to the spatial light modulator 1032 can be effectively reduced.

In the present modification, the body portion 1256*a* of each shaft 1256 is also slidably engaged with each shaft positioning hole 1040Ad over a certain length. Therefore, the bracket 1040 can thus be prevented from being inclined with respect to the vertical plane orthogonal to the optical axis Ax1.

Fourth Embodiment

Next, a fourth embodiment of the present disclosure will be described.

Figure 17:
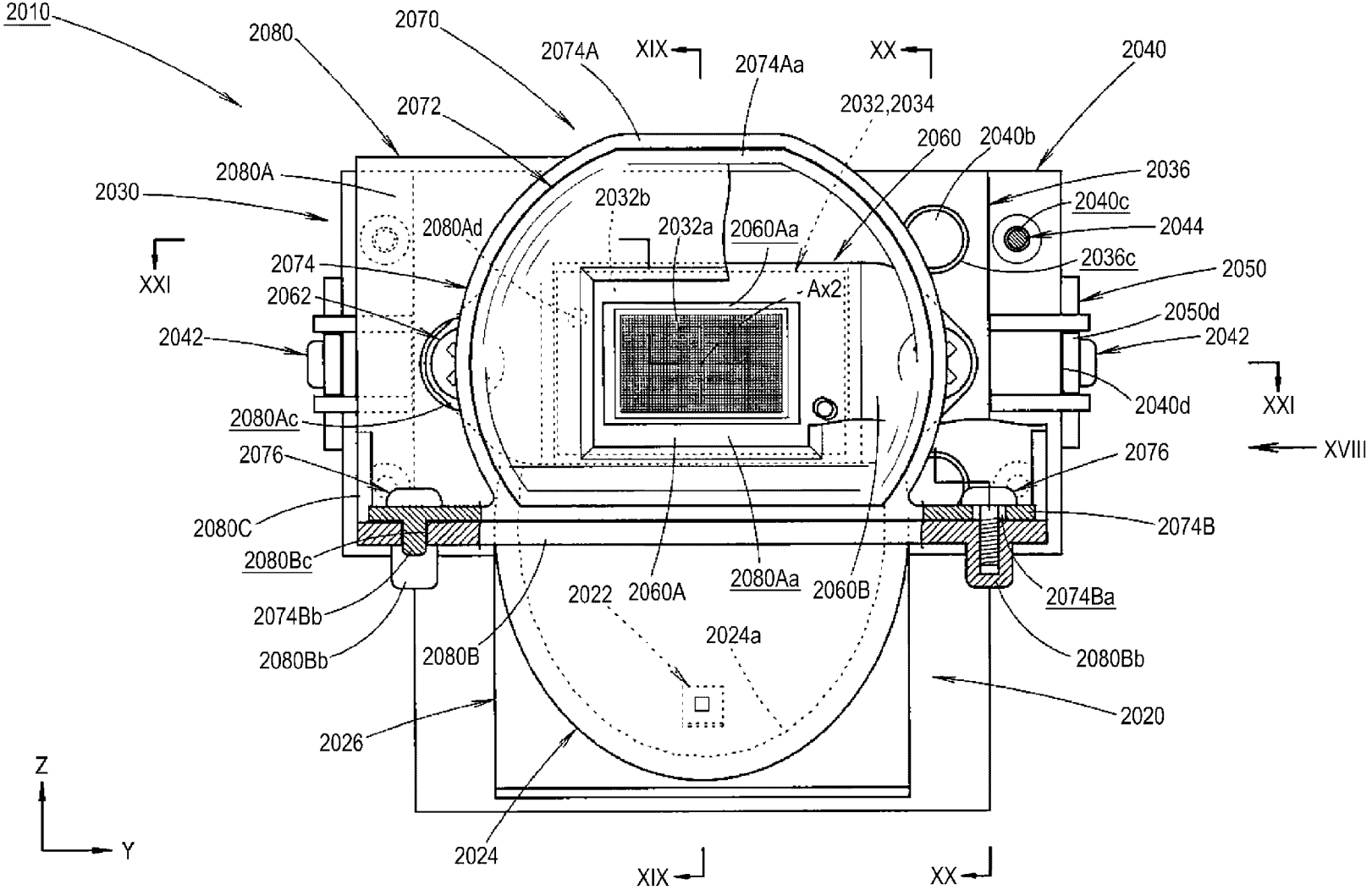
FIG. 17 is a front view showing a vehicle lamp according to a fourth embodiment of the present disclosure.
Figure 18:
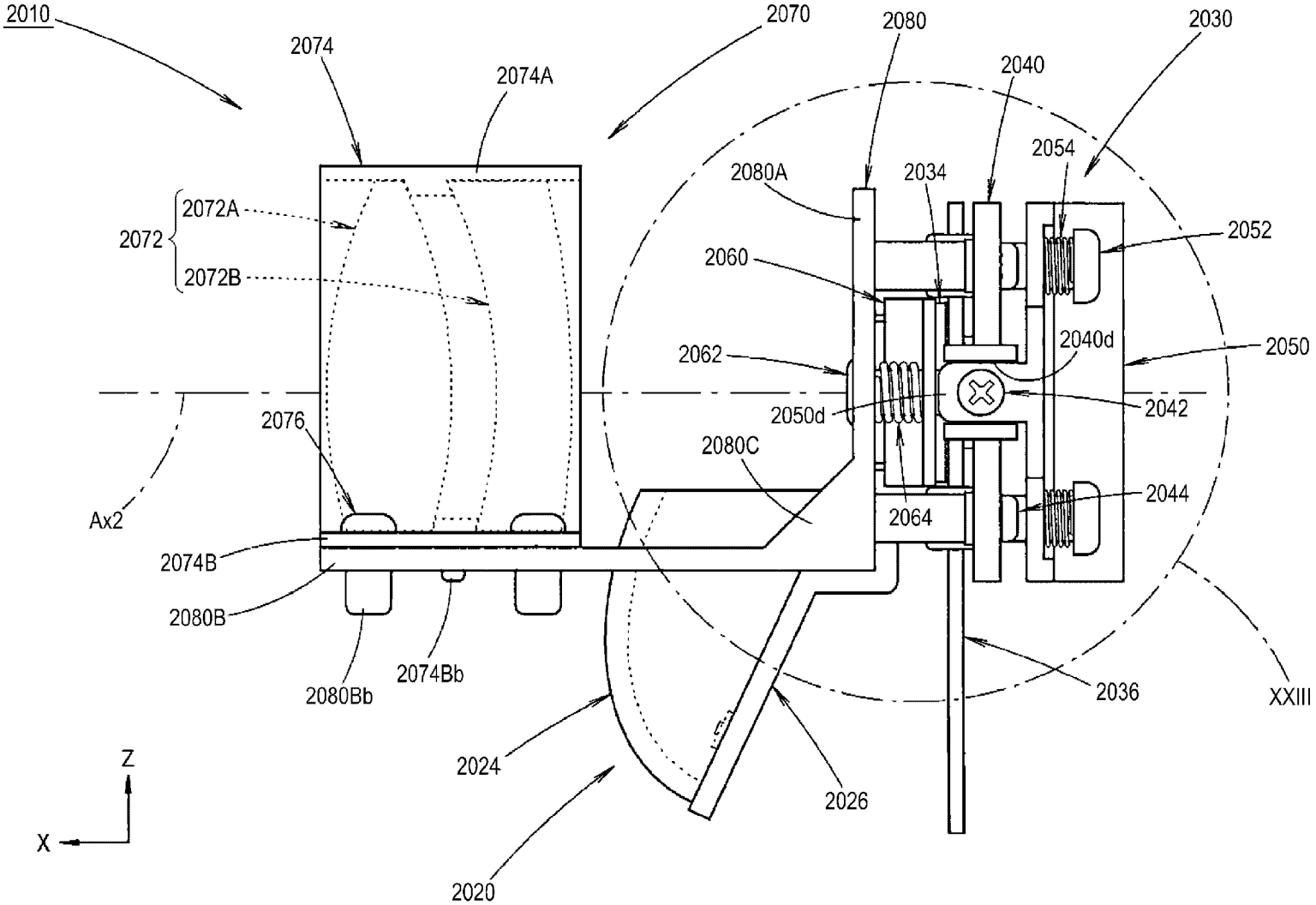
FIG. 18 is taken along arrow XVIII of FIG. 17.
Figure 19:
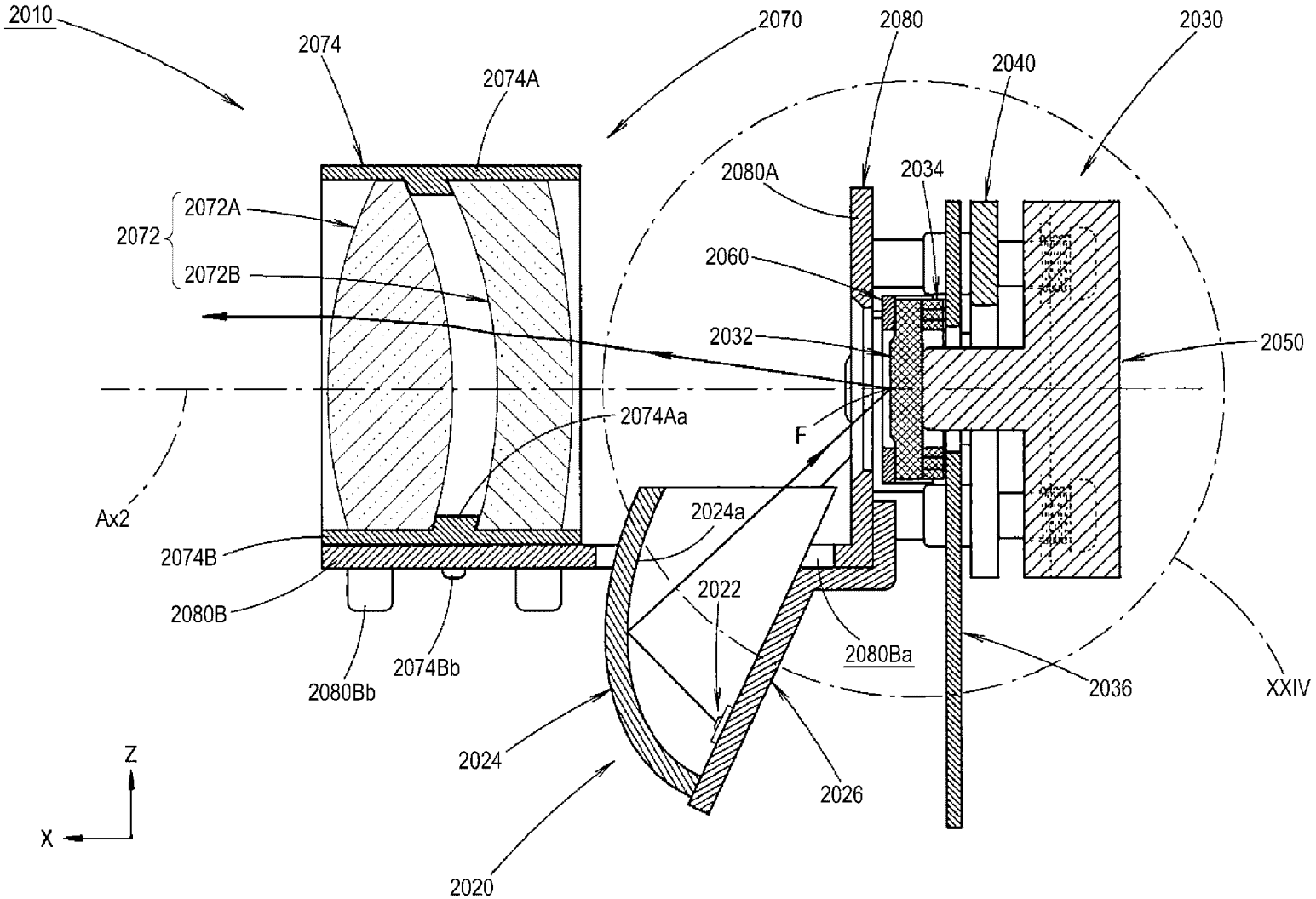
FIG. 19 is a cross-sectional view taken along line XIX-XIX of FIG. 17.
Figure 20:
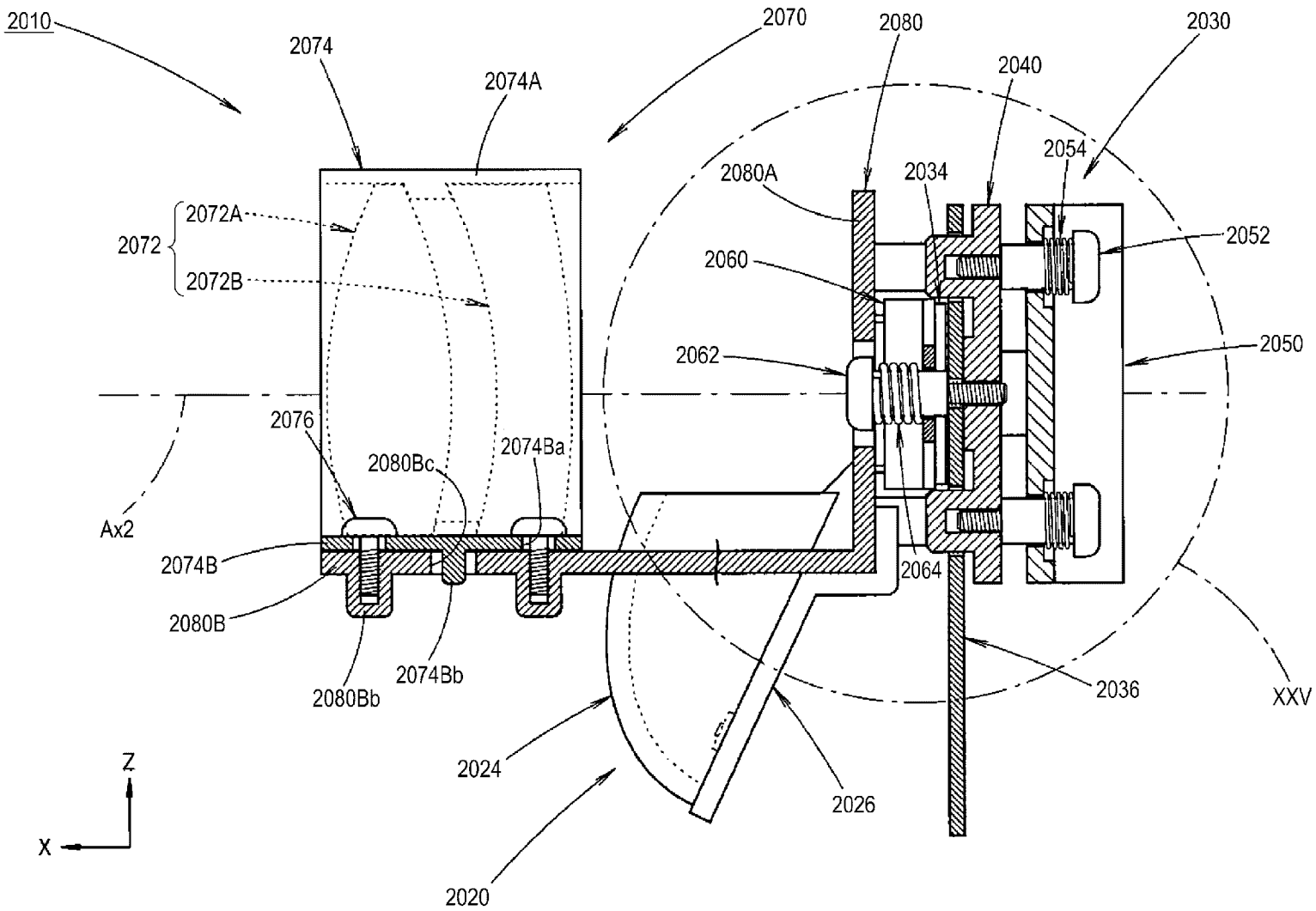
FIG. 20 is a cross-sectional view taken along line XX-XX of FIG. 17.
Figure 21:
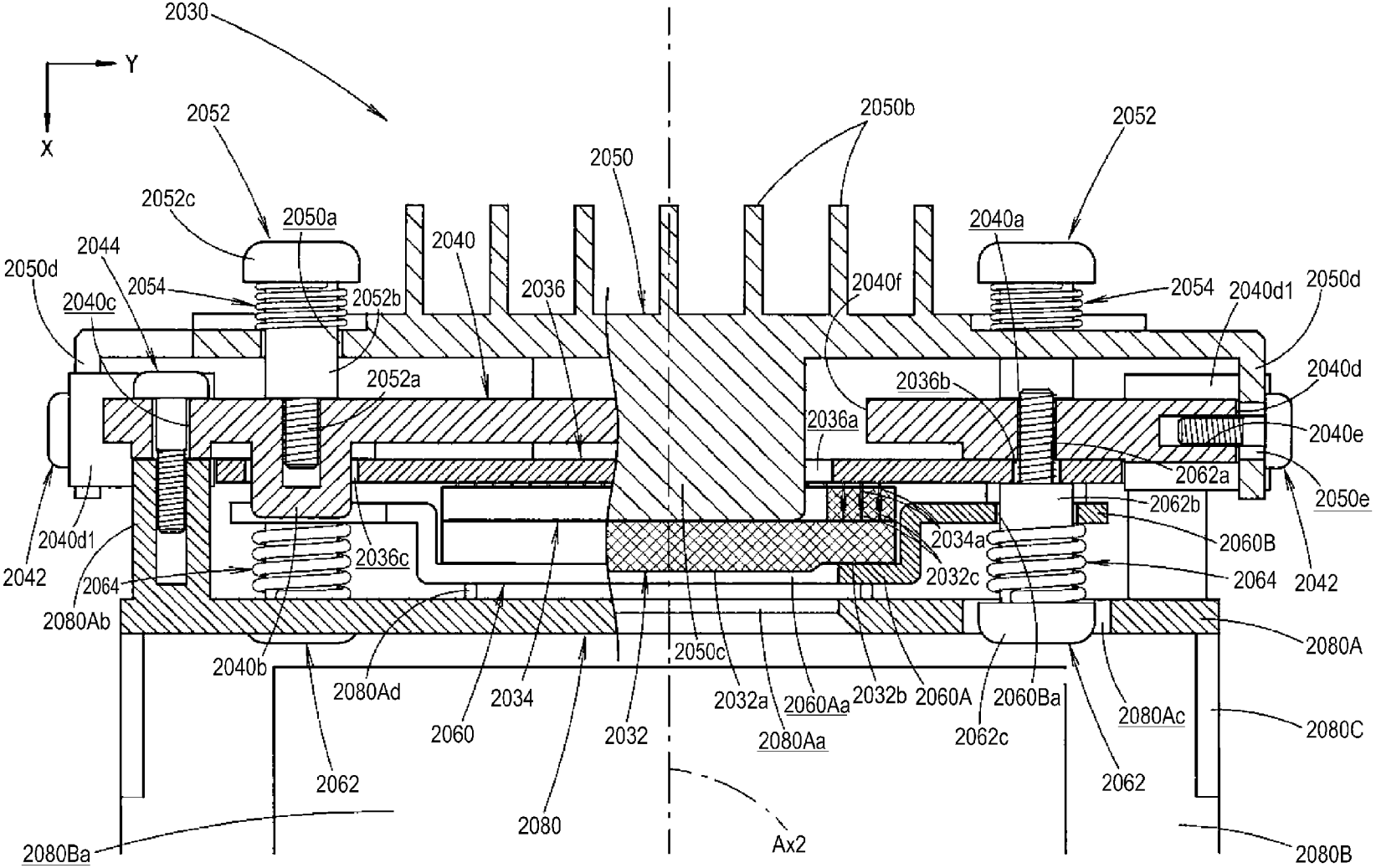
FIG. 21 is a cross-sectional view taken along line XXI-XXI of FIG. 17.

FIG. 17 is a front view showing a vehicle lamp 2010 according to the fourth embodiment of the present disclosure. FIG. 18 is taken along arrow XVIII of FIG. 17. FIG. 19 is a cross-sectional view taken along line XIX-XIX of FIG. 17. FIG. 20 is a cross-sectional view taken along line XX-XX of FIG. 17. FIG. 21 is a cross-sectional view taken along line XXI-XXI of FIG. 17. In FIG. 17, a part of constituent elements are shown in a broken state.

In these drawings, the direction indicated by X is the "front side" of the lamp (also of the vehicle), the direction indicated by Y is the "left direction" that is orthogonal to the "front side" (also the "left direction" of the vehicle, and the "right direction" in the front view of the lamp), and the direction indicated by Z is the "up direction". The same also applies to the other drawings.

As shown in these drawings, the vehicle lamp 2010 according to the present embodiment is a headlamp provided at a front end portion of a vehicle, and is configured as a projector-type lamp unit incorporated in a lamp chamber formed by a lamp body and a translucent cover (not shown).

The vehicle lamp 2010 includes: a light source side sub-assembly 2020; a spatial light modulator sub-assembly 2030; a lens side sub-assembly 2070; and a support bracket 2080 configured to support the above members. The support bracket 2080 of the vehicle lamp 2010 is supported by the above lamp body via an attachment structure (not shown).

As shown in FIG. 19, the light source side sub-assembly 2020 includes: a light source 2022; a reflector 2024 configured to reflect light emitted from the light source 2022 toward the spatial light modulator sub-assembly 2030; and a base member 2026 configured to support the light source 2022 and the reflector 2024.

The spatial light modulator sub-assembly 2030 includes: a spatial light modulator 2032; a control board 2036 arranged on the lamp rear side of the spatial light modulator 2032; a board bracket 2040 arranged on the lamp rear side of the control board 2036; a heat sink 2050 arranged on the lamp rear side of the board bracket 2040; and a pressing tool 2060 arranged on the lamp front side of the spatial light modulator 2032.

The lens side sub-assembly 2070 includes: a projection lens 2072 which has an optical axis Ax2 extending in the vehicle front-rear direction; and a lens holder 2074 configured to support the projection lens 2072.

The vehicle lamp 2010 according to the present embodiment is configured such that various light distribution patterns can be formed with high accuracy by emitting light from the light source 2022 reflected by the reflector 2024 toward the front side of the lamp via the spatial light modulator 2032 and the projection lens 2072. The light distribution patterns are, for example, low-beam light distribution patterns or high-beam light distribution patterns, light distribution patterns that change according to vehicle traveling situations, or light distribution patterns that draw characters or symbols on a road surface in front of the vehicle.

In order to realize such light distribution patterns, during an assembly process of the vehicle lamp 2010, a positional relationship between the spatial light modulator 2032 and the projection lens 2072 is finely adjusted in a state where the light source 2022 is lit to form the light distribution patterns, and accuracy of the positional relationship is improved.

Next, a specific configuration of each of the light source side sub-assembly 2020, the spatial light modulator sub-assembly 2030, the lens side sub-assembly 2070 and the support bracket 2080 will be described.

First, the configuration of the light source side sub-assembly 2020 will be described.

The light source 2022 is a white light emitting diode, and is fixedly supported by the base member 2026 in a state where a light emitting surface thereof faces obliquely upward and forward. The base member 2026 is fixedly supported on the support bracket 2080.

The reflector 2024 covers the light source 2022 from the lamp front side, and a peripheral edge portion thereof is fixedly supported by the base member 2026. The reflector 2024 reflects the light emitted from the light source 2022 obliquely upward and rearward. A reflecting surface 2024*a* of the reflector 2024 converges the light emitted from the light source 2022 to the vicinity of a rear focal plane which includes the rear focus F of the projection lens 2072.

Next, the configuration of the spatial light modulator sub-assembly 2030 will be described.

Figure 22:
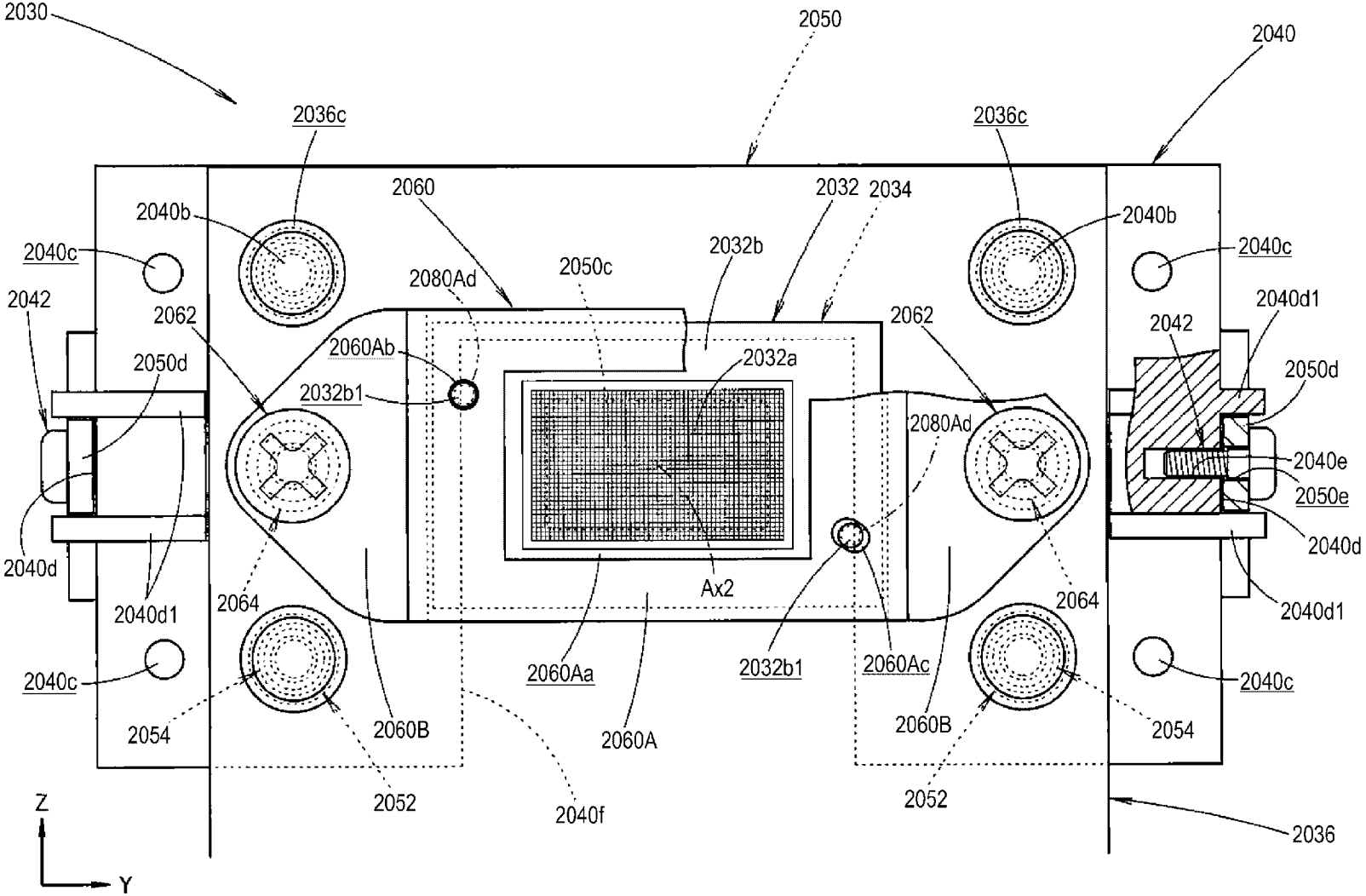
FIG. 22 is a front view showing a spatial light modulator sub-assembly of the vehicle lamp in a taken-out state.
Figure 23:
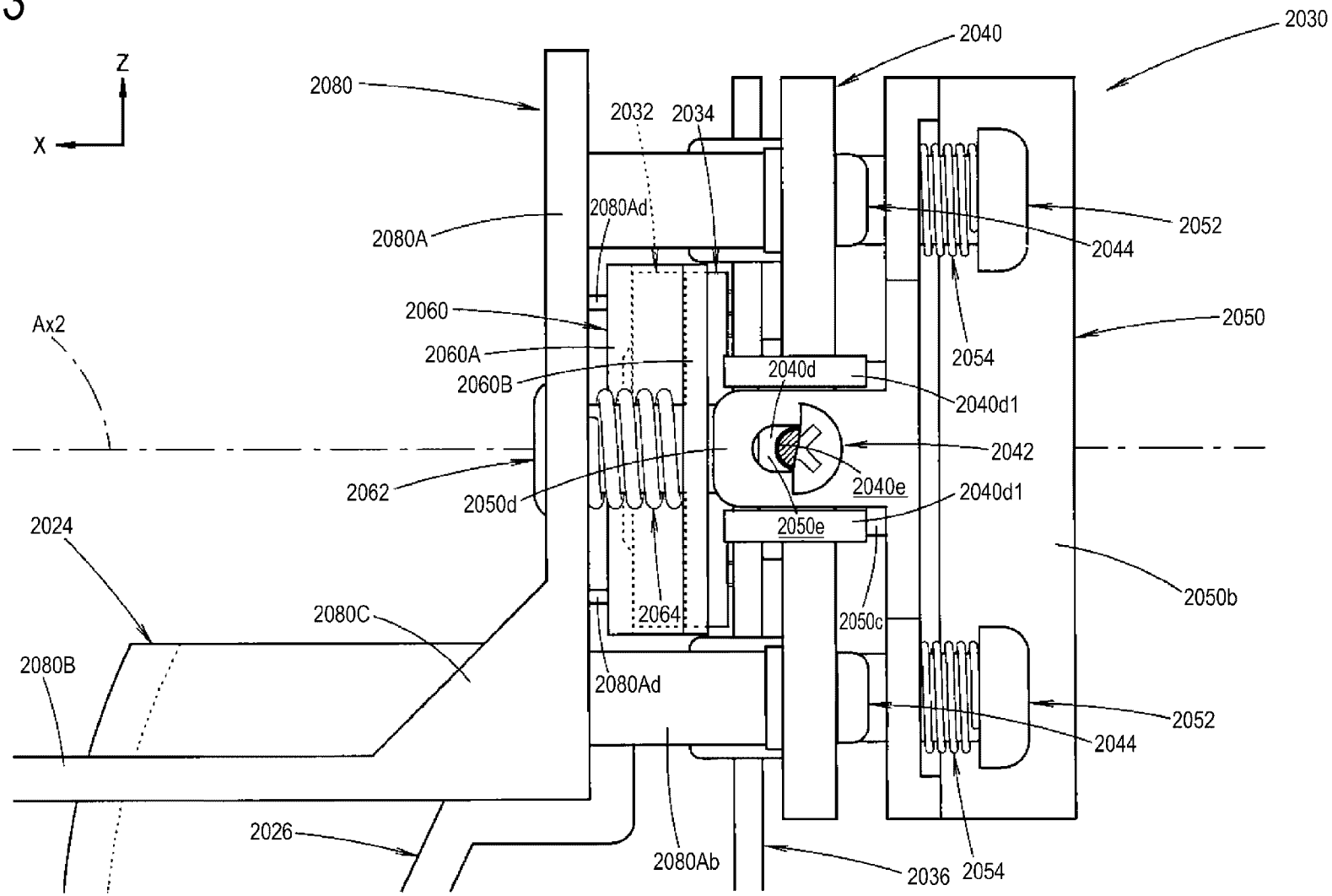
FIG. 23 is a detailed view of portion XXIII of FIG. 18.
Figure 24:
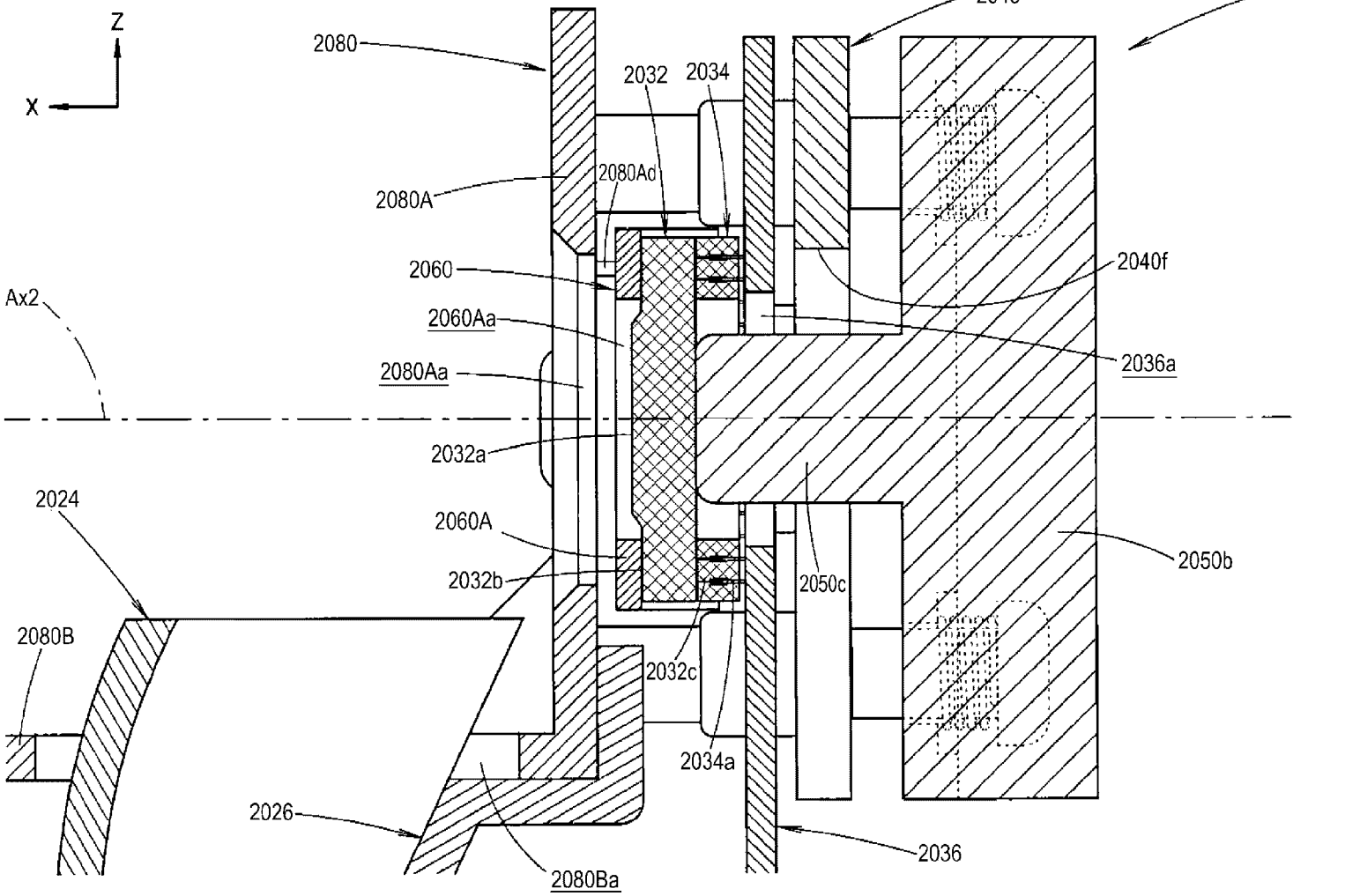
FIG. 24 is a detailed view of portion XXIV of FIG. 19.
Figure 25:
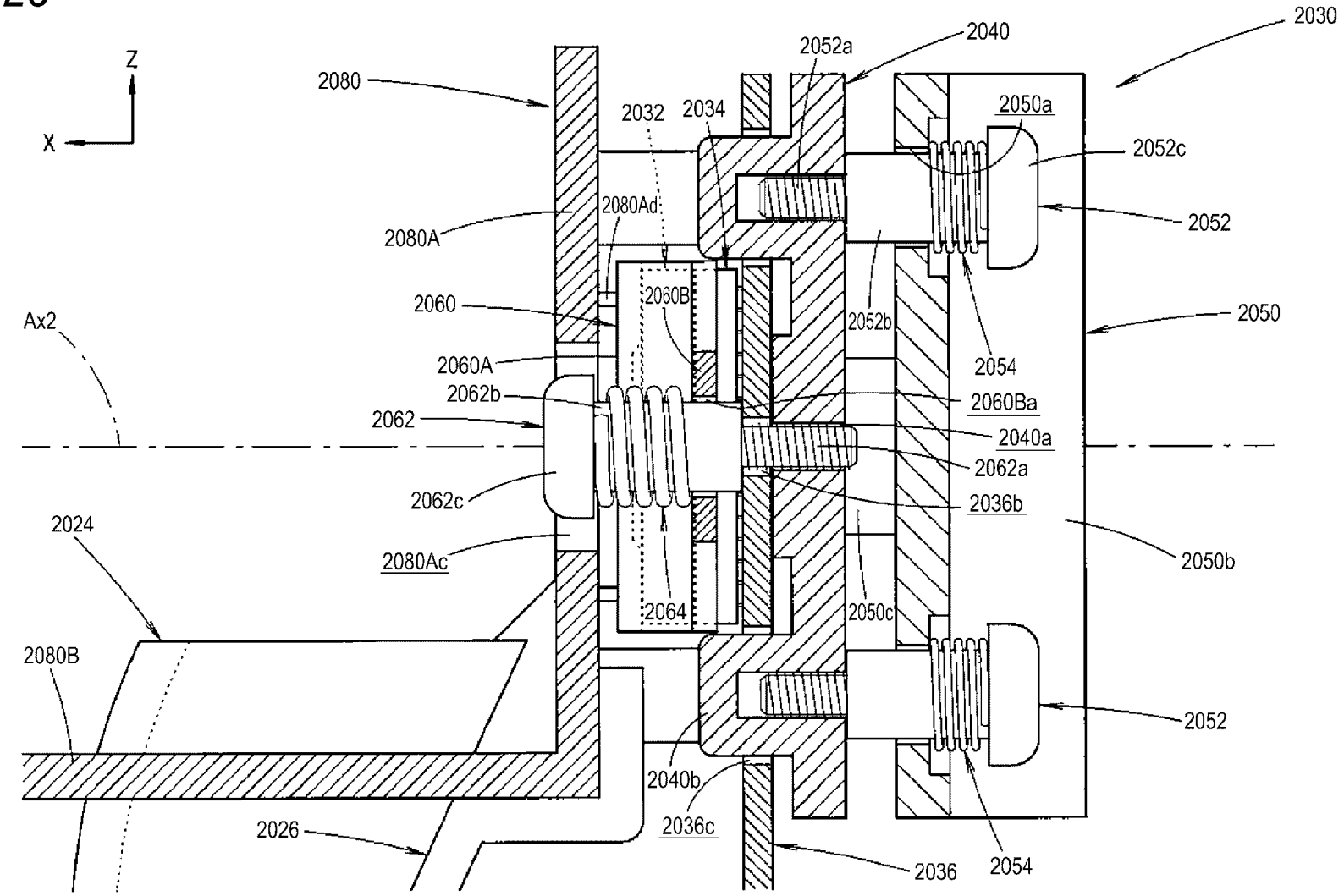
FIG. 25 is a detailed view of portion XXV of FIG. 20.
Figure 26:
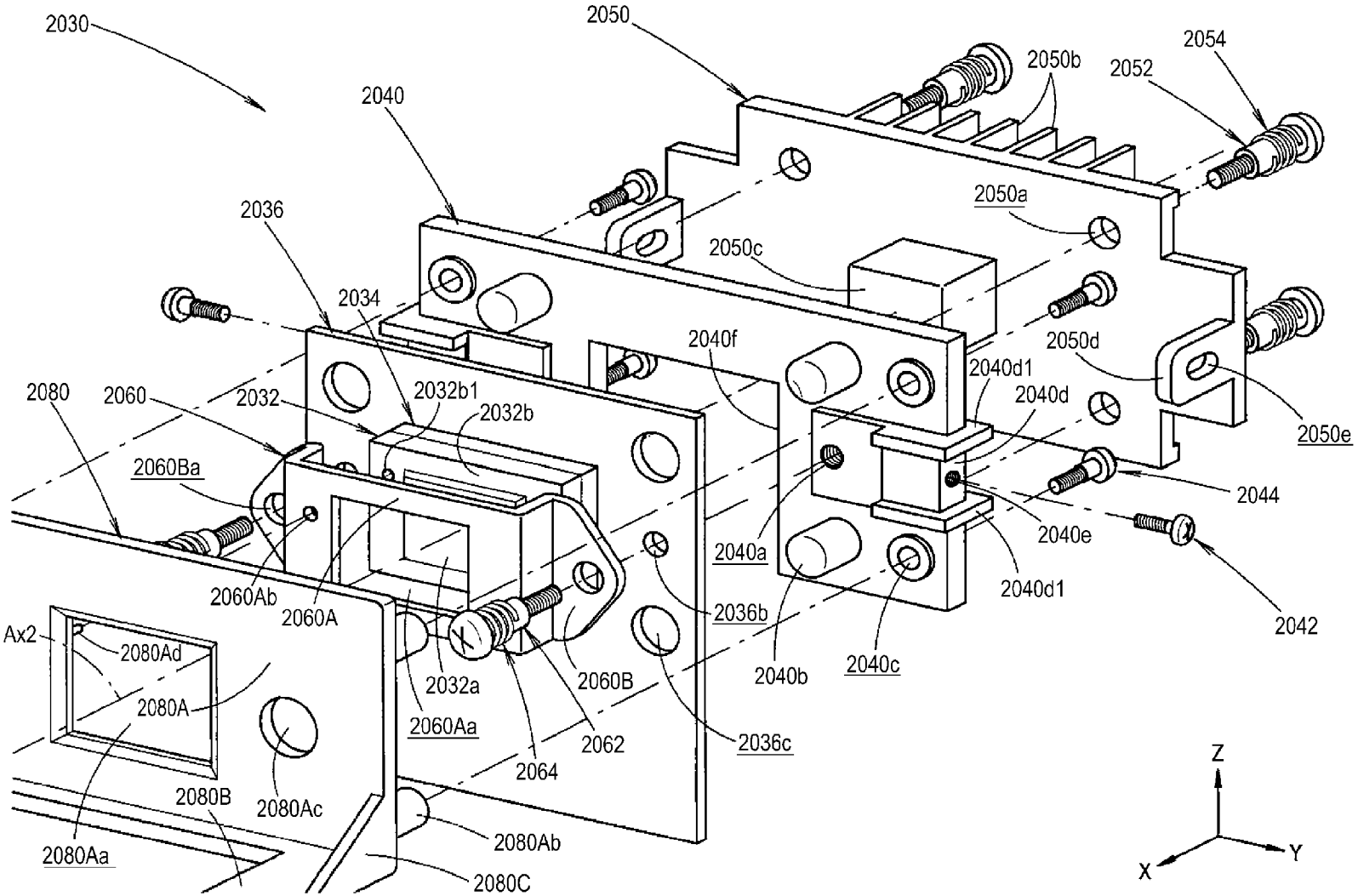
FIG. 26 is a perspective view showing the spatial light modulator sub-assembly in a state where constituent elements thereof are exploded together with a support bracket.

FIG. 22 is a front view showing the spatial light modulator sub-assembly 2030 in a taken-out state. FIG. 23 is a detailed view of portion XXIII of FIG. 18. FIG. 24 is a detailed view of portion XXIV of FIG. 19. FIG. 25 is a detailed view of portion XXV of FIG. 20. Further, FIG. 26 is a perspective view showing the spatial light modulator sub-assembly 2030 in a state where constituent elements thereof are exploded together with the support bracket 2080.

As shown in these figures, the spatial light modulator 2032 is a reflective spatial light modulator, and includes a digital micromirror device (DMD) in which a plurality of (for example, several hundreds of thousands) micromirrors are arranged in a matrix.

The spatial light modulator 2032 is configured to selectively switch a reflection direction of the light from the light source 2022 that has reached the spatial light modulator 2032 by controlling an angle of a reflecting surface of each of the plurality of micromirrors. Specifically, a mode in which the light from the light source 2022 is reflected toward the projection lens 2072 and a mode in which the light is reflected toward another direction (that is, a direction that does not adversely affect formation of the light distribution patterns) are selected.

The spatial light modulator 2032 is arranged along a vertical plane that is orthogonal to the optical axis Ax2 at the position of the rear focus F of the projection lens 2072, and a reflected light control region 2032*a* thereof has a laterally elongated rectangular outer shape centered on the optical axis Ax2.

A rear surface of a peripheral edge portion 2032*b* of the spatial light modulator 2032 that surrounds the reflected light control region 2032*a* is supported by the control board 2036 via a socket 2034.

The socket 2034 is configured as a laterally elongated rectangular frame member along the peripheral edge portion 2032*b* of the spatial light modulator 2032, and is fixed to the control board 2036 in a state of being electrically connected to a conductive pattern (not shown) formed on the control board 2036. An opening portion 2036*a* that has substantially the same shape as an inner peripheral edge shape of the socket 2034 is formed in the control board 2036.

As shown in FIGS. 21 and 24, the peripheral edge portion 2032*b* of the spatial light modulator 2032 is formed with a plurality of terminal pins 2032*c* that protrudes from the rear surface thereof toward the rear side of the lamp. Meanwhile, the socket 2034 are formed with a plurality of terminal pins 2034*a* that protrudes from a rear surface thereof toward the rear side of the lamp at positions corresponding to the plurality of terminal pins 2032*c*.

A base end portion (that is, a tip end portion embedded in the socket 2034) of each terminal pin 2034*a* of the socket 2034 has a substantially cylindrical shape, and a tip end portion of each terminal pin 2032*c* of the spatial light modulator 2032 is fitted into the base end portion, so that the spatial light modulator 2032 and the socket 2034 are electrically connected to each other.

A tip end portion of each terminal pin 2034*a* of the socket 2034 is soldered to the conductive pattern of the control board 2036. Therefore, the socket 2034 is arranged in a state where the rear surface thereof slightly floats from a front surface of the control board 2036.

The spatial light modulator 2032 is supported by the pressing tool 2060 and the heat sink 2050 from the two sides in the lamp front-rear direction.

The pressing tool 2060 is a member that is made of metal (for example, aluminum die casting), and includes: a body portion 2060A that extends in a flat plate shape along the vertical plane orthogonal to the optical axis Ax2; and a pair of flange portions 2060B located on left and right sides of the body portion 2060A.

An opening portion 2060Aa that has a laterally elongated rectangular shape is formed in the body portion 2060A with the optical axis Ax2 serving as a center. The opening portion 2060Aa has a laterally elongated rectangular opening shape that is smaller than an outer peripheral edge shape of the spatial light modulator 2032 and larger than the reflected light control region 2032*a*.

The pair of left and right flange portions 2060B extend from side end edges of the body portion 2060A toward the lamp rear side in the vicinity of the left and right sides of the spatial light modulator 2032, and are then bent at a right angle in a direction deviated from the optical axis Ax2 and extend in a flat plate shape. Each flange portion 2060B is formed with a bolt insertion hole 2060Ba that penetrates the flange portion 2060B in the lamp front-rear direction.

The pair of left and right flange portions 2060B of the pressing tool 2060 are fixed to the board bracket 2040 by a pair of left and right first stepped bolts 2062 in a state where the body portion 2060A is abutted against the peripheral edge portion 2032*b* of the spatial light modulator 2032 from the lamp front side. The fixing is performed in a state where the spatial light modulator 2032 is elastically pressed toward the rear side of the lamp by the pressing tool 2060.

A specific configuration for performing such pressing is as follows.

That is, a tip end surface of a large diameter portion 2062*b* of each first stepped bolt 2062 is abutted against the control board 2036 in a state where the large diameter portion 2062*b* is inserted through the bolt insertion hole 2060Ba of the pressing tool 2060. A small diameter portion 2062*a* of each first stepped bolt 2062 is screwed into a screw hole 2040*a* formed in the board bracket 2040 in a state where the small diameter portion 2062*a* is inserted through a bolt insertion hole 2036*b* formed in the control board 2036.

A first spring 2064 which is configured to elastically press the pressing tool 2060 toward the rear side of the lamp is attached to the large diameter portion 2062*b* of each first stepped bolt 2062. Each first spring 2064 includes a compression coil spring arranged between a head portion 2062*c* of each first stepped bolt 2062 and each flange portion 2060B of the pressing tool 2060.

In a state where the body portion 2060A of the pressing tool 2060 is abutted against the peripheral edge portion 2032*b* of the spatial light modulator 2032, a rearward displacement amount of each flange portion 2060B from the body portion 2060A is set in a manner that allows each flange portion 2060B to be spaced apart from the control board 2036 on the lamp front side.

The heat sink 2050 is a member that is made of metal (for example, aluminum die casting), and extends along the vertical plane that is orthogonal to the optical axis Ax2. A plurality of heat dissipating fins 2050*b* are formed in a vertical stripe pattern on a rear surface thereof.

A prismatic protruding portion 2050*c* that protrudes toward the front side of the lamp is formed at a central portion of a front surface of the heat sink 2050. The protruding portion 2050*c* has a laterally elongated rectangular cross-sectional shape centered on the optical axis Ax2, and a size thereof is set to a value smaller than an inner peripheral surface shape of the socket 2034.

The heat sink 2050 is fixed to the board bracket 2040 by two pairs of left and right second stepped bolts 2052 in a state where a front end surface of the protruding portion 2050*c* is abutted against a central portion of the spatial light modulator 2032 (that is, a portion where the reflected light control region 2032*a* is located) from the lamp rear side. The fixing is performed in a state where the spatial light modulator 2032 is elastically pressed toward the front side of the lamp by the protruding portion 2050*c*.

A specific configuration for performing such pressing is as follows.

That is, the two pairs of left and right second stepped bolts 2052 are arranged at two upper and lower locations on the left and right sides of the spatial light modulator 2032.

A tip end surface of a large diameter portion 2052*b* of each second stepped bolt 2052 is abutted against the board bracket 2040 in a state where the large diameter portion 2052*b* is inserted through a bolt insertion hole 2050*a* formed in the heat sink 2050, and a small diameter portion 2052*a* of each second stepped bolt 2052 is screwed to a screw hole of a boss portion 2040*b* formed on the board bracket 2040.

A second spring 2054 which is configured to elastically press the protruding portion 2050*c* of the heat sink 2050 toward the front side of the lamp is attached to the large diameter portion 2052*b* of each second stepped bolt 2052. Each second spring 2054 includes a compression coil spring arranged between a head portion 2052*c* of each second stepped bolt 2052 and the heat sink 2050.

Two pairs of left and right boss portion insertion holes 2036*c* which are configured to prevent interference with the boss portion 2040*b* are formed in the control board 2036 with a diameter larger than that of the boss portion 2040*b*.

In this way, in the spatial light modulator sub-assembly 2030 of the present embodiment, the spatial light modulator 2032 is elastically pressed together with the socket 2034 by the pressing tool 2060 and the heat sink 2050 from the two sides in the lamp front-rear direction, so that a state where the spatial light modulator 2032 and the socket 2034 are electrically connected is reliably maintained while no excessive load is applied to the spatial light modulator 2032.

In the present embodiment, an elastic pressing force of the pressing tool 2060 with respect to the spatial light modulator 2032 is set to a value larger than an elastic pressing force of the heat sink 2050 with respect to the spatial light modulator 2032, so that a state where the peripheral edge portion 2032*b* of the spatial light modulator 2032 is always pressed against the control board 2036 via the socket 2034 is maintained.

Specifically, the compression coil spring constituting each first spring 2064 has a larger wire diameter (for example, a wire diameter of two times or more) than the compression coil spring constituting each second spring 2054, so that a total elastic pressing force of each of the two first springs 2064 is set to a value larger than a total elastic pressing force of each of the four second springs 2054.

A protruding piece 2050*d* which protrudes toward the front side of the lamp is formed on each of left and right end portions of the heat sink 2050. Meanwhile, a guide groove portion 2040*d*, which engages with upper and lower end surfaces of each of the pair of left and right protruding pieces 2050*d* and extends in the lamp front-rear direction, is formed in each of left and right end portions of the board bracket 2040.

By engaging the protruding pieces 2050*d* with the guide groove portions 2040*d* on left and right sides of the board bracket 2040 in this way, the heat sink 2050 is prevented from rotating with respect to the board bracket 2040 in the up-down direction.

An elongated hole 2050*e* that extends in the lamp front-rear direction is formed in each protruding piece 2050*d*, and a screw hole 2040*e* that is opened laterally is formed in each guide groove portion 2040*d*.

The heat sink 2050 is fixed to the board bracket 2040 in a state of being positioned in the lamp front-rear direction with respect to the board bracket 2040 by fastening a screw 2042 to each screw hole 2040 through each elongated hole 2050*e*.

A portion of the board bracket 2040 where the guide groove portion 2040*d* is formed is thicker than other portions so as to secure strength in the vicinity of the screw hole 2040*e*. Moreover, a pair of upper and lower horizontal flange portions 2040*d*1, which form the guide groove portions 2040*d* of the board bracket 2040, extend around front and rear sides of the board bracket 2040 in directions approaching the optical axis Ax2, so that rigidity of the guide groove portions 2040*d* is sufficiently secured.

Next, the configuration of the support bracket 2080 will be described.

The support bracket 2080 is a member that is made of metal (for example, aluminum die casting), and includes: a vertical surface portion 2080A that extends along the vertical plane orthogonal to the optical axis Ax2; and a horizontal surface portion 2080B that extends along the horizontal plane from a lower end edge of the vertical surface portion 2080A toward the front side of the lamp. Reinforcing flange portions 2080C which are configured to reinforce a connection portion between the vertical surface portion 2080A and the horizontal surface portion 2080B are formed on left and right side portions of the support bracket 2080.

An opening portion 2080Aa that has a laterally elongated rectangular shape is formed in the vertical surface portion 2080A with the optical axis Ax2 serving as a center. The opening portion 2080Aa has a laterally elongated rectangular opening shape that is smaller than an outer peripheral edge shape of the spatial light modulator 2032 and larger than the reflected light control region 2032*a*, and a front end edge of an inner peripheral surface thereof is chamfered over an entire circumference.

Two pairs of left and right boss portions 2080Ab which extend toward the rear side of the lamp on left and right sides of the control board 2036 are formed on a rear surface of the vertical surface portion 2080A. The two pairs of left and right boss portions 2080Ab are located at substantially the same height as the two pairs of left and right second stepped bolts 2052.

Meanwhile, screw insertion holes 2040*c* are formed in the board bracket 2040 at positions corresponding to the two pairs of left and right boss portions 2080Ab.

A screw 2044 is fastened to a screw hole of each boss portion 2080Ab of the vertical surface portion 2080A through each screw insertion hole 2040*c* of the board bracket 2040 from the lamp rear side, and thus the spatial light modulator sub-assembly 2030 is fixed to the support bracket 2080.

A length of each boss portion 2080Ab is set to allow the vertical surface portion 2080A of the support bracket 2080 to be located on the lamp front side of the body portion 2060A of the pressing tool 2060.

A pair of left and right opening portions 2080Ac which are configured to prevent interference with the pair of left and right first stepped bolts 2062 are formed in the vertical surface portion 2080A of the support bracket 2080 with a diameter larger than that of the head portion 2062*c* of the first stepped bolt 2062.

The horizontal surface portion 2080B extends to the lamp front side of the reflector 2024, and a laterally elongated rectangular opening portion 2080Ba where the reflector 2024 is inserted is formed in the horizontal surface portion 2080B.

As shown in FIG. 22, cylindrical positioning holes 2032*b*1 are formed in a front surface of the peripheral edge portion 2032*b* of the spatial light modulator 2032 at two locations on a diagonal with respect to the optical axis Ax2. Moreover, pin insertion holes 2060Ab and 2060Ac, which penetrate the body portion 2060A in the lamp front-rear direction, are formed in the body portion 2060A of the pressing tool 2060 at positions corresponding to the positioning holes 2032*b*1 of the spatial light modulator 2032. Further, cylindrical positioning pins 2080Ad which extend toward the rear side of the lamp are formed on the vertical surface portion 2080A of the support bracket 2080 at positions corresponding to the positioning holes 2032*b*1 of the spatial light modulator 2032.

The positioning pins 2080Ad of the support bracket 2080 are inserted into the respective positioning holes 2032*b*1 of the spatial light modulator 2032 via the respective pin insertion holes 2060Ab, 2060Ac of the pressing tool 2060. As a result, when the spatial light modulator sub-assembly 2030 is assembled to the support bracket 2080, positioning is performed within the vertical plane orthogonal to the optical axis Ax2. Moreover, after the assembly, the spatial light modulator 2032 is prevented from being inadvertently displaced in the vertical plane.

As for the two pin insertion holes 2060Ab, 2060Ac formed in the body portion 2060A of the pressing tool 2060, one pin insertion hole 2060Ab is formed as a circular hole and the other pin insertion hole 2060Ac is formed as an elongated hole extending in a direction of the above diagonal.

Next, the configuration of the lens side sub-assembly 2070 will be described.

As shown in FIG. 19, the projection lens 2072 includes first and second lenses 2072A, 2072B that are arranged at a predetermined interval in the lamp front-rear direction on the optical axis Ax2.

The first lens 2072A that is located on the lamp front side is configured as a biconvex lens, and the second lens 2072B that is located on the lamp rear side is configured as a concave meniscus lens that bulges toward the rear side of the lamp. Upper end portions of the first and second lenses 2072A, 2072B are cut slightly along the horizontal plane, and lower end portions thereof are cut relatively large along the horizontal plane.

Outer peripheral edge portions of the first and second lenses 2072A, 2072B are supported by the common lens holder 2074.

The lens holder 2074 is a member that is made of metal (for example, aluminum die casting), and includes: a holder body 2074A that surrounds the projection lens 2072 in a cylindrical shape; and a pair of flange portions 2074B that protrude on left and right sides along the horizontal plane at a lower end portion of an outer peripheral surface of the holder body 2074A.

A protruding portion 2074Aa that is configured to position the first and second lenses 2072A, 2072B is formed on an inner peripheral surface of the holder body 2074A. Meanwhile, the pair of left and right flange portions 2074B are formed in flat plate shapes that extend in the lamp front-rear direction over an entire length of the lens holder 2074 with a constant left-right width.

Figure 27:
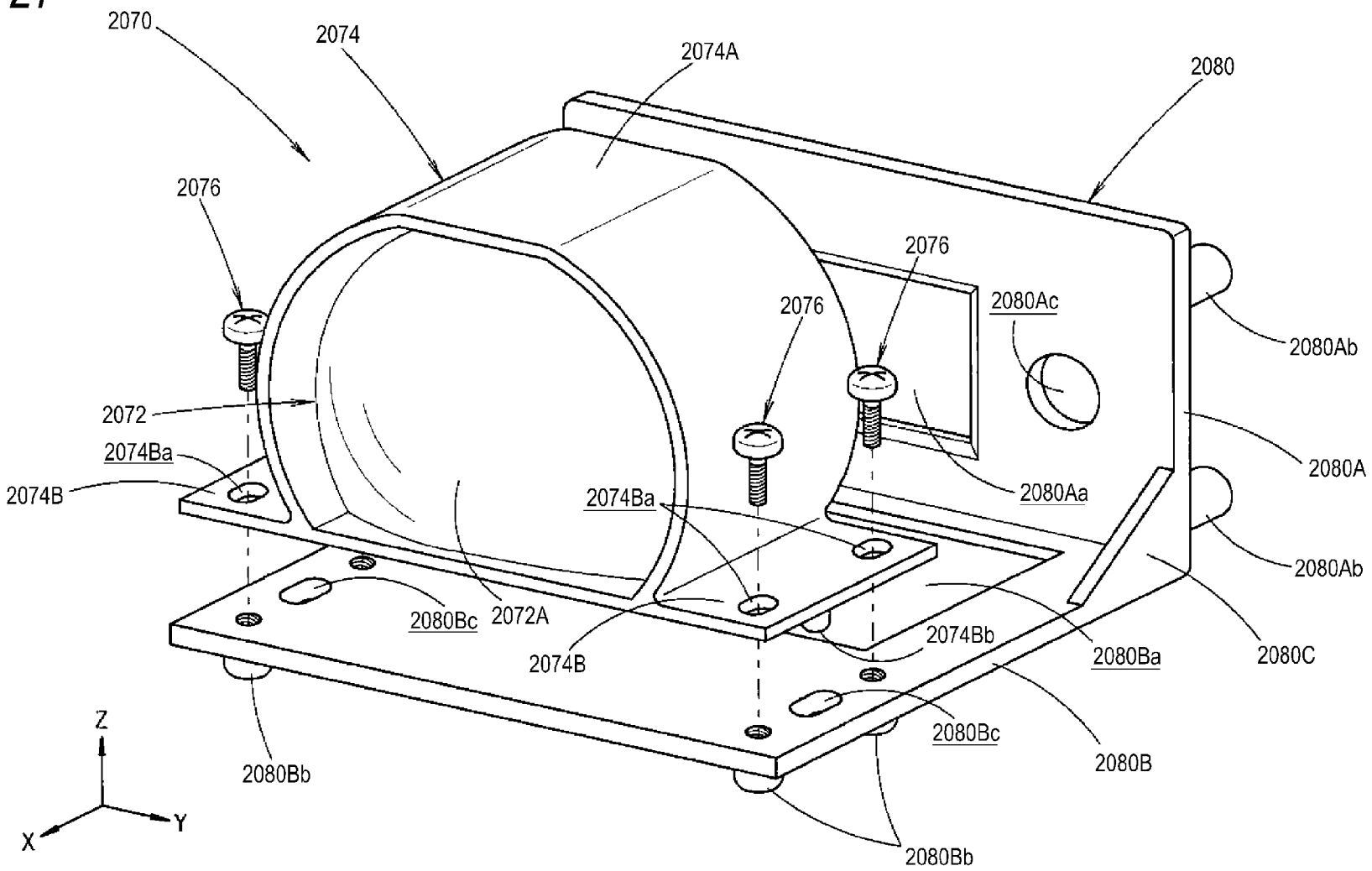
FIG. 27 is a perspective view showing a lens side sub-assembly of the vehicle lamp together with the support bracket in an exploded state.

FIG. 27 is a perspective view showing the lens side sub-assembly 2070 together with the support bracket 2080 in an exploded state.

Still as shown in FIG. 27, the pair of left and right flange portions 2074B of the lens holder 2074 are fixed to the horizontal surface portion 2080B of the support bracket 2080 by mechanical fastening. The fixing of the mechanical fastening is performed by screwing.

In order to realize such a configuration, each flange portion 2074B of the lens holder 2074 is formed with a pair of front and rear screw insertion holes 2074Ba that penetrate the flange portion 2074B in the up-down direction. Moreover, a pair of front and rear boss portions 2080Bb which include screw holes are formed on the horizontal surface portion 2080B of the support bracket 2080 so as to protrude downward. A screw 2076 is screwed into the screw hole of each boss portion 2080Bb from an upper side of each flange portion 2074B via each screw insertion hole 2074Ba.

Each screw insertion hole 2074Ba is formed as an elongated hole extending in the lamp front-rear direction with a left-right width that is larger than a screw diameter of each screw 2076. As a result, the lens holder 2074 can be screwed to the support bracket 2080 in a state where a position of the lens holder 2074 in the lamp front-rear direction is adjusted.

A positioning pin 2074Bb is formed on a lower surface of each flange portion 2074B of the lens holder 2074 so as to protrude vertically downward at a front-rear direction central position of the pair of front and rear screw insertion holes 2074Ba. Each positioning pin 2074Bb is formed in a cylindrical shape, and a tip end portion thereof is formed in a convex curved surface shape. A downward protrusion amount of each positioning pin 2074Bb from the flange portion 2074B is set to a value slightly larger than a plate thickness of the horizontal surface portion 2080B of the support bracket 2080.

Meanwhile, an elongated hole 2080Bc that penetrates the horizontal surface portion 2080B in the up-down direction is formed in the horizontal surface portion 2080B of the support bracket 2080 at a position corresponding to each positioning pin 2074Bb. Each elongated hole 2080Bc is formed as an elongated hole that extends in the lamp front-rear direction with a left-right width slightly larger than a diameter of the positioning pin 2074Bb.

When the lens holder 2074 is screwed to the support bracket 2080, the positioning pin 2074Bb is inserted into the elongated hole 2080Bc in advance, so that the lens holder 2074 is restricted from being displaced in the left-right direction with respect to the support bracket 2080, and a positional relationship between the lens holder 2074 and the support bracket 2080 can be finely adjusted in the lamp front-rear direction. As a result, the lens holder 2074 is prevented from being inadvertently rotated with respect to the support bracket 2080 due to torque generated at the time of the screwing, and accuracy of a positional relationship between the spatial light modulator 2032 and the projection lens 2072 is improved.

Next, an operation of the present embodiment will be described.

The vehicle lamp 2010 according to the present embodiment is configured to emit light from the light source 2022 toward the front side of the lamp via the spatial light modulator 2032 and the projection lens 2072. Various light distribution patterns can be formed with high accuracy by controlling spatial distribution of light reaching the projection lens 2072 in the spatial light modulator 2032.

The pressing tool 2060 which is configured to elastically press the spatial light modulator 2032 toward the rear side of the lamp in the state of being abutted against the peripheral edge portion 2032*b* of the spatial light modulator 2032 is arranged on the lamp front side of the spatial light modulator 2032. The heat sink 2050, which is configured to elastically press the spatial light modulator 2032 toward the front side of the lamp in the state of being abutted against the central portion of the spatial light modulator 2032 (that is, the portion where the reflected light control region 2032*a* is located), is arranged on the lamp rear side of the spatial light modulator 2032. Therefore, even when a vibration load or an impact load acts on the vehicle lamp 2010, it is possible to prevent an excessive load from acting on the spatial light modulator 2032. As a result, the damage to the spatial light modulator 2032 can be effectively reduced.

The control board 2036 which is electrically connected to the spatial light modulator 2032 in the state of being abutted against the peripheral edge portion 2032*b* of the spatial light modulator 2032 via the socket 2034 is arranged on the lamp rear side of the spatial light modulator 2032. The board bracket which is configured to support the control board 2036 in the state of being abutted against the control board 2036 is arranged on the lamp rear side of the control board 2036. The pressing tool 2060 is fixed to the board bracket 2040 from the lamp front side, and the heat sink 2050 is fixed from the lamp rear side. Therefore, even when a vibration load or an impact load acts on the vehicle lamp 2010, a positional relationship between the control board 2036 and the board bracket 2040 or the heat sink 2050 can be prevented from being misaligned. As a result, it is possible to prevent an excessive load from acting on a connection portion between the spatial light modulator 2032 and the control board 2036 (that is, a connection portion between the spatial light modulator 2032 and the socket 2034 and a connection portion between the socket 2034 and the control board 2036). As a result, damage to the connection portion between the spatial light modulator 2032 and the control board 2036 can be effectively reduced.

In this way, according to the present embodiment, it is possible to effectively prevent the spatial light modulator 2032 from being damaged and prevent the connection portion between the spatial light modulator 2032 and the control board 2036 from being damaged by the vibration load or the like in the vehicle lamp 2010 that includes the reflective spatial light modulator 2032.

In the present embodiment, the elastic pressing force of the pressing tool 2060 with respect to the spatial light modulator 2032 is set to the value larger than the elastic pressing force of the heat sink 2050 with respect to the spatial light modulator 2032. Therefore, the state where the peripheral edge portion 2032*b* of the spatial light modulator 2032 is always pressed against the control board 2036 can be maintained, so that the electric connection between the spatial light modulator 2032 and the control board 2036 can be more reliably maintained.

In the present embodiment, the pair of left and right first stepped bolts 2062 which are configured to fix the pressing tool 2060 to the board bracket 2040 are arranged around the spatial light modulator 2032. The tip end surface of the large diameter portion 2062*b* of each first stepped bolt 2062 is abutted against the control board 2036 in the state where the large diameter portion 2062*b* is inserted through the bolt insertion hole 2060Ba of the pressing tool 2060. The small diameter portion 2062*a* of each first stepped bolt 2062 is screwed into the screw hole 2040*a* formed in the board bracket 2040 in the state where the small diameter portion 2062*a* is inserted through the bolt insertion hole 2036*b* formed in the control board 2036. Moreover, the first spring 2064 which is configured to elastically press the pressing tool 2060 toward the rear side of the lamp is attached to the large diameter portion 2062*b* of each first stepped bolt 2062. Therefore, it is possible to easily press the spatial light modulator 2032 stably by the pressing tool 2060 with a predetermined elastic pressing force.

By employing such a configuration, the control board 2036 can also be supported by the board bracket 2040 at the same time when the pressing tool 2060 is fixed to the board bracket 2040, so that a configuration of the vehicle lamp 2010 can be simplified.

In the present embodiment, the two pairs of left and right second stepped bolts which are configured to fix the heat sink 2050 to the board bracket 2040 are arranged around the spatial light modulator 2032. The tip end surface of the large diameter portion 2052*b* of each second stepped bolt 2052 is abutted against the board bracket 2040 in the state where the large diameter portion 2052*b* is inserted through the bolt insertion hole 2050*a* formed in the heat sink 2050, and the small diameter portion 2052*a* of each second stepped bolt 2052 is screwed to the board bracket 2040 while the second spring 2054 which is configured to elastically press the heat sink 2050 toward the front side of the lamp is attached to the large diameter portion 2052*b*. Therefore, it is possible to easily press the spatial light modulator 2032 stably by the heat sink 2050 with a predetermined elastic pressing force.

Further, in the present embodiment, the protruding piece 2050*d* which protrudes toward the front side of the lamp is formed on each of the left and right end portions of the heat sink 2050. The guide groove portion 2040*d*, which engages with the upper and lower end surfaces of the protruding piece 2050*d* and extends in the lamp front-rear direction, is formed in each of the left and right end portions of the board bracket 2040. Therefore, the heat sink 2050 can be prevented from rotating in the up-down direction with respect to the board bracket 2040. As a result, the central portion of the spatial light modulator 2032 can be easily pressed by the heat sink 2050 with a uniform pressure distribution.

The elongated hole 2050*e* that extends in the lamp front-rear direction is formed in each protruding piece 2050*d*, and the screw hole 2040*e* is formed in each groove portion 2040*d*. The heat sink 2050 is fixed to the board bracket 2040 in the state of being positioned in the lamp front-rear direction with respect to the board bracket 2040 by fastening the screw 2042 to each screw hole 2040 via each elongated hole 2050*e*. Therefore, a positional relationship between the members can be fixed while maintaining a state where the spatial light modulator 2032 is pressed by the predetermined elastic pressing forces from two sides in the lamp front-rear direction. As a result, even when a vibration load or an impact load acts on the vehicle lamp 2010, it is possible to prevent a load that is equal to or greater than the elastic pressing force of the pressing tool 2060 and the elastic pressing force of the heat sink 2050 from acting on the spatial light modulator 2032 and the connection portion between the spatial light modulator 2032 and the control board 2036.

Although fastening torque is generated when the screw 2042 is fastened to each screw hole 2040*e* via each elongated hole 2050*e*, each protruding piece 2050*d* of the heat sink 2050 is engaged with the guide groove portion 2040*d* of the board bracket 2040. Therefore, the heat sink 2050 does not rotate with respect to the board bracket 2040 due to the fastening torque.

In the above fourth embodiment, the control board 2036 is electrically connected to the spatial light modulator 2032 in the state of being abutted against the peripheral edge portion 2032*b* of the spatial light modulator 2032 via the socket 2034. However, the control board 2036 may also be electrically connected to the spatial light modulator 2032 in a state where the control board 2036 is directly abutted against the peripheral edge portion 2032*b* of the spatial light modulator 2032.

In the above fourth embodiment, the light emitted from the light source 2022 reflected by the reflector 2024 is reflected by the spatial light modulator 2032. However, it is also possible to employ a configuration in which the light emitted from the light source 2022 whose deflection is controlled by a lens or the like is reflected by the spatial light modulator 2032 or a configuration in which the light emitted from the light source 2022 is directly reflected by the spatial light modulator 2032.

Next, a modification of the fourth embodiment will be described.

Figure 28:
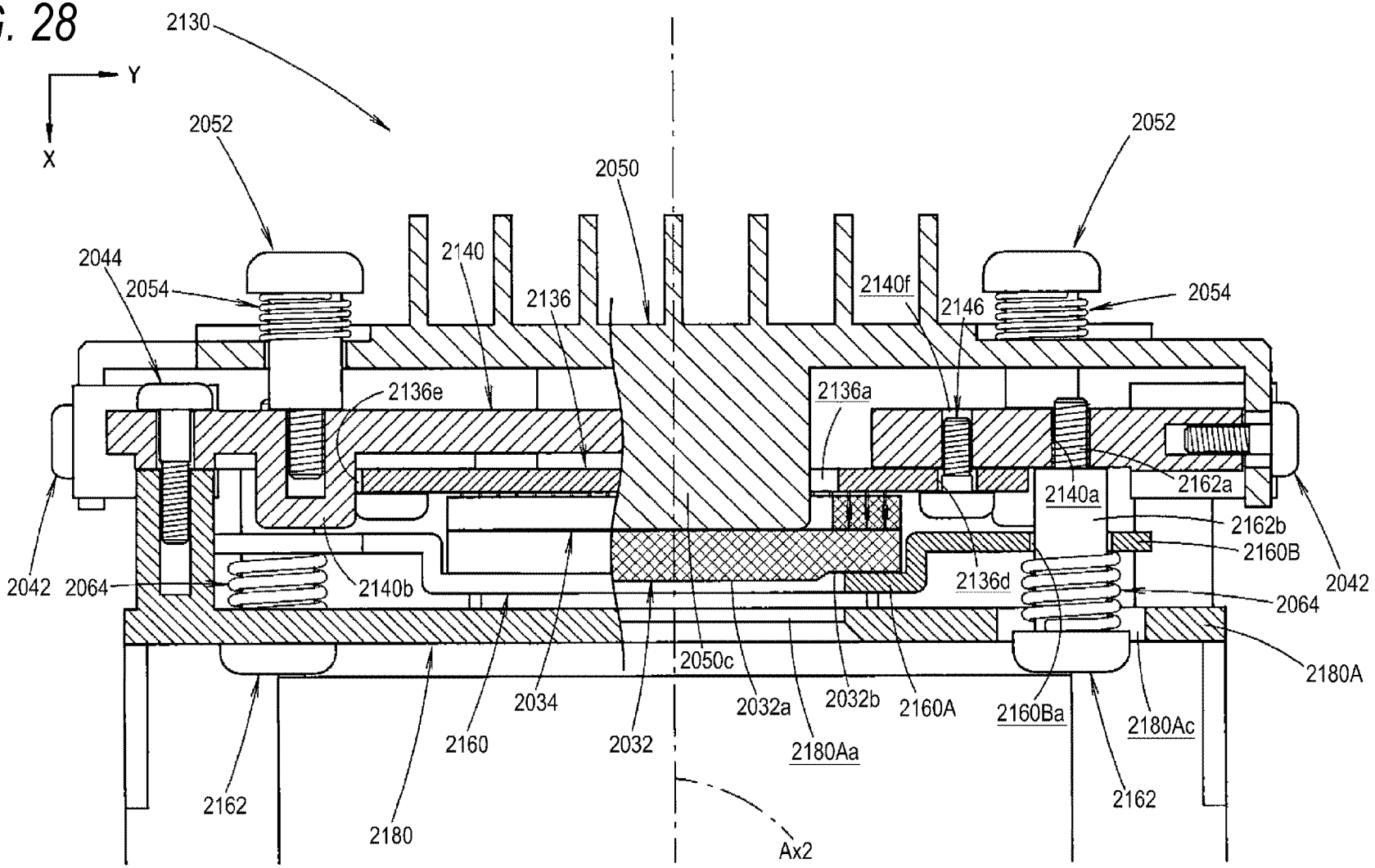
FIG. 28 shows a modification of the fourth embodiment, which is the same as FIG. 21.

FIG. 28 shows a main part of a vehicle lamp according to the present modification, which is the same as FIG. 21.

As shown in FIG. 28, a basic configuration of the present modification is the same as that of the fourth embodiment, except that a configuration of a spatial light modulator sub-assembly 2130 is partially different from that of the fourth embodiment.

That is, the spatial light modulator sub-assembly 2130 of the present modification is different from the case of the fourth embodiment in that a control board 2136 and a pressing tool 2160 are individually fixed to a board bracket 2140.

Specifically, the control board 2136 of the present modification has a left-right width that is smaller than that of the control board 2036 of the fourth embodiment. In the control board 2136, a pair of screw insertion holes 2136*d* are formed on left and right sides of an opening portion 2136*a* where the protruding portion 2050*c* of the heat sink 2050 is inserted.

Screw holes 2140*f* are formed in the board bracket 2140 of the present modification at positions corresponding to the pair of left and right screw insertion holes 2136*d*. A screw 146 is fastened to each screw hole 2140*f* of the board bracket 2140 from the lamp front side via each screw insertion hole 2136*d* of the control board 2136, so that the control board 2136 is fixed to the board bracket 2140.

A cutout portion 2136*e* which is configured to prevent interference with a boss portion 2140*b* of the board bracket 2140 is formed on a side end portion of the control board 2136.

The body portion 2160A of the pressing tool 2160 of the present modification has the same configuration as that of the pressing tool 2060 of the fourth embodiment, except that a configuration of a pair of left and right flange portions 2160B is partially different. That is, a rearward displacement amount of each flange portion 2160B from the body portion 2160A is smaller than that in the case of the fourth embodiment. Meanwhile, each flange portion 2160B extends laterally from the body portion 2160A, and a bolt insertion hole 2160Ba thereof is formed at a position which is farther from the optical axis Ax2 than a side end surface of the control board 2136.

The pair of left and right flange portions 2160B of the pressing tool 2160 are fixed to the board bracket 2140 by a pair of left and right first stepped bolts 2162 in a state where the body portion 2160A is abutted against the peripheral edge portion 2032*b* of the spatial light modulator 2032 from the lamp front side.

Each first stepped bolt 2162 is formed such that a large diameter portion 2162*b* thereof is longer than the large diameter portion 2062*b* of each first stepped bolt 2062 of the fourth embodiment by a plate thickness of the control board 2136. A small diameter portion 2162*a* of each first stepped bolt 2162 is shorter than the small diameter portion 2062*a* of each first stepped bolt 2062 of the fourth embodiment. Other configurations are the same as those in the fourth embodiment.

A tip end surface of the large diameter portion 2162*b* of each first stepped bolt 2162 is abutted against the board bracket 2140 in a state where the large diameter portion 2162*b* is inserted through the bolt insertion hole 2160Ba of the pressing tool 2160. The small diameter portion 2162*a* of each first stepped bolt 2162 is screwed to a screw hole 2140*a* formed in the board bracket 2140.

In the present modification, the first spring 2064 is also attached to the large diameter portion 2162*b* of each first stepped bolt 2162, and thus the pressing tool 2160 elastically presses the spatial light modulator 2032 toward the rear side of the lamp.

A support bracket 2180 of the present modification has the same configuration as that of the support bracket 2080 of the fourth embodiment, except that a pair of left and right opening portions 2180Ac which are formed in a vertical surface portion 2180A are formed at positions spaced apart from the optical axis Ax2 which correspond to positions of the pair of left and right first stepped bolts 2162.

In this way, in a case where the configuration of the present modification is employed, it is possible to effectively prevent the spatial light modulator 2032 from being damaged and prevent a connection portion between the spatial light modulator 2032 and the control board 2136 from being damaged by the vibration load or the like in a vehicle lamp that includes the reflective spatial light modulator 2032.

In the case where the configuration of the present modification is employed, the control board 2136 and the pressing tool 2160 can be sequentially assembled to the board bracket 2140.

Fifth Embodiment

Next, a fifth embodiment of the present disclosure will be described.

Figure 29:
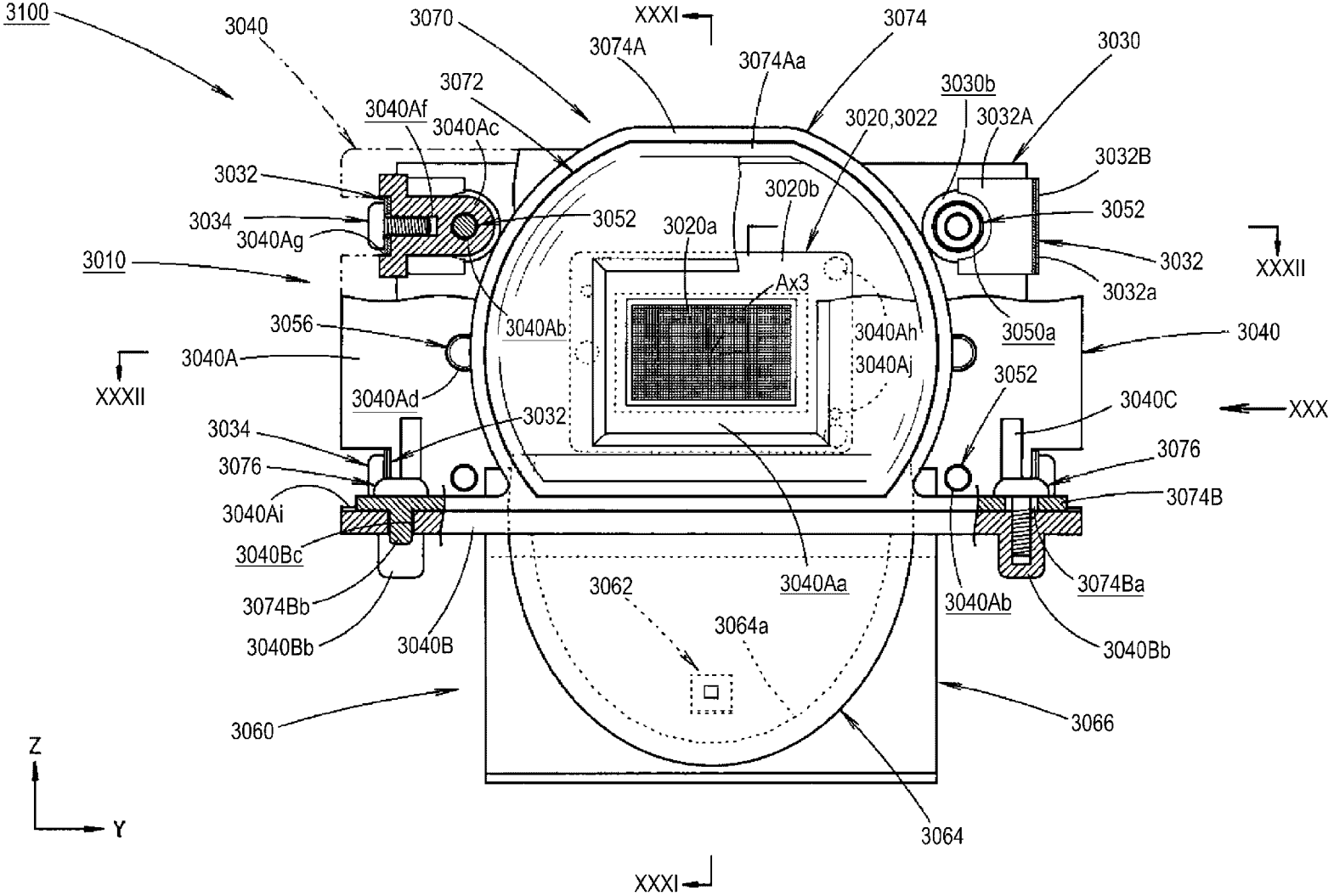
FIG. 29 is a front view showing a vehicle lamp in which a spatial light modulation unit according to a fifth embodiment of the present disclosure is incorporated.
Figure 30:
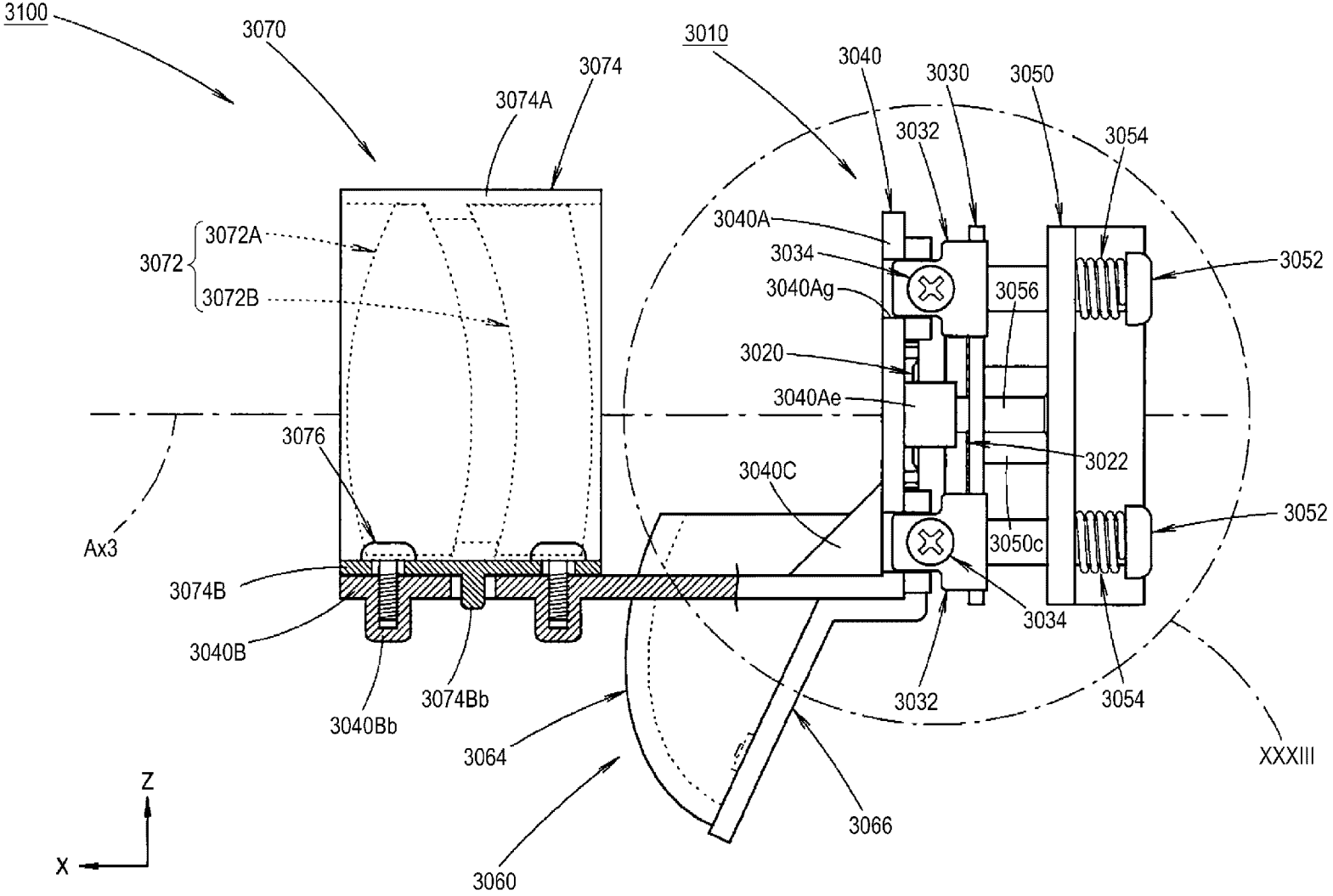
FIG. 30 is taken along arrow XXX of FIG. 29.
Figure 31:
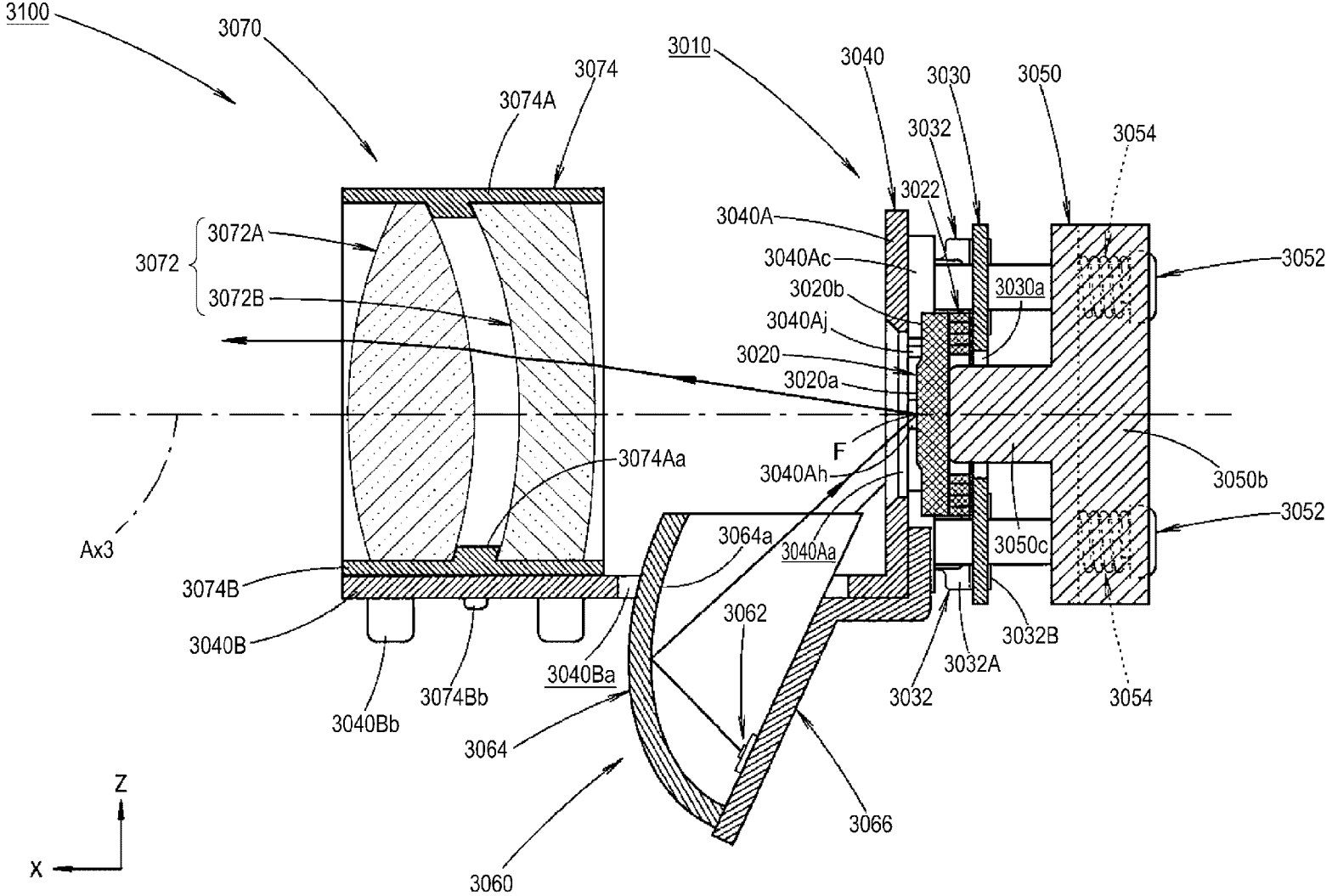
FIG. 31 is a cross-sectional view taken along line XXXI-XXXI of FIG. 29.
Figure 32:
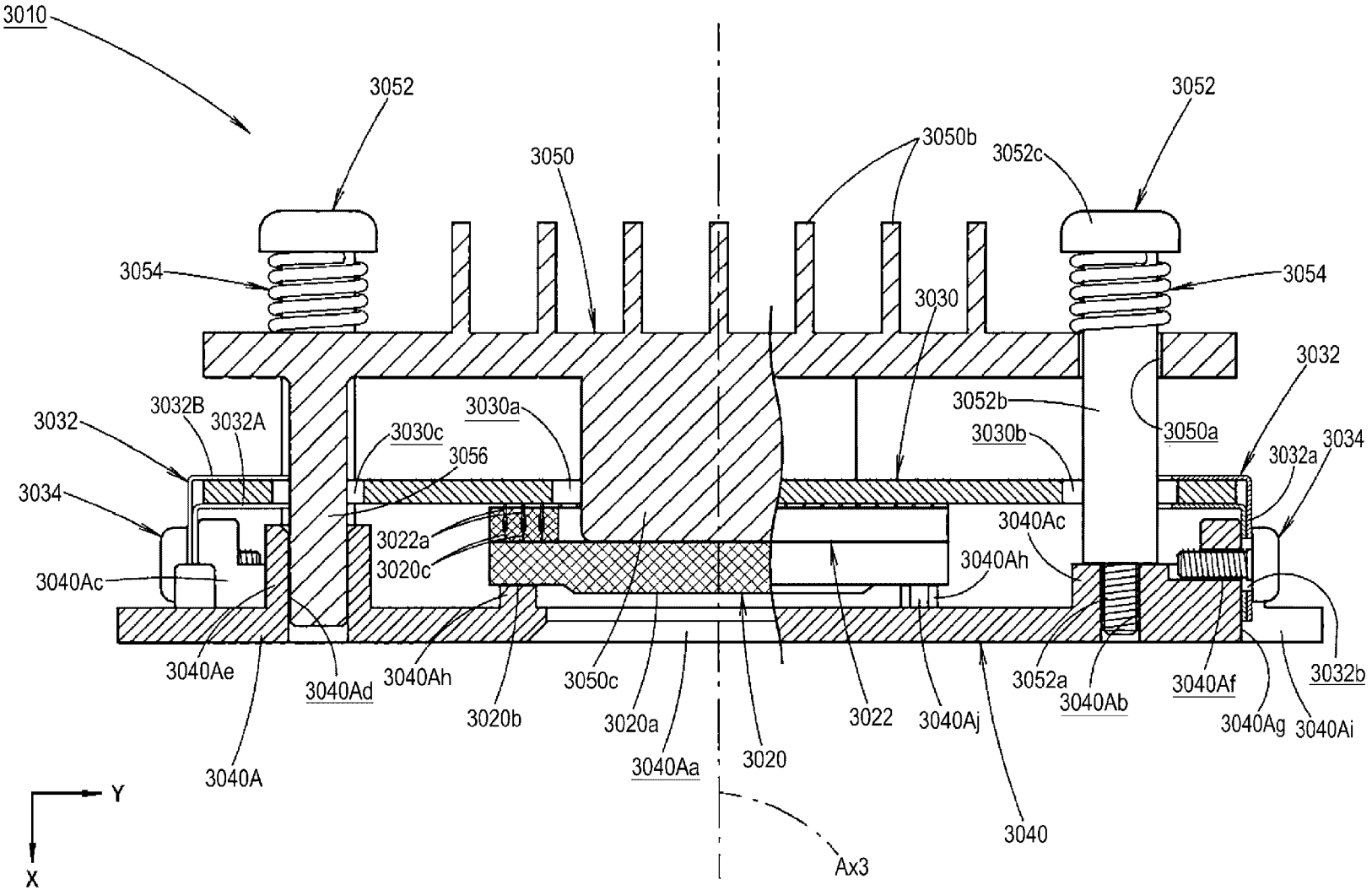
FIG. 32 is a cross-sectional view taken along line XXXII-XXXII of FIG. 29.

FIG. 29 is a front view showing a vehicle lamp 3100 in which a spatial light modulation unit 3010 according to the present embodiment is incorporated. FIG. 30 is taken along arrow XXX of FIG. 29. FIG. 31 is a cross-sectional view taken along line XXXI-XXXI of FIG. 29. FIG. 32 is a cross-sectional view taken along line XXXII-XXXII of FIG. 29. In these drawings, a part of constituent elements are shown in an appropriately broken state.

In these drawings, the direction indicated by X is the "front side" of the spatial light modulation unit 3010 and the vehicle lamp 3100 (also of the vehicle), the direction indicated by Y is the "left direction" that is orthogonal to the "front side" (also the "left direction" of the vehicle, and the "right direction" in the front view of the lamp), and the direction indicated by Z is the "up direction". The same also applies to the other drawings.

As shown in these drawings, the vehicle lamp 3100 according to the present embodiment is a headlamp provided at a front end portion of a vehicle, and is configured as a projector-type lamp unit incorporated in a lamp chamber formed by a lamp body and a translucent cover (not shown).

The vehicle lamp 3100 includes: the spatial light modulation unit 3010, a light source side sub-assembly 3060; and a lens side sub-assembly 3070. A bracket 3040 of the vehicle lamp 3100, which is a constituent element of the spatial light modulation unit 3010, is supported by the above lamp body via an attachment structure (not shown).

As shown in FIG. 31, the light source side sub-assembly 3060 includes: a light source 3062; a reflector 3064 configured to reflect light emitted from the light source 3062 toward the spatial light modulation unit 3010; and a base member 3066 configured to support the light source 3062 and the reflector 3064.

The spatial light modulation unit 3010 includes: a spatial light modulator 3020; a support board 3030 arranged on the lamp rear side (that is, a unit rear side) of the spatial light modulator 3020; the bracket 3040 arranged on the lamp front side of the support board 3030; and a heat sink 3050 arranged on the lamp rear side of the spatial light modulator 3020.

The lens side sub-assembly 3070 includes: a projection lens 3072 which has an optical axis Ax3 extending in the vehicle front-rear direction; and a lens holder 3074 configured to support the projection lens 3072.

The vehicle lamp 3100 according to the present embodiment is configured such that various light distribution patterns can be formed with high accuracy by emitting light from the light source 3062 reflected by the reflector 3064 toward the front side of the lamp via the spatial light modulator 3020 and the projection lens 3072. The light distribution patterns are, for example, low-beam light distribution patterns or high-beam light distribution patterns, light distribution patterns that change according to vehicle traveling situations, or light distribution patterns that draw characters or symbols on a road surface in front of the vehicle.

In order to realize such light distribution patterns, during an assembly process of the vehicle lamp 3100, a positional relationship between the spatial light modulator 3020 and the projection lens 3072 is finely adjusted in a state where the light source 3062 is lit to form the light distribution patterns, and accuracy of the positional relationship is improved.

Next, a specific configuration of each of the spatial light modulation unit 3010, the light source side sub-assembly 3060, and the lens side sub-assembly 3070 will be described.

First, the configuration of the light source side sub-assembly 3060 will be described before describing the configuration of the spatial light modulation unit 3010.

The light source 3062 is a white light emitting diode, and is fixedly supported by the base member 3066 in a state where a light emitting surface thereof faces obliquely upward and forward. The base member 3066 is fixedly supported by the bracket 3040 of the spatial light modulation unit 3010.

The reflector 3064 covers the light source 3062 from the lamp front side, and a peripheral edge portion thereof is fixedly supported by the base member 3066. The reflector 3064 reflects the light emitted from the light source 3062 obliquely upward and rearward. A reflecting surface 3064*a* of the reflector 3064 converges the light emitted from the light source 3062 to the vicinity of a rear focal plane which includes the rear focus F of the projection lens 3072.

Next, the configuration of the spatial light modulation unit 3010 will be described.

The spatial light modulator 3020 is a reflective spatial light modulator, and includes a digital micromirror device (DMD) in which a plurality of (for example, several hundreds of thousands) micromirrors are arranged in a matrix as a reflected light control region 3020*a*.

The spatial light modulator 3020 is configured to selectively switch a reflection direction of the light from the light source 3062 that has reached the reflected light control region 3020*a* by controlling an angle of a reflecting surface of each of the plurality of micromirrors that constitute the reflected light control region 3020*a*. Specifically, a mode in which the light from the light source 3062 is reflected toward the projection lens 3072 and a mode in which the light is reflected toward another direction (that is, a direction that does not adversely affect formation of the light distribution patterns) are selected.

The spatial light modulator 3020 is arranged in a state where a front surface of the reflected light control region 3020*a* extends along a vertical plane that is orthogonal to the optical axis Ax3 at the position of the rear focus F of the projection lens 3072, and the reflected light control region 3020*a* has a laterally elongated rectangular outer shape centered on the optical axis Ax3.

A peripheral edge portion 3020*b* of the spatial light modulator 3020 that surrounds the reflected light control region 3020*a* is formed in a state where a front surface thereof is stepped down toward the lamp rear side with respect to the front surface of the reflected light control region 3020*a* while a rear surface thereof is supported by the support board 3030 via a socket 3022.

The socket 3022 is configured as a laterally elongated rectangular frame member along the peripheral edge portion 3020*b* of the spatial light modulator 3020, and is fixed to the support board 3030 in a state of being electrically connected to a conductive pattern (not shown) formed on the support board 3030. An opening portion 3030*a* that has substantially the same shape as an inner peripheral edge shape of the socket 3022 is formed in the support board 3030.

As shown in FIG. 32, the peripheral edge portion 3020*b* of the spatial light modulator 3020 is formed with a plurality of terminal pins 3020*c* that protrudes from the rear surface thereof toward the rear side of the lamp. Meanwhile, the socket 3022 is formed with a plurality of terminal pins 3022*a* that protrudes from a rear surface thereof toward the rear side of the lamp at positions corresponding to the plurality of terminal pins 3020*c*.

A base end portion (that is, a tip end portion embedded in the socket 3022) of each terminal pin 3022*a* of the socket 3022 has a substantially cylindrical shape, and a tip end portion of each terminal pin 3020*c* of the spatial light modulator 3020 is fitted into the base end portion, so that the spatial light modulator 3020 and the socket 3022 are electrically connected to each other.

A tip end portion (that is, a rear end portion) of each terminal pin 3022*a* of the socket 3022 is soldered to the conductive pattern of the control board 3030. Therefore, the socket 3022 is arranged in a state where the rear surface thereof slightly floats from a front surface of the support board 3030.

The spatial light modulator 3020 of the spatial light modulation unit 3010 is supported by the bracket 3040 and the heat sink 3050 from two sides in the lamp front-rear direction.

The bracket 3040 is a member that is made of metal (for example, aluminum die casting), and includes: a vertical surface portion 3040A that extends along the vertical plane orthogonal to the optical axis Ax3; and a horizontal surface portion 3040B that extends along the horizontal plane from a lower end edge of the vertical surface portion 3040A toward the front side of the lamp. Reinforcing flange portions 3040C which are configured to reinforce a connection portion between the vertical surface portion 3040A and the horizontal surface portion 3040B are formed on left and right end portions of the bracket 3040.

As shown in FIG. 29, an opening portion 3040Aa that has a laterally elongated rectangular shape is formed in the vertical surface portion 3040A with the optical axis Ax3 serving as a center. The opening portion 3040Aa has a laterally elongated rectangular opening shape that is smaller than an outer peripheral edge shape of the spatial light modulator 3020 and larger than the reflected light control region 3020*a*, and a front end edge of an inner peripheral surface thereof is chamfered over an entire circumference.

Cylindrical protruding portions 3040Ah are formed on a rear surface of the vertical surface portion 3040A so as to protrude toward the rear side of the lamp at three locations around the opening portion 3040Aa. Tip end surfaces (that is, rear end surfaces) of the protruding portions 3040Ah at the three locations of the bracket 3040 are abutted against the peripheral edge portion 3020*b* of the spatial light modulator 3020 from the lamp front side.

As shown in FIG. 30, the horizontal surface portion 3040B extends to the lamp front side of the reflector 3064, and a laterally elongated rectangular opening portion 3040Ba where the reflector 3064 is inserted is formed in the horizontal surface portion 3040B.

The heat sink 3050 is a member that is made of metal (for example, aluminum die casting), and extends along the vertical plane that is orthogonal to the optical axis Ax3. A plurality of heat dissipating fins 3050*b* are formed in a vertical stripe pattern on a rear surface thereof.

A prismatic protruding portion 3050*c* that protrudes toward the front side of the lamp is formed at a central portion of a front surface of the heat sink 3050. The protruding portion 3050*c* has a laterally elongated rectangular cross-sectional shape centered on the optical axis Ax3, and a size thereof is set to a value smaller than an inner peripheral surface shape of the socket 3022. A front end surface of the protruding portion 3050*c* is abutted against a central portion of the spatial light modulator 3020 (that is, a portion where the reflected light control region 3020*a* is located) from the lamp rear side in a state of being inserted into the opening portion 3030*a* of the support board 3030.

The heat sink 3050 is fixed to the vertical surface portion 3040A of the bracket 3040 by two pairs of left and right stepped bolts 3052 in a state where a front end surface of the protruding portion 3050*c* is abutted against the central portion of the spatial light modulator 3020 (that is, the portion where the reflected light control region 3020*a* is located) from the lamp rear side. The fixing is performed in a state where the spatial light modulator 3020 is elastically pressed toward the front side of the lamp by the protruding portion 3050*c*.

A specific configuration for performing such pressing is as follows.

That is, the two pairs of left and right stepped bolts 3052 are arranged at two upper and lower locations on left and right sides of the spatial light modulator 3020.

As shown in FIG. 32, small diameter portions 3052*a* located at tip ends of the stepped bolts 3052 are screwed to the vertical surface portion 3040A of the bracket 3040 in a state where large diameter portions 3052*b* of the stepped bolts 3052 are inserted into a bolt insertion hole 3050*a* formed in the heat sink 3050 and a bolt insertion hole 3030*b* formed in the support board 3030 from the lamp rear side. In order to realize such a configuration, the vertical surface portion 3040A of the bracket 3040 is provided with screw holes 3040Ab where the small diameter portions 3052*a* of the stepped bolts 3052 are screwed at four locations corresponding to the four stepped bolts 3052. The vertical surface portion 3040A of the bracket 3040 is formed as a thick portion 3040Ac in which a peripheral portion of each screw hole 3040Ab is thickened toward the lamp rear side.

A spring 3054 configured to elastically press the protruding portion 3050*c* of the heat sink 3050 toward the lamp front side is attached to the large diameter portion 3052*b* of each stepped bolt 3052. Each spring 3054 includes a compression coil spring arranged between a head portion 3052*c* of each stepped bolt 3052 and the heat sink 3050.

In this way, by elastically pressing the heat sink 3050 toward the lamp front side at the two upper and lower locations on the left and right sides of the spatial light modulator 3020, the central portion of the spatial light modulator 3020 is elastically pressed toward the lamp front side in a state where no excessive load is applied to the spatial light modulator 3020. As a result, a state where the plurality of terminal pins 3020*c* formed on the peripheral edge portion 3020*b* of the spatial light modulator 3020 are properly fitted into the plurality of fitting holes (that is, the base end portions of the terminal pins 3022*a* which are formed in the substantially cylindrical shape) formed in the socket 3022 (that is, a state where the electric connection between the spatial light modulator 3020 and the socket 3022 is reliably performed) is maintained.

A pair of left and right shafts 3056 which extend in the lamp front-rear direction are arranged around the spatial light modulator 3020 in a state where rear end portions thereof are fixed to the heat sink 3050. Specifically, each shaft 3056 is formed integrally with the heat sink 3050, and extends in a cylindrical shape toward the front side of the lamp on left and right sides of the protruding portion 3050*c* of the heat sink 3050.

A pair of left and right shaft insertion holes 3030*c* where the pair of left and right shafts 3056 are inserted are formed in the support board 3030. Each shaft insertion hole 3030*c* is formed as a cylindrical opening portion that has a diameter larger than that of each shaft 3056.

A pair of left and right shaft positioning holes 3040Ad are formed in the vertical surface portion 3040A of the bracket 3040 so as to position tip end portions of the pair of left and right shafts 3056 in the direction orthogonal to lamp front-rear direction in a state where the tip end portions are inserted. Each shaft positioning hole 3040Ad has a diameter that is slightly larger than that of each shaft 3056.

Each shaft positioning hole 3040Ad is formed by a sleeve 3040Ae formed on the rear surface of the vertical surface portion 3040A so as to extends toward the rear side of the lamp with a length longer than a plate thickness of the vertical surface portion 3040A. As a result, each shaft positioning hole 3040Ad is slidably engaged with each shaft 3056 over a certain length. As a result, the vertical surface portion 3040A of the bracket 3040 is prevented from being inclined with respect to the vertical surface orthogonal to the optical axis Ax3.

Figure 33:
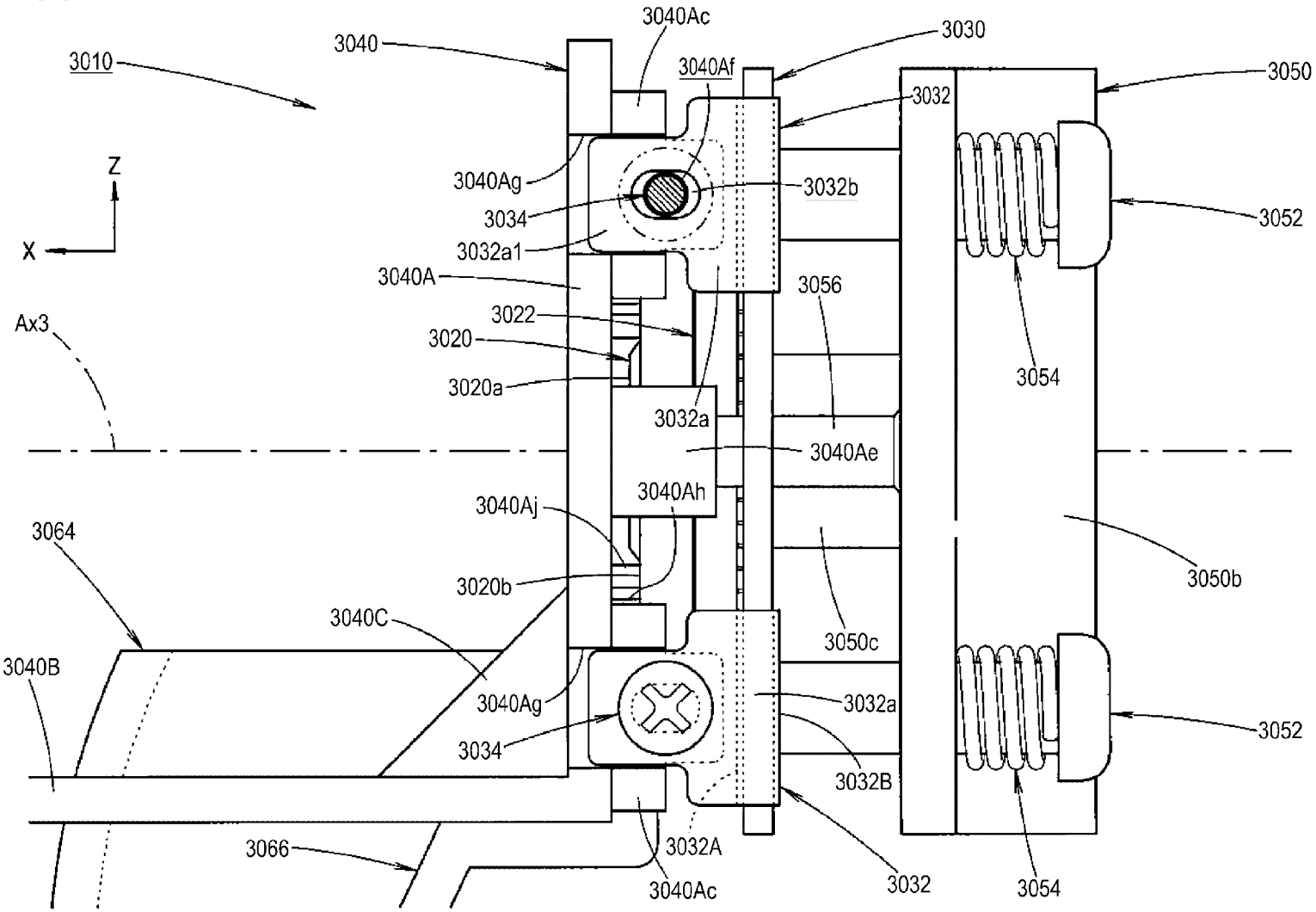
FIG. 33 is a detailed view of portion XXXIII of FIG. 30.
Figure 34:
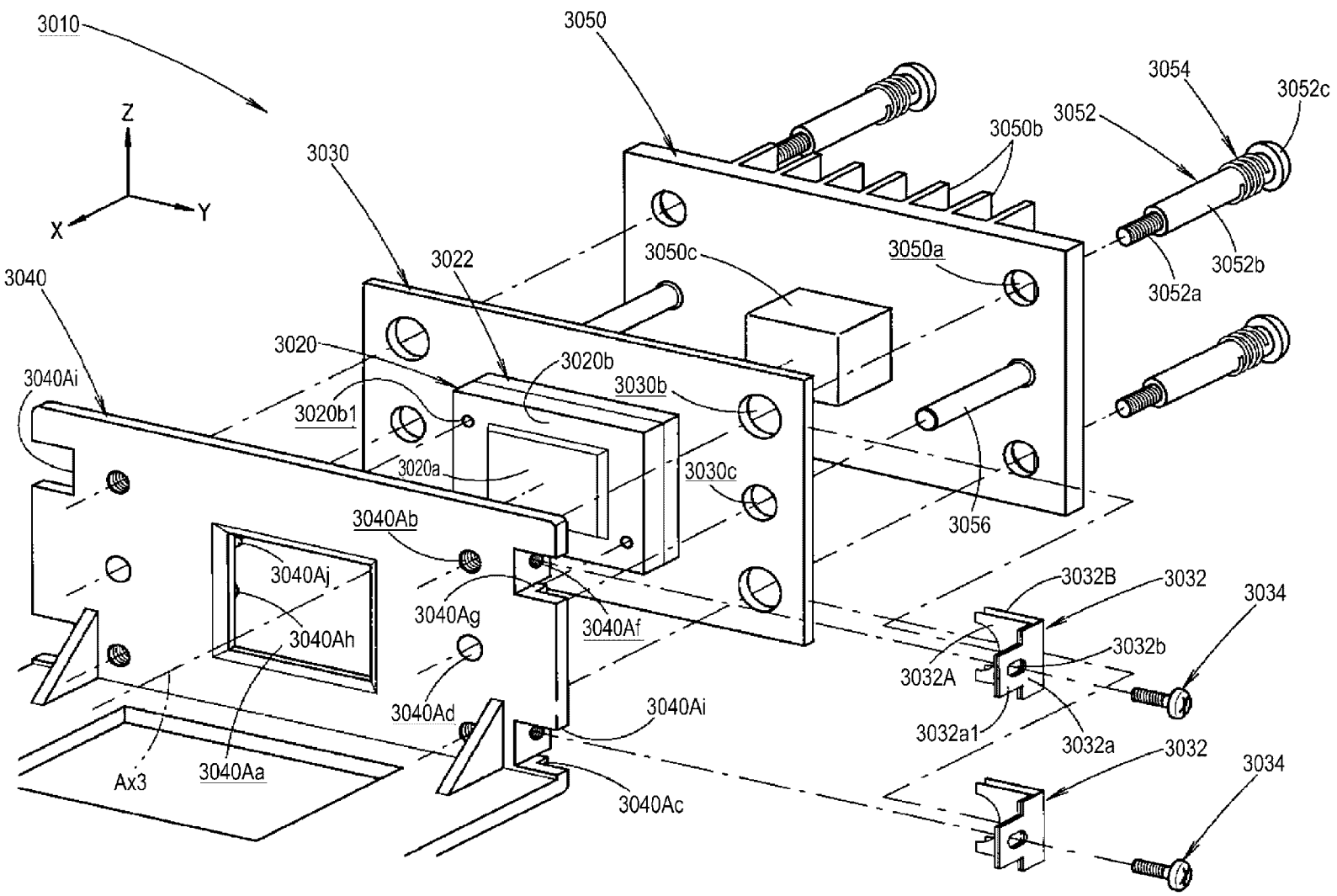
FIG. 34 is a perspective view showing the spatial light modulation unit in a state where constituent elements thereof are exploded.
Figure 35:
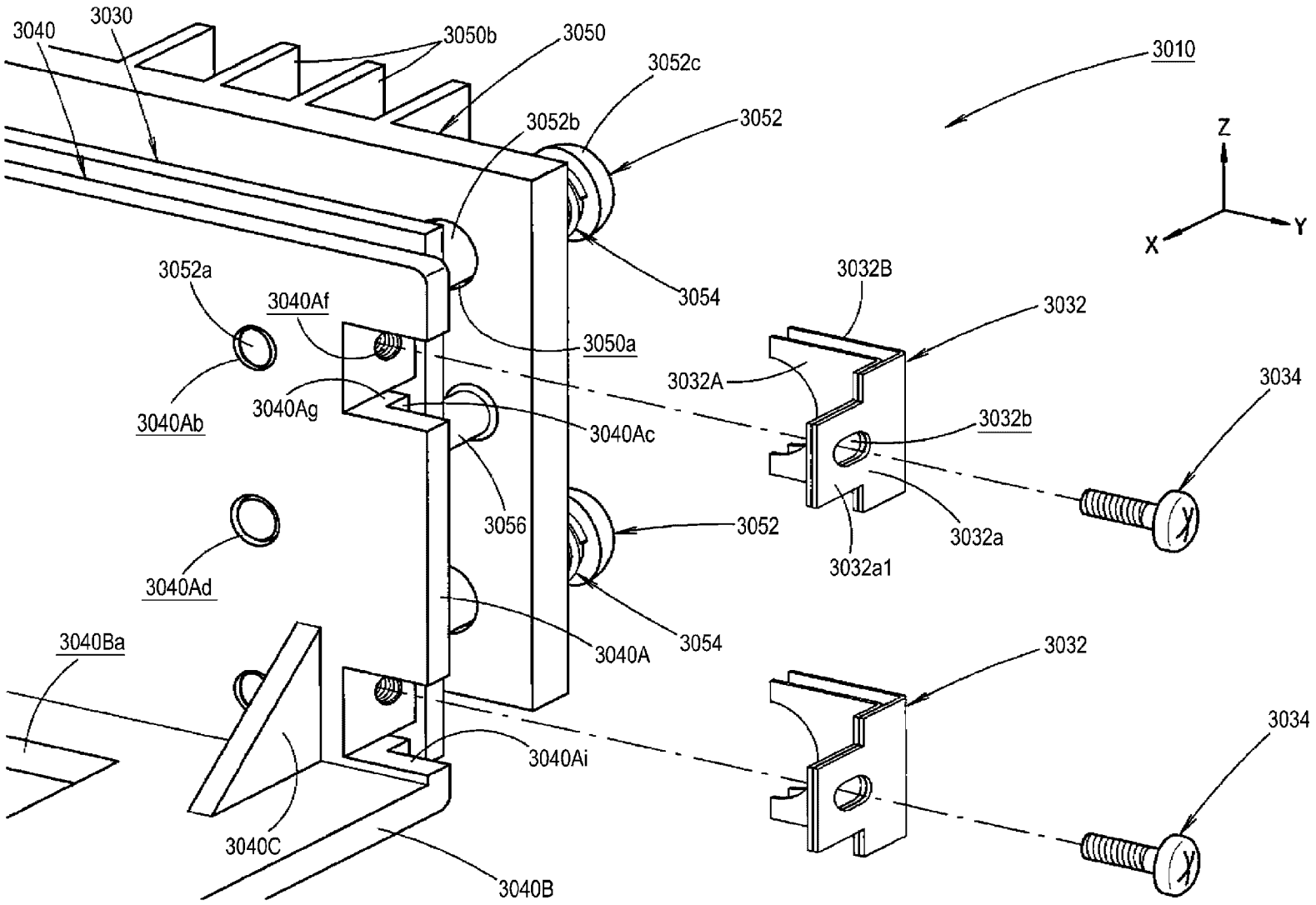
FIG. 35 is a perspective view showing a main part of the spatial light modulation unit.

FIG. 33 is a detailed view of portion XXXIII of FIG. 30. FIG. 34 is a perspective view showing the spatial light modulation unit 3010 in a state where constituent elements thereof are exploded. FIG. 35 is a perspective view showing a main part of the spatial light modulation unit 3010.

As shown in these drawings, the vertical surface portion 3040A of the bracket 3040 has a left-right width that is larger than that of the support board 3030, and rectangular cutout portions 3040Ai are formed at two upper and lower locations on left and right end surfaces thereof.

Clamping members 3032 which are configured to clamp the support board 3030 from two sides in the unit front-rear direction are mounted at two upper and lower locations on left and right end surfaces of the support board 3030. Each clamping member 3032 is fixed to the vertical surface portion 3040A of the bracket 3040 at a position of each cutout portion 3040Ai.

Each clamping member 3032 is formed by welding two metal plates 3032A, 3032B which are formed in an L-shape in a plan view to each other in a state where the two metal plates 3032A, 3032B are spaced apart from each other in the lamp front-rear direction (that is, the unit front-rear direction). An overlapping portion 3032*a* where the two metal plates 3032A, 3032B are overlapped is fixed to the vertical surface portion 3040A of the bracket 3040.

Specifically, screw holes 3040Af that extend in the horizontal direction orthogonal to the lamp front-rear direction are formed at two upper and lower locations on the left and right end surfaces of the vertical surface portion 3040A of the bracket 3040. Meanwhile, an elongated hole 3032*b* that extends in the lamp front-rear direction is formed in the overlapping portion 3032*a* of each clamping member 3032. Each clamping member 3032 is fixed to the bracket 3040 by fastening a screw 3034 to each screw hole 3040Af through each elongated hole 3032*b*. A front half portion 3032*a*1 of the overlapping portion 3032*a* of each clamping member 3032 is formed with an up-down width that is smaller than that of other portions.

The welding of the two metal plates 3032A, 3032B is performed by spot welding at a plurality of locations around the elongated hole 3032*b* of the overlapping portion 3032*a* (for example, three locations on the lamp front side, lamp diagonally upper side and lamp diagonally lower side of the elongated hole 3032*b*).

A tip end surface of each of the metal plates 3032A, 3032B (that is, end faces near the optical axis Ax3) are notched in an arc shape so as to prevent interference with the large diameter portion 3052*b* of the stepped bolt 3052.

Guide groove portions 3040Ag that extend in the lamp front-rear direction are formed at two upper and lower locations on the left and right end surfaces of the vertical surface portion 3040A of the bracket 3040 in a state of being engaged with the front half portion 3032*a*1 of the overlapping portion 3032*a* of each clamping member 3032.

As shown in FIG. 34, cylindrical positioning holes 3020*b*1 are formed in a front surface of the peripheral edge portion 3020*b* of the spatial light modulator 3020 at two locations on a diagonal with respect to the optical axis Ax3. Meanwhile, cylindrical positioning pins 3040Aj which extend toward the rear side of the lamp are formed on the vertical surface portion 3040A of the bracket 3040 at positions corresponding to the positioning holes 3020*b*1 of the spatial light modulator 3020.

By inserting each positioning pin 3040Aj of the bracket 3040 into each positioning hole 3020*b*1 of the spatial light modulator 3020, positioning is performed in the direction orthogonal to the optical axis Ax3 when the spatial light modulation unit 3010 is assembled to the bracket 3040. Moreover, after the assembly, the spatial light modulator 3020 is prevented from being inadvertently displaced in the vertical plane orthogonal to the optical axis Ax3.

Next, the configuration of the lens side sub-assembly 3070 will be described.

As shown in FIG. 31, the projection lens 3072 includes first and second lenses 3072A, 3072B that are arranged at a predetermined interval in the lamp front-rear direction on the optical axis Ax3.

The first lens 3072A that is located on the lamp front side is configured as a biconvex lens, and the second lens 3072B that is located on the lamp rear side is configured as a concave meniscus lens that bulges toward the rear side of the lamp. Upper end portions of the first and second lenses 3072A, 3072B are cut slightly along the horizontal plane, and lower end portions thereof are cut relatively large along the horizontal plane.

Outer peripheral edge portions of the first and second lenses 3062A, 3062B are supported by the common lens holder 3074.

The lens holder 3074 is a member that is made of metal (for example, aluminum die casting), and includes: a holder body 3074A that surrounds the projection lens 3072 in a cylindrical shape; and a pair of flange portions 3074B that protrude on left and right sides along the horizontal plane at a lower end portion of an outer peripheral surface of the holder body 3074A.

A protruding portion 3074Aa that is configured to position the first and second lenses 3072A, 3072B is formed on an inner peripheral surface of the holder body 3074A. Meanwhile, the pair of left and right flange portions 3074B are formed in flat plate shapes that extend in the lamp front-rear direction over an entire length of the lens holder 3074 with a constant left-right width.

Figure 36:
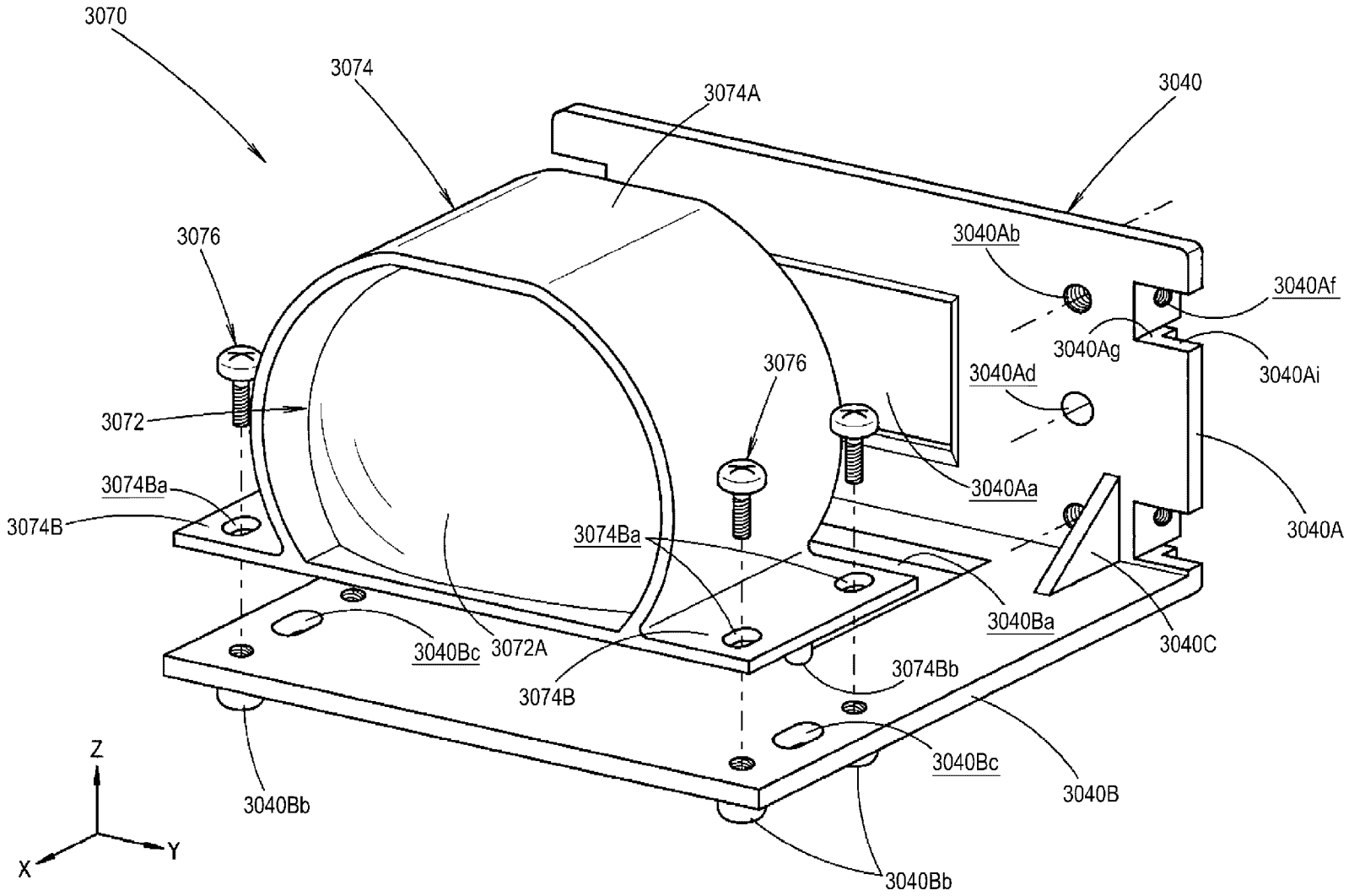
FIG. 36 is a perspective view showing a lens side sub-assembly of the vehicle lamp together with a bracket of the spatial light modulation unit in an exploded state.

FIG. 36 is a perspective view showing the lens side sub-assembly 3070 together with the bracket 3040 in an exploded state.

Still as shown in FIG. 36, the pair of left and right flange portions 3074B of the lens holder 3074 are fixed to the horizontal surface portion 3040B of the bracket 3040 by mechanical fastening. The fixing of the mechanical fastening is performed by screwing.

In order to realize such a configuration, each flange portion 3074B of the lens holder 3074 is formed with a pair of front and rear screw insertion holes 3074Ba that penetrate the flange portion 3074B in the up-down direction. Moreover, a pair of front and rear boss portions 3040Bb which include screw holes are formed on the horizontal surface portion 3040B of the bracket 3040 so as to protrude downward. A screw 3076 is screwed into the screw hole of each boss portion 3040Bb from an upper side of each flange portion 3074B via each screw insertion hole 3074Ba.

Each screw insertion hole 3074Ba is formed as an elongated hole extending in the lamp front-rear direction with a left-right width that is larger than a screw diameter of each screw 3076. As a result, the lens holder 3074 can be screwed to the bracket 3040 in a state where a position of the lens holder 3074 in the lamp front-rear direction is adjusted.

A positioning pin 3074Bb is formed on a lower surface of each flange portion 3074B of the lens holder 3074 so as to protrude vertically downward at a front-rear direction central position of the pair of front and rear screw insertion holes 3074Ba. Each positioning pin 3074Bb is formed in a cylindrical shape, and a tip end portion thereof is formed in a convex curved surface shape. A downward protrusion amount of each positioning pin 3074Bb from the flange portion 3074B is set to a value slightly larger than a plate thickness of the horizontal surface portion 3040B of the bracket 3040.

Meanwhile, an elongated hole 3040Bc that penetrates the horizontal surface portion 3040B in the up-down direction is formed in the horizontal surface portion 3040B of the bracket 3040 at a position corresponding to each positioning pin 3074Bb. Each elongated hole 3040Bc is formed as an elongated hole that extends in the lamp front-rear direction with a left-right width slightly larger than a diameter of the positioning pin 3074Bb.

When the lens holder 3074 is screwed to the bracket 3040, the positioning pin 3074Bb is inserted into the elongated hole 3040Bc in advance, so that the lens holder 3074 is restricted from being displaced in the left-right direction with respect to the bracket 3040, and a positional relationship between the lens holder 3074 and the bracket 3040 can be finely adjusted in the lamp front-rear direction. As a result, the lens holder 3074 is prevented from being inadvertently rotated with respect to the bracket 3040 due to torque generated at the time of the screwing, and accuracy of a positional relationship between the spatial light modulator 3020 and the projection lens 3072 is improved.

Next, an operation of the present embodiment will be described.

The spatial light modulation unit 3010 according to the present embodiment is incorporated in the vehicle lamp 3100. The spatial light modulation unit 3010 includes the reflective spatial light modulator 3020 which is configured to reflect the light from the light source 3062. Various light distribution patterns can be formed with high accuracy by controlling spatial distribution of the reflected light in the spatial light modulator 3020.

The spatial light modulator 3020 is electrically connected to the support board 3030 which is configured to support the peripheral edge portion 3020*b* of the spatial light modulator 3020 from the unit rear side (that is, the lamp rear side) via the socket 3022. The bracket 3040 which is abutted against the peripheral edge portion 3020*b* of the spatial light modulator 3020 from the unit front side is arranged on the unit front side of the spatial light modulator 3020. Therefore, electric connection between the spatial light modulator 3020 and the support board 3030 can be stably maintained.

The clamping members 3032 which are configured to clamp the support board 3030 from the two sides in the unit front-rear direction are mounted at the plurality of locations of the support board 3030, and each clamping member 3032 is fixed to the bracket 3040. Therefore, the support board 3030 and the bracket 3040 can be maintained in a fixed positional relationship with respect to the unit front-rear direction.

Therefore, even when a vibration load or an impact load acts on the spatial light modulation unit 3010, the positional relationship between the support board 3030 and the bracket 3040 can be prevented from being misaligned in the unit front-rear direction.

As a result, even though the spatial light modulation unit 3010 is placed on a vehicle, it is possible to effectively prevent an excessive load from acting on a connection portion between the spatial light modulator 3020 and the support board 3030 and damaging the connection portion.

In this way, according to the present embodiment, it is possible to effectively prevent the connection portion between the spatial light modulator 3020 and the support board 3030 from being damaged by the vibration load or the like in the in-vehicle spatial light modulation unit 3010 that includes the reflective spatial light modulator 3020.

In the present embodiment, the screw holes 3040Af that extend in the direction orthogonal to the unit front-rear direction are formed at the plurality of locations of the bracket 3040. The elongated hole 3032*b* that extends in the unit front-rear direction is formed in each clamping member 3032. Each clamping member 3032 is fixed to the bracket 3040 by fastening the screw 3034 to each screw hole 3040Af through each elongated hole 3032*b*. Therefore, the support board 3030 can be fixedly supported by the bracket 3040 in a state where the support board 3030 is arranged at an optimum position in the unit front-rear direction. As a result, the damage to the connection portion between the spatial light modulator 3020 and the support board 3030 caused by the vibration load or the like can be more effectively reduced.

The guide groove portion 3040Ag that extends in the unit front-rear direction is formed at each of the plurality of locations of the bracket 3040 so as to be engaged with each clamping member 3032. Therefore, the clamping member 3032 can be prevented from being inadvertently rotated when each clamping member 3032 is mounted to the support board 3030 by the screwing. As a result, each clamping member 3032 can be mounted to the support board 3030 in an appropriate state.

In the present embodiment, the plurality of locations where the clamping members 3032 are mounted on the support board 3030 are set at the two upper and lower locations on the left and right sides of the spatial light modulator 3020. Therefore, the support board 3030 can be fixedly supported by the bracket 3040 stably. As a result, the damage to the connection portion between the spatial light modulator 3020 and the support board 3030 caused by the vibration load or the like can be more effectively reduced.

Each clamping member 3032 is formed by welding the two L-shaped metal plates to each other in the state where the two metal plates are spaced apart from each other in the unit front-rear direction. Therefore, each clamping member 3032 can be inexpensive and have a simple structure.

In the present embodiment, the heat sink 3050, which is configured to elastically press the spatial light modulator 3020 toward the unit front side in the state of being abutted against the central portion of the spatial light modulator 3020 (that is, the portion where the reflected light control region 3020*a* is located), is arranged on the unit rear side of the support board 3030. Therefore, the spatial light modulator 3020 can dissipate heat while no excessive load acts on the spatial light modulator 3020.

The positional relationship between the support board 3030 and the bracket 3040 is maintained constant in the unit front-rear direction. Therefore, even when the vibration load or the impact load acts on the spatial light modulation unit 3010, a positional relationship between the spatial light modulator 3020 and the heat sink 3050 is not misaligned. Therefore, the spatial light modulator 3020 can be prevented from being damaged by a load from the heat sink 3050.

The plurality of stepped bolts 3052 are arranged around the spatial light modulator 3020 to fix the heat sink 3050 to the bracket 3040. The tip end surfaces of the large diameter portions 3052*b* of the stepped bolts 3052 are abutted against the bracket 3040 in the state where the large diameter portions 3052*b* are inserted through the bolt insertion hole 3050*a* formed in the heat sink 3050 and the bolt insertion hole 3030*b* formed in the support board 3030, and the small diameter portion 3052*a* of each stepped bolt 3052 is screwed to the bracket 3040 while the spring 3054 which is configured to elastically press the heat sink 3050 toward the front side of the unit is attached to the large diameter portion 3052*b*. Therefore, it is possible to easily press the spatial light modulator 3020 stably by the heat sink 3050 with a predetermined elastic pressing force.

Further, the pair of left and right shafts 3056 which extend in the unit front-rear direction are arranged around the spatial light modulator 3020 in the state where the rear end portions thereof are fixed to the heat sink 3050. The pair of left and right shaft insertion holes 3030*c* are formed in the support board 3030. The pair of left and right shaft positioning holes 3040Ad are formed in the bracket 3040. The front end portion of each shaft 3056 is inserted into each shaft positioning hole 3040Ad in the state where each shaft 3056 is inserted through each shaft insertion hole 3030*c*. Therefore, the following operational effect can be obtained.

That is, presence of the pair of left and right shafts 3056 allows the heat sink 3050 and the bracket 3040 to be maintained in a fixed positional relationship with respect to the direction orthogonal to the unit front-rear direction. Therefore, even though it is difficult to maintain the support board 3030 and the bracket 3040 in a fixed positional relationship with respect to the direction orthogonal to the unit front-rear direction, it is possible to maintain the positional relationship only by mounting the clamping members 3032 at the two upper and lower locations on the left and right sides of the spatial light modulator 3020 of the support board 3030. As a result, it is possible to minimize the number of locations where the clamping members 3032 are mounted, and it is possible to further simplify the structure of each clamping member 3032.

Although each shaft 3056 is integrally formed as a part of the heat sink 3050 in the above fifth embodiment, the shaft 3056 may also be formed of a member separate from the heat sink 3050, and a rear end portion 3056*c* thereof may be fixed to the heat sink 3050 by press-fitting, screwing, or the like.

Although the support board 3030 is electrically connected to the spatial light modulator 3020 in the state where the support board 3030 is abutted against the peripheral edge portion 3020*b* of the spatial light modulator 3020 via the socket 3022 in the above fifth embodiment, the support board 3030 may also be electrically connected to the spatial light modulator 3020 in a state of being directly abutted against the peripheral edge portion 3020*b* of the spatial light modulator 3020.

Although the lamp front-rear direction (that is, a direction in which the optical axis Ax3 extends) and the unit front-rear direction (that is, a direction orthogonal to the front surface of the reflected light control region 3020*a* of the spatial light modulator 3020) coincide with each other in the above fifth embodiment, the unit front-rear direction may also extend in a direction that is inclined with respect to the lamp front-rear direction.

Although the light emitted from the light source 3062 reflected by the reflector 3064 is reflected by the spatial light modulator 3020 in the above fifth embodiment, it is also possible to employ a configuration in which the light emitted from the light source 3062 whose deflection is controlled by a lens or the like is reflected by the spatial light modulator 3020 or a configuration in which the light emitted from the light source 3062 is directly reflected by the spatial light modulator 3020.

Next, first to fourth modifications of the clamping member 3032 of the fifth embodiment will be described.

Figure 37A:
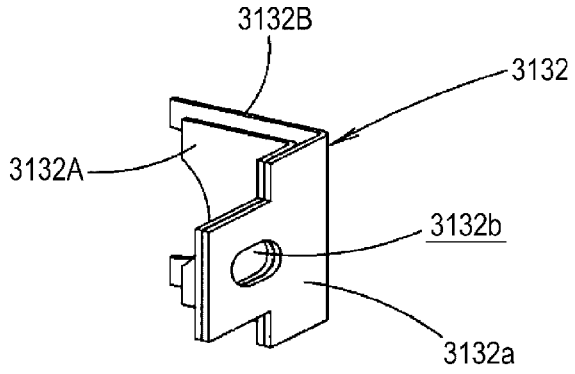
FIG. 37A is a perspective view showing a clamping member according to a first modification of the fifth embodiment.

FIG. 37A is a perspective view showing a clamping member 3132 according to the first modification.

As shown in FIG. 37A, the clamping member 3132 of the present modification is also formed by welding two metal plates 3132A, 3132B which are formed in an L-shape in a plan view to each other in a state where the two metal plates 3132A, 3132B are spaced apart from each other in the unit front-rear direction, and an elongated hole 3132*b* that extends in the unit front-rear direction is formed in an overlapping portion 3132*a* where the two metal plates 3132A, 3132B are overlapped, which is the same as the clamping member 3032 of the fifth embodiment.

However, positions of tip end surfaces of the two metal plates 3132A, 3132B (that is, end surfaces near the optical axis Ax3) are misaligned from each other.

By employing the configuration of the present modification, it is possible to easily mount the clamping member 3132 to the support board 3030.

Figure 37B:
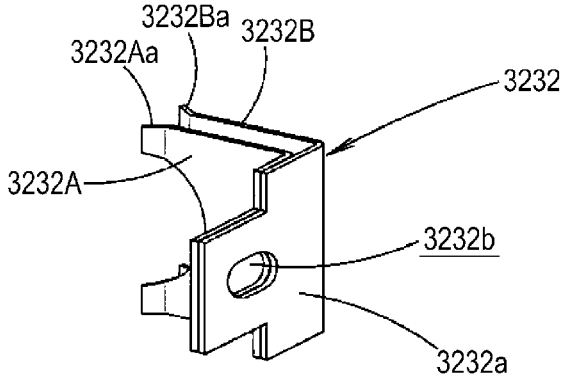
FIG. 37B is a perspective view showing a clamping member according to a second modification of the fifth embodiment.

FIG. 37B is a perspective view showing a clamping member 3232 according to the second modification.

As shown in FIG. 37B, the clamping member 3232 of the present modification is also formed by welding two metal plates 3232A, 3232B which are formed in an L-shape in a plan view to each other in a state where the two metal plates 3232A, 3232B are spaced apart from each other in the unit front-rear direction, and an elongated hole 3232*b* that extends in the unit front-rear direction is formed in an overlapping portion 3232*a* where the two metal plates 3232A, 3232B are overlapped, which is the same as the clamping member 3032 of the fifth embodiment.

However, the two metal plates 3232A, 3232B are bent obliquely such that tip end portions (that is, end portions near the optical axis Ax3) 3232Aa, 3232Ba thereof are opened in the unit front-rear direction.

By employing the configuration of the present modification, it is possible to more easily mount the clamping member 3232 to the support board 3030.

Figure 37C:
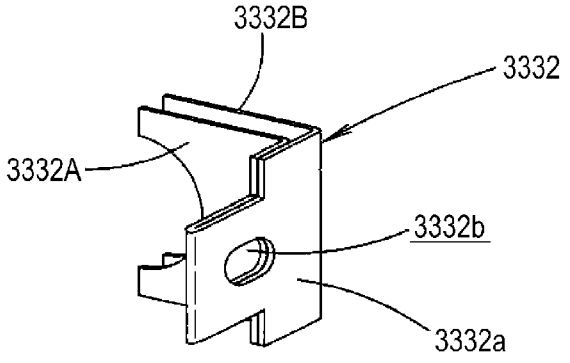
FIG. 37C is a perspective view showing a clamping member according to a third modification of the fifth embodiment.

FIG. 37C is a perspective view showing a clamping member 3332 according to the third modification.

As shown in FIG. 37C, the clamping member 3332 of the present modification has the same shape as the clamping member 3032 of the fifth embodiment, and is different from the case of the fifth embodiment in that the clamping member 3332 is formed by bending a single metal plate.

That is, the clamping member 3332 of the present modification is formed of a single metal plate in which two plate-shaped portions 3332A, 3332B having the same shape as the two metal plates 3032A, 3032B of the clamping member 3032 of the fifth embodiment are connected at front end positions thereof.

In the clamping member 3332, an elongated hole 3332*b* that extends in the unit front-rear direction is also formed in an overlapping portion 3332*a* where the two plate-shaped portions 3332A, 3332B are overlapped.

By employing the configuration of the present modification, it is possible to eliminate a welding process when manufacturing the clamping member 3332.

Figure 37D:
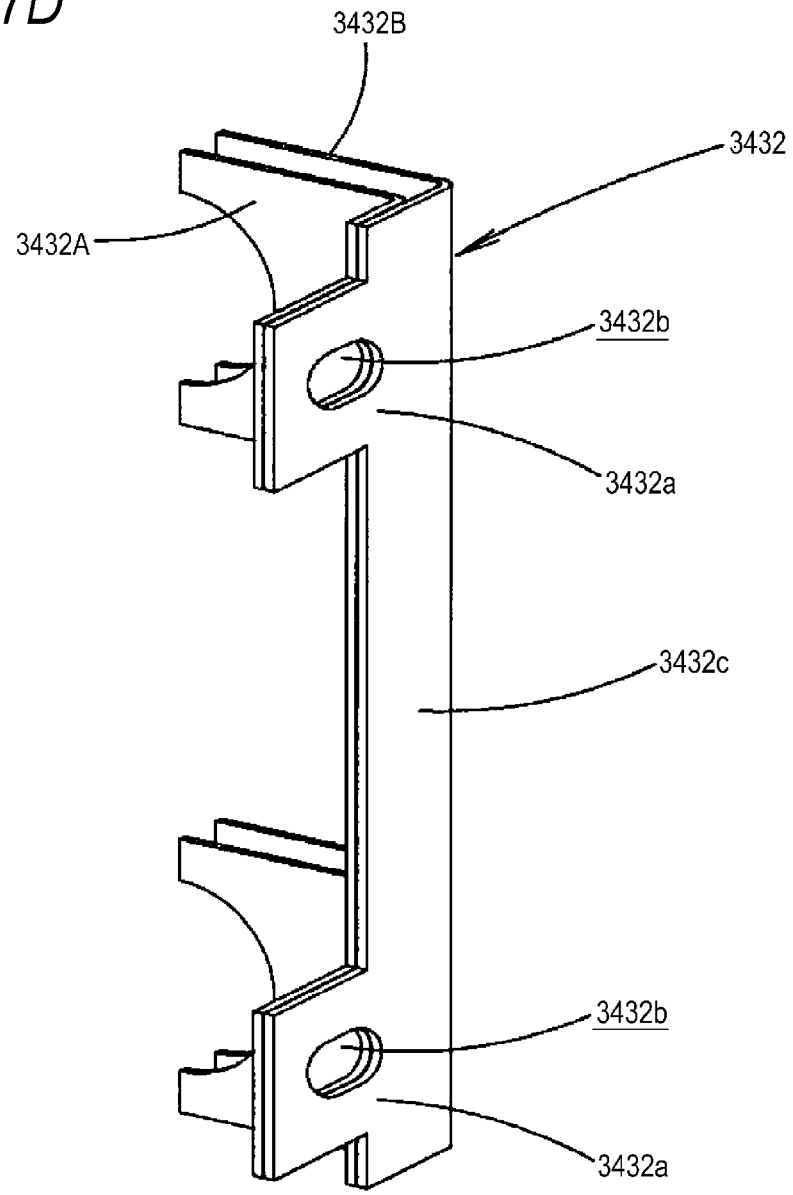
FIG. 37D is a perspective view showing a clamping member according to a fourth modification of the fifth embodiment.

FIG. 37D is a perspective view showing a clamping member 3432 according to the fourth modification.

As shown in FIG. 37D, the clamping member 3432 of the present modification is configured such that the pair of upper and lower clamping members 3032 arranged at the two upper and lower locations in the fifth embodiment are integrally formed.

That is, the clamping member 3432 of the present modification is also formed by welding two metal plates 3432A, 3432B which are formed in an L-shape in a plan view to each other in a state where the two metal plates 3432A, 3432B are spaced apart from each other in the unit front-rear direction. The clamping member 3432 is configured such that two portions located at upper and lower locations and having the same configuration as the clamping member 3032 of the fifth embodiment are integrated via a connecting portion 3432*c* that extends in the up-down direction at an overlapping portion 3432*a* where the two metal plates 3432A, 3432B are overlapped.

In the clamping member 3432, elongated holes 3432*b* that extend in the unit front-rear direction are also formed in the overlapping portions 3432*a* at the two upper and lower locations.

By employing the configuration of the present modification, the number of components can be reduced and it is possible to stably perform a screwing operation when the clamping members 3432 mounted on the support board 3030 at the two upper and lower locations are fixed to the bracket 3040.

Sixth Embodiment

Next, a sixth embodiment of the present disclosure will be described.

Figure 38:
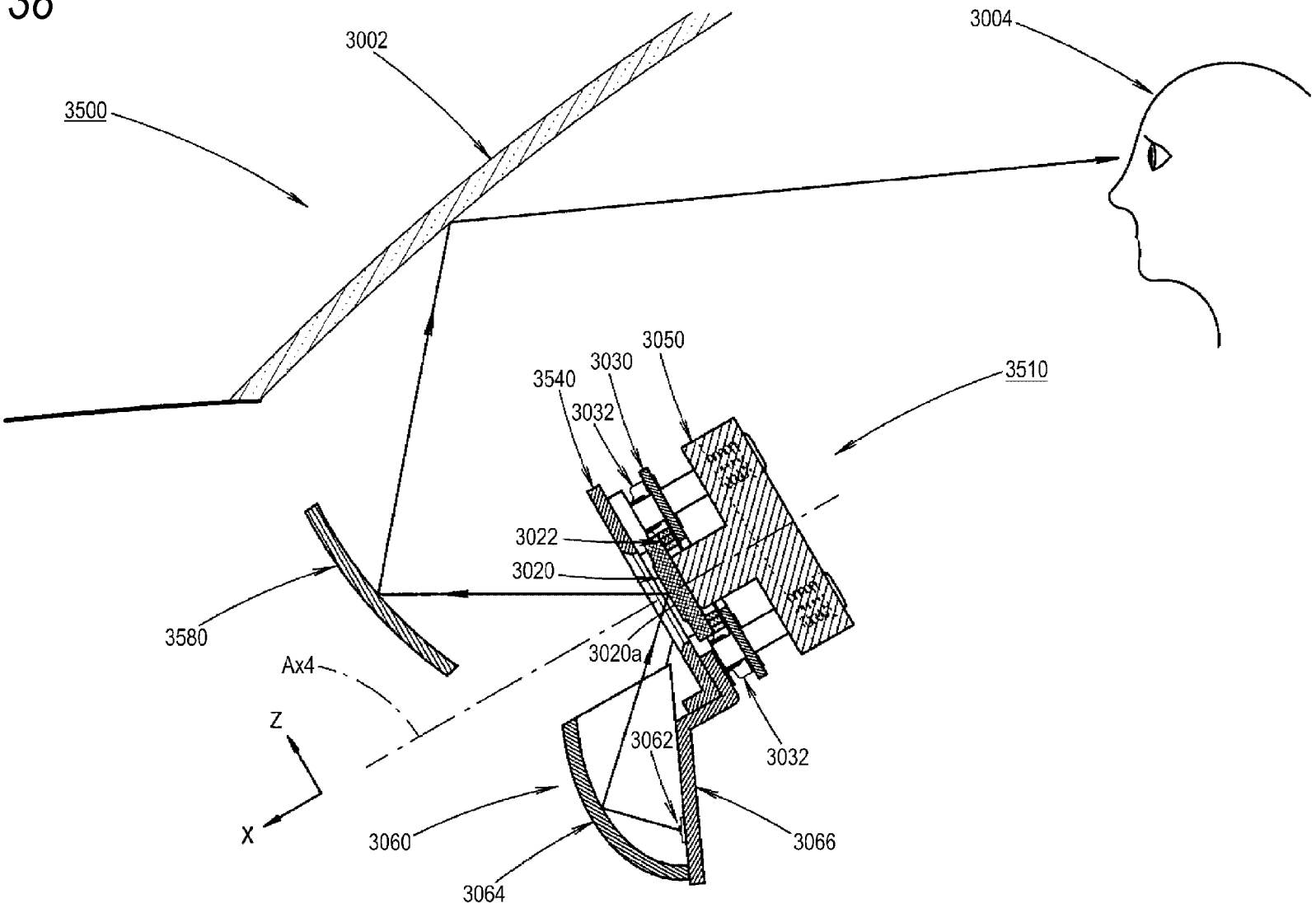
FIG. 38 is a side cross-sectional view showing a head-up display in which a spatial light modulation unit according to a sixth embodiment of the present disclosure is incorporated.

FIG. 38 is a side cross-sectional side view showing a head-up display 3500 in which a spatial light modulation unit 3510 according to the present embodiment is incorporated.

The head-up display 3500 includes: a vehicle front window 3002; the spatial light modulation unit 3510 which is arranged in vehicle interior below the front window 3002; and a concave mirror 3580 arranged on a vehicle front side with respect to the spatial light modulator 3020. The head-up display 3500 is configured to allow a driver 4 to visually recognize image information generated by the spatial light modulation unit 3510 by sequentially reflecting the image information on the concave mirror 3580 and the front window 3002.

Therefore, although the spatial light modulation unit 3510 has the same basic configuration as that of the spatial light modulation unit 3010 according to the fifth embodiment, contents of reflected light control of the spatial light modulator 3020 with respect to the light from the light source 3062 reflected by the reflector 3064 are different. The spatial light modulation unit 3510 is different from the case of the fifth embodiment in that a bracket 3540 does not have a function of supporting the lens side sub-assembly 3070 like the bracket 3040 of the fifth embodiment.

In order to reflect the reflected light from the spatial light modulator 3020 by the concave mirror 3580 and make the light incident on an inner surface of the front window 3002, a unit reference axis (that is, an axis extending in a direction orthogonal to the reflected light control region 3020*a* of the spatial light modulator 3020) Ax4 of the spatial light modulation unit 3510 is arranged to extend in a direction inclined downward toward a front side of the vehicle. That is, in FIG. 38, the direction indicated by X is the "front side" of the spatial light modulation unit 3010 ("obliquely lower front side" of the vehicle), and the direction indicated by Z is the "up direction" which is orthogonal to the "front side" ("obliquely upper front side" of the vehicle).

Next, an operation of the present embodiment will be described.

The spatial light modulation unit 3510 according to the present embodiment is configured as a part of the head-up display 3500. The spatial light modulation unit 3510 includes the reflective spatial light modulator 3020 which is configured to reflect the light from the light source 3062. Various types of image information can be formed with high accuracy by controlling spatial distribution of the reflected light in the spatial light modulator 3020.

The spatial light modulation unit 3510 has the same configuration as that of the spatial light modulation unit 3010 according to the fifth embodiment. Therefore, the damage to the spatial light modulator 3020 and the damage to the connection portion between the spatial light modulator 3020 and the support board 3030 caused by the vibration load or the like can be effectively reduced.

Seventh Embodiment

Next, a seventh embodiment of the present disclosure will be described.

Figure 39:
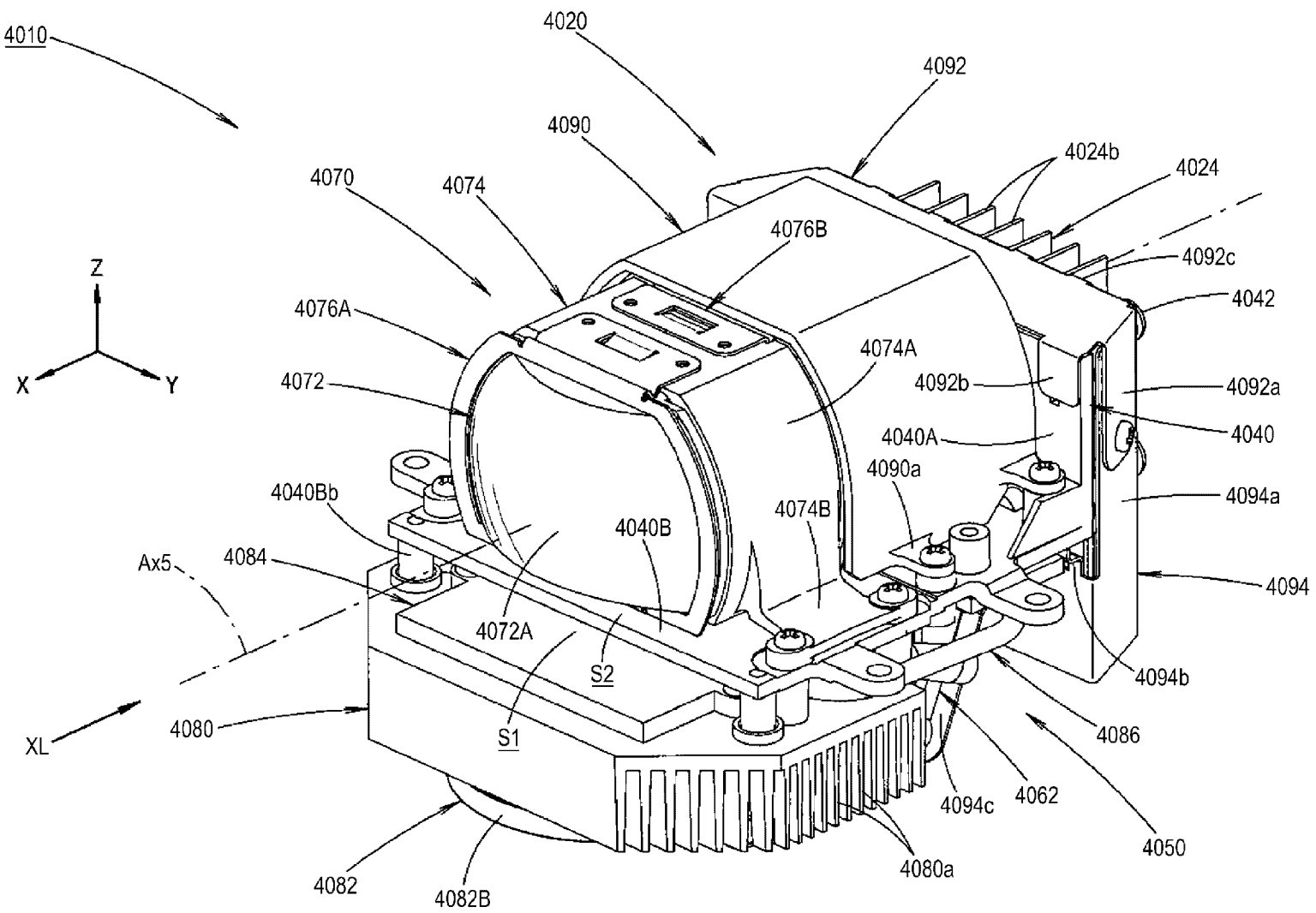
FIG. 39 is a perspective view showing a lamp unit according to a seventh embodiment of the present disclosure.
Figure 40:
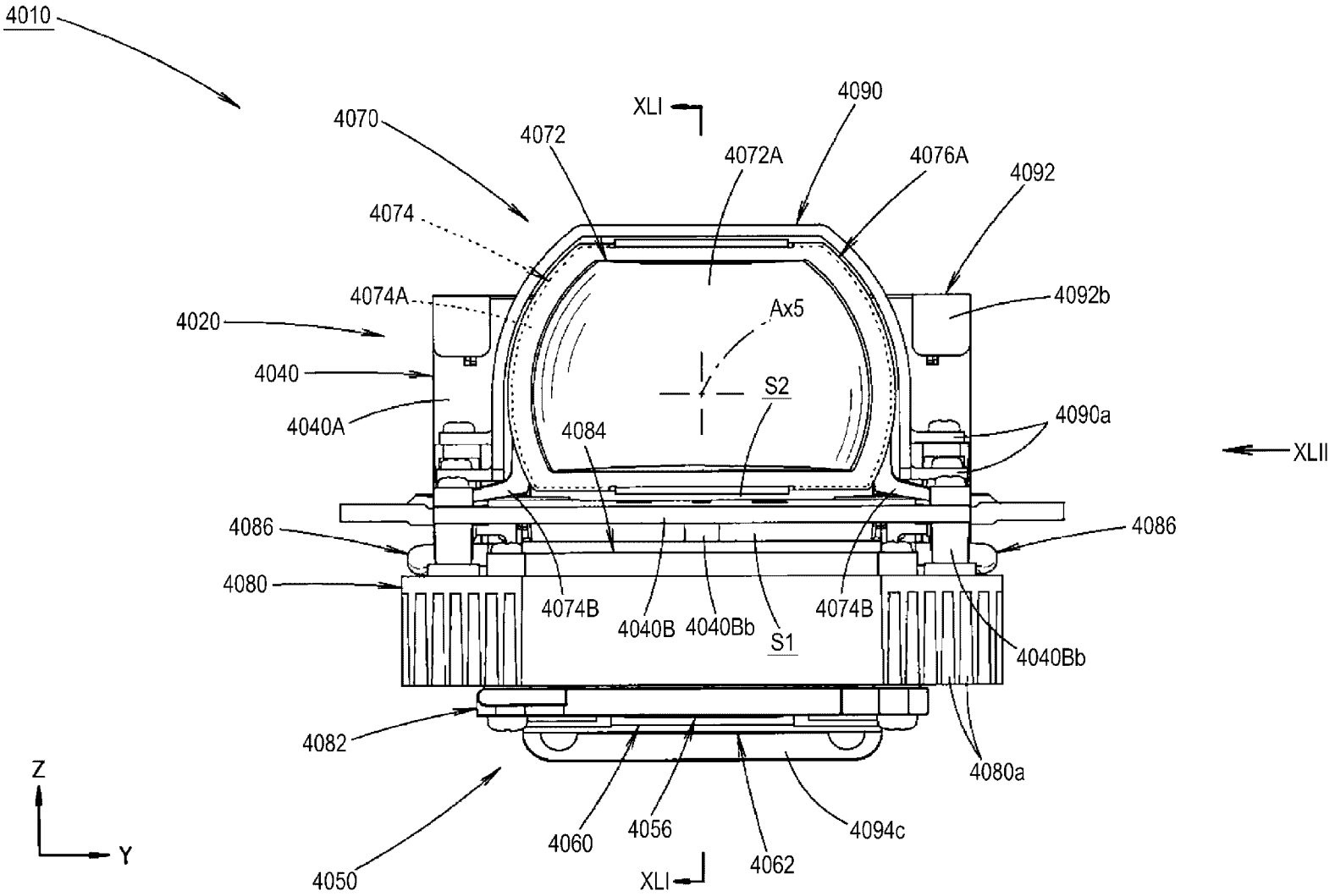
FIG. 40 is taken along arrow XL of FIG. 39.
Figure 41:
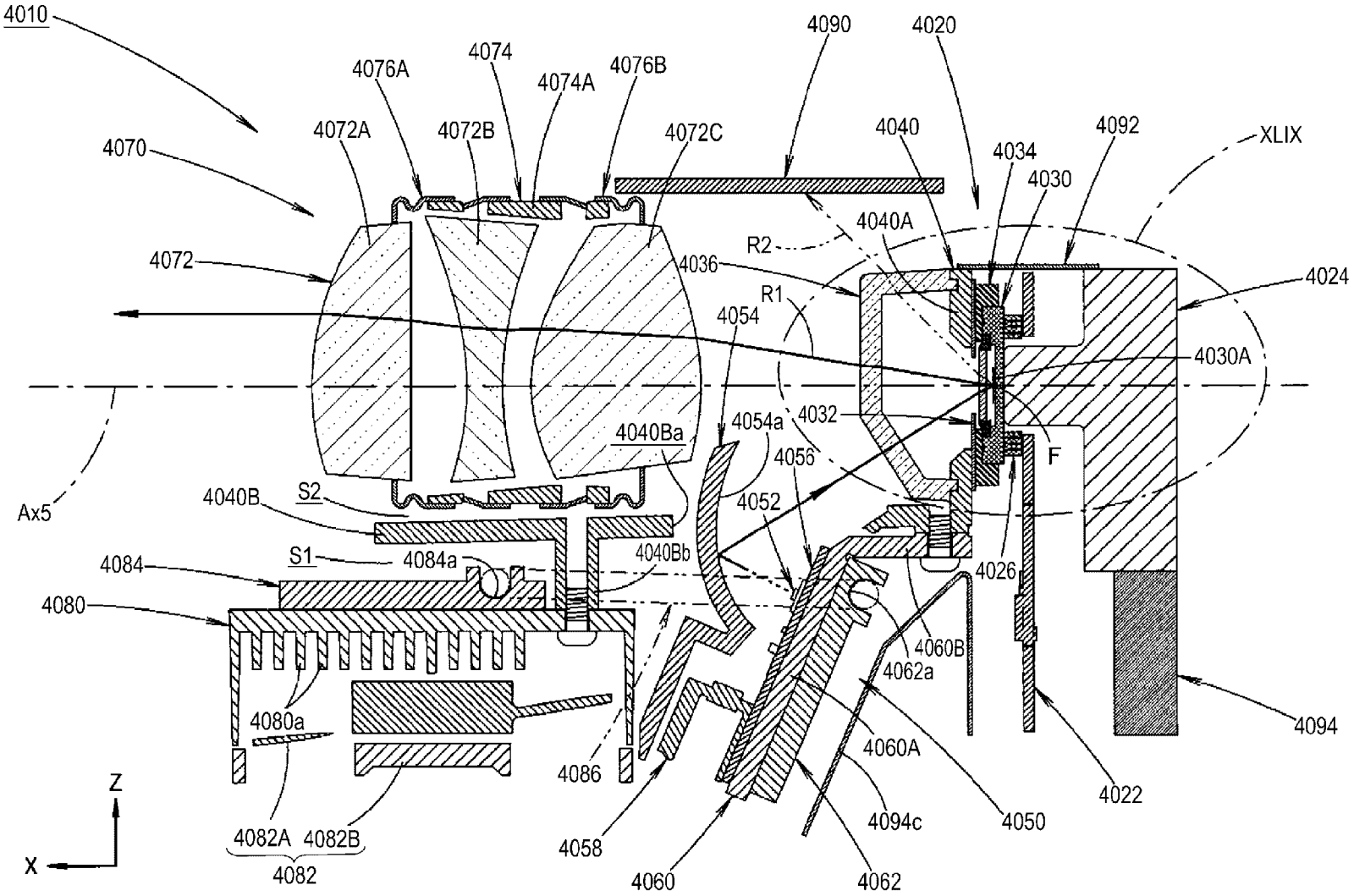
FIG. 41 is a cross-sectional view taken along line XLI-XLI of FIG. 40.
Figure 42:
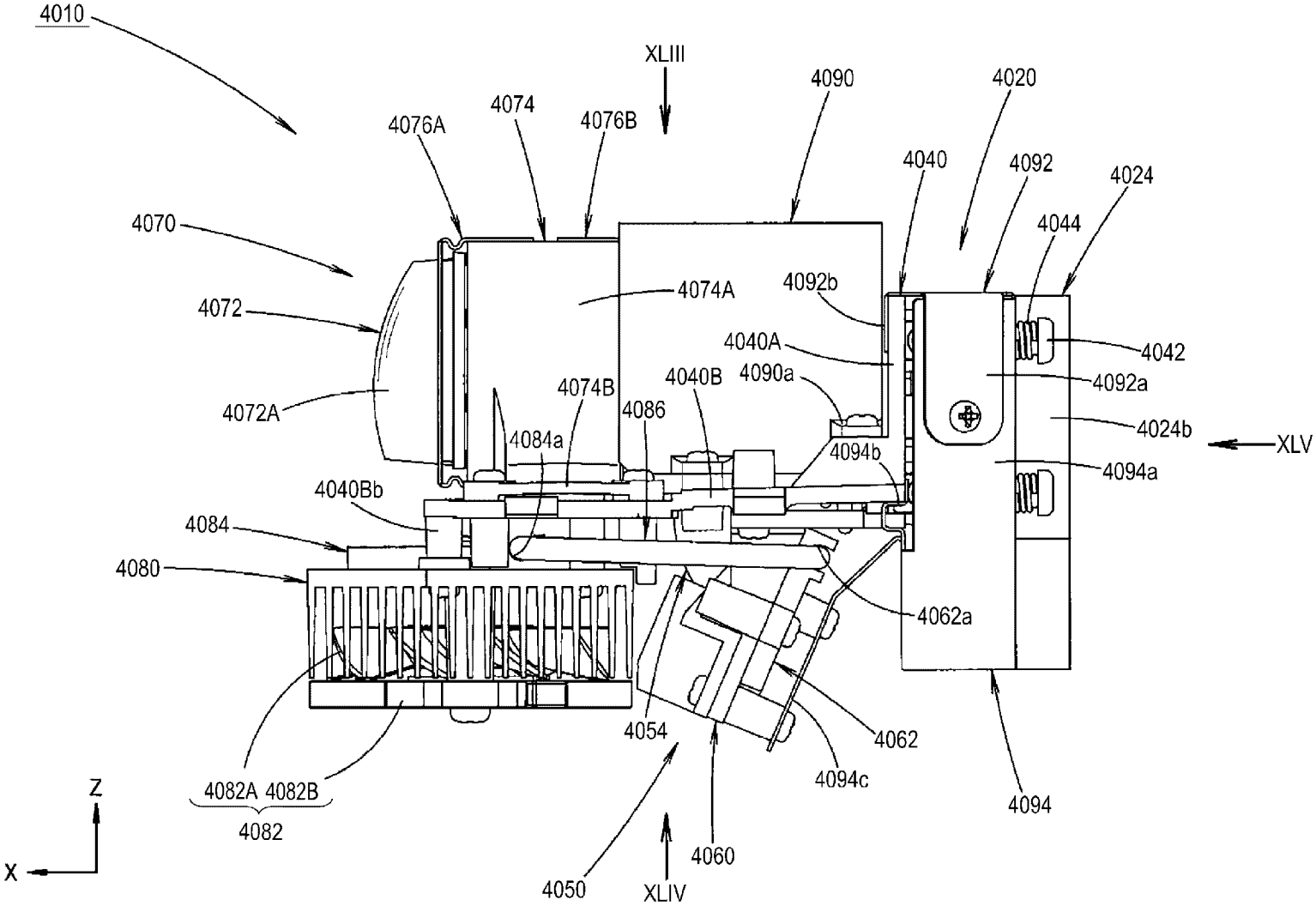
FIG. 42 is taken along arrow XLII of FIG. 40.
Figure 43:
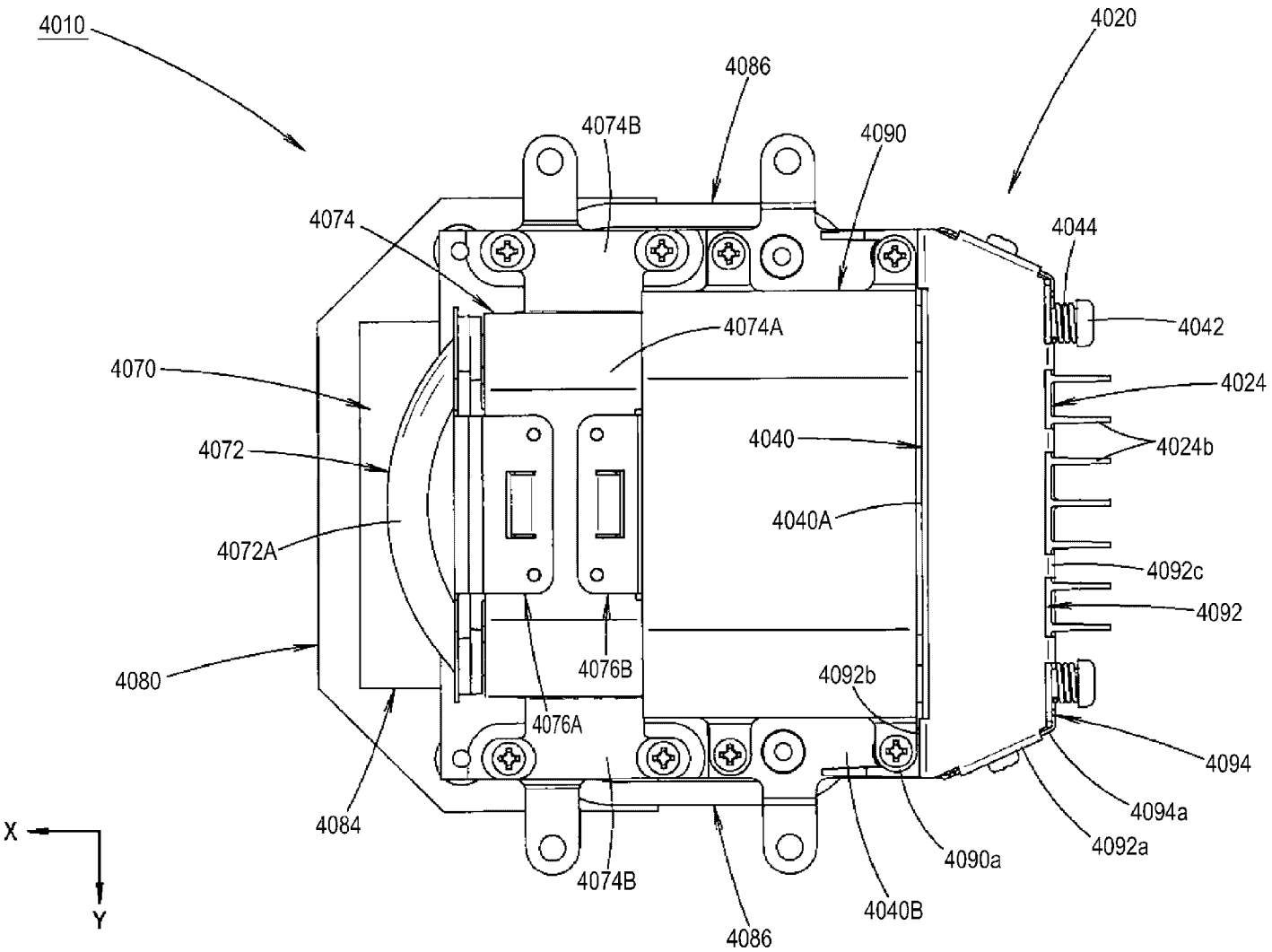
FIG. 43 is taken along arrow XLIII of FIG. 42.
Figure 44:
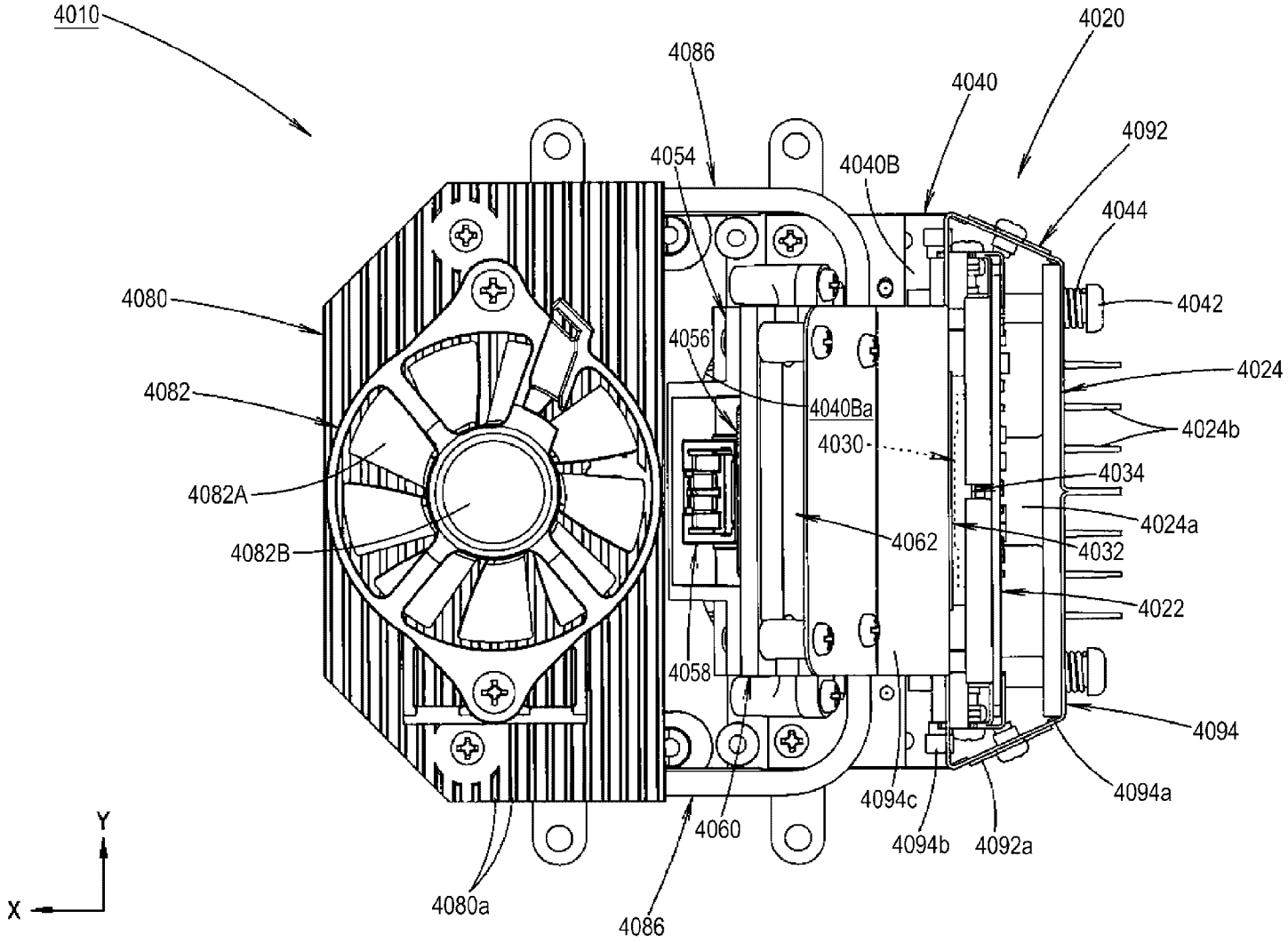
FIG. 44 is taken along arrow XLIV of FIG. 42.
Figure 45:
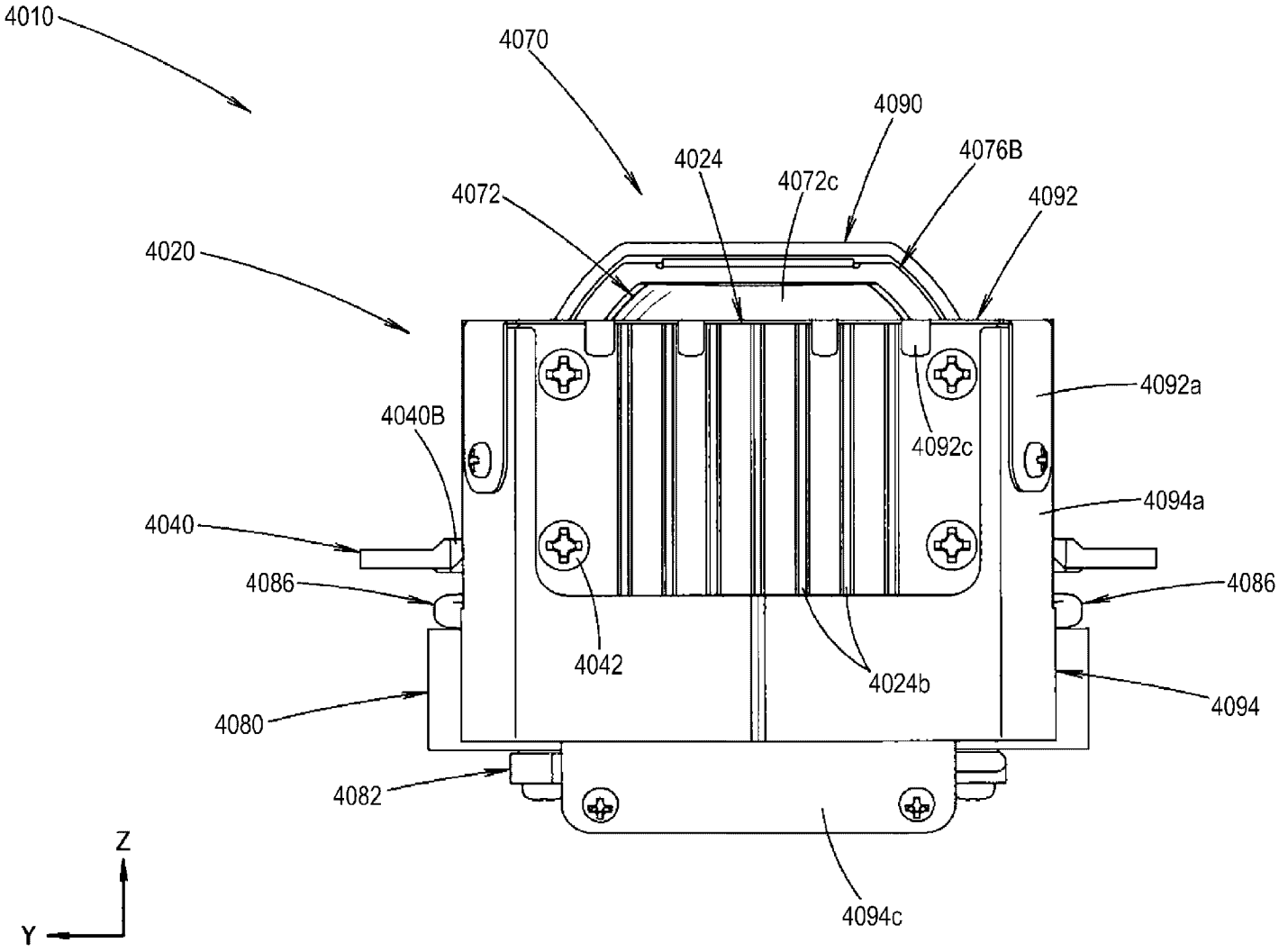
FIG. 45 is taken along arrow XLV of FIG. 42.

FIG. 39 is a perspective view showing a lamp unit 4010 according to the seventh embodiment of the present disclosure. FIG. 40 is taken along arrow XL of FIG. 39. FIG. 41 is a cross-sectional view taken along line XLI-XLI of FIG. 40. FIG. 42 is taken along arrow XLII of FIG. 40. Further, FIG. 43 is taken along arrow XLIII of FIG. 42. FIG. 44 is taken along arrow XLIV of FIG. 42. FIG. 45 is taken along arrow XLV of FIG. 42.

In these drawings, the direction indicated by X is the "unit front side", the direction indicated by Y is the "left direction" that is orthogonal to the "unit front side" (the "right direction" in a front view of the unit), and the direction indicated by Z is the "up direction". The same also applies to the other drawings.

Figure 52:
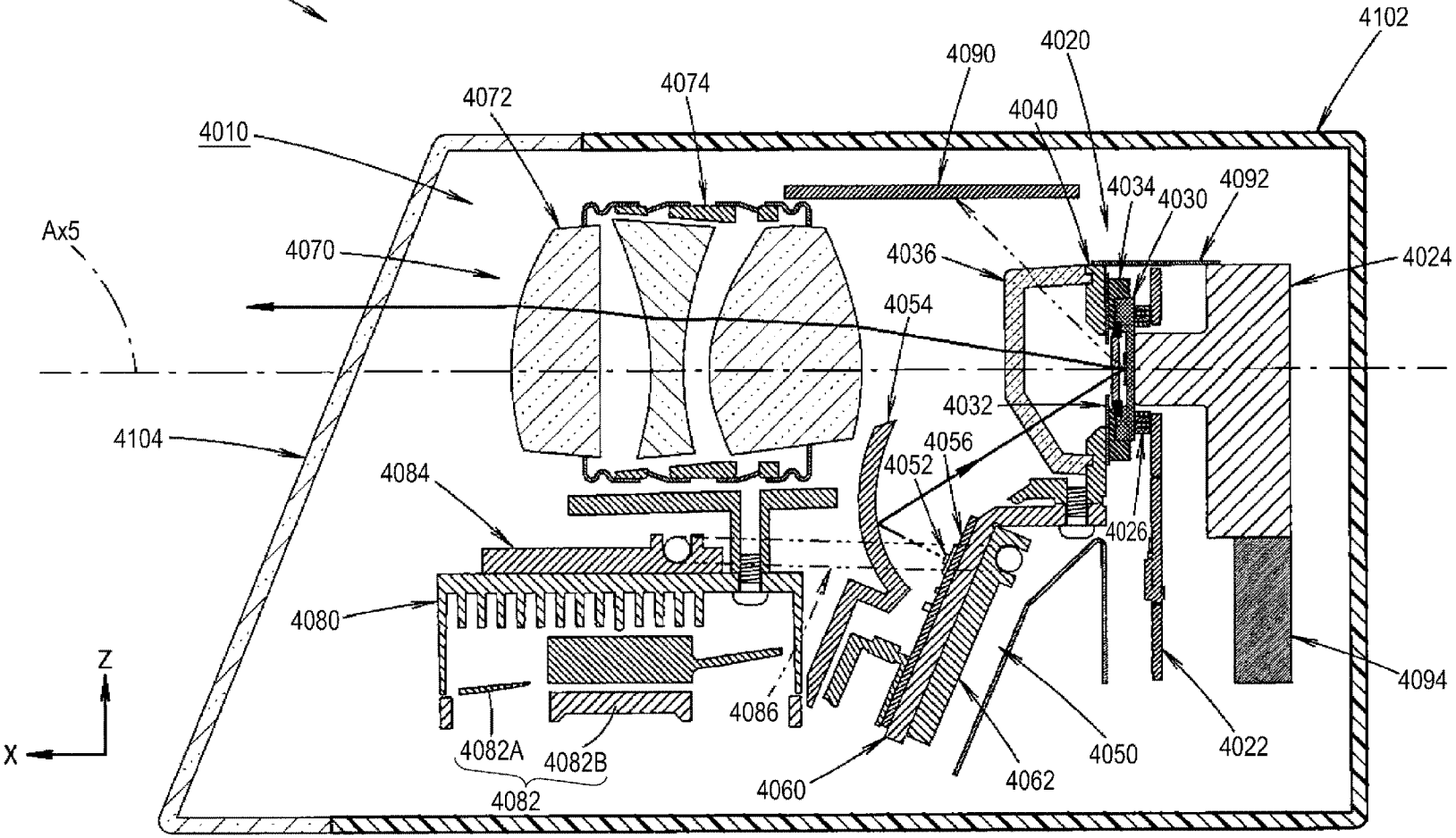
FIG. 52 is a side cross-sectional view showing a vehicle lamp including the lamp unit.

The lamp unit 4010 according to the present embodiment is used in a state of being incorporated in a vehicle lamp 4100 shown in a side cross-sectional view of FIG. 52.

Specifically, the vehicle lamp 4100 is a headlamp provided at a front end portion of a vehicle. The lamp unit 4010 is accommodated in a lamp chamber formed by a lamp body 4102 and a translucent cover 4104, and is used in a state where optical axis adjustment is performed such that a front-rear direction of the lamp unit 4010 coincides with the vehicle front-rear direction (that is, the unit front-rear direction).

The lamp unit 4010 includes: a spatial light modulation unit 4020; a light source side sub-assembly 4050; and a lens side sub-assembly 4070. A bracket 4040 of the lamp unit 4010, which constitutes a part of the spatial light modulation unit 4020, is supported by the lamp body 4102 via an attachment structure (not shown).

As shown in FIG. 41, the spatial light modulation unit 4020 includes: a spatial light modulator 4030; a support board 4022 arranged on the unit rear side of the spatial light modulator 4030; a heat sink 4024 arranged on the unit rear side of the support board 4022; and the bracket 4040 arranged on the unit front side of the spatial light modulator 4030.

The bracket 4040 is a member that is made of metal (for example, aluminum die casting), and includes: a vertical surface portion 4040A that extends along the vertical plane orthogonal to the unit front-rear direction; and a horizontal surface portion 4040B that extends substantially along the horizontal plane from a lower end edge of the vertical surface portion 4040A toward the front side of the unit.

Figure 46:
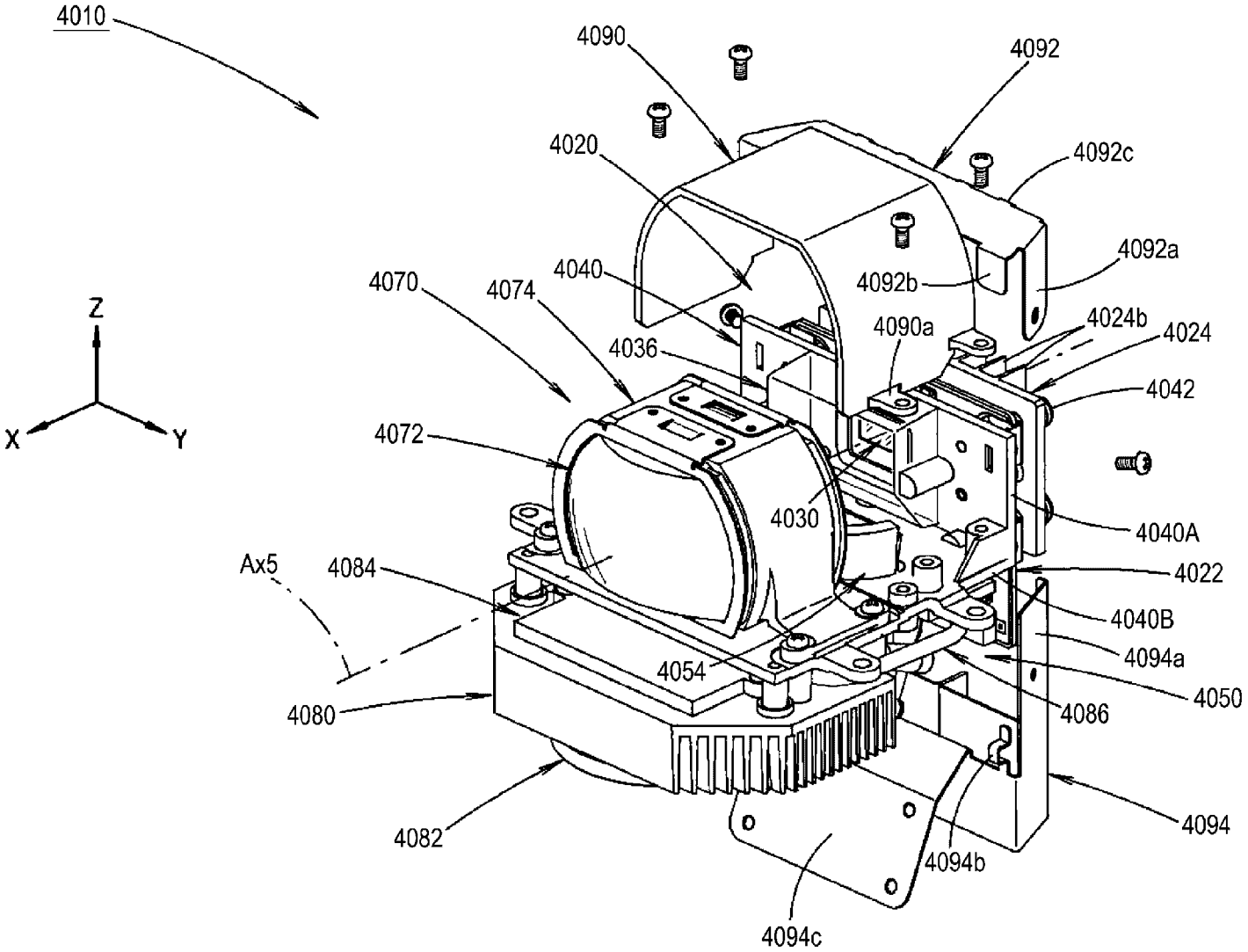
FIG. 46 is a perspective view showing the lamp unit in a state where a part of constituent elements thereof are exploded.
Figure 47:
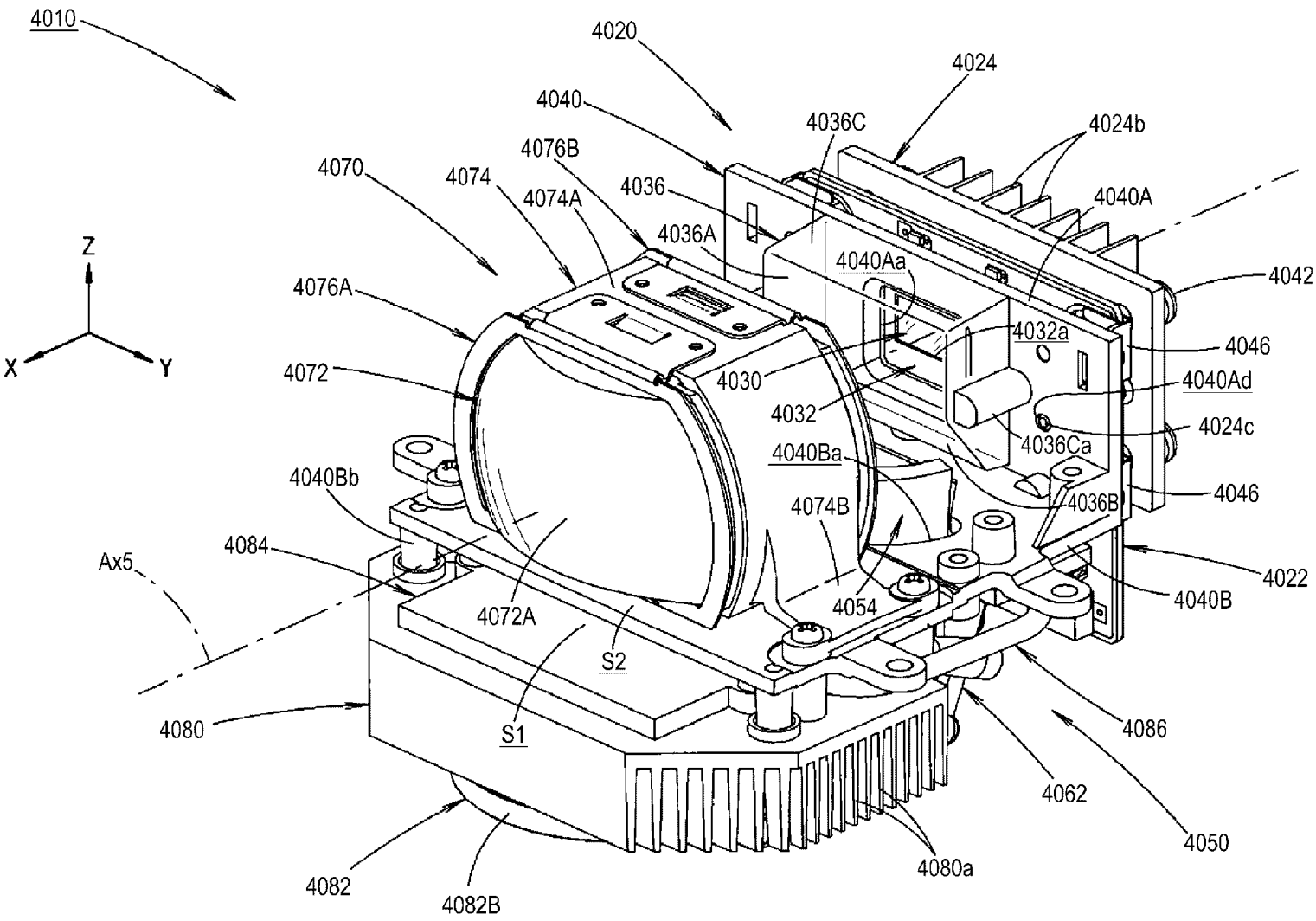
FIG. 47 is a perspective view showing the lamp unit in a state where the above constituent elements are taken out.
Figure 48:
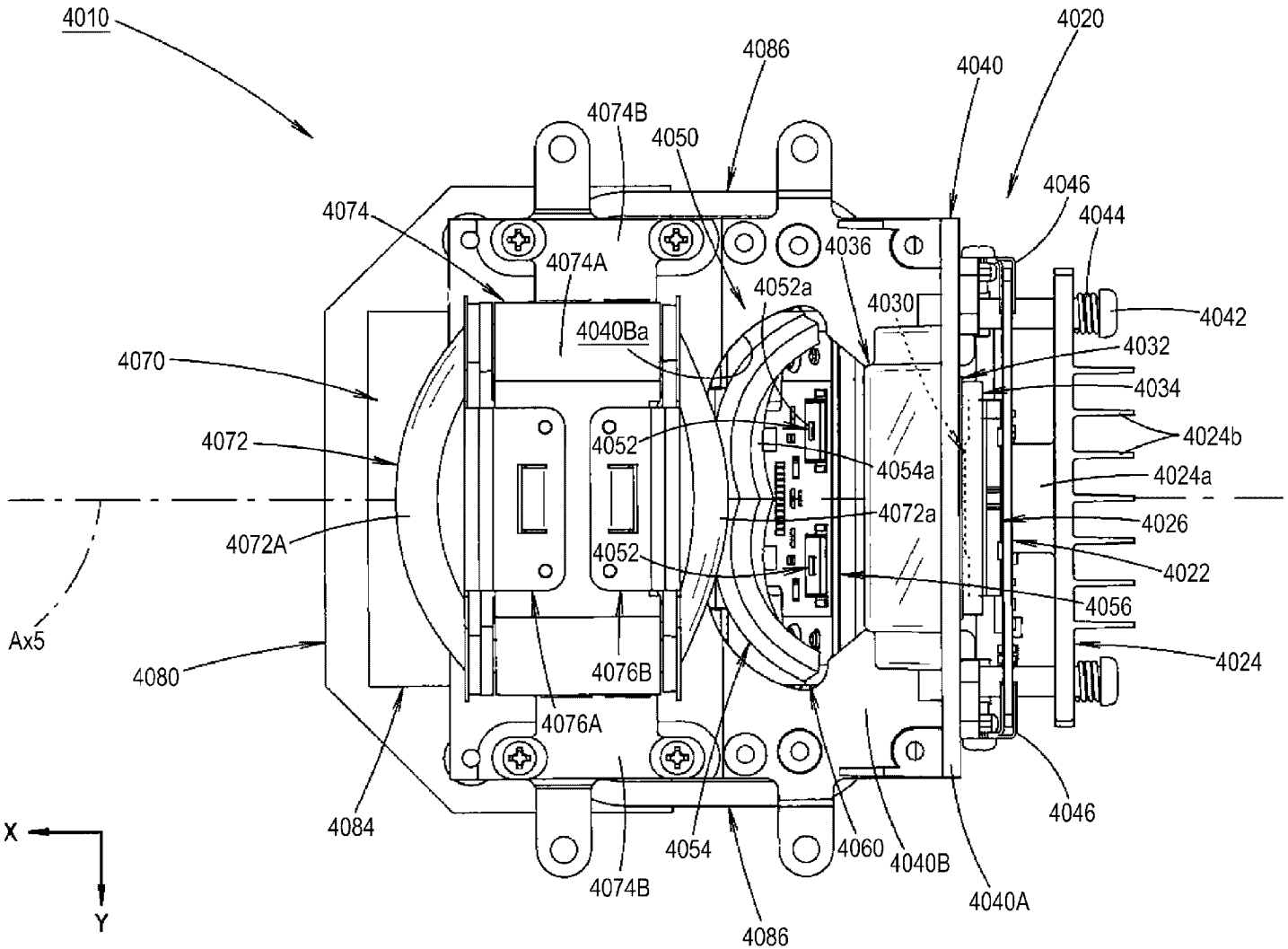
FIG. 48 is a plan view showing the lamp unit in a state where the above constituent elements are taken out.

FIG. 46 is a perspective view showing the lamp unit 4010 in a state where constituent elements thereof (a light shielding cover 4090, an upper cover 4092 and a lower cover 4094 which will be described below) are exploded. FIG. 47 is a perspective view showing these members in a taken-out state. FIG. 48 is a plan view showing these members in the taken-out state.

As shown in FIGS. 41 and 48, the light source side sub-assembly 4050 includes: a pair of left and right light sources 4052; a reflector 4054 configured to reflect light emitted from the light sources 4052 toward the spatial light modulation unit 4020; and a base member 4060 configured to support the light sources 4052 and the reflector 4054.

The lens side sub-assembly 4070 includes: a projection lens 4072 which has an optical axis Ax5 extending in the unit front-rear direction; and a lens holder 4074 configured to support the projection lens 4072.

The vehicle lamp 4010 according to the present embodiment is configured such that various light distribution patterns can be formed with high accuracy by emitting light from each light source 4052 reflected by the reflector 4054 toward the front side of the unit via the spatial light modulator 4030 and the projection lens 4072. The light distribution patterns are, for example, low-beam light distribution patterns or high-beam light distribution patterns, light distribution patterns that change according to vehicle traveling situations, or light distribution patterns that draw characters or symbols on a road surface in front of the vehicle.

In order to realize such light distribution patterns, during an assembly process of the lamp unit 4010, a positional relationship between the spatial light modulator 4030 and the projection lens 4072 is finely adjusted in a state where each light source 4052 is lit to form the light distribution patterns, and accuracy of the positional relationship is improved.

Next, a specific configuration of each of the spatial light modulation unit 4020, the light source side sub-assembly 4050, and the lens side sub-assembly 4070 will be described.

First, the configuration of the light source side sub-assembly 4050 will be described before describing the configuration of the spatial light modulation unit 4020.

As shown in FIG. 48, the pair of left and right light sources 4052 are both white light-emitting diodes and are arranged in a bilaterally symmetrical positional relationship with respect to the vertical plane including the optical axis Ax5. Each light source 4052 is mounted on a front surface of a board 4056 in a state where a light emitting surface 4052*a* thereof faces obliquely upward and forward. The board 4056 is fixed to the base member 4060 by screwing in a state where a rear surface thereof is in surface contact with the base member 4060. As shown in FIGS. 41 and 44, a connector 4058 which is configured to supply power to the pair of left and right light sources 4052 is placed on a lower end portion of the front surface of the board 4056.

As shown in FIG. 41, the base member 4060 is a plate-shaped member that is made of metal (for example, aluminum die casting), and includes: an inclined surface portion 4060A that extends obliquely upward and rearward from a lower end position toward an upper end position; and a horizontal surface portion 4060B that extends from the upper end position of the inclined surface portion 4060A toward the rear side of the unit. The horizontal surface portion 4060B of the base member 4060 is fixed to the horizontal surface portion 4040B of the bracket 4040 by screwing.

As shown in FIG. 48, the reflector 4054 covers the pair of left and right light sources 4052 from the unit front side, and a peripheral edge portion thereof is fixed to the base member 4060 by screwing. The reflector 4054 includes a pair of left and right reflecting surfaces 4054*a* which are formed in a bilaterally symmetrical positional relationship with respect to the vertical plane including the optical axis Ax5. A surface shape of each reflecting surface 4054*a* is set to converge the light emitted from each light source 4052 to the vicinity of the rear focus F (see FIG. 41) of the projection lens 4072. The lower end portion of the reflector 4054 surrounds the connector 4058.

As shown in FIG. 41, the horizontal surface portion 4040B of the bracket 4040 extends to the unit front side of the reflector 4054, and an opening portion 4040Ba where the reflector 4054 is inserted is formed in the horizontal surface portion 4040B.

A heat transfer plate 4062 that is made of metal (for example, aluminum die casting) is arranged on a rear surface side of the inclined surface portion 4060A of the base member 4060. The heat transfer plate 4062 is fixed to the inclined surface portion 4060A by screwing in a state of being in surface contact with a rear surface of the inclined surface portion 4060A of the base member 4060.

As shown in FIG. 41, a heat sink 4080 is arranged on the unit front side of the light source side sub-assembly 4050 and below the lens side sub-assembly 4070 as a heat dissipating member which is configured to dissipate heat generated by the lighting of each light source 4052.

The heat sink 4080 is a member that is made of metal (for example, aluminum die casting), and extends along the horizontal plane. A plurality of heat dissipating fins 4080*a* are formed in a horizontal stripe pattern (that is, to extend in the left-right direction) on a lower surface of the heat sink 4080. The heat sink 4080 is fixed to the horizontal surface portion 4040B of the bracket 4040 by screwing. The screwing is performed with respect to boss portions 4040Bb which protrude downward at a plurality of locations (specifically, three locations) of the horizontal surface portion 4040B of the bracket 4040, and thus certain space is formed between an upper surface of the heat sink 4080 and the horizontal surface portion 4040B of the bracket 4040.

A heat dissipating fan 4082 which is configured to improve heat dissipation of the heat sink 4080 is arranged below the heat sink 4080.

The heat dissipating fan 4082 includes: a fan body 4082A; and a support portion 4082B which is configured to rotatably support the fan body 4082A around a vertical axis. The heat dissipating fan 4082 is configured to apply wind generated by rotation of the fan body 4082A to the heat dissipating fins 4080*a* of the heat sink 4080. The support portion 4082B of the heat dissipating fan 4082 is fixed to the heat sink 4080 by screwing (see FIG. 44).

As shown in FIG. 41, a heat transfer plate 4084 that is made of metal (for example, aluminum die casting) is arranged on an upper surface side of the heat sink 4080. The heat transfer plate 4084 extends along the horizontal plane, and is fixed to the heat sink 4080 by screwing in a state of being in surface contact with the upper surface of the heat sink 4080.

The heat transfer plate 4084 is connected to the heat transfer plate 4062 of the light source side sub-assembly 4050 via a pair of left and right heat pipes 4086. That is, each heat pipe 4086 is a heat transfer member configured to connect the heat transfer plates 4062, 4084, and is configured as a heat transport member having a lower thermal resistance than in a case where the heat sink 4080 and the heat transfer plates 4062, 4084 are connected by the same material with the same size.

The heat pipes 4086 extend in the unit front-rear direction on left and right sides of the light source side sub-assembly 4050. A front end portion and a rear end portion of each heat pipe 4086 extend horizontally in a direction approaching the optical axis Ax5. The front end portion of each heat pipe 4086 is fixed to the heat transfer plate 4084 in a state of being fitted into a support recessed portion 4084*a* formed in an upper surface of a rear portion of the heat transfer plate 4084. The rear end portion of each heat pipe 4086 is fixed to the heat transfer plate 4062 in a state of being fitted into a support recessed portion 4062*a* formed in a rear surface of an upper portion of the heat transfer plate 4062.

A length dimension of each boss portion 4040Bb formed on the horizontal surface portion 4040B of the bracket 4040 is set such that a gap S1 is formed between a lower surface of the horizontal surface portion 4040B and an upper surface of the heat transfer plate 4084. An up-down width of the gap S1 is set to a value of 1 mm or more (for example, about 2 to 10 mm).

Next, the configuration of the spatial light modulation unit 4020 will be described.

Figure 49:
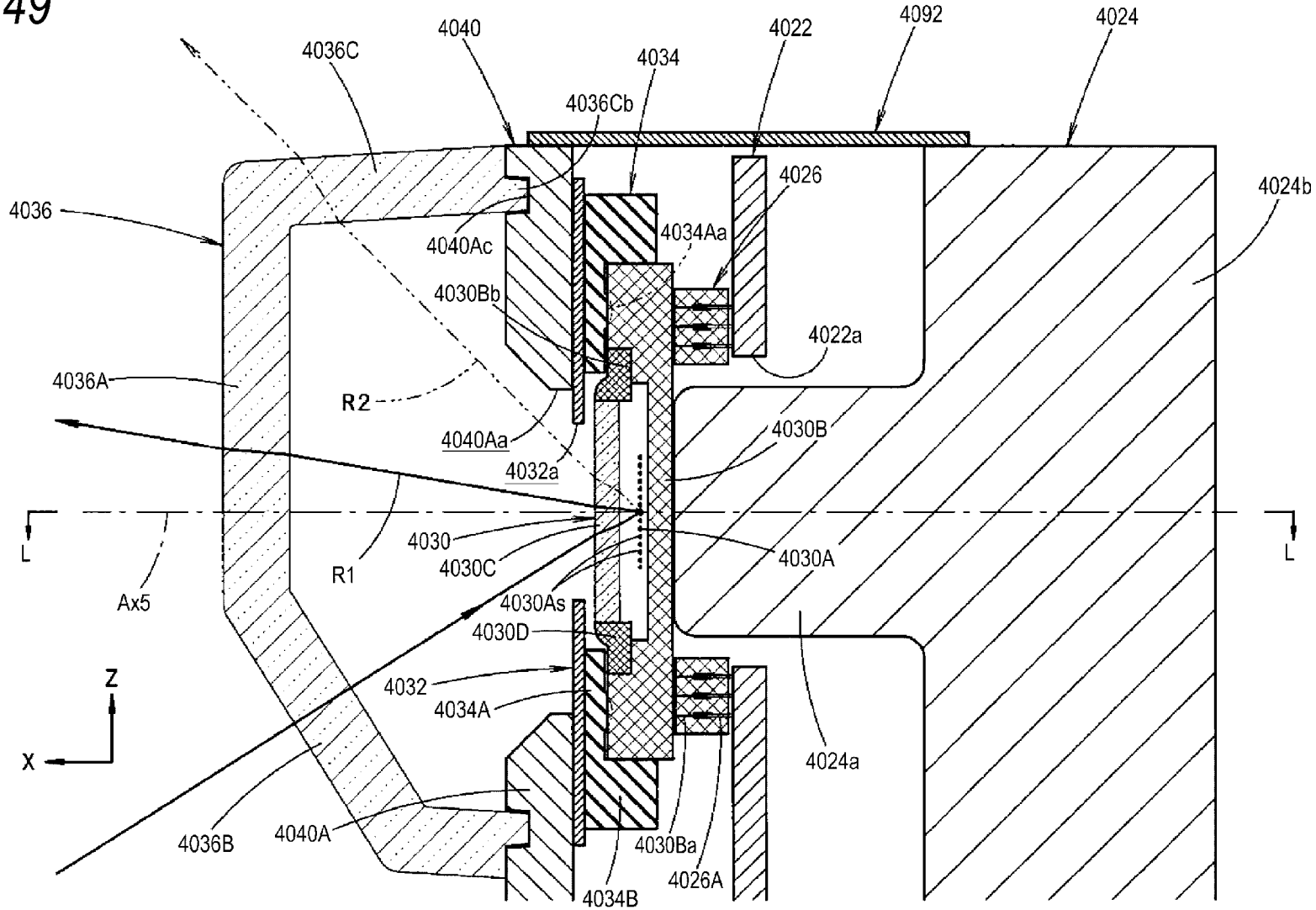
FIG. 49 is a detailed view of portion XLIX of FIG. 41.
Figure 50:
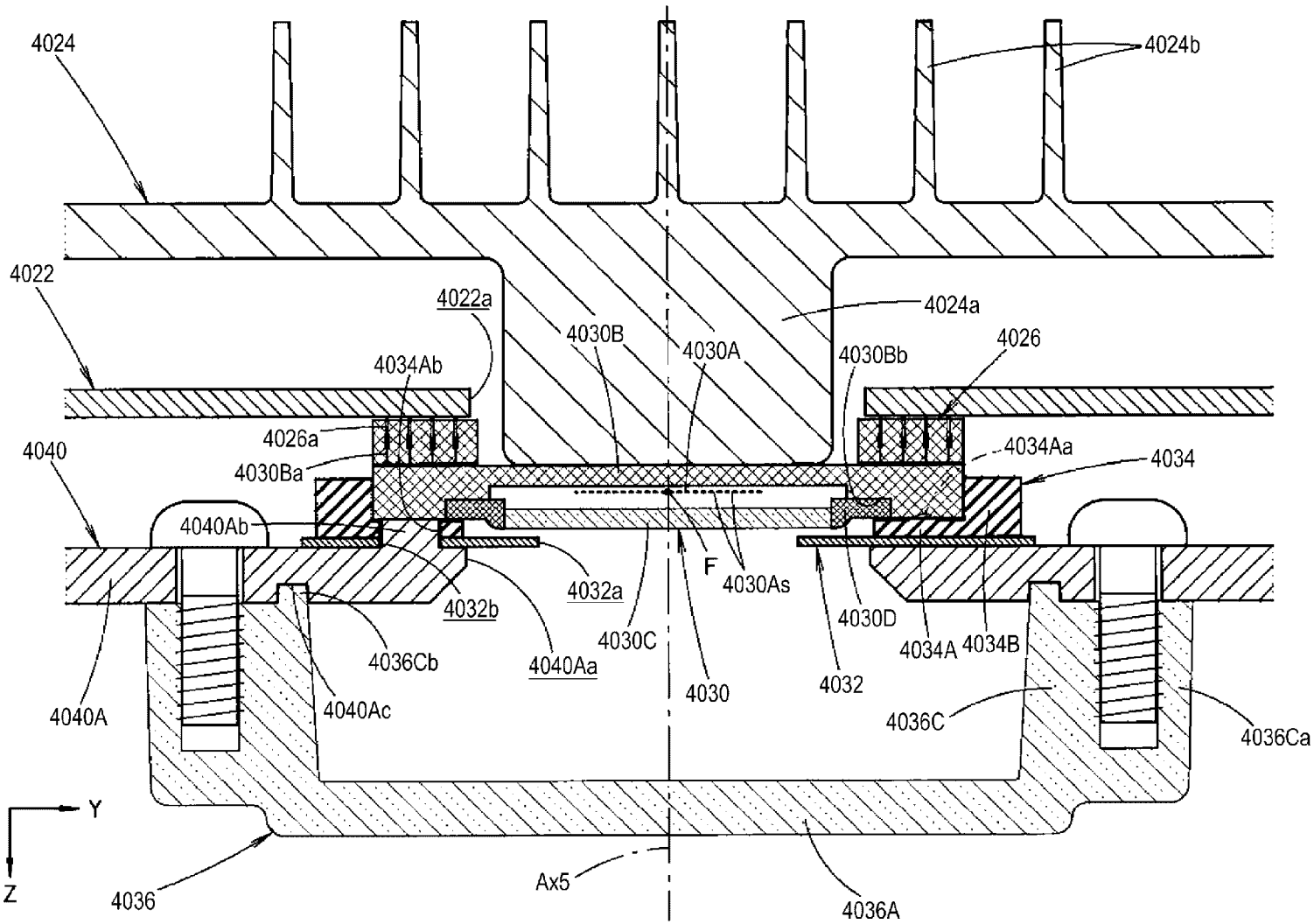
FIG. 50 is a cross-sectional view taken along line L-L of FIG. 49.

FIG. 49 is a detailed view of portion XLIX of FIG. 41. FIG. 50 is a cross-sectional view taken along line L-L of FIG. 49.

As shown in these figures, the spatial light modulator 4030 is a reflective spatial light modulator, and includes: a reflection control unit 4030A; a housing portion 4030B configured to accommodate the reflection control unit 4030A; a translucent plate 4030C arranged on the unit front side of the reflection control unit 4030A; and a seal portion 4030D. The reflection control unit 4030A includes a plurality of reflecting elements 4030As configured to reflect reflected light from the reflector 4054. The seal portion 4030D seals the translucent plate 4030C to the housing portion 4030B at a peripheral edge portion of the translucent plate 4030C.

Specifically, the spatial light modulator 4030 is a digital micromirror device (DMD), and the reflection control unit 4030A thereof has a configuration in which several hundreds of thousands of micromirrors are arranged in a matrix as the plurality of reflecting elements 4030As. The reflection control unit 4030A has a laterally elongated rectangular outer shape centered on the optical axis Ax5 in a front view of the unit, and a size thereof is set to, for example, about vertical 6×horizontal 12 mm.

The spatial light modulator 4030 is configured to selectively switch a reflection direction of the light from the pair of left and right light sources 4052 that has reached the reflecting elements 4030As by controlling an angle of a reflecting surface of each of the plurality of reflecting elements 4030As that constitute the reflection control unit 4030A. Specifically, a first mode in which the light from the pair of left and right light sources 4052 is reflected in a direction of an optical path R1 toward the projection lens 4072 and a second mode in which the light is reflected in an optical path R2 toward a direction deviated from the projection lens 4072 (that is, a direction that does not adversely affect formation of the light distribution patterns) are selected.

Figure 51:
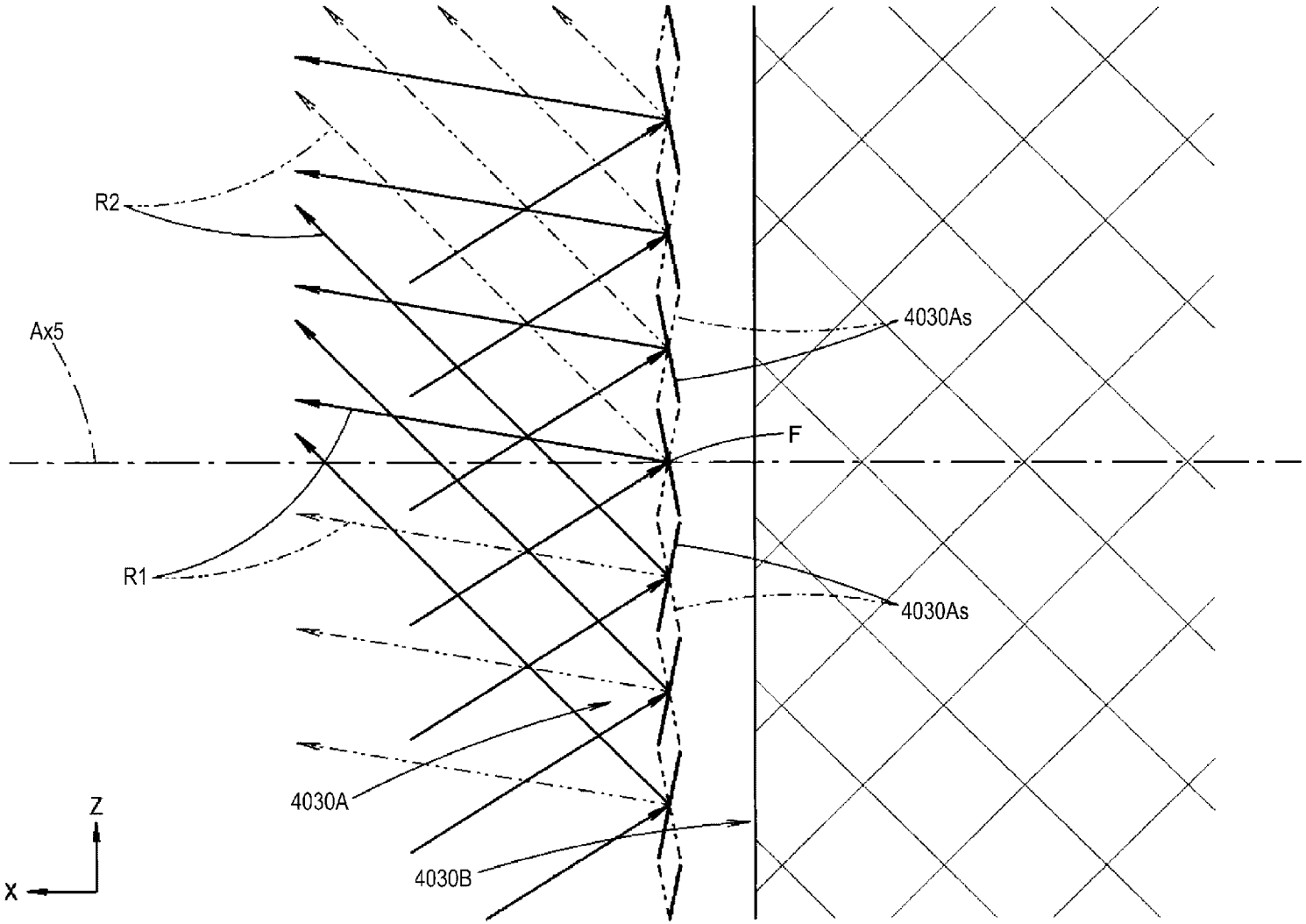
FIG. 51 is a detailed view of a main part of FIG. 49.

FIG. 51 is a detailed view of a main part of FIG. 49.

As shown in FIG. 51, each reflecting element 4030As can rotate around a horizontal axis extending in the left-right direction. In the first mode, each reflecting element 4030As is inclined downward by a predetermined angle (for example, about 12 degrees) with respect to the vertical plane orthogonal to the optical axis Ax5, and reflects the reflected light from the reflector 4054 (see FIG. 41) toward the front side of the unit as slightly upward light (light of the optical path R1). On the other hand, in the second mode, each reflecting element 4030As is inclined upward by a predetermined angle (for example, about 12 degrees) with respect to the vertical plane orthogonal to the optical axis Ax5, and reflects the reflected light from the reflector 4054 toward the front side of the unit as considerably upward light (light of the optical path R2).

The switching between the first mode and the second mode is performed by controlling energization of an electrode (not shown) arranged in the vicinity of a member (not shown) that rotatably supports each reflecting element 4030As. In a neutral state where the energization is not performed, the reflecting elements 4030As are configured such that the reflecting surfaces thereof are flush with each other along the vertical plane orthogonal to the optical axis Ax5.

The rear focus F of the projection lens 4072 (see FIG. 41) is set at a position of an intersection between a vertical plane formed by the reflecting surfaces of the plurality of reflecting elements 4030As in the neutral state and the optical axis Ax5.

In FIG. 51, the reflecting element 4030As located on the optical axis Ax5 and the reflecting element 4030As located above the optical axis Ax5 are in a first mode angular position, and the reflecting element 4030As positioned below the optical axis Ax5 is in a second mode angular position.

As shown in FIGS. 49 and 50, the translucent plate 4030C of the spatial light modulator 4030 is formed of a flat plate-shaped glass plate which has a laterally elongated rectangular outer shape, and a plate thickness thereof is set to a value of about 1 to 1.5 mm.

An annular step portion 4030Bb is formed on an inner peripheral edge portion of a front surface of the housing portion 4030B of the spatial light modulator 4030. The seal portion 4030D of the spatial light modulator 4030 is formed by filling a sealing material which contains an organic material between an outer peripheral surface of the translucent plate 4030C and the annular step portion 4030Bb of the housing portion 4030B, so that a gap between the two members is completely sealed.

A front surface of the spatial light modulator 4030 is displaced to the unit rear side at a position of the seal portion 4030D, so that the front surface of the housing portion 4030B is stepped down to the unit rear side with respect to a front surface of the translucent plate 4030C.

A rear surface of the housing portion 4030B of the spatial light modulator 4030 is supported by the support board 4022 via a socket 4026.

The socket 4026 is configured as a laterally elongated rectangular frame member along a peripheral edge portion of the rear surface of the housing portion 4030B. Meanwhile, the support board 4022 is arranged to extend along the vertical plane orthogonal to the optical axis Ax5 on the unit rear side of the socket 4026. An opening portion 4022*a* that has substantially the same shape as an inner peripheral surface shape of the socket 4026 is formed in the support board 4022, and a conductive pattern (not shown) is formed on a front surface of the support board 4022. The socket 4026 is fixed to the support board 4022 in a state of being electrically connected to the conductive pattern formed on the support board 4022.

The peripheral edge portion of the rear surface of the housing portion 4030B of the spatial light modulator 4030 is formed with a plurality of terminal pins 4030Ba that protrudes toward the rear side of the unit. Meanwhile, the socket 4026 is formed with a plurality of terminal pins 4026*a* that protrudes from a rear surface thereof toward the rear side of the unit at positions corresponding to the plurality of terminal pins 4030Ba.

A base end portion (that is, a front end portion of a portion embedded in the socket 4026) of each terminal pin 4026*a* of the socket 4026 has a substantially cylindrical shape, and a tip end portion of each terminal pin 4030Ba of the spatial light modulator 4030 is fitted into the base end portion, so that the spatial light modulator 4030 and the socket 4026 are electrically connected to each other.

A tip end portion (that is, a rear end portion) of each terminal pin 4026*a* of the socket 4026 is soldered to the conductive pattern (not shown) of the control board 4022. Therefore, the socket 4026 is arranged in a state where the rear surface thereof slightly floats from the front surface of the support board 4022.

The spatial light modulator 4030 of the spatial light modulation unit 4020 is supported by the vertical surface portion 4040A of the bracket 4040 and the heat sink 4024 from two sides in the unit front-rear direction.

A laterally elongated rectangular opening portion 4040Aa is formed in the vertical surface portion 4040A of the bracket 4040. The opening portion 4040Aa is centered on a position displaced downward from the optical axis Ax5 so as to surround the optical axis Ax5. As for an inner peripheral surface shape of the opening portion 4040Aa, an upper end surface and left and right side end surfaces thereof are set to a value larger than an outer peripheral surface shape of the translucent plate 4030C of the spatial light modulator 4030 and smaller than an outer peripheral surface shape of the seal portion 4030D, while a lower end surface thereof is set to a value larger than the outer peripheral surface shape of the seal portion 4030D. Further, a front end edge of an inner peripheral surface of the opening portion 4040Aa is chamfered over an entire circumference thereof.

As shown in FIG. 50, cylindrical protruding portions 4040Ab are formed on a rear surface of the vertical surface portion 4040A of the bracket 4040 so as to protrude toward the rear side of the unit at three locations around the opening portion 4040Aa. Tip end surfaces (that is, rear end surfaces) of the protruding portions 4040Ab at the three locations of the vertical surface portion 4040A of the bracket 4040 are abutted against the housing portion 4030B from the unit front side. The protruding portion 4040Ab at the three locations are abutted against an up-down direction central position of a right end portion of the housing portion 4030B and abutted against an upper position and a lower position of a left end portion of the housing portion 4030B.

A plate-shaped member 4032 and a gasket 4034 are arranged between the vertical surface portion 4040A of the bracket 4040 and the spatial light modulator 4030.

The plate-shaped member 4032 is made of an aluminum plate which has a larger outer peripheral surface shape than that of the housing portion 4030B of the spatial light modulator 4030, and a surface thereof is subjected to black alumite treatment.

A laterally elongated rectangular opening portion 4032*a* centered on the optical axis Ax5 is formed in the plate-shaped member 4032 so as to surround the reflection control unit 4030A of the spatial light modulator 4030. The opening portion 4032*a* has an opening shape that is smaller than the outer peripheral surface shape of the translucent plate 4030C, so that the plate-shaped member 4032 covers the seal portion 4030D of the spatial light modulator 4030 from the unit front side.

The plate-shaped member 4032 has a plate thickness that is smaller than that of the translucent plate 4030C of the spatial light modulator 4030 (for example, a plate thickness of about 0.3 to 0.6 mm), and is arranged in a state of being in surface contact with the rear surface of the vertical surface portion 4040A of the bracket 4040. The plate-shaped member 4032 is arranged at a position that is spaced apart from the translucent plate 4030C of the spatial light modulator 4030 on the unit front side, and a gap between the two members is set to a value that is smaller than the plate thickness of the translucent plate 4030C (for example, a value of about 0.5 mm).

Insertion hole 4032*b* where the protruding portions 4040Ab are inserted are formed in the plate-shaped member 4032 at positions corresponding to the three protruding portions 4040Ab formed on the rear surface of the vertical surface portion 4040A of the bracket 4040. Two insertion holes 4032*b* among the three insertion holes 4032*b* have a circular shape that is slightly larger than an outer diameter of the protruding portion 4040Ab, so that the plate-shaped member 4032 is positioned in a direction orthogonal to the optical axis Ax5 by engagement with the vertical surface portion 4040A of the bracket 4040.

Meanwhile, the gasket 4034 is made of silicone rubber, and is interposed between the plate-shaped member 4032 and the housing portion 4030B of the spatial light modulator 4030.

A front surface of the gasket 4034 is formed in a planar shape, and is in surface contact with the plate-shaped member 4032.

The gasket 4034 has an outer peripheral surface shape that is slightly smaller than an outer peripheral surface shape of the plate-shaped member 4032, and has an inner peripheral surface shape that is slightly smaller than an outer peripheral surface shape of the seal portion 4030D of the spatial light modulator 4030.

A portion of the gasket 4034 located on the unit front side of the housing portion 4030B is formed as a thin portion 4034A, and a portion of the gasket 4034 surrounding the housing portion 4030B is formed as a thick portion 4034B. A thickness of the thin portion 4034A is set to a value that is slightly smaller than a difference between a length of the protruding portion 4040Ab of the bracket 4040 and the plate thickness of the plate-shaped member 4032. Dome-shaped protruding portions 4034Aa that protrude toward the rear side of the unit are formed on a rear surface of the thin portion 4034A at four locations in a peripheral direction (specifically, left-right direction central positions on upper and lower sides, an up-down direction central position on a left side, and a lower position on a right side). A protrusion height of each protruding portion 4034Aa is set to a value that is larger than an interval between the thin portion 4034A and the housing portion 4030B.

As a result, when each protruding portion 4040Ab of the bracket 4040 is abutted against the housing portion 4030B, an apex portion of each protruding portion 4034Aa of the gasket 4034 is abutted against the housing portion 4030B and elastically deformed, so that the housing portion 4030B is prevented from being excessively pressed.

Moreover, insertion holes 4034Ab where the protruding portions 4040Ab of the bracket 4040 are inserted are formed in the thin portion 4034A of the gasket 4034 at positions corresponding to the three insertion holes 4032*b* of the gasket 4034.

As shown in FIGS. 49 and 50, a translucent cover 4036 which covers the opening portion 4040Aa from the unit front side is supported on the vertical surface portion 4040A of the bracket 4040.

The translucent cover 4036 is formed of a member that is made of transparent resin (for example, acrylic resin). The translucent cover 4036 includes: a front surface upper region 4036A that extends in a planar shape along the vertical plane orthogonal to the optical axis Ax5; a front surface lower region 4036B that extends in a planar shape obliquely downward and rearward from a lower end edge of the front surface upper region 4036A; and an outer peripheral flange portion 4036C formed to surround the front surface upper region 4036A and the front surface lower region 4036B.

A boundary position between the front surface upper region 4036A and the front surface lower region 4036B is located below the optical axis Ax5. The front surface lower region 4036B of the translucent cover 4036 transmits reflected light from the reflector 4054. The front surface upper region 4036A of the translucent cover 4036 is configured to transmit reflected light from the reflecting element 4030As in the first mode. An upper region of the outer peripheral flange portion 4036C of the translucent cover 4036 is configured to transmit reflected light from the reflecting element 4030As in the second mode.

A pair of left and right boss portions 4036Ca formed on left and right sides of the outer peripheral flange portion 4036C of the translucent cover 4036 are fixed to the vertical surface portion 4040A of the bracket 4040 by screwing.

An annular groove portion 4040Ac which extends to surround the opening portion 4040Aa is formed in a front surface of the vertical surface portion 4040A of the bracket 4040. Meanwhile, an annular rib 4036Cb that protrudes toward the rear side of the unit from a rear end surface of the outer peripheral flange portion 4036C is formed on the translucent cover 4036. The fixing of the translucent cover 4036 to the vertical surface portion 4040A of the bracket 4040 is performed in a state where the annular rib 4036Cb is engaged with the annular groove portion 4040Ac of the vertical surface portion 4040A.

An interval in the unit front-rear direction between the front surface upper region 4036A and the front surface lower region 4036B of the translucent cover 4036 and the translucent plate 4030C of the spatial light modulator 4030 is set to a value that is larger (for example, a value of 5 times or more) than an interval in the unit front-rear direction between the translucent plate 4030C and the reflection control unit 4030A.

Space between the translucent cover 4036 and the spatial light modulator 4030 is sealed by the vertical surface portion 4040A of the bracket 4040, the plate-shaped member 4032 and the gasket 4034 interposed between the translucent cover 4036 and the spatial light modulator 4030, so that foreign matter such as dust is prevented from adhering to a surface of the translucent plate 4030C of the spatial light modulator 4030.

The heat sink 4024 is a member that is made of metal (for example, aluminum die casting), and extends along the vertical plane that is orthogonal to the optical axis Ax5. A plurality of heat dissipating fins 4024*b* are formed in a vertical stripe pattern on a rear surface thereof.

A prismatic protruding portion 4024*a* that protrudes toward the front side of the unit is formed at a central portion of a front surface of the heat sink 4024. The protruding portion 4024*a* has a laterally elongated rectangular cross-sectional shape centered on the optical axis Ax5, and a size thereof is set to a value smaller than the inner peripheral surface shape of the socket 4026. A front end surface of the protruding portion 4024*a* is abutted against the housing portion 4030B of the spatial light modulator 4030 from the unit rear side in a state of being inserted into the opening portion 4022*a* of the support board 4022.

The heat sink 4024 is fixed to the vertical surface portion 4040A of the bracket 4040 by two pairs of left and right stepped bolts 4042 in a state where a front end surface of the protruding portion 4024*a* is abutted against the housing portion 4030B of the spatial light modulator 4030 (see FIGS. 47 and 48). The fixing is performed in a state where the spatial light modulator 4030 abutted against the protruding portion 4024*a* of the heat sink 4024 is elastically pressed toward the front side of the unit by a compression coil spring 4044 attached to a large diameter portion of each stepped bolt 4042.

As shown in FIG. 47, a pair of left and right shafts 4024*c* which protrude toward the front side of the unit are formed on a front surface of the heat sink 4024. Each shaft 4024*c* is located at a center of the pair of upper and lower stepped bolts 4042, and is formed in a cylindrical shape.

Meanwhile, a pair of left and right shaft positioning holes 4040Ad are formed in the vertical surface portion 4040A of the bracket 4040 so as to position the heat sink 4024 with respect to the bracket 4040 in the direction orthogonal to the optical axis Ax5 in a state where tip end portions of the pair of left and right shafts 4024*c* are inserted.

Each shaft positioning hole 4040Ad of the vertical surface portion 4040A slidably engages with each shaft 4024*c* over a certain length, so that the front end surface of the protruding portion 4024*a* of the heat sink 4024 is prevented from being inclined with respect to the vertical surface orthogonal to the optical axis Ax5.

A pair of left and right shaft insertion holes (not shown) where the pair of left and right shafts 4024*c* are inserted are formed in the support board 4022.

As shown in FIGS. 47 and 48, clamping members 4046 which are configured to clamp the support board 4022 from two sides in the unit front-rear direction are mounted at two upper and lower locations on left and right end surfaces of the support board 4022. Each clamping member 4046 is formed by welding two metal plates which are formed in an L-shape in a plan view to each other in a state where the two metal plates are spaced apart from each other in the unit front-rear direction. A portion of each clamping member 4046 where the two metal plates overlap with each other is fixed to the vertical surface portion 4040A of the bracket 4040 by screwing.

Each clamping member 4046 is formed with an elongated hole (not shown) extending in the unit front-rear direction, and a position of the support board 4022 with respect to the vertical surface portion 4040A of the bracket 4040 can be finely adjusted in the unit front-rear direction by screwing in the elongated hole.

As a result, as shown in FIGS. 49 and 50, a state where the plurality of terminal pins 4030Ba formed on the rear surface of the housing portion 4030B of the spatial light modulator 4030 are properly fitted into the plurality of fitting holes (that is, the base end portions of the terminal pins 4026*a* which are formed in the substantially cylindrical shape) formed in the socket 4026 (that is, a state where electric connection between the spatial light modulator 4030 and the socket 4026 is reliably performed) is maintained.

Next, the configuration of the lens side sub-assembly 4070 will be described.

As shown in FIG. 41, the projection lens 4072 includes first, second and third lenses 4072A, 4072B, 4072C that are made of resin and arranged at predetermined intervals in the unit front-rear direction on the optical axis Ax5.

The first lens 4072A that is located closest to the unit front side is configured as a plano-convex lens that bulges toward the front side of the unit. The second lens 4072B that is located in the middle is configured as a biconcave lens. The third lens 4072C that is located closest to the unit rear side is configured as a biconvex lens. Upper end portions of the first to third lenses 4072A to 4072C are cut slightly along the horizontal plane, and lower portions thereof are cut relatively large along the horizontal plane.

Outer peripheral edge portions of the first to third lenses 4072A to 4072C are supported by the common lens holder 4074.

As shown in FIG. 40, the lens holder 4074 is a member that is made of metal (for example, aluminum die casting), and includes: a holder body 4074A that surrounds the projection lens 4072 in a cylindrical shape; and a pair of left and right flange portions 4074B that protrude on left and right sides from a lower end portion of an outer peripheral surface of the holder body 4074A.

A first metal fitting 4076A is mounted to the holder body 4074A from the unit front side, and a second metal fitting 4076B is mounted from the unit rear side. The first to third lenses 4072A to 4072C are supported in a predetermined positional relationship with respect to the holder body 4074A by the first and second metal fittings 4076A, 4076B and a support structure (not shown).

A pair of left and right flange portions 4074B protrude slightly downward toward left and right sides from a lower end portion of an outer peripheral surface of the holder body 4074A, and tip end portions thereof extend along the horizontal plane.

As shown in FIG. 39, two front and rear locations of the tip end portion of each flange portion 4074B of the lens holder 4074 are screwed to the horizontal surface portion 4040B of the bracket 4040.

Each flange portion 4074B is formed with an elongated hole (not shown) extending in the unit front-rear direction, and a position of the lens holder 4074 with respect to the horizontal surface portion 4040B of the bracket 4040 can be finely adjusted in the unit front-rear direction by screwing in the elongated hole. As a result, a position of the rear focus F of the projection lens 4072 can be set in consideration of optical path deviation caused by refraction generated when the reflected light from each reflecting element 4030As passes through the translucent plate 4030C and the translucent cover 4036.

Since the pair of left and right flange portions 4074B of the lens holder 4074 protrude slightly downward toward the left and right sides, a gap S2 is formed between the holder body 4074A and the horizontal surface portion 4040B of the bracket 4040. An up-down width of the gap S2 is set to a value of 1 mm or more (for example, about 1 to 5 mm).

As shown in FIGS. 39, 41, and 46, the light shielding cover 4090 which is configured to shield the light reflected from each of the plurality of reflecting elements 4030As when the second angular position is taken is arranged between the spatial light modulation unit 4020 and the lens side sub-assembly 4070.

The light shielding cover 4090 is formed of a plate-shaped member which is subjected to surface treatment to restrict light reflection, and is formed to cover space between the lens holder 4074 and the vertical surface portion 4040A of the bracket 4040 from above. A pair of front and rear flange portions 4090*a* formed on left and right sides of the light shielding cover 4090 are fixed to the horizontal surface portion 4040B of the bracket 4040 by screwing.

The light shielding cover 4090 is configured as a conductive member that is electrically grounded to a vehicle body side conductive member (not shown) via the bracket 4040.

Specifically, the light shielding cover 4090 is formed of an aluminum plate (specifically, an aluminum die cast product formed in a substantially semi-cylindrical shape) which is subjected to black alumite treatment. When the light shielding cover 4090 is screwed to the horizontal surface portion 4040B of the bracket 4040, a portion subjected to the black alumite treatment is scraped off, so that conduction with the bracket 4040 can be achieved.

When the light shielding cover 4090 is fixed to the horizontal surface portion 4040B of the bracket 4040, a black alumite treated portion of a portion to be in surface contact with the horizontal surface portion 4040B (that is, lower surfaces of two left and right pairs of the flange portions 4090*a*) may be peeled off in advance, so that the conduction with the bracket 4040 can be more reliably performed.

In the state where the light shielding cover 4090 is fixed to the horizontal surface portion 4040B of the bracket 4040, a shape of the light shielding cover 4090 is set such that a front end portion thereof covers a rear end portion of the lens holder 4074 while a rear end edge thereof is located in the vicinity of the vertical surface portion 4040A of the bracket 4040 on the front side of the unit.

Meanwhile, as shown in FIGS. 39, 41, and 46, the upper cover 4092 and the lower cover 4094 are arranged around the board 4022.

The upper cover 4092 and the lower cover 4094 are formed by bending a metal plate (for example, an aluminum plate). The upper cover 4092 is arranged to surround an upper region of the board 4022. The lower cover 4094 is arranged to surround a lower region of the board 4022.

The upper cover 4092 covers space between the vertical surface portion 4040A of the bracket 4040 and the heat sink 4024 from an upper side and left and right sides. The lower cover 4094 covers the board 4022 from front, rear, left, and right sides below the vertical surface portion 4040A of the bracket 4040 and the heat sink 4024.

The upper cover 4092 and the lower cover 4094 are abutted against the bracket 4040 and the heat sink 4024 from upper and lower sides. Left and right side portions 4092*a*, 4094*a* of the upper cover 4092 and the lower cover 4094 are integrated by screwing in a state where the left and right side portions 4092*a*, 4094*a* partially overlap each other.

The upper cover 4092 is formed with a pair of left and right locking pieces 4092*b* configured to lock the vertical surface portion 4040A of the bracket 4040 at left and right end portions of the vertical surface portion 4040A, and a plurality of locking pieces 4092*c* configured to lock the heat sink 4024 at a plurality of locations in the left-right direction.

Meanwhile, the lower cover 4094 is formed with a pair of left and right locking pieces 4094*b* configured to lock the vertical surface portion 4040A of the bracket 4040 at the left and right end portions of the vertical surface portion 4040A. An inclined surface portion 4094*c* that extends obliquely downward and forward from an upper end edge of a front surface portion of the lower cover 4094 is formed on the lower cover 4094. The inclined surface portion 4094*c* of the lower cover 4094 is fixed to the base member 4060 by screwing.

Like the light shielding cover 4090, the upper cover 4092 and the lower cover 4094 are configured as electrically grounded second conductive members.

As a result, the light shielding cover 4090, the upper cover 4092 and the lower cover 4094 function as electromagnetic shields which are configured to protect the spatial light modulator 4030 from noise generated due to repetition of lighting and extinguishing of the light source 4052, so it is possible to effectively prevent control of the spatial light modulator 4030 from being adversely affected.

Next, an operation of the present embodiment will be described.

The lamp unit 4010 according to the present embodiment is an in-vehicle lamp unit configured to emit the light from the light source 4052 reflected by the spatial light modulator 4030 toward the front side of the unit via the projection lens 4072 (optical member). Various light distribution patterns can be formed with high accuracy by controlling spatial distribution of the reflected light in the spatial light modulator 4030.

In order to realize such a function, the spatial light modulator 4030 is configured such that each of the plurality of reflecting elements 4030As constituting the reflection control unit 4030A thereof is capable of taking the first angular position to reflect the light from the light source 4052 that reaches the reflecting element 4030As toward the projection lens 4072, and taking the second angular position to reflect in the direction deviated from the projection lens 4072. The light shielding cover 4090 which shields the light reflected from each of the plurality of reflecting elements 4030As when the second angular position is taken is arranged between the spatial light modulator 4030 and the projection lens 4072. Therefore, light that does not contribute to formation of the light distribution patterns can be prevented from becoming stray light.

In the present embodiment, the light shielding cover 4090 is made of the electrically grounded conductive member. Therefore, the light shielding cover 4090 can function as the electromagnetic shield that protects the spatial light modulator 4030 from the noise generated due to the repetition of lighting and extinguishing of the light source 4052, thereby effectively preventing the control of the spatial light modulator 4030 from being adversely affected.

According to the present embodiment, an influence of the noise on the spatial light modulator 4030 can be minimized in the lamp unit 4010 that includes the reflective spatial light modulator 4030.

In the present embodiment, the light shielding cover 4090 is formed of the plate-shaped member that is subjected to the surface treatment to restrict light reflection. Therefore, the reflected light from each of the plurality of reflecting elements 4030As when the second angular position is taken can be effectively prevented from being re-reflected by the light shielding cover 4090 and becoming stray light, thereby a light shielding function of the light shielding cover 4090 can be improved.

The light shielding cover 4090 is formed of the aluminum plate which is subjected to the black alumite treatment. Therefore, re-reflection of the light shielding cover 4090 can be more effectively prevented, thereby the light shielding function of the light shielding cover 4090 can be further improved.

Further, the electrically grounded upper cover 4092 and lower cover 4094 (second conductive members) are arranged around the board 4022 where the spatial light modulator 4030 is placed so as to surround the board 4022. Therefore, an electromagnetic shielding function for preventing the influence of the noise on the spatial light modulator 4030 can be further improved.

The spatial light modulator 4030 includes: the reflection control unit 4030A in which the plurality of reflecting elements 4030As configured to reflect the light from the light source 4052 are arranged; the housing portion 4030B configured to accommodate the reflection control unit 4030A; and the translucent plate 4030C which is supported by the housing portion 4030B in the state of being arranged on the unit front side of the reflection control unit 4030A. Therefore, it is possible to prevent foreign matter from adhering to the reflection control unit 4030A.

In the lamp unit 4010 according to the present embodiment, the bracket 4040 that is configured to support the spatial light modulator 4030 is arranged on the unit front side of the spatial light modulator 4030. The opening portion 4040Aa that surrounds the translucent plate 4030C of the spatial light modulator 4030 is formed in the vertical surface portion 4040A of the bracket 4040. The translucent cover 4036 which is configured to cover the opening portion 4040Aa from the unit front side is supported on the vertical surface portion 4040A of the bracket 4040. Therefore, it is possible to prevent foreign matter from adhering to the translucent plate 4030C.

On the other hand, in the lamp unit 4010 according to the present embodiment, even when foreign matter adheres to the translucent cover 4036, the translucent cover 4036 is spaced apart from the reflection control unit 4030A farther on the unit front side than the translucent plate 4030C. Therefore, an image of the foreign matter projected by the projection lens 4072 is greatly blurred. Therefore, an unexpected shadow or glare can be effectively prevented from being generated in the light distribution pattern.

In this way, according to the present embodiment, the unexpected shadow or glare can be effectively prevented from being generated in the light distribution pattern in the lamp unit 4010 that includes the reflective spatial light modulator 4030.

In the present embodiment, the gasket 4034 is interposed between the vertical surface portion 4040A of the bracket 4040 and the housing portion 4030B of the spatial light modulator 4030 together with the plate-shaped member 4032. Therefore, sealability of space where a front surface of the translucent plate 4030C is exposed can be improved, and thus possibility of adhesion of foreign matter to the translucent plate 4030C can be further reduced.

In the present embodiment, the annular groove portion 4040Ac which extends to surround the opening portion 4040Aa is formed in the front surface of the vertical surface portion 4040A of the bracket 4040, and the translucent cover 4036 is attached to the bracket 4040 in the state of being engaged with the annular groove portion 4040Ac. Therefore, the sealability of the space where the front surface of the translucent plate 4030C is exposed can be improved, and thus the possibility of adhesion of foreign matter to the translucent plate 4030C can be further reduced.

Further, in the present embodiment, the interval in the unit front-rear direction between the translucent cover 4036 and the translucent plate 4030C is set to the value that is larger than the interval in the unit front-rear direction between the translucent plate 4030C and the reflection control unit 4030A. Therefore, the translucent cover 4036 is spaced apart from the reflection control unit 4030A on the unit front side at a position more than twice as far as the translucent plate 4030C. As a result, it is possible to greatly blur the image of the foreign matter projected by the projection lens 4072 easily. Therefore, the unexpected shadow or glare can be more effectively prevented from being generated in the light distribution pattern.

The spatial light modulator 4030 includes: the reflection control unit 4030A in which the plurality of reflecting elements 4030As are arranged; the housing portion 4030B configured to accommodate the reflection control unit 4030A; the translucent plate 4030C which is supported by the housing portion 4030B in the state of being arranged on the unit front side of the reflection control unit 4030A; and the seal portion 4030D configured to seal the peripheral edge portion of the translucent plate 4030C to the housing portion 4030B. Therefore, foreign matter such as dust can be prevented from adhering to the reflection control unit 4030A.

The plate-shaped member 4032 is arranged between the vertical surface portion 4040A of the bracket 4040, which supports the spatial light modulator 4030 on the unit front side of the spatial light modulator 4030, and the spatial light modulator 4030. The plate-shaped member 4032 includes the opening portion 4032*a* which is configured to cover the seal portion 4030D from the unit front side and to surround the reflection control unit 4030A. The gasket 4034 is interposed between the plate-shaped member 4032 and the housing portion 4030B. Therefore, the following operational effect can be obtained.

That is, the seal portion 4030D of the spatial light modulator 4030 is covered with the plate-shaped member 4032 from the unit front side. Therefore, even when external light passes through the projection lens 4072 at an angle where the external light converges on the seal portion 4030D, the converged light can be shielded by the plate-shaped member 4032, and thus the seal portion 4030D can be prevented from being melted and damaged.

Figure 53:
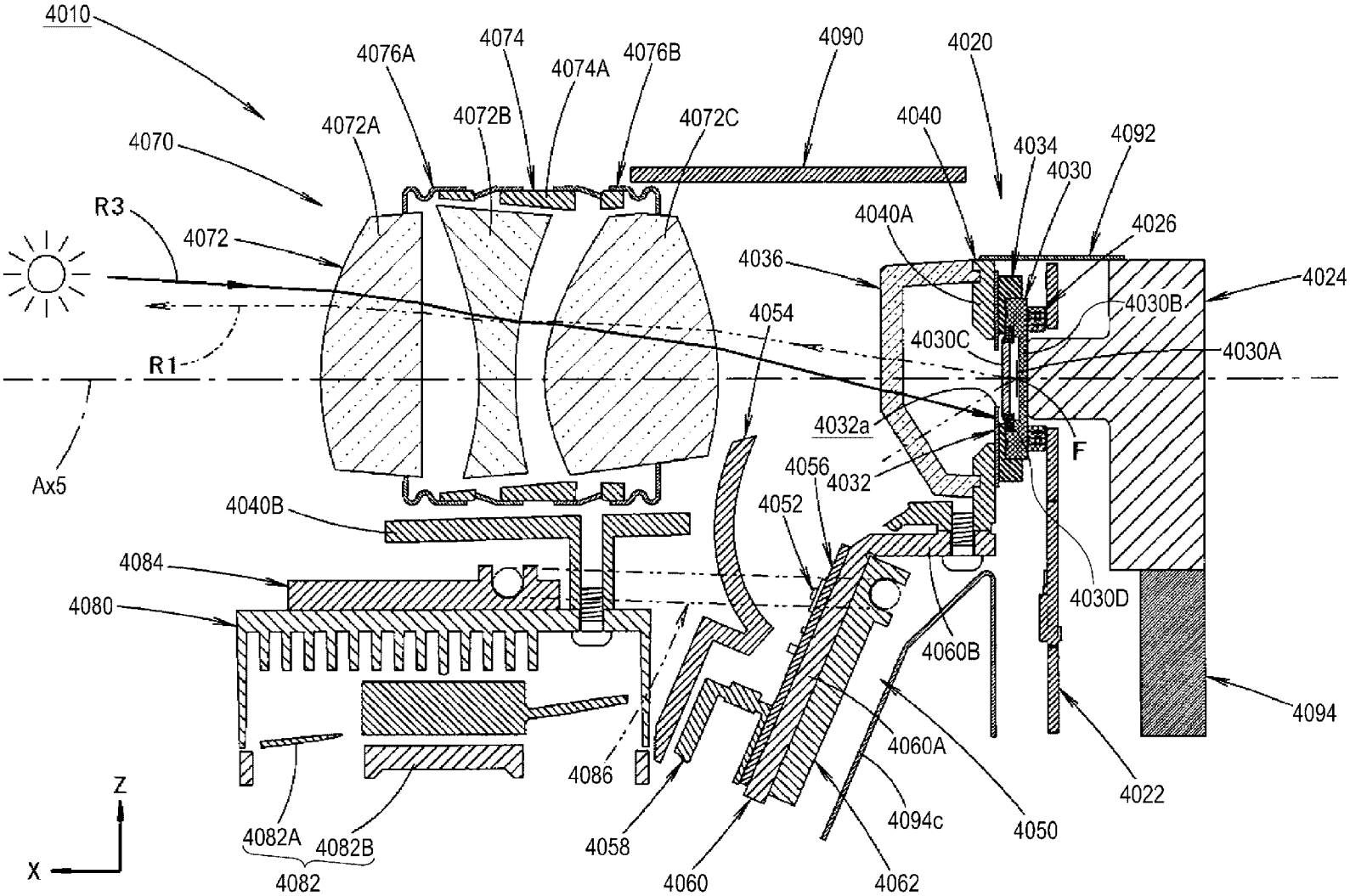
FIG. 53 specifically shows an operational effect of the seventh embodiment, which is the same as FIG. 41.

FIG. 53 specifically shows such an operational effect, which is the same as FIG. 41.

FIG. 53 shows a state where the lamp unit 4010 is irradiated with external light from a direction close to a horizontal direction, such as sunlight of morning and evening.

As shown in FIG. 53, the external light from the direction close to the horizontal direction is light traveling toward the spatial light modulator 4030 through the projection lens 4072 and the translucent cover 4036 in an optical path R3 that is substantially opposite to the optical path R1 of the light emitted from the lamp unit 4010.

In FIG. 53, if the plate-shaped member 4032 is not provided, the light directed to the spatial light modulator 4030 in the optical path R3 reaches a lower region of the seal portion 4030D below the translucent plate 4030C, and the external light reaches the lower region of the seal portion 4030D as converged light since the seal portion 4030D is located at a position close to the rear focus F of the projection lens 4072 in the unit front-rear direction.

In practice, the seal portion 4030D is covered by the plate-shaped member 4032 from the unit front side. Therefore, the converged light directed to the spatial light modulator 4030 in the optical path R3 is shielded by the plate-shaped member 4032 and does not reach the seal portion 4030D, and thus the seal portion 4030D is prevented from being melted and damaged.

In this way, according to the present embodiment, the seal portion 4030D of the spatial light modulator 4030 can be prevented from being melted and damaged by the external light in the lamp unit 4010 that includes the reflective spatial light modulator 4030. As a result, sealability of internal space of the spatial light modulator 4030 can be prevented from being impaired.

In the present embodiment, the gasket 4034 is interposed between the plate-shaped member 4032 and the housing portion 4030B. Therefore, the plate-shaped member 4032 can be supported without applying an excessive load to the spatial light modulator 4030, and thus functions of the spatial light modulator 4030 can be prevented from being impaired.

Further, the plate-shaped member 4032 is formed of the aluminum plate whose surface is subjected to the black alumite treatment. Therefore, light reflected by the surface of the plate-shaped member 4032 can be effectively prevented from becoming stray light and being emitted to the front side of the lamp unit.

In the present embodiment, the plate-shaped member 4032 is positioned in the direction orthogonal to the unit front-rear direction by engaging with the bracket 4040. Therefore, accuracy of a positional relationship between the reflection control unit 4030A of the spatial light modulator 4030 and the opening portion 4032*a* of the plate-shaped member 4032 can be improved, and thus the seal portion 4030D of the spatial light modulator 4030 can be covered in an appropriate state.

The protruding portions 4040Ab are formed at the plurality of locations on the rear surface of the vertical surface portion 4040A of the bracket 4040. Therefore, the plate-shaped member 4032 can be easily positioned in the direction orthogonal to the unit front-rear direction by engaging the protruding portions 4040Ab with the plate-shaped member 4032.

Further, the protruding portions 4034Aa are formed at the plurality of locations on the rear surface of the gasket 4034. Therefore, the plate-shaped member 4032 can be easily supported in a proper manner without applying an excessive load to the spatial light modulator 4030 by abutting the protruding portions 4034Aa against the housing portion 4030B and elastically deforming the gasket 4034.

The plate-shaped member 4032 is formed with the plate thickness that is thinner than that of the translucent plate 4030C. Therefore, it is possible to easily prevent optical paths of the light that enters the spatial light modulator 4030 from the light source 4052 and the light that is reflected by the spatial light modulator 4030 from being inadvertently obstructed by the plate-shaped member 4032.

Further, the plate-shaped member 4032 is arranged at the position that is spaced apart from the translucent plate 4030C on the unit front side, and the gap between the plate-shaped member 4032 and the translucent plate 4030C is set to the value that is smaller than the plate thickness of the translucent plate 4030C. Therefore, interference between the plate-shaped member 4032 and the translucent plate 4030C is prevented, and thus it is possible to easily prevent the optical paths of the light that enters the spatial light modulator 4030 from the light source 4052 and the light that is reflected by the spatial light modulator 4030 from being inadvertently obstructed by the plate-shaped member 4032.

In the lamp unit 4010, the base member 4060 (light source support member) which is configured to support the light source 4052 via the board 4056 is arranged below the spatial light modulator 4030. Therefore, it is possible to easily arrange the projection lens 4072 at a position close to a surface of a vehicle body, and thus a degree of freedom in vehicle design can be improved.

In the lamp unit 4010, the heat sink 4080 (heat dissipating member) which is configured to dissipate heat generated by lighting of the light source 4052 is arranged on the unit front side of the base member 4060 and below the projection lens 4072. The heat transfer plate 4084 fixed to the heat sink 4080 and the heat transfer plate 4062 fixed to the base member 4060 are connected to each other via the heat pipe 4086 (heat transfer member). Therefore, a heat dissipation function can be ensured without increasing an up-down direction dimension of the lamp unit 4010.

In this way, according to the present embodiment, the heat dissipation function can be ensured without increasing the up-down direction dimension even when the base member 4060 is arranged below the spatial light modulator 4030 in the lamp unit 4010 that includes the reflective spatial light modulator 4030. As a result, the degree of freedom in vehicle design can be improved, and arrangement space of the lamp unit 4010 can be easily secured.

The heat pipe 4086 used as the heat transfer member in the present embodiment is configured as a heat transport member having a lower thermal resistance than the heat sink 4080. Therefore, heat transfer efficiency from the base member 4060 to the heat sink 4080 can be improved (specifically, heat conductivity is about 100 W/mK when the heat sink 4080 is made of die cast aluminum, while heat conductivity of the heat pipe 4086 is about several thousands to several tens of thousands W/mK).

In the present embodiment, the heat transfer plate 4062 that is in surface contact with the base member 4060 and the heat transfer plate 4084 that is in surface contact with the heat sink 4080 are connected by the pair of left and right heat pipes 4086. Therefore, the heat generated by the lighting of the light source 4052 can be efficiently transmitted to the heat sink 4080.

The lamp unit 4010 according to the present embodiment includes the bracket 4040 configured to support the spatial light modulator 4030 and the lens holder 4074 (holder) configured to support the projection lens 4072. The bracket 4040 includes the horizontal surface portion 4040B that extends toward the front side of the unit between the lens holder 4074 and the heat sink 4080. Therefore, the heat dissipated from the heat sink 4080 is received by the horizontal surface portion 4040B of the bracket 4040, and thus the heat can be prevented from being directly transmitted to the lens holder 4074. As a result, optical characteristics of the projection lens 4072 can be effectively prevented from being changed due to an influence of the heat.

In the present embodiment, the heat sink 4080 is attached to the horizontal surface portion 4040B of the bracket 4040 in the state where the gap S1 is formed between the heat sink 4080 and the horizontal surface portion 4040B of the bracket 4040. Therefore, the heat dissipated from the heat sink 4080 can become less likely to be transmitted to the bracket 4040, and thus a thermal effect on the projection lens 4072 can be further reduced.

In the present embodiment, the lens holder 4074 is attached to the horizontal surface portion 4040B of the bracket 4040 in the state where the gap S2 is formed between the lens holder 4074 and the horizontal surface portion 4040B of the bracket 4040. Therefore, the heat dissipated from the horizontal surface portion 4040B of the bracket 4040 can become less likely to be transmitted to the lens holder 4074, and thus the thermal effect on the projection lens 4072 can be further reduced.

Further, in the present embodiment, the heat dissipating fan 4082 is arranged below the heat sink 4080. Therefore, it is possible to promote a heat dissipation effect of the heat sink 4080 by wind generated by the heat dissipating fan 4082.

Although the unit front-rear direction (that is, a direction in which the optical axis Ax5 extends) is orthogonal to a direction in which the reflection control unit 4030A of the spatial light modulator 4030 extends in a planar shape in the above seventh embodiment, the reflection control unit 4030A may also extend in a direction that is inclined with respect to the plane orthogonal to the unit front-rear direction.

Although the light emitted from the light source 4052 reflected by the reflector 4054 is reflected by the spatial light modulator 4030 in the above seventh embodiment, it is also possible to employ a configuration in which the light emitted from the light source 4052 whose deflection is controlled by a lens or the like is reflected by the spatial light modulator 4030 or a configuration in which the light emitted from the light source 4052 is directly reflected by the spatial light modulator 4030.

Although the lamp unit 4010 is described as an in-vehicle lamp unit in the above seventh embodiment, the lamp unit 4010 may also be used in applications other than in-vehicle use.

Next, a modification of the seventh embodiment will be described.

First, a first modification of the seventh embodiment will be described.

Figure 54:
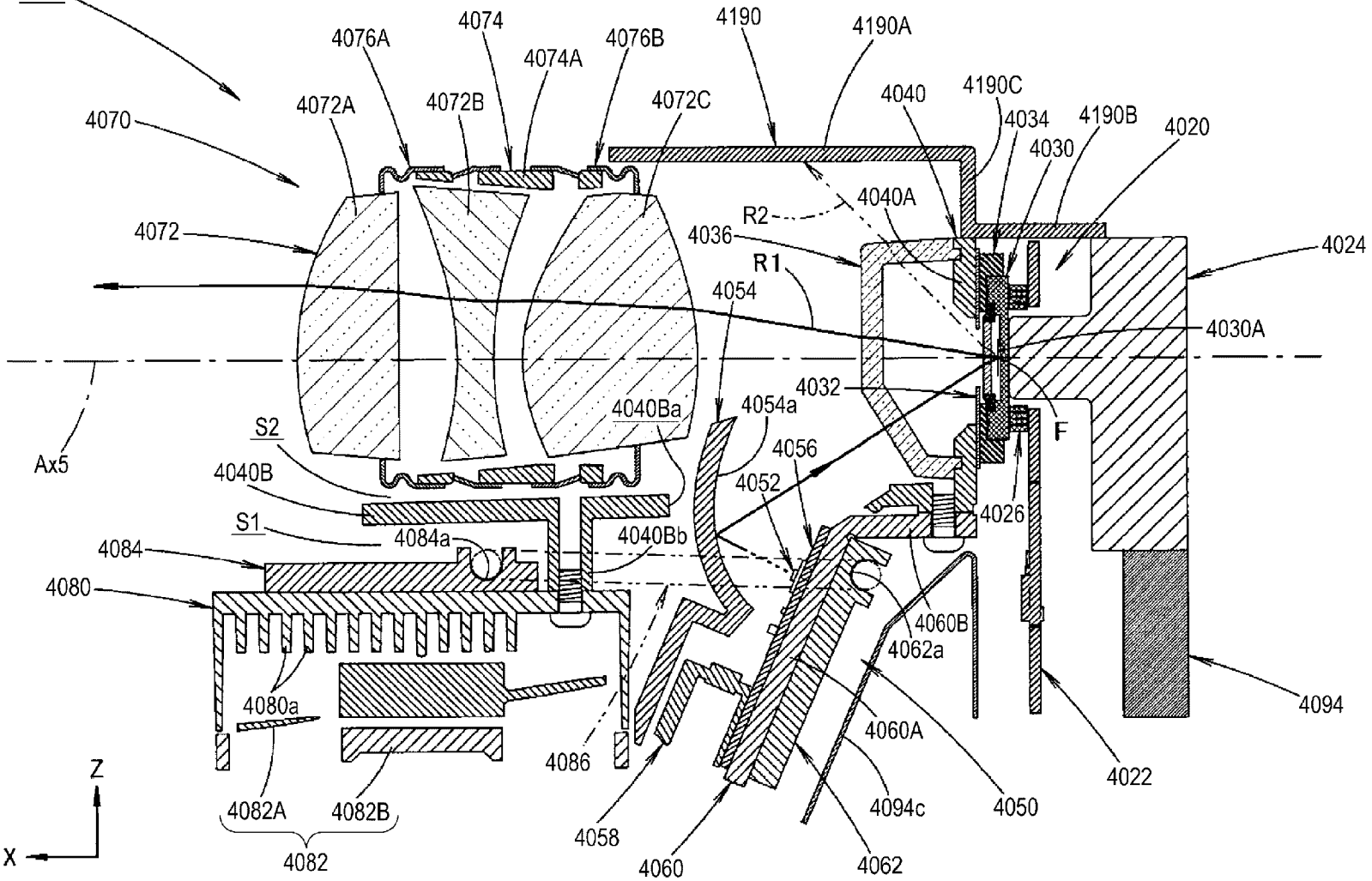
FIG. 54 shows a lamp unit according to a first modification of the seventh embodiment, which is the same as FIG. 41.

FIG. 54 shows a lamp unit 4110 according to the present modification, which is the same as FIG. 41.

As shown in FIG. 54, a basic configuration of the present modification is the same as that of the seventh embodiment, except that a configuration of a light shielding cover 4190 is partially different from that of the seventh embodiment.

That is, in the present modification, the light shielding cover 4190 which corresponds to the light shielding cover 4090 of the seventh embodiment is extended to the unit rear side, and the light shielding cover 4190 also functions as the upper cover 4092 of the seventh embodiment.

Specifically, the light shielding cover 4190 includes: a light shielding portion 4190A which has the same configuration as the light shielding cover 4090 of the seventh embodiment; an upper cover portion 4190B which covers the space between the vertical surface portion 4040A of the bracket 4040 and the heat sink 4024 from an upper side and left and right sides; and a connecting portion 4190C that connects the light shielding portion 4190A and the upper cover portion 4190B.

In the present modification, the lower cover 4094 is fixed to the upper cover portion 4190B of the light shielding cover 4190 by screwing. In this way, the lamp unit 4110 according to the present modification does not include the upper cover 4092 of the seventh embodiment.

By employing the configuration of the present modification, the function as the electromagnetic shield that protects the spatial light modulator 4030 from the noise generated due to the repetition of lighting and extinguishing of the light source 4052 can be effectively exhibited with a small number of components.

Next, a second modification of the seventh embodiment will be described.

Figure 55:
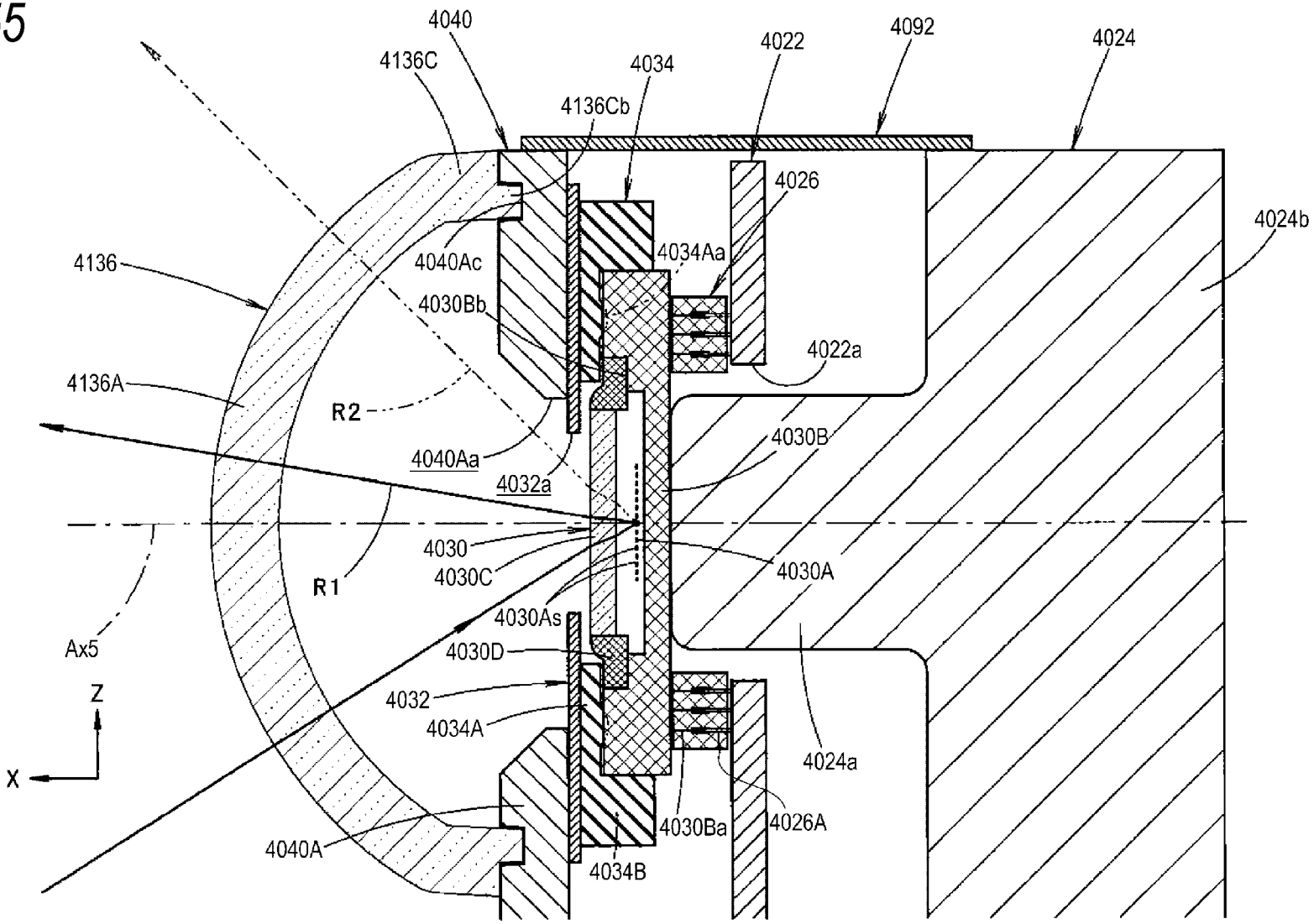
FIG. 55 shows a main part of a lamp unit according to a second modification of the seventh embodiment, which is the same as FIG. 49.

FIG. 55 shows a main part of a lamp unit according to the present modification, which is the same as FIG. 49.

As shown in FIG. 55, a basic configuration of the present modification is the same as that of the seventh embodiment, except that a configuration of a translucent cover 4136 is partially different from that of the seventh embodiment.

That is, although the translucent cover 4136 which covers the opening portion 4040Aa from the unit front side is also supported on the vertical surface portion 4040A of the bracket 4040 in the lamp unit according to the present modification, the translucent cover 4136 is formed to extend along a convex curved surface centered on a position of the reflection control unit 4030A of the spatial light modulator 4030.

Specifically, the translucent cover 4136 includes: a front surface region 4136A which extend with a constant thickness along a spherical surface centered on a position of the rear focus F of the projection lens 4072; and an outer peripheral flange portion 4136C which surrounds the front surface region 4136A.

The translucent cover 4136 is configured such that the front region 4136A allows the reflected light from the reflector 4054 to pass therethrough and allows the reflected light from the reflecting element 4030As in the first mode and the reflected light from the reflecting element 4030As in the second mode to pass therethrough.

An annular rib 4136Cb which protrudes toward the rear side of the unit from a rear end surface of the outer peripheral flange portion 4136C is also formed in the translucent cover 4136 of the present modification, and the annular rib 4136Cb is engaged with the annular groove portion 4040Ac formed in the vertical surface portion 4040A of the bracket 4040.

An interval in the unit front-rear direction between the front surface region 4136A of the translucent cover 4136 of the present modification and the translucent plate 4030C of the spatial light modulator 4030 is also set to a value that is larger (for example, a value of 5 times or more) than the interval in the unit front-rear direction between the translucent plate 4030C and the reflection control unit 4030A.

By employing the configuration of the present modification, the light from the light source 4052 that enters the spatial light modulator 4030 and the light from the light source 4052 that is reflected by the spatial light modulator 4030 pass through the front surface region 4136A of the translucent cover 4136 with almost no refraction, so that optical path deviation of the light can be effectively prevented when the light passes through the translucent cover 4136. As a result, a light distribution control function of the lamp unit can be improved.

Although the front surface region 4136A of the translucent cover 4136 extends along the spherical surface centered on the position of the rear focus F of the projection lens 4072 in the above second modification, it is also possible to employ a configuration in which the front surface region 4136A extends along another convex curved surface (for example, a laterally elongated elliptical spherical surface or a free curved surface).

Next, a third modification of the seventh embodiment will be described.

Figure 56:
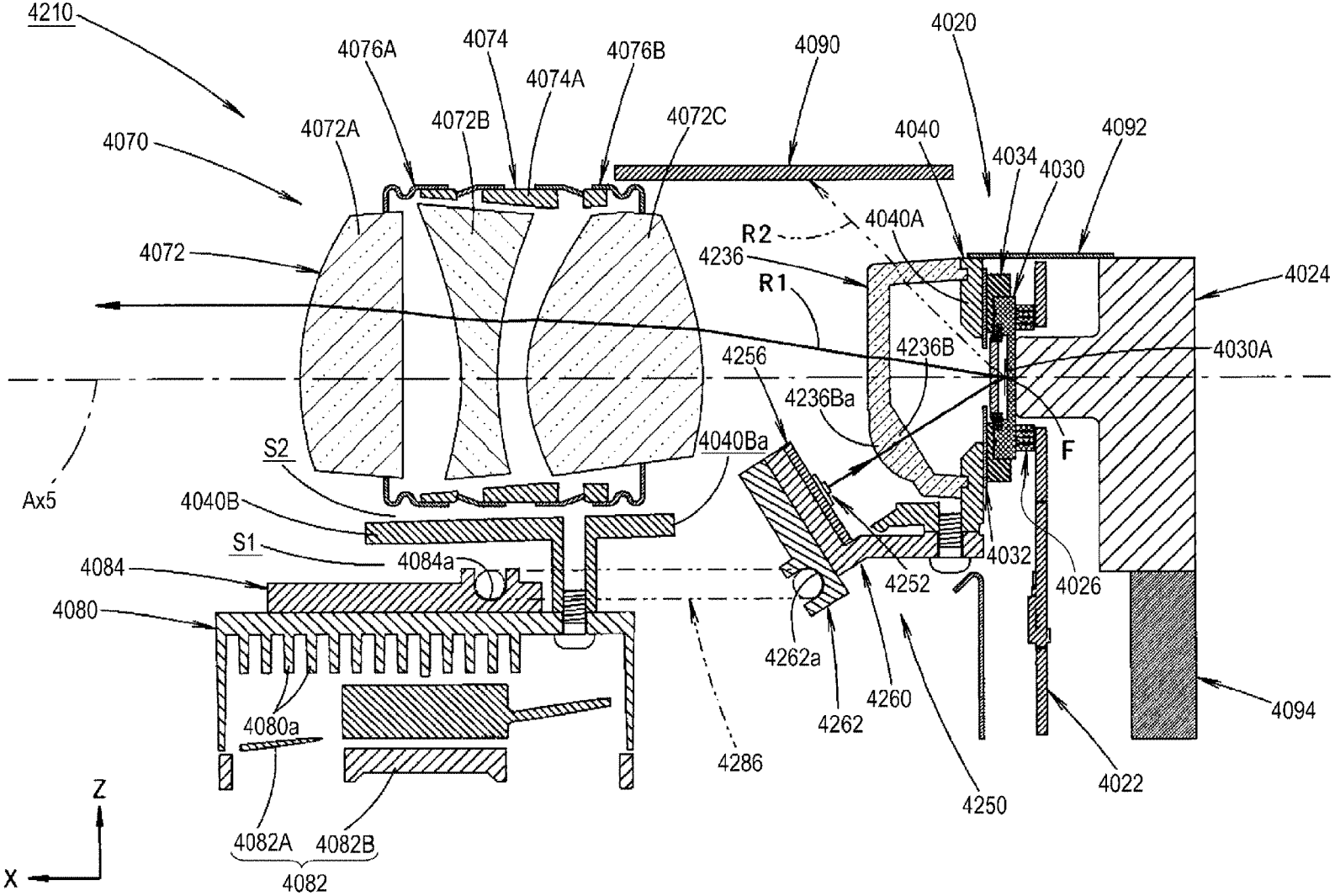
FIG. 56 shows a lamp unit according to a third modification of the seventh embodiment, which is the same as FIG. 41.

FIG. 56 shows a lamp unit 4210 according to the present modification, which is the same as FIG. 41.

As shown in FIG. 56, a basic configuration of the present modification is the same as that of the seventh embodiment, except that a configuration of a light source side sub-assembly 4250 is partially different from that of the seventh embodiment.

That is, the light source side sub-assembly 4250 of the present modification is configured to cause light emitted from a light source 4252 to enter the spatial light modulation unit 4020 via a condenser lens portion 4236Ba formed on the translucent cover 4236.

The light source 4252 is a white light emitting diode, and is placed on a rear surface of a board 4256 in a state where a light emitting surface thereof faces the rear focus F of the projection lens 4072 at a position below the optical axis Ax5 (that is, in a state of facing obliquely upward and rearward). The board 4256 is fixed to a base member 4260 by screwing in a state where a front surface thereof is in surface contact with the base member 4260.

The base member 4260 is a plate-shaped member that is made of metal (for example, aluminum die casting), and includes: a first inclined surface portion configured to support the board 4256; a second inclined surface portion that extends obliquely upward and rearward from a lower end position of the first inclined surface portion; and a horizontal surface portion that extends from an upper end position of the second inclined surface portion toward the rear side of the unit. The horizontal surface portion of the base member 4260 is fixed to the horizontal surface portion 4040B of the bracket 4040 by screwing.

The translucent cover 4236 has the same configuration as that of the translucent cover 4036 of the seventh embodiment, except that the condenser lens portion 4236Ba is formed on a front surface lower region 4236B thereof, which is different from the translucent cover 4036 of the seventh embodiment. The condenser lens portion 4236Ba is formed by forming a front surface of the front surface lower region 4236B in a convex curved surface shape.

A heat transfer plate 4262 that is made of metal (for example, aluminum die casting) is arranged on a front surface side of the first inclined surface portion of the base member 4260. The heat transfer plate 4262 is fixed to the first inclined surface portion by screwing in a state of being in surface contact with a front surface of the first inclined surface portion of the base member 4260.

The heat transfer plate 4262 is connected to the heat transfer plate 4084 supported by the heat sink 4080 via a pair of left and right heat pipes 4286. The heat pipes 4286 extend in the unit front-rear direction on left and right sides of the light source side sub-assembly 4250. A front end portion and a rear end portion of each heat pipe 4286 extend horizontally in the direction approaching the optical axis Ax5. The front end portion of each heat pipe 4286 is fixed to the heat transfer plate 4084 in a state of being fitted into the support recessed portion 4084*a* of the heat transfer plate 4084. The rear end portion of each heat pipe 4286 is fixed to the heat transfer plate 4262 in a state of being fitted into a support recessed portion 4262*a* formed in a front surface of a lower portion of the heat transfer plate 4262.

In the present modification, the translucent cover 4236 that covers the opening portion 4040Aa from the unit front side is also supported on the vertical surface portion 4040A of the bracket 4040. Therefore, it is possible to prevent foreign matter from adhering to the translucent plate 4030C.

In the present modification, the translucent cover 4236 has a function of serving as the condenser lens portion 4236Ba which is configured to control the light emitted from the light source 4252. Therefore, the above operational effect can be obtained with a small number of components.

Although the condenser lens portion 4236Ba is formed in a plano-convex lens shape in the above third modification, it is also possible to employ a configuration in which the condenser lens portion 4236Ba is formed in a biconvex lens shape or a convex meniscus lens shape. Moreover, the light sources 4252 may be arranged on the left and right sides of the optical axis Ax5 as the light sources 4052 of the seventh embodiment, and the condenser lens portion 4236Ba may be formed at a position corresponding to each of the pair of left and right light sources 4252.

Next, a fourth modification of the seventh embodiment will be described.

Figure 57:
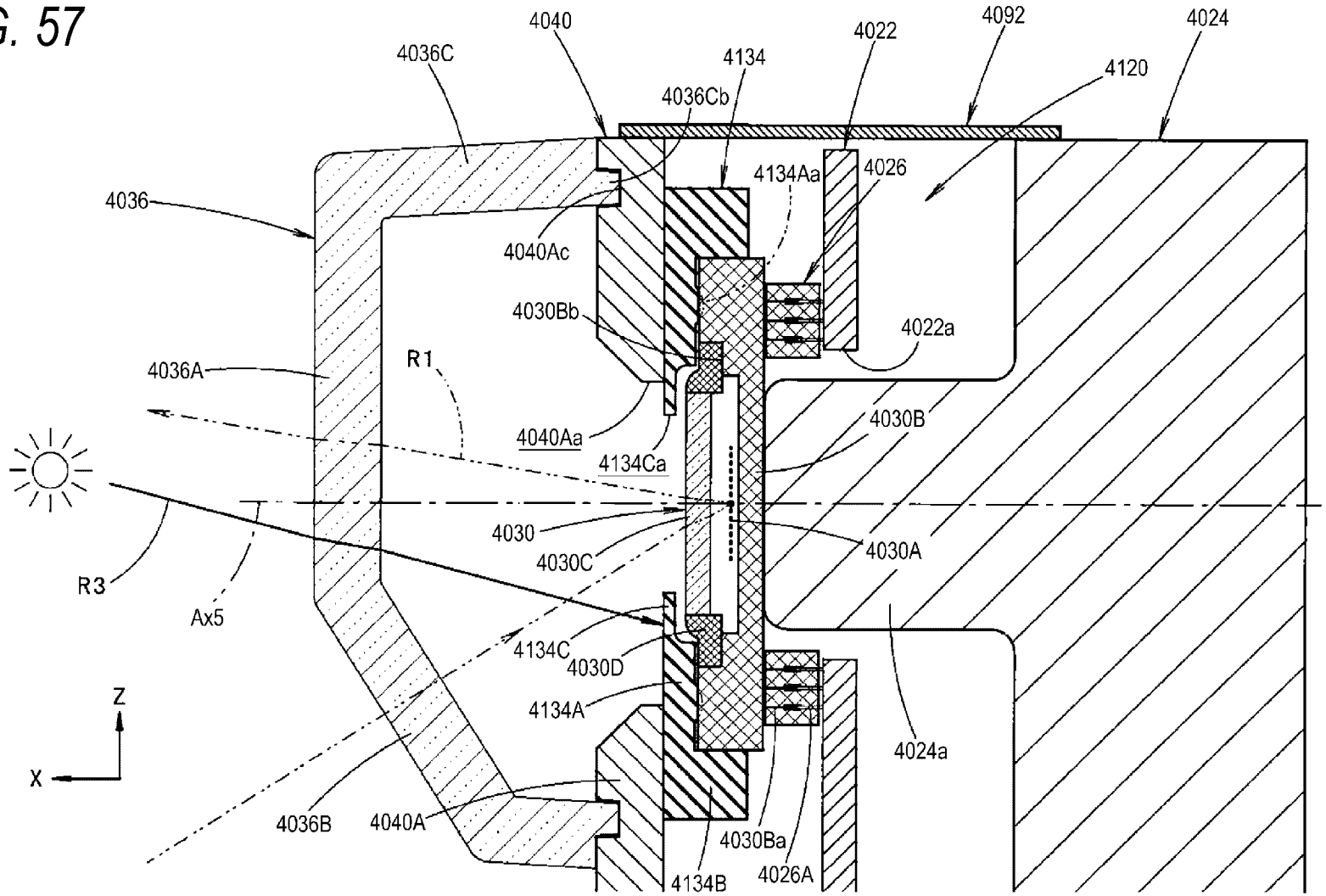
FIG. 57 shows a main part of a lamp unit according to a fourth modification of the seventh embodiment, which is the same as FIG. 49.

FIG. 57 shows a main part of a lamp unit according to the present modification, which is the same as FIG. 49.

As shown in FIG. 57, a basic configuration of the present modification is the same as that of the seventh embodiment, except that a configuration of a spatial light modulation unit 4120 is partially different from that of the above embodiment. Specifically, the spatial light modulation unit 4120 of the present modification is different from the case of the seventh embodiment in that a gasket 4134 has functions of the plate-shaped member 4032 and the gasket 4034 of the above embodiment.

That is, in the spatial light modulation unit 4120 of the present modification, the gasket 4134 which is made of black silicone rubber is arranged between the vertical surface portion 4040A of the bracket 4040 and the spatial light modulator 4030.

Like the gasket 4034 of the seventh embodiment, a front surface of the gasket 4134 is formed in a planar shape, and the gasket 4134 is in surface contact with the vertical surface portion 4040A of the bracket 4040.

Like the gasket 4034 of the seventh embodiment, a portion of the gasket 4134 located on the unit front side of the housing portion 4030B is formed as a thin portion 4134A, and a portion of the gasket 4134 surrounding the housing portion 4030B is formed as a thick portion 4134B. The gasket 4134 has a configuration in which a thinnest portion 4134C is formed on an inner side of the thin portion 4134A.

A thickness of the thin portion 4134A of the gasket 4134 is set to a value obtained by adding the plate thickness of the plate-shaped member 4032 of the seventh embodiment to a thickness of the thin portion 4034A of the gasket 4034 of the seventh embodiment. A thickness of the thick portion 4134B is set to a value obtained by adding the plate thickness of the plate-shaped member 4032 of the seventh embodiment to a thickness of the thick portion 4034B of the gasket 4034 of the seventh embodiment. A thickness of the thinnest portion 4134C is set to the same value as the plate thickness of the plate-shaped member 4032 of the seventh embodiment.

Protruding portions 4134Aa are formed at four locations in a peripheral direction on a rear surface of the thin portion 4134A, which is the same as the case of the gasket 4034 of the seventh embodiment. Insertion holes (not shown) are formed at three locations in the thin portion 4134A, which is the same as the case of the gasket 4034 of the seventh embodiment.

Further, an opening portion 4134Ca which has the same shape as the opening portion 4032*a* of the plate-shaped member 4032 of the seventh embodiment is formed in the thinnest portion 4134C. As a result, the thinnest portion 4134C of the gasket 4134 covers the seal portion 4030D of the spatial light modulator 4030 from the unit front side.

In a case where the configuration of the present modification is employed, the seal portion 4030D of the spatial light modulator 4030 is covered by the thinnest portion 4134C of the gasket 4134. Therefore, even when the external light passes through the projection lens 4072 at the angle where the external light converges on the seal portion 4030D, the converged light can be shielded by the gasket 4134, and thus the seal portion 4030D can be prevented from being melted and damaged.

In the present modification, the gasket 4134 is interposed between the vertical surface portion 4040A of the bracket 4040 and the spatial light modulator 4030. Therefore, an excessive load can be prevented from being applied to the spatial light modulator 4030, and thus functions of the spatial light modulator 4030 can be prevented from being impaired.

By employing the configuration of the present modification, the number of components of the lamp unit can be reduced.

Further, the gasket 4134 is made of black silicone rubber. Therefore, light reflected by a surface of the gasket 4134 can be effectively prevented from becoming stray light and being emitted to the front side of the unit.

In the present modification, the gasket 4134 is also positioned in the direction orthogonal to the unit front-rear direction by engaging with the bracket 4040. Therefore, accuracy of a positional relationship between the reflection control unit 4030A of the spatial light modulator 4030 and the opening portion 4134Ca of the gasket 4134 can be improved, and thus the seal portion 4030D of the spatial light modulator 4030 can be covered in an appropriate state.

Further, the protruding portions 4134Aa are formed at the plurality of locations on the rear surface of the gasket 4134. Therefore, the plate-shaped member 4032 can be easily supported in a proper manner without applying an excessive load to the spatial light modulator 4030 by abutting the protruding portions 4134Aa against the housing portion 4030B and elastically deforming the gasket 4134.

A region surrounding the opening portion 4134Ca of the gasket 4134 is formed as the thinnest portion 4134C. Therefore, it is possible to easily prevent the optical paths of the light that enters the spatial light modulator 4030 from the light source 4052 and the light that is reflected by the spatial light modulator 4030 from being inadvertently obstructed by the gasket 4134.

Further, the gasket 4134 is arranged at a position that is spaced apart from the translucent plate 4030C on the unit front side, and a gap between the thinnest portion 4134C of the gasket 4134 and the translucent plate 4030C is set to a value that is smaller than the plate thickness of the translucent plate 4030C. Therefore, interference between the gasket 4134 and the translucent plate 4030C is prevented, and thus it is possible to easily prevent the optical paths of the light that enters the spatial light modulator 4030 from the light source 4052 and the light that is reflected by the spatial light modulator 4030 from being inadvertently obstructed by the gasket 4134.

Next, a fifth modification of the seventh embodiment will be described.

Figure 58:
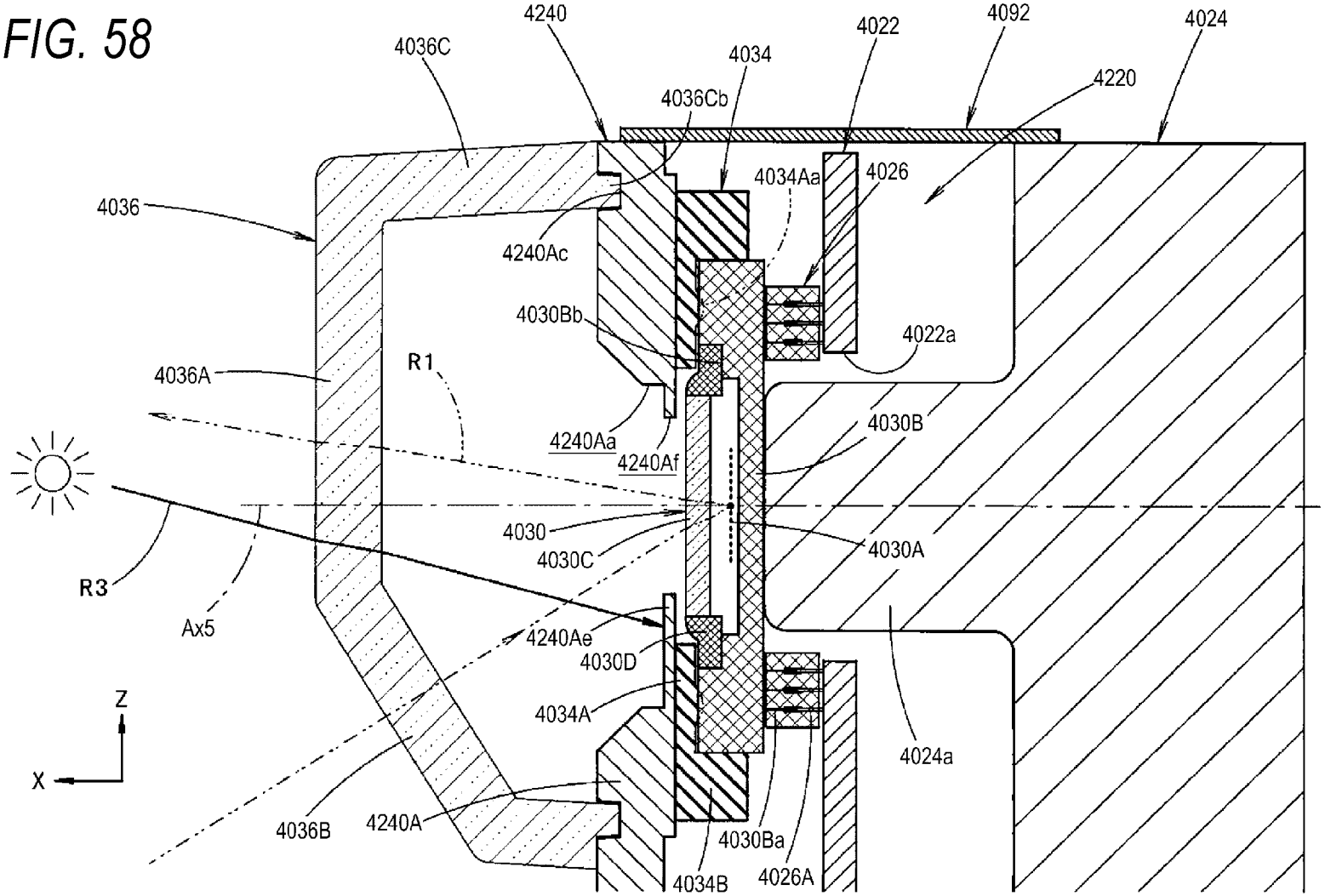
FIG. 58 shows a main part of a lamp unit according to a fifth modification of the seventh embodiment, which is the same as FIG. 49.

FIG. 58 shows a main part of a lamp unit according to the present modification, which is the same as FIG. 49.

As shown in FIG. 58, a basic configuration of the present modification is the same as that of the seventh embodiment, except that a configuration of a spatial light modulation unit 4220 is partially different from that of the seventh embodiment. Specifically, in the present modification, a bracket 4240 has functions of the bracket 4040 and the plate-shaped member 4032 of the seventh embodiment, which is different from the case of the seventh embodiment.

That is, the bracket 4240 of the present modification also has a configuration in which an opening portion 4240Aa and an annular groove portion 4240Ac are formed in a vertical surface portion 4240A thereof as in the case of the seventh embodiment. The vertical surface portion 4240A protrudes toward the rear side of the unit in the same shape as the plate-shaped member 4032 of the seventh embodiment, and a rear surface thereof is in surface contact with the gasket 4034.

Specifically, a plate-shaped portion 4240Ae that protrudes into inner peripheral side space of the opening portion 4240Aa is formed on the vertical surface portion 4240A of the bracket 4240. The plate-shaped portion 4240Ae has the same plate thickness as that of the plate-shaped member 4032 of the seventh embodiment, and is formed with an opening portion 4240Af which has the same shape as the opening portion 4032*a* of the plate-shaped member 4032. As a result, the plate-shaped portion 4240Ae of the vertical surface portion 4240A of the bracket 4240 covers the seal portion 4030D of the spatial light modulator 4030 from the unit front side.

In a case where the configuration of the present modification is employed, the seal portion 4030D of the spatial light modulator 4030 is also covered by the plate-shaped portion 4240Ae formed on the vertical surface portion 4240A of the bracket 4240. Therefore, even when the external light passes through the projection lens 4072 at the angle where the external light converges on the seal portion 4030D, the converged light can be shielded by the plate-shaped portion 4240Ae, and thus the seal portion 4030D can be prevented from being melted and damaged.

By employing the configuration of the present modification, the number of components of the lamp unit can be reduced.

Next, a sixth modification of the seventh embodiment will be described.

Figure 59:
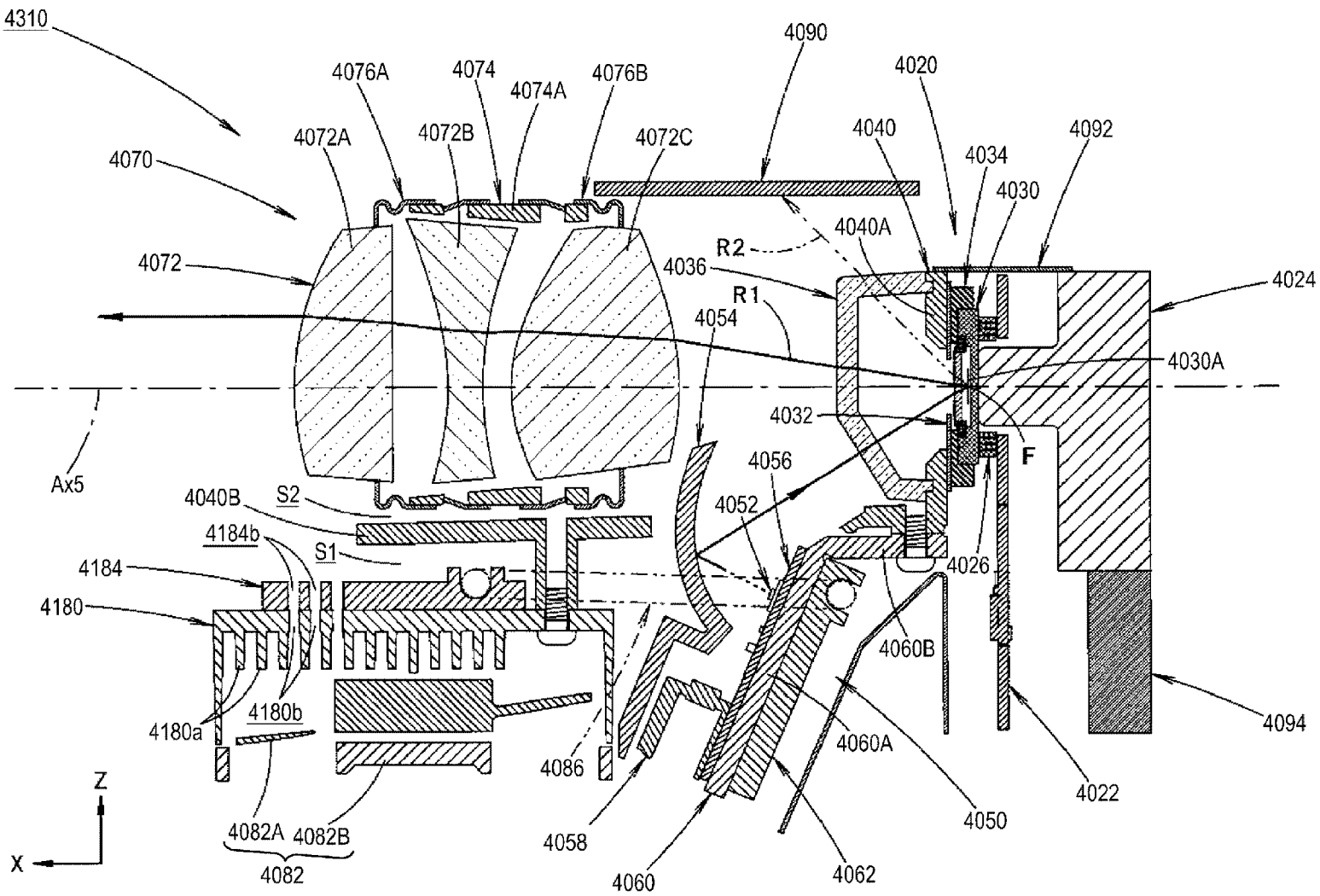
FIG. 59 shows a lamp unit according to a sixth modification of the seventh embodiment, which is the same as FIG. 41.

FIG. 59 shows a lamp unit 4310 according to the present modification, which is the same as FIG. 41.

As shown in FIG. 59, a basic configuration of the present modification is the same as that of the seventh embodiment, except that configurations of a heat sink 4180 and a heat transfer plate 4184 are partially different from those of the seventh embodiment.

That is, in the lamp unit 4310 according to the present modification, the heat transfer plate 4062 that is in surface contact with the base member 4060 and the heat transfer plate 4184 that is in surface contact with the heat sink 4180 are also connected by the heat pipe 4086, and the heat dissipating fan 4082 is arranged below the heat sink 4180. The lamp unit 4310 is different from the case of the seventh embodiment in that through holes 4180*b*, 4184*b* are formed in the heat sink 4180 and the heat transfer plate 4184 to guide the wind generated by the heat dissipating fan 4082 to the projection lens 4072.

The through hole 4180*b* of the heat sink 4180 extends in the left-right direction between a plurality of heat dissipating fins 4180*a* located below the first lens 4072A of the projection lens 4072. The through hole 4184*b* of the heat transfer plate 4184 is formed at a position above the through hole 4180*b* of the heat sink 4180.

By employing the configuration of the present modification, the projection lens 4072 can be positively cooled, and thus the thermal effect on the projection lens 4072 can be further reduced.

Next, a seventh modification of the seventh embodiment will be described.

Figure 60:
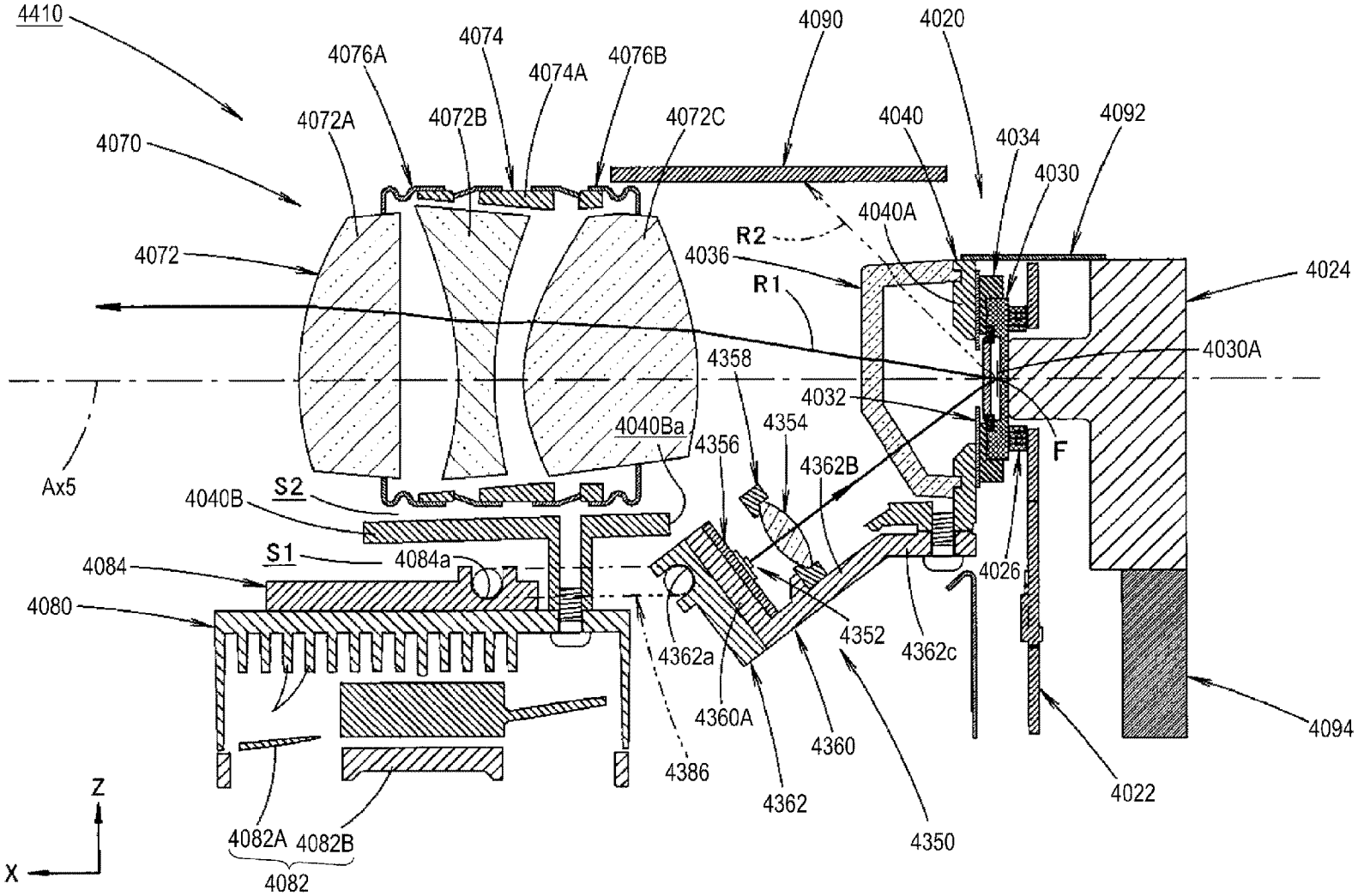
FIG. 60 shows a lamp unit according to a seventh modification of the seventh embodiment, which is the same as FIG. 41.

FIG. 60 shows a lamp unit 4410 according to the present modification, which is the same as FIG. 41.

As shown in FIG. 60, a basic configuration of the present modification is the same as that of the seventh embodiment, except that a configuration of a light source side sub-assembly 4350 is partially different from that of the seventh embodiment.

That is, the light source side sub-assembly 4350 of the present modification is configured to cause light emitted from a light source 4352 to enter the spatial light modulation unit 4020 via a condenser lens 4354.

The light source 4352 is a white light emitting diode, and is placed on a rear surface of a board 4356 in a state where a light emitting surface thereof faces the rear focus F of the projection lens 4072 at a position below the optical axis Ax5 (that is, in a state of facing obliquely upward and rearward). The board 4356 is fixed to a base member 4360 by screwing in a state where a front surface thereof is in surface contact with the base member 4360.

The base member 4360 is a plate-shaped member that is made of metal (for example, aluminum die casting), and includes: a first inclined surface portion 4360A configured to support the board 4356; a second inclined surface portion 4360B that extends obliquely upward and rearward from a lower end position of the first inclined surface portion 4360A; and a horizontal surface portion 4360C that extends from an upper end position of the second inclined surface portion 4360B toward the rear side of the unit. The horizontal surface portion 4360C of the base member 4360 is fixed to the horizontal surface portion 4040B of the bracket 4040 by screwing.

The condenser lens 4354 is supported by a lens holder 4358, and the lens holder 4358 is supported in a state of being positioned on the second inclined surface portion 4360B of the base member 4360.

A heat transfer plate 4362 that is made of metal (for example, aluminum die casting) is arranged on a front surface side of the first inclined surface portion 4360A of the base member 4360. The heat transfer plate 4362 is fixed to the first inclined surface portion 4360A by screwing in a state of being in surface contact with a front surface of the first inclined surface portion 4360A of the base member 4360.

The heat transfer plate 4362 is connected to the heat transfer plate 4084 supported by the heat sink 4080 via a pair of left and right heat pipes 4386. The heat pipes 4386 extend in the unit front-rear direction on left and right sides of the light source side sub-assembly 4350. A front end portion and a rear end portion of each heat pipe 4386 extend horizontally in the direction approaching the optical axis Ax5. The front end portion of each heat pipe 4386 is fixed to the heat transfer plate 4084 in a state of being fitted into the support recessed portion 4084*a* of the heat transfer plate 4084. The rear end portion of each heat pipe 4386 is fixed to the heat transfer plate 4362 in a state of being fitted into a support recessed portion 4362*a* formed in a front surface of an upper portion of the heat transfer plate 4362.

In a case where the configuration of the present modification is employed, the heat transfer plate 4362 that is in surface contact with the base member 4360 and the heat transfer plate 4084 that is in surface contact with the heat sink 4080 are also connected by the heat pipes 4386. Therefore, heat generated by lighting of the light source 4352 can be efficiently transmitted to the heat sink 4080. Therefore, the same operational effect as in the case of the seventh embodiment can also be obtained.

Numerical values shown as specifications in the above first embodiment to seventh embodiment and the modifications thereof are merely examples, and these values may be set to different values as appropriate.

The present disclosure is not limited to the configurations described in the above first embodiment to seventh embodiment and the modifications thereof, and a configuration added with various other changes may be adopted.

The present application is based on JP-A-2018-073701 filed on Apr. 6, 2018, JP-A-2018-081299 filed on Apr. 20, 2018, JP-A-2018-132358 filed on Jul. 12, 2018, JP-A-2018-167585 filed on Sep. 7, 2018, JP-A-2018-245149 filed on Dec. 27, 2018, JP-A-2018-245150 filed on Dec. 27, 2018, JP-A-2018-245151 filed on Dec. 27, 2018, and JP-A-2018-245152 filed on Dec. 27, 2018, the contents of which are incorporated herein by reference.

The invention claimed is:

1. A vehicle lamp comprising:

a spatial light modulator configured to reflect light from a light source toward a front side of a lamp;

a support board which is arranged on a lamp rear side of the spatial light modulator and is configured to support a peripheral edge portion of the spatial light modulator from the lamp rear side in a state of being electrically connected to the spatial light modulator;

a bracket which is arranged on a lamp front side of the spatial light modulator and is abutted against the peripheral edge portion of the spatial light modulator from the lamp front side;

a heat sink which is arranged on the lamp rear side of the support board and is configured to elastically press the spatial light modulator toward the lamp front side in a state of being abutted against a central portion of the spatial light modulator; and at least one shaft which is arranged around the spatial light modulator and extends in a lamp front-rear direction, wherein at least one shaft insertion hole is formed in the support board, at least one shaft positioning hole is formed in the bracket, and the shaft is inserted through the shaft insertion hole, a rear end portion thereof is press-fitted to, formed integrally with, the heat sink, and a front end portion thereof is inserted into the shaft positioning hole.

2. The vehicle lamp according to claim 1, wherein the front end portion of the shaft protrudes toward a front side of the lamp from the shaft positioning hole, and a displacement restricting member, which is configured to restrict displacement of the bracket toward the lamp front side by engaging with a front surface of the bracket, is attached to the front end portion of the shaft.

3. The vehicle lamp according to claim 1, wherein the front end portion of the shaft is fixed to the bracket by an adhesive in the shaft positioning hole.

4. The vehicle lamp according to claim 1, further comprising:

a plurality of stepped bolts which are arranged around the spatial light modulator and extend in the lamp front-rear direction, wherein each of the stepped bolts is screwed to the bracket at a small diameter portion of the stepped bolt in a state where the stepped bolts are inserted through a bolt insertion hole formed in the heat sink and a bolt insertion hole formed in the support board from the lamp rear side, and a spring configured to elastically press the support board toward the lamp front side is attached to a large diameter portion of each of the stepped bolts.

5. The vehicle lamp according to claim 4, wherein the plurality of stepped bolts are arranged at two upper and lower locations on left and right sides of the spatial light modulator, and the shaft includes two shafts, and the two shafts are respectively arranged between the stepped bolts arranged at the two upper and lower locations on the left and right sides of the spatial light modulator.

6. The vehicle lamp according to claim 1, wherein the bracket has a portion which extends toward the front side of the lamp and wherein this portion has an opening portion where a reflector is inserted.

* * * * *